US007384126B2

(12) United States Patent
Nakamura et al.

(10) Patent No.: US 7,384,126 B2
(45) Date of Patent: Jun. 10, 2008

(54) LIQUID DROP DISCHARGE HEAD, DISCHARGE METHOD AND DISCHARGE DEVICE; ELECTRO OPTICAL DEVICE, METHOD OF MANUFACTURE THEREOF, AND DEVICE FOR MANUFACTURE THEREOF; COLOR FILTER, METHOD OF MANUFACTURE THEREOF, AND DEVICE FOR MANUFACTURE THEREOF; AND DEVICE INCORPORATING BACKING, METHOD OF MANUFACTURE THEREOF, AND DEVICE FOR MANUFACTURE THEREOF

(75) Inventors: Shinichi Nakamura, Okaya (JP); Yoshiaki Yamada, Shimosuwa-machi (JP); Tsuyoshi Kitahara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 11/151,523

(22) Filed: Jun. 14, 2005

(65) Prior Publication Data

US 2005/0231564 A1 Oct. 20, 2005

Related U.S. Application Data

(62) Division of application No. 10/347,701, filed on Jan. 22, 2003, now Pat. No. 6,921,148.

(30) Foreign Application Priority Data

Jan. 30, 2002 (JP) ..... 2002-021732

(51) Int. Cl.
*B41J 2/15* (2006.01)
*B41J 2/145* (2006.01)

(52) U.S. Cl. ..... 347/40; 347/43

(58) Field of Classification Search ..... 347/40–43, 347/37

See application file for complete search history.

(56) References Cited

U.S. PATENT DOCUMENTS

| | | | | |
|---|---|---|---|---|
| 5,132,702 | A * | 7/1992 | Shiozaki et al. | 347/12 |
| 6,109,727 | A | 8/2000 | Akahira et al. | |
| 6,277,529 | B1 * | 8/2001 | Marumoto et al. | 430/7 |
| 6,471,352 | B2 * | 10/2002 | Akahira | 347/106 |
| 6,604,821 | B1 | 8/2003 | Akahira et al. | |
| 6,843,937 | B1 | 1/2005 | Kiguchi et al. | |

FOREIGN PATENT DOCUMENTS

| | | |
|---|---|---|
| JP | 09-049920 | 2/1997 |
| JP | 2000-089020 | 3/2000 |
| JP | 2001-124923 | 5/2001 |
| KR | 1999-013883 | 2/1999 |

* cited by examiner

*Primary Examiner*—Thinh Nguyen
(74) *Attorney, Agent, or Firm*—Oliff & Berridge, PLC

(57) ABSTRACT

An ink jet head 22 of linear form which consists of a plurality of nozzles 27 arranged as a nozzle row 28 is provided in an ink jet device for manufacture of a color filter. Filter element material 13 from the nozzles 27 which differ from the motherboard 12 is discharged four superimposed times by the plurality of nozzles 27, and is formed to a predetermined film thickness upon a single filter element 3. It is possible to prevent the occurrence of undesirable deviations in film thickness between different ones of the filter elements 3, so that it is possible to flatten and make even the optical transparency characteristic of the resulting color filter 1.

20 Claims, 66 Drawing Sheets

STRIPE

MOSAIC

DELTA

903(903R)
903(903B)
903(903G)
906
832a
842a
832
B
835
842a
831
A
905a
905b
905
835a
836
605
604a
603
A
842a
903R
905a
905b
905
832d
832b
832a
923
910
911
912
842
841
840
604
603
833
B
844
832c
832
903B
903G
905a
905b
905
832d
832b

LIQUID DROP DISCHARGE HEAD, DISCHARGE METHOD AND DISCHARGE DEVICE; ELECTRO OPTICAL DEVICE, METHOD OF MANUFACTURE THEREOF, AND DEVICE FOR MANUFACTURE THEREOF; COLOR FILTER, METHOD OF MANUFACTURE THEREOF, AND DEVICE FOR MANUFACTURE THEREOF; AND DEVICE INCORPORATING BACKING, METHOD OF MANUFACTURE THEREOF, AND DEVICE FOR MANUFACTURE THEREOF

This is a Division of application Ser. No. 10/347,701 filed Jan. 22, 2003 now U.S. Pat. No. 6,921,148. The entire disclosure of the prior application is hereby incorporated by reference herein in its entirety.

FIELD OF THE INVENTION

The present invention relates to a liquid drop discharge head which discharges a liquid mass which is endowed with a certain flowability. Furthermore, the present invention relates to a discharge method and device for discharging a liquid mass which has a certain flowability.

And, the present invention relates to an electro optical device such as a liquid crystal device, an electroluminescent device, an electrical migration device, an electron emission device or a PDP (Plasma Display Panel) device or the like, to a method of manufacture of an electro optical device for manufacturing such an electro optical device, and to a device for manufacturing the same. Furthermore, the present invention relates to a color filter which is used in an electro optical device, and to a method of manufacture of such a color filter and to a device for manufacturing the same. Yet further, the present invention relates to a device which comprises a backing such as an electro optical member, a semiconductor device, an optical member, a reagent inspection member or the like, and to a method of manufacture of such a device which comprises such a backing and to a device for manufacturing the same.

BACKGROUND ART

In recent years display devices which are so called electro optical devices, such as liquid crystal devices and electroluminescent devices and the like, have become widespread as display sections for electronic devices such as portable telephones, portable computers and the like. Furthermore, recently, it has become common to provide a full color display upon such a display device. A full color display upon such a liquid crystal device is provided, for example, by passing light which has been modulated by a liquid crystal layer through a color filter. And such a color filter is made by arranging filter elements of various colors such as R (red), G (green), and B (blue) in dot form upon the surface of a substrate plate which is made from, for example, glass or plastic or the like in a predetermined array configuration such as a so called stripe array, delta array, or mosaic array or the like.

Furthermore, a full color display upon such an electroluminescent device is provided by, for example, arranging electroluminescent layers of various colors such as R (red), G (green), and B (blue) in dot form upon the surface of a substrate plate which is made from, for example, glass or plastic or the like in a predetermined array configuration such as a so called stripe array, delta array, or mosaic array or the like, and sandwiching these electroluminescent layers between pairs of electrodes so as to form picture elements (pixels). And, by controlling the voltage which is applied between these electrodes for each picture element pixel, a full color display is provided by causing light of the desired colors to be emitted from these picture elements.

In the past, there has been a per se known method of using photolithography when patterning the filter elements of a color filter of various colors such as R, G, and B, or when patterning the picture elements of an electroluminescent device of various colors such as R, G, and B. However there are certain problems when using this photolithography method, such as the fact that the process is complicated, the fact that large quantities of the color material or the photoresist are consumed, the fact that the cost becomes high, and the like.

In order to solve this problem, a method has been contemplated of forming a filament or an electroluminescent layer or the like as a dot form array by discharging in dot form a filter element material or an electroluminescent material by an ink jet method in which liquid drops are discharged.

Now, a method of making a filament or an electroluminescent layer or the like as a dot form array by an ink jet method will be explained. The case will be considered in which, as shown in FIG. 52(*b*), a plurality of filter elements 303 which are arrayed in dot form are formed, based upon an ink jet method, upon the internal regions of a plurality of panel regions 302 shown in FIG. 52(*a*) which are established upon the surface of a so called motherboard 301 which is a substrate plate of relatively large area which is made from glass, plastic or the like. In this case, as for example shown in FIG. 52(*c*), while performing a plurality of episodes of main scanning (in FIG. 52, two episodes) for a single panel region 302, as shown by the arrow signs A1 and A2 in FIG. 52(*b*), with an ink jet head which has a plurality of nozzles 304 which are arranged in a linear array so as to constitute a nozzle row 305, filter elements 303 are formed in the desired positions by discharging ink, i.e. filter material, selectively from this plurality of nozzles during these main scanning episodes.

These filter elements 303 are ones which are formed by arraying various colors such as R, G, and B and the like as described above in a suitable array form such as a so called stripe array, delta array, or mosaic array or the like. Due to this, in the ink discharge processing by the ink jet head 306 shown in FIG. 52(*b*), ink jet heads 306 for just the three colors R, G, and B are provided in advance, so as to discharge the single colors R, G, and B. And a three color array including R, G, and B or the like is formed upon the single motherboard 301 by using these ink jet heads 306 in order.

However, with regard to the ink jet heads 306, generally, undesirable deviations can occur in the ink discharge amounts of the plurality of nozzles 304 which make up the rows of nozzles 305. Typically, as shown for example in FIG. 53(*a*), such an ink jet head 306 has an ink discharge characteristic Q in which the ink discharge amounts at positions which correspond to the two end portions of the row of nozzles 305 are the greatest, and the ink discharge amount at a central position between these end portions is the next great, while the discharge amounts in the regions intermediate between these positions are lower.

Accordingly, when using the ink jet heads 306 to manufacture a filter element 303 by operating as shown in FIG. 52(*b*), as shown in FIG. 53(*b*), thick concentrated lines are undesirably formed at positions P1 which correspond to the end portions of the ink jet heads 306 or at the central positions P2, or at both the ends P1 and P2. Due to this, there is the problem that the planar light transmission characteristic of the color filter becomes uneven.

On the other hand, if a plurality of panel regions 302 are formed upon the motherboard 301, then it has been contemplated to form the filter element 303 at high efficiency by using an ink jet head of elongated form so that the ink jet head is positioned along substantially the entire extent of the widthwise dimension of the motherboard 301, which constitutes its widthwise direction with respect to the main scanning direction of the ink jet head. However there is the problem that, if a motherboard 301 is utilized whose size is different from and does not correspond to the size of the panel regions 302, every time this happens, a different ink jet head comes to be required, and accordingly the cost is increased.

SUMMARY OF THE INVENTION

The present invention has been conceived in view of the above described considerations, and its objective is to provide: a liquid drop discharge head, a discharge method, and a discharge device which are made so as, when discharging a liquid mass against a object against which the mass is to be discharged, to ensure uniformity of the amount of the liquid mass which is painted upon that object against which the mass is to be discharged; and an electro optical device, a method of manufacture of the same, and a device for manufacture of the same, a color filter, a method of manufacture of the same, and a device for manufacture of the same, and a device incorporating a backing, a method of manufacture of the same, and a device for manufacture of the same, which are formed so that the characteristic is made uniform when a liquid mass which is painted upon a substrate plate or a backing is being discharged so as to be made uniform.

(1) A primary version of the liquid drop discharge head according to the present invention proposes a surface which is provided with a plurality of nozzles which discharge a liquid mass is relatively shifted with respect to an object against which liquid drops are to be discharged, and in that it is for discharging the liquid mass from the nozzles against the object against which liquid drops are to be discharged, and in that, in a state in which this liquid drop discharge head is oriented in a direction which intersects the relative shifting direction at a sloping angle, at least the nozzles among the plurality of nozzles which are positioned in a central portion thereof and are used for discharge of the liquid mass are arranged so that a plurality of their openings are positioned upon a hypothetical straight line which extends along the relative shifting direction.

With the present invention as defined above, in a state in which the liquid drop discharge head is oriented in a direction which intersects the relative shifting direction at a sloping angle, at least the nozzles among the plurality of nozzles which are positioned in a central portion thereof and are used for discharge of the liquid mass are arranged so that a plurality of their openings are positioned upon a hypothetical straight line which extends along the relative shifting direction. According to this structure, the nozzle main body can be shared in common, and it is possible merely to select and use, for example, a predetermined nozzle plate in which nozzles are positioned in correspondence to a plurality of openings upon a straight line which extends along the relative shift direction, even though it is inclined corresponding the pitch of the dot pattern which is painted upon the object against which liquid drops are to be discharged, so that it is not necessary to manufacture individual nozzle main bodies corresponding to the paint pattern required, and accordingly the cost is reduced.

(2) The discharge device according to the present invention may further comprise a holding means for holding the above described liquid drop discharge head, and a shifting means which shifts at least one of this holding means and the object against which liquid drops are to be discharged relatively to the other.

With this specialization of the present invention, at least one of the holding means which holds the liquid drop discharge head which is capable of utilizing, for example, the above described products in common, and the object against which liquid drops are to be discharged, is shifted relatively to the other by the shifting means. According to this specialization of the present invention, it is possible to reduce the painting cost.

(3) With another version of the present invention, there is proposed a discharge device in which are included: a liquid drop discharge head which is provided with a plurality of nozzles which discharge a liquid mass which is endowed with a certain flowability; a holding means for holding the liquid drop discharge head so as to make a surface of this liquid drop discharge head in which the nozzles are provided oppose an object against which liquid drops are to be discharged; and a shifting means for relatively shifting at least one of this holding means and the object against which liquid drops are to be discharged relatively to the other; and the liquid drop discharge head is held in the holding means so that at least two or more of the nozzles which are positioned at least in a central portion among the plurality of nozzles and which are used for discharge of the liquid mass are positioned upon a hypothetical straight line which extends along the relative shifting direction.

With this version of the present invention as expressed above, the liquid drop discharge head which is provided with a plurality of nozzles which discharge a liquid mass which is endowed with a certain flowability is held by the holding means so as to make its surface in which the nozzles are provided oppose an object against which liquid drops are to be discharged, and at least one of this holding means and the object against which liquid drops are to be discharged is shifted by a shifting means relatively to the other. And the liquid drop discharge head is held in the holding means so that at least two or more of the nozzles which are positioned at least in a central portion among the plurality of nozzles and which are used for discharge of the liquid mass are positioned upon a hypothetical straight line which extends along the relative shifting direction. According to this construction, a structure is obtained in which the liquid mass is discharged in superimposition from two or more different ones of the nozzles, and, even if hypothetically undesirable deviations should be present in the discharge amounts between the plurality of nozzles, it is possible to flatten and to prevent undesirable deviations in the total discharge amounts of liquid mass which are discharged, so as to obtain a flattened and even discharge characteristic.

(4) With another version of the present invention, there is proposed a discharge device in which are included: a plurality of liquid drop discharge heads, each of which is provided with a plurality of nozzles which discharge a liquid mass which is endowed with a certain flowability; a holding means for holding the plurality of the liquid drop discharge heads in a line so that a surface in which these nozzles are provided opposes an object against which liquid drops are to be discharged; and a shifting means for relatively shifting at least one of this holding means and the object against which liquid drops are to be discharged relatively to the other; and wherein the plurality of liquid drop discharge heads are arranged in the holding means so that at least one portion each of the nozzles which are used for discharge of the liquid mass in at least two or more of the liquid discharge heads among these liquid drop discharge heads are positioned upon a hypothetical straight line which extends along the relative shifting direction.

With this version of the present invention, the plurality of liquid drop discharge heads, each of which is provided with a plurality of nozzles which discharge a liquid mass which is endowed with a certain flowability, are arranged in the holding means in a line to oppose an object against which liquid drops are to be discharged, and at least one of this holding means and the object against which liquid drops are to be discharged is shifted by the shifting means relatively to the other. And the plurality of liquid drop discharge heads are arranged in the holding means so that at least one portion each of the nozzles which are used for discharge of the liquid mass in at least two or more of the liquid discharge heads are positioned upon a hypothetical straight line which extends along the relative shifting direction. According to this construction, a structure is obtained in which the liquid mass is discharged in superimposition from two or more different ones of the nozzles, and, even if hypothetically undesirable deviations should be present in the discharge amounts between the plurality of nozzles, it is possible to flatten and to prevent undesirable deviations in the total discharge amounts of liquid mass which are discharged, so as to obtain a flattened and even discharge characteristic.

And, with the present invention, it is desirable, in the liquid drop discharge head, for the plurality of nozzles to be provided as arrayed in a plurality of rows. According to such a construction, a structure in which the liquid mass is discharged from two or more different nozzles is easily provided, and also it becomes possible to set the array region of the nozzles wider, and to discharge liquid mass over a wider range, so that, along with enhancing the discharge efficiency, it is not necessary to form any ink jet head in specially elongated form, so that the generality of the procedure is enhanced. Furthermore, with the present invention, it is desirable for the liquid drop discharge heads to be held in the holding means in a state in which the direction in which the nozzles are arranged intersects the relative shifting direction at a slanting angle. According to such a structure, the situation is established in which the direction of arrangement of the nozzles is inclined with respect to the relative shifting direction, so that the pitch, i.e. the interval, at which the liquid mass is discharged becomes narrower than the pitch between the nozzles; and accordingly, by merely setting the state of inclination appropriately, it is possible easily to make this pitch correspond to the pitch between the dots which is desired when discharging the liquid mass in the form of dots against the object against which the liquid drops are to be to discharged, so that, along with enhancing the discharge efficiency, it is not necessary to form the ink jet head so as to correspond to the pitch between the dots, so that the generality of the procedure is enhanced.

Yet further, with the present invention, it is desirable for each of at least two or more of the liquid drop discharge heads to be arranged so as partially to overlap another of the liquid drop discharge heads in the relative shifting direction. According to such a structure, no regions occur between any of the ink jet heads in which neighboring ink jet heads do not overlap so that no liquid mass is discharged, and accordingly the desirable discharge of a continuous liquid mass is obtained.

Still further, with the present invention, it is desirable for the nozzles in a predetermined region in the vicinity of the end portions among the nozzles which are arranged in the liquid drop discharge heads to be set as non discharging nozzles, for a plurality of nozzles in the liquid drop discharge heads to be arranged along a predetermined direction which intersects the relative shifting direction at a slanting angle, and for the plurality of liquid drop discharge heads to be arranged in a plurality of parallel rows along a direction which intersects the relative shifting direction; with non discharge nozzles of the liquid drop discharge heads in one row of the liquid drop discharge heads among the plurality of rows of liquid drop discharge heads, and discharge nozzles which discharge liquid mass in another row of liquid drop discharge heads which is arranged in the relative shifting direction, being arranged so as to be positioned upon a hypothetical straight line in the relative shifting direction. According to such a structure, since the nozzles of the liquid drop discharge heads in the vicinity of the end portions thereof, which are those nozzles for which variation in the discharge amount can occur most easily, are set as non discharge nozzles, and these non discharge nozzles are arranged along the relative shifting direction from the discharge nozzles of another nozzle row which do discharge the liquid mass, thereby it is possible to flatten out and prevent undesirable deviations in the discharge amounts of the liquid mass between different ones of the nozzles, so that a planar and uniform discharge is obtained.

And, with the present invention, it is desirable for the nozzles of the liquid drop discharge heads to be arranged in a plurality of rows; and for the plurality of liquid drop discharge heads to be arranged so that a state exists in which a non discharge nozzle of one liquid drop discharge head and a plurality of rows of discharge nozzles of another liquid drop discharge head are positioned upon a hypothetical straight line which extends along the relative shifting direction, and a state exists in which a discharge nozzle and a non discharge nozzle of one liquid drop discharge head and a discharge nozzle and a non discharge nozzle of another liquid drop discharge head are likewise positioned upon a hypothetical straight line which extends along the relative shifting direction. According to such a structure, the plurality of liquid drop discharge heads are arranged so that, if a non discharge nozzle of one liquid drop discharge head is positioned upon a hypothetical straight line which extends along the relative shifting direction, then a plurality of rows of discharge nozzles of another liquid drop discharge head are likewise positioned upon the hypothetical straight line; and also so that, if a non discharge nozzle and also a discharge nozzle of one liquid drop discharge head are positioned upon such a hypothetical straight line, then a non discharge nozzle and also a discharge nozzle of another liquid drop discharge head are also positioned upon that hypothetical straight line.

And, according to this structure, it becomes possible to flatten and to prevent the occurrence of undesirable deviations in the discharge amounts of the liquid mass between the various ones of the plurality of discharge heads, so that a planar and uniform discharge characteristic is obtained. Furthermore, with the present invention, it is desirable for the plurality of nozzles to be arranged so that the array pitch of the nozzle openings along a direction which is perpendicular to the relative shifting direction is roughly equal to or is roughly an integral multiple of the pitch of the anticipated discharge positions upon the object against which liquid drops are to be discharged along a direction which is perpendicular to the relative shifting direction. According to such a structure, it becomes easy to paint a structure which has any specified configuration, such as, for example, a stripe type, a mosaic type, or a delta type structure or the like.

Furthermore, by doing the same thing, for example, it becomes possible to discharge a wide range of different liquid masses using ink jet heads which are all produced according to a single specification, so that it is not necessary to utilized a special ink head for each application, whereby it is possible to anticipate a reduction in cost as compared with the case of using a component specified according to the prior art. Furthermore, by for example suitably setting the direction in which the ink jet heads are arranged, it becomes possible to make them correspond to the regions in which the liquid mass is to be discharged, so that the convenience is enhanced. Yet further, it becomes possible to make the liquid mass correspond to the regions in which it is to be discharged, even with only a single type of ink jet head, so that it becomes possible to simplify the structure, to enhance the manufacturability, and also to reduce the cost of manufacture.

Furthermore, with the present invention, it is desirable for control of the liquid drop discharge head to be exerted so that different nozzles which are positioned upon a hypothetical straight line which extends along the relative shifting direction are all discharged against the same predetermined place upon the object against which liquid drops are to be discharged. By doing this, it is possible to prevent undesirable deviations in the discharge amounts of the liquid mass at different positions by flattening its characteristic, so that a planar and uniform discharge can be obtained.

(5) With the present invention, it is convenient to manufacture an electro optical device by forming an electroluminescent layer by, with the liquid mass which is to be discharged being a liquid mass which includes an electroluminescent material, discharging this liquid mass against, as the object against which liquid drops are to be discharged, a substrate plate.

(6) With the present invention, it is convenient to manufacture a color filter which is an electro optical device by, with the liquid mass which is to be discharged being a liquid mass which includes a color filter material, discharging this liquid mass against, as the object against which liquid drops are to be discharged, one of a pair of substrate plates between which a liquid crystal is to be sandwiched.

(7) With the present invention, it is convenient to manufacture a device which comprises a backing, wherein a predetermined layer is formed upon the backing by discharging a liquid mass which is endowed with a certain flowability against the backing, which is the object against which liquid drops are to be discharged, by a discharge method of one of the types described above.

According to the present invention, since the object against which the liquid drops are to be discharged is relatively shifted in a state in which the one or more liquid drop discharge heads in which the nozzles are provided oppose the object against which the liquid drops are to be discharged, and the liquid mass is discharged from at least two or more of the nozzles from among the plurality of nozzles which are positioned upon a hypothetical straight line which extends along this relative shifting direction, accordingly a structure is obtained in which the liquid mass is discharged from two or more different nozzles, so that even if, hypothetically, undesirable deviations should exist in discharge amount between the plurality of nozzles, it becomes possible to flatten out and prevent undesirable deviations in the total amount of liquid mass which is discharged, and accordingly it becomes possible to obtain a planar and uniform discharge.

DESCRIPTION OF THE PREFERRED EMBODIMENTS

Figure 6A:
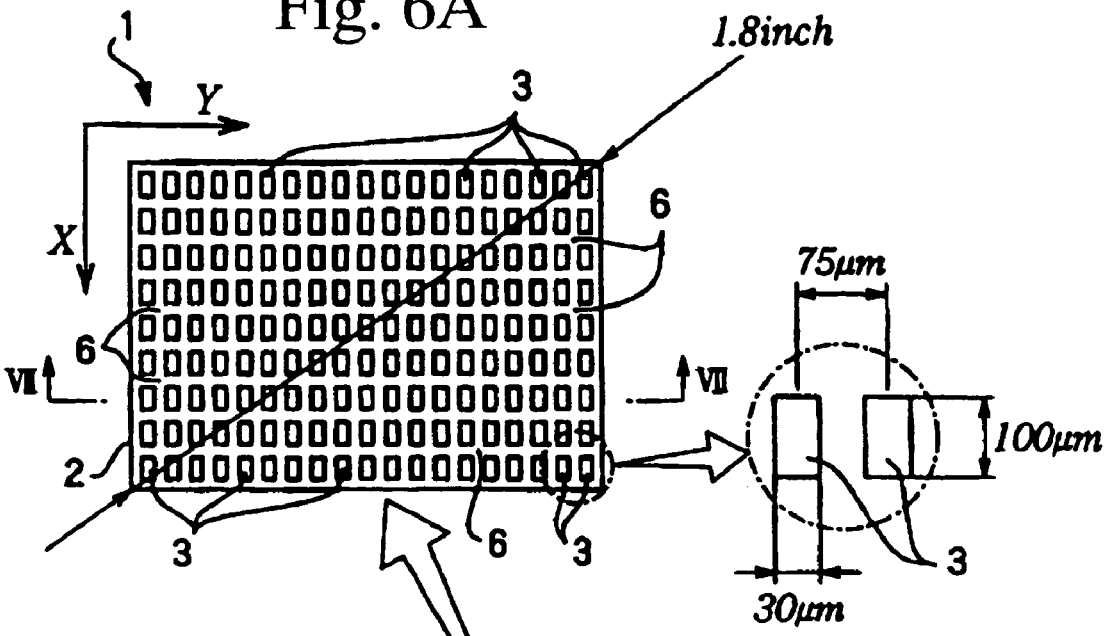
FIG. 6(*a*) is a plan view showing a preferred embodiment of the color filter according to the present invention, and FIG. 6(*b*) is a plan view showing a preferred embodiment of a motherboard which constitutes its foundation.
Figure 6B:
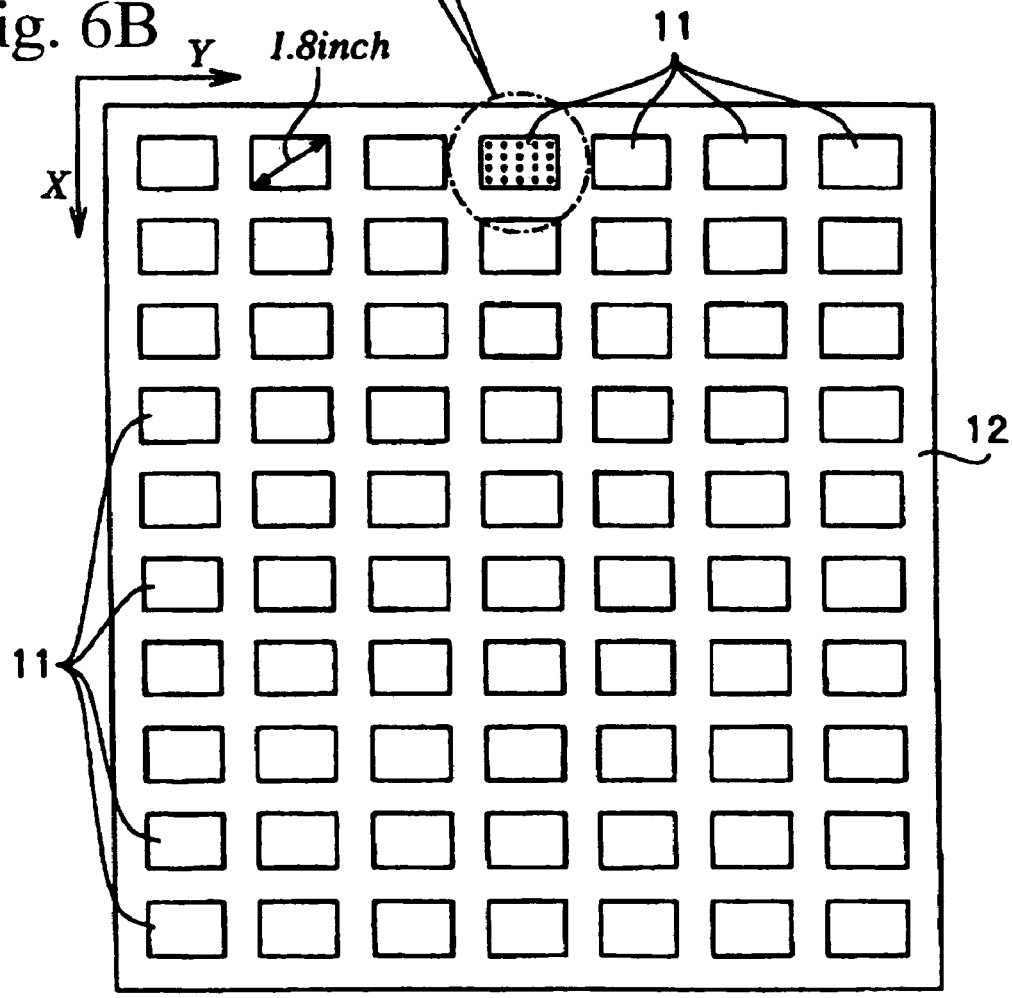
Figure 7A:
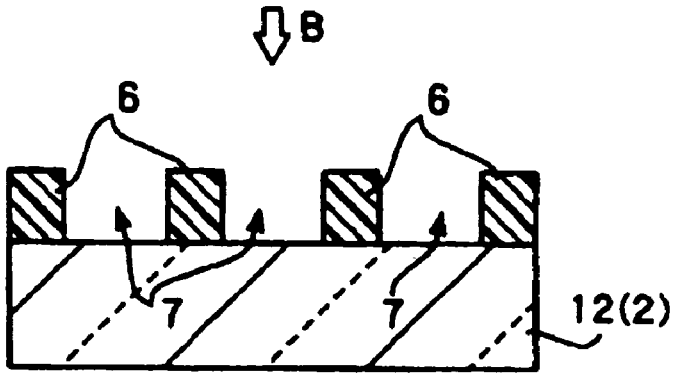
FIGS. 7(A)-7(D) are figures schematically showing a manufacturing process for a color filter taken in a sectional plane shown by the arrows VII-VII in FIG. 6(*a*).
Figure 7B:
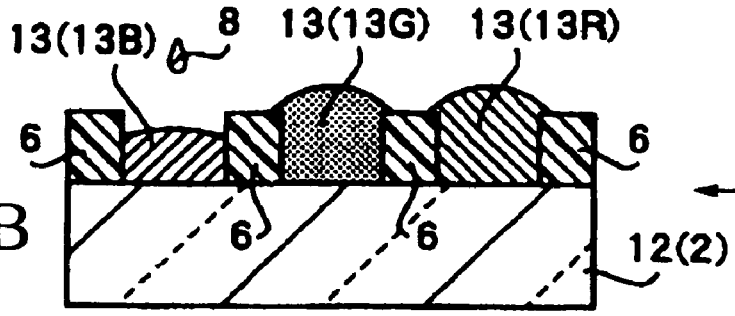
Figure 7C:
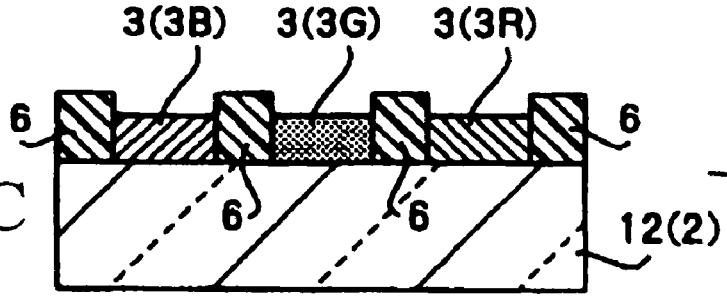
Figure 7D:
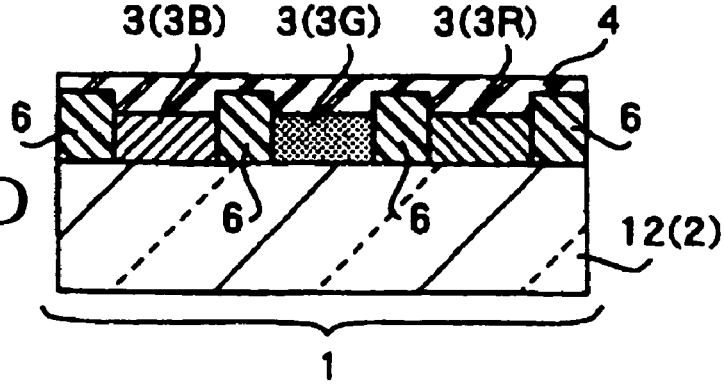

Method of Manufacture of a Color Filter, and Device for Manufacturing the Same—Part 1 of the Explanation In the following, the basic method and structure of a method for manufacture and of a device for manufacture of a color filter according to the present invention will be explained. First, before explaining this method of manufacture and device for manufacture, the color filter which is manufactured by the use of this method of manufacture and device for manufacture or the like will be explained. FIG. 6(*a*) schematically shows the planar structure of a preferred embodiment of the color filter.

Furthermore, FIG. 7(*d*) shows the sectional structure thereof, taken in a plane shown by the arrows VII-VII in FIG. 6(*a*).

The color filter 1 according to this preferred embodiment comprises a plurality of filter elements 3 which are formed in a dot pattern—in the preferred embodiment in dot matrix form—upon the surface of a rectangular shaped substrate plate 2 which is made of glass, plastic, or the like. Furthermore, as shown in FIG. 7(*d*), this color filter 1 is made by superimposing a protective layer 4 upon the filter elements 3. It should be understood that FIG. 6(*a*) shows a plan view of the color filter 1 in its state with the protective layer 4 removed.

The filter elements 3 are made by filling colored material into a plurality of rectangular regions which are arranged in dot matrix form and are formed into compartments by division walls 6 which are arranged in a lattice form pattern and are made from a resin material which is not transparent.

Figure 8A:
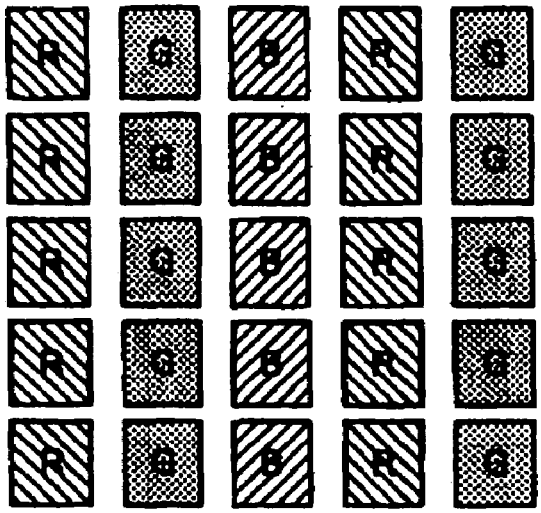
FIGS. 8(A)-8(C) are figures showing an example of an array of R, G, and B picture elements in a color filter.
Figure 8B:
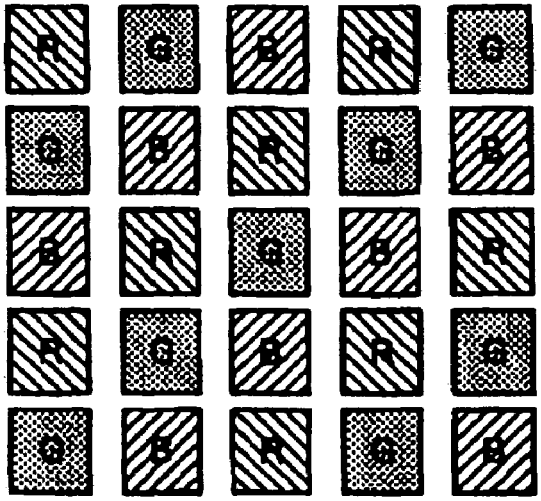
Figure 8C:
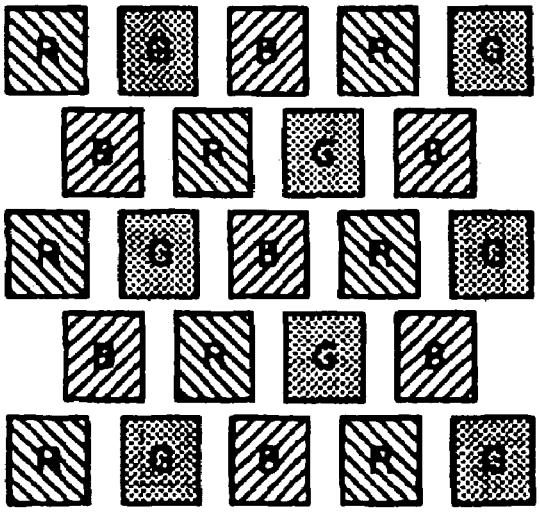

Furthermore, each of these filter elements 3 is formed from a single R (red), G (green), or B (blue) colored material, and these filter elements 3 of each of these colors are arranged in a predetermined array. There are various per se known formats for this array; for example, a so called stripe array as shown in FIG. 8(*a*), a so called mosaic array as shown in FIG. 8(*b*), or a so called delta array as shown in FIG. 8(*c*), or the like. It should be understood that in this description of the present invention the term "division wall" is used to include the meaning of "bank", and is an expression which denotes portions which are convex as seen from the substrate plate, and have side surfaces which, as seen from the substrate plate, are almost perpendicular or which have angles somewhat greater than or what less than roughly 90 degree.

And, a stripe array is an array in which the colors are arranged so that each of the matrix columns is all of the same color.

Furthermore, a mosaic array is an array in which the colors are arranged so that any three successive filter elements 3 arranged along a straight line, either vertically or horizontally, are of the three colors R, G, and B. Yet further, a delta array is an array in which the colors are arranged so that the disposition of the filter elements is uneven, with any neighboring three filter elements being of the three colors R, G, and B.

The size of the color filter 1 is, for example, about 4.57 cm (1.8 inches). Furthermore, the size of a single filter element 3 is, for example, 30 μm×100 μm. And the interval between the filter elements 3, in other words the pitch of the filter elements, is, for example, 75 μm.

If the color filter 1 according to this preferred embodiment of the present invention is utilized as an optical element for a full color display, a single picture element is constituted by a unit which consists of three of the filter elements 3 (one R, one G, and one B), and a full color display is provided by selectively allowing light to pass through one or a combination of the R, G, and B filter elements 3 in each single picture element. At this time, the division walls 6 which are made from a resin material which is non transparent function as black masks.

The above described color filter 1 is, for example, cut out from a motherboard 12 of large area, which is a substrate plate such as the one shown in FIG. 6(*b*). In concrete terms, first, the pattern for a single one of the color filters 1 is formed upon the surface of each of a plurality of color filter formation regions 11 which are established within the motherboard 12. And grooves are formed around these color filter formation regions 11 for cutting them apart, and the individual color filters 1 are made by cutting the motherboard 1 apart along these grooves.

In the following, a method of manufacture and a device for manufacture of the color filter 1 shown in FIG. 6(*a*) will be explained.

FIG. 7 schematically shows the order of procedure in the method of manufacture of the color filter 1. First, the division walls 6 are formed, from a resin material which is non transparent, upon the surface of the motherboard 12 in a lattice form pattern as seen from the direction of the arrow B. The lattice hole portions 7 of the lattice form pattern are the regions in which the filter elements 3 will be formed, in other words are the filter element formation regions. The plan view dimensions of each of these filter element formation regions which are defined by these division walls 6, when seen from the direction of the arrow B are made to be, for example, about 30 μm×100 μm.

The division walls 6 have both the function of preventing flow of the filter element material 13 while it is in the form of the liquid masses which are supplied into the filter element formation regions 7, and also the function of acting as a black mask. Furthermore, the division walls 6 may be formed by any patterning method, for example by a photolithographic method; and they may be fired by the application of heat using a heater, according to requirements.

After forming the division walls 6, as shown in FIG. 7(*b*), filter element material 13 is filled into each of the filter element formation regions 7 by supplying a liquid drop 8 of filter element material into each of these filter element formation regions 7. In FIG. 7(*b*), the reference symbol 13R denotes a quantity of filter element material which is R (red) colored, the reference symbol 13G denotes a quantity of filter element material which is G (green) colored, and the reference symbol 13B denotes a quantity of filter element material which is B (blue) colored. It should be understood that, in this description of the present invention, the term "ink" will sometimes be employed for "liquid drop".

After a predetermined amount of filter element material 13 has been filled into each of the filter element formation regions 7, the motherboard 12 is heated up by the use of a heater to, for example, about 70 degree Celsius, so that the solvent in the filter element material 13 is vaporized. The volume of the filter element material 13 is reduced by this vaporization, as shown in FIG. 7(*c*), and the filter element material 13 is flattened. If the amount of reduction of the volume is very great, the supply of a liquid drop of filter element material 13 and the heating up of this liquid drop is executed repeatedly, until sufficient film thickness has been obtained for the color filter 1. By the above described processing, finally, only the solid component of the filter element material 13 remains as a film, and in this manner filter elements 3 of the various desired colors are formed.

After the filter elements 3 have been formed in the manner described above, heating processing at a predetermined temperature is carried out for a predetermined time period, in order to dry out these filter elements 3 completely. After this, the protective layer 4 is formed using a suitable procedure, such as, for example, a spin coating method, a roll coating method, a ripping method, or an ink jet method. This protective layer 4 is formed in order to protect the surfaces of the filter elements 3 and so on, and in order to flatten the surface of the color filter 1.

Figure 9:
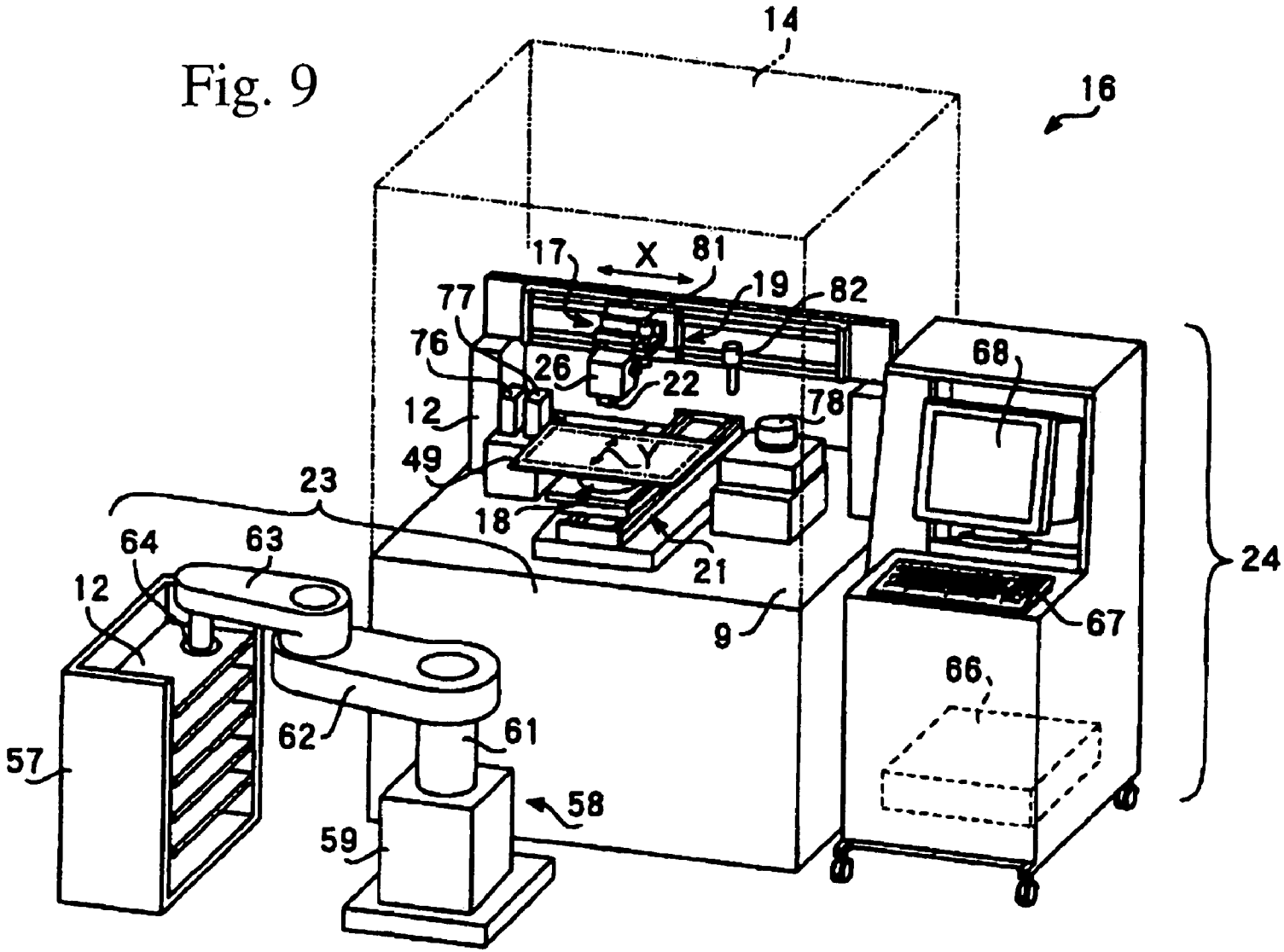
FIG. 9 is a perspective view showing a preferred embodiment of a liquid drop discharge device which is a principal portion of various manufacturing devices, such as a device for manufacture of the color filter according to the present invention, a device for manufacture of a liquid crystal device according to the present invention, and a device for manufacture of an electro-luminescent device according to the present invention.

FIG. 9 shows a preferred embodiment of a liquid drop discharge device for performing the procedure of supplying the filter element material 13 shown in FIG. 7(*b*). This liquid drop discharge device 16 is a device for discharging and adhering filter element material 13 as liquid drops 8 of ink of one color selected from R, G, and B (for example R), in predetermined positions within each of the color filter formation regions 11 upon the motherboard 12 (refer to FIG. 6(*b*)). Although individual liquid drop discharge devices 16 are provided as well for each of the other colors of filter element material 13, i.e., in the above example, for the G and B colored filter element materials 13, the explanation thereof will be curtailed, since they may be of the same structure as the liquid drop discharge device 16 for R colored filter element material which is shown in FIG. 9.

Referring to FIG. 9, this liquid drop discharge device 16 comprises: a head unit 26 comprising an ink jet head 22, which is an example of a liquid drop discharge head which is used in a printer or the like; a head position control device 17 which controls the position of this ink jet head 22; a substrate plate position control device 18 which controls the position of the motherboard 12; a main scanning drive device 19 which serves as a main scanning drive means for performing main scanning shifting of the ink jet head 22 with respect to the motherboard 12; a widthwise scanning drive device 21 which serves as a widthwise scanning drive means for performing widthwise scanning shifting of the ink jet head 22 with respect to the motherboard 12; a substrate plate supply device which supplies the motherboard 12 to a predetermined working position within this liquid drop discharge device 16; and a control device 24 which manages overall control of this liquid drop discharge device 16.

The head position control device 17, the substrate plate position control device 18, the main scanning drive device 19 which performs main scanning shifting of the ink jet head 22 with respect to the motherboard 12, and the widthwise scanning drive device 21 are mounted upon a base 9. Furthermore, a cover 14 is fitted over each of these devices, according to requirements.

Figure 10:
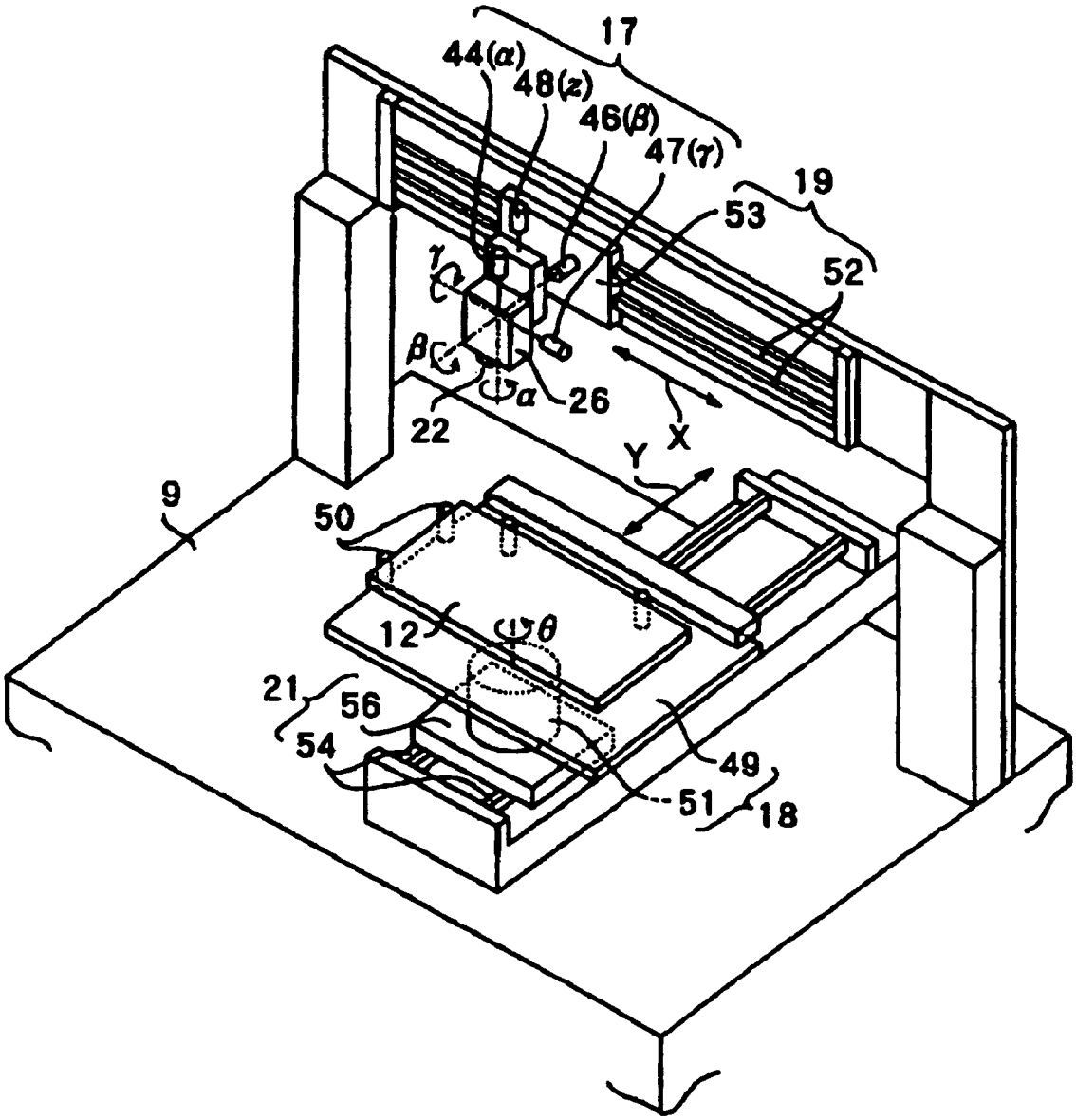
FIG. 10 is a perspective figure, showing a magnified view of a principal portion of the device of FIG. 9.
Figure 11:
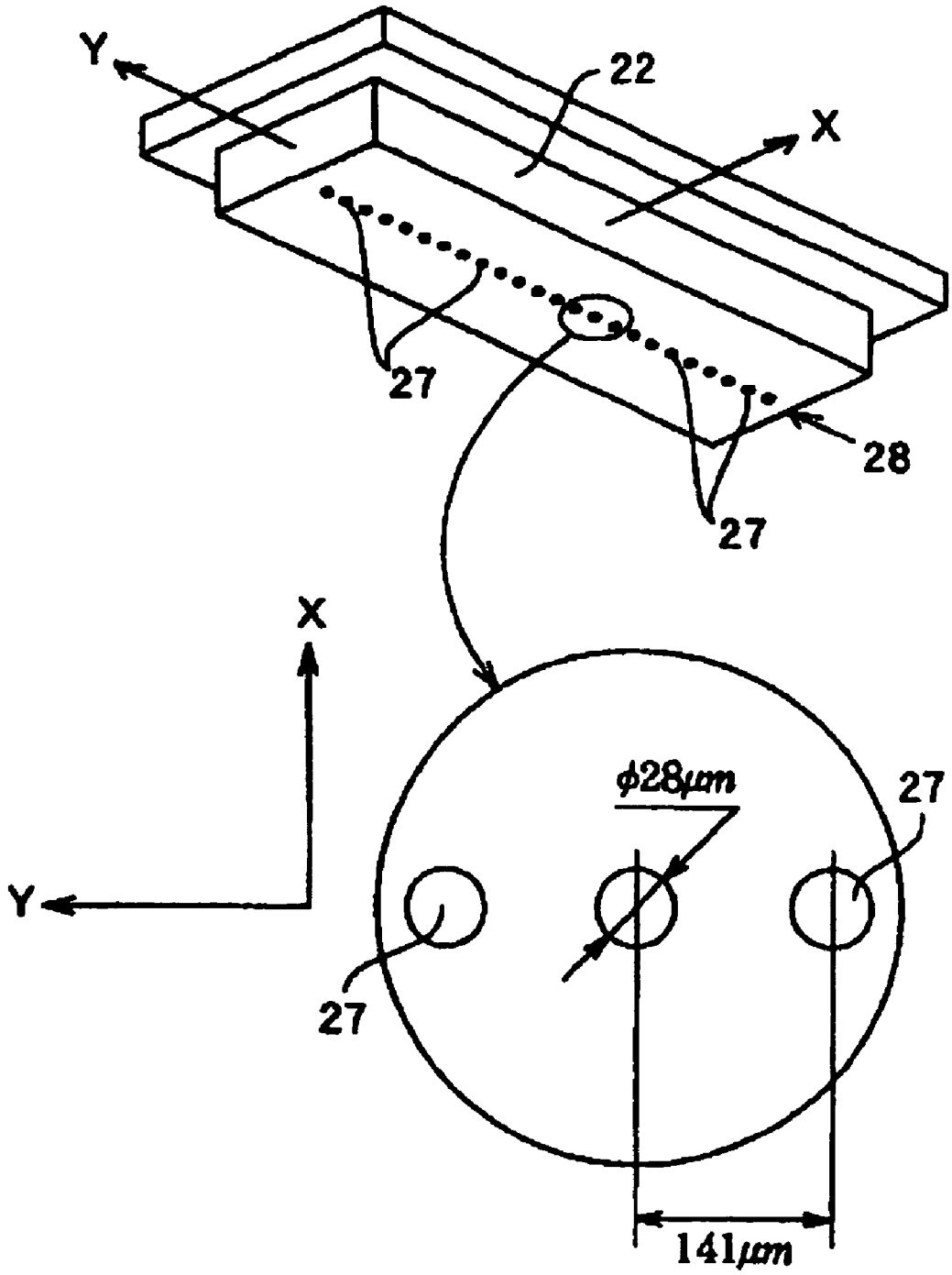
FIG. 11 is a perspective figure, showing a magnified view of an ink jet head which is a principal portion of the device of FIG. 10.

The ink jet head 22 comprises a row 28 of nozzles which is formed by arranging a plurality of nozzles 27 in a line, as shown, for example, in FIG. 11. The number of such nozzles 27 may be, for example, 180, and the aperture diameter of each of the nozzles 27 may be, for example, 141 μm, while the pitch between the nozzles 27 may be, for example, 141 μm. The main scanning direction X as shown in FIGS. 6(*a*) and 6(*b*) with respect to the color filter 1 and the motherboard 12, and the widthwise scanning direction Y which is perpendicular thereto, are set as shown in FIG. 10.

The ink jet head 22 is set into position so that its row 28 of nozzles extends in a direction which crosses the main scanning direction X, and filter element material 13 is adhered in predetermined positions upon the motherboard 12 (refer to FIG. 6(*b*)) by selectively discharging this filter element material 13 as ink from the plurality of nozzles 27, while the ink jet head 22 is parallel shifted relative to this main scanning direction X. Furthermore, it is possible to shift the main scanning position by the ink jet head 22 through a predetermined interval by relatively parallel shifting the ink jet head 22 in the widthwise scanning direction Y by just a predetermined distance.

Figure 13A:
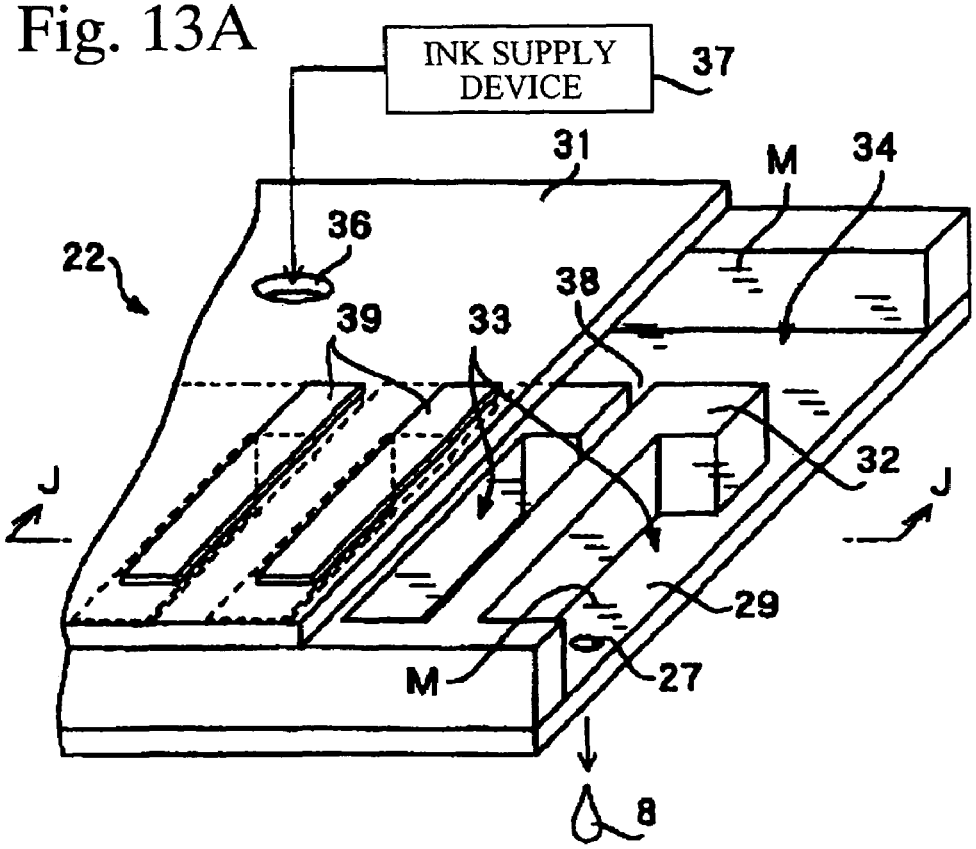
FIG. 13 is a figure showing the internal structure of the ink jet head; its view 13(*a*) shows a perspective view thereof with one portion broken away, while its view 13(*b*) shows a section through the same, taken in a sectional plane shown by the arrows J-J in its view 13(*a*).
Figure 13B:
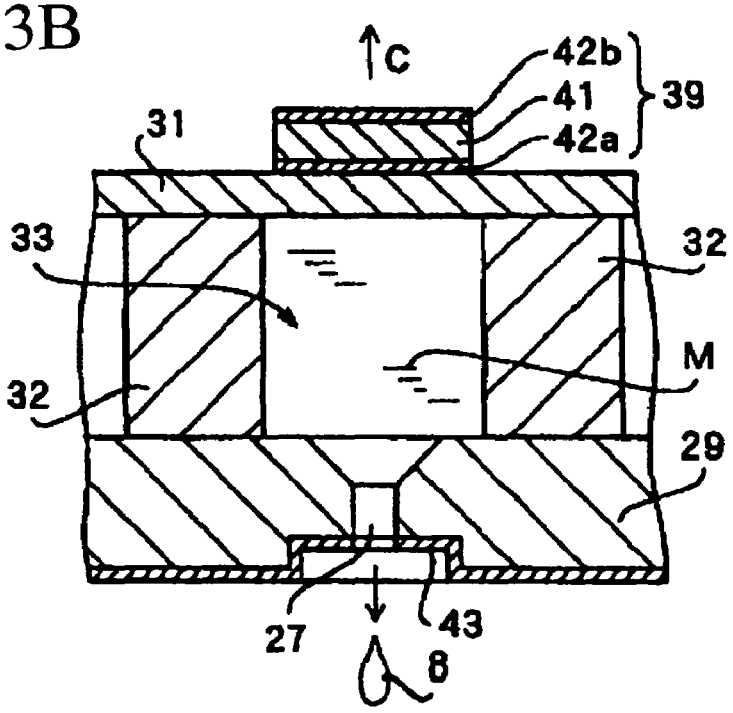

The ink jet head 22, for example, may have an internal structure as shown in FIGS. 13(*a*) and 13(*b*). In concrete terms, the ink jet head 22 may comprises a nozzle plate 29 which is made from, for example, stainless steel, a vibration plate 31 which is arranged to confront the nozzle plate 29, and a plurality of partition members 32 which mutually connect together the nozzle plate 29 and the vibration plate 31. A plurality of ink chambers 33 and an accumulator 34 are defined between the nozzle plate 29 and the vibration plate 31 by these partition members 32. This plurality of ink chambers 33 and the accumulator 34 are mutually communicated together via conduits 38.

An ink supply hole 36 is formed at a suitable position in the vibration plate 31, and an ink supply device 37 is connected to this ink supply hole 36. This ink supply device 37 supplies filter element material M of one of the colors R, G, and B—for example, R—to the ink supply hole 36. The filter element material M which is supplied fills the accumulator 34, and furthermore passes through the conduits 38 to fill the ink chambers 33.

The nozzles 27 are provided in the nozzle plate 29 for ejecting the filter element material M from the ink chambers 33 in the form of jets. Furthermore, ink pressurization elements 39 are fitted to the rear surface of the vibration plate 31 which defines the ink chambers 33 in positions which correspond to these ink chambers 33. Each of these ink pressurization elements 39, as shown in FIG. 13(*b*), comprises a piezoelectric element 41 and a pair of electrodes 42*a* and 42*b* which sandwich this piezoelectric element 41. When electrical current is supplied to the electrodes 42*a* and 42*b*, the piezoelectric element 41 is flexed and deformed so as to project to the exterior as shown by the arrow C in the figure, and thereby the volume of the ink chamber 33 is increased. When this happens, a quantity of filter element material M which corresponds to the amount by which this volume has increased is sucked from the accumulator 34 via the conduits 38 into the ink chamber 33.

Next, when the supply of current to the piezoelectric element 41 is stopped, the shapes of this piezoelectric element 41 and the vibration plate 31 both return to original. Due to this, since the volume of the ink chamber 33 also returns to original, the pressure of the filter element material M in the inside of this ink chamber 33 rises, and the filter element material M is ejected as liquid drops 8 from the corresponding nozzle 27 towards the motherboard 12 (refer to FIG. 6(*b*)). It should be understood that an ink repellent layer 43, which consists of, for example, a eutectic metallic layer of Ni-tetrafluoroethylene, is provided at the portions surrounding the nozzles 27, in order to prevent flight deviation of the liquid drops 8 and blockage of the holes in the nozzles 27 or the like.

Returning to FIG. 10, the head position control device 17 comprises an α motor 44 which rotates the ink jet head 22 in a horizontal plane, a β motor 46 which rotates the ink jet head 22 in an oscillatory manner around a rotational axis which is parallel to the widthwise scanning direction Y, a γ motor 47 which rotates the ink jet head 22 in an oscillatory manner around a rotational axis which is parallel to the main scanning direction, and a Z motor 48 which parallel shifts the ink jet head 22 in the vertical direction.

The substrate plate position control device 18 shown in FIG. 9 comprises, as shown in FIG. 10, a table 49 which bears the motherboard 12 and a θ motor 51 which rotates this table 49 within the horizontal plane as shown by the arrow θ. Furthermore, the main scanning drive device 19 shown in FIG. 9 comprises, as shown in FIG. 10, X guide rails 52 which extend along the main scanning direction X and an X slider 53 which includes a linear motor which is pulse driven. This X slider 53 is parallel shifted along the main scanning direction X along the X guide rails 52 when the linear motor which is included within said X slider 53 is driven.

Furthermore, the widthwise scanning drive device 21 shown in FIG. 9 comprises, as shown in FIG. 10, Y guide rails 54 which extend along the widthwise scanning direction Y and a Y slider 56 which includes a linear motor which is pulse driven. This Y slider 56 is parallel shifted along the widthwise scanning direction Y along the Y guide rails 54 when the linear motor which is included within said Y slider 56 is driven.

The pulse driven linear motors which are included within the X slider 53 and the Y slider 56 are capable of accurately performing fine rotational angle control of their output shafts according to supply of appropriate pulse signals to said motors, and accordingly it is possible to control with high accuracy the position and so on of the ink jet head 22 which is supported by the X slider 53 along the main scanning direction, and the position and so on of the table 49 which is supported by the Y slider 56 along the widthwise scanning direction Y. It should be understood that this position control of the ink jet head 22 and the table 49 is not limited to position control by the use of pulse motors; it would also be possible, as an alternative, to implement this position control by some other desired control method, such as feedback control using servo motors or the like.

The substrate plate supply device 23 shown in FIG. 9 comprises a substrate plate accommodation section 57 which accommodates a plurality of motherboards 12, and a robot 58 which transports one or the other of these motherboards 12. This robot 58 comprises a base 59 which is disposed upon an arrangement surface such as a floor or the surface of the ground, a raising and lowering shaft 61 which can shift upwards and downwards relatively to the base 59, a first arm 62 which rotates around this raising and lowering shaft 61 as an axis, a second arm 63 which rotates with respect to this first arm 62, and a suction pad 64 which is provided at the lower end surface of this second arm 63. The suction pad 64 is able to grip a motherboard by vacuum suction.

Referring to FIG. 9, a capping device 76 and a cleaning device 77 are arranged at a position on one side of the widthwise scanning drive device 21 which is below the track of the ink jet head 22 when it is driven by the main scanning drive device 19 so as to be shifted along the main scanning direction. Furthermore, an electronic scale 78 is arranged at a position on the other side of the widthwise scanning drive device 21. The cleaning device 77 is a device for cleaning the ink jet head 22. The electronic scale 78 is a device for measuring the weight of the liquid drops 8 of ink which are discharged from each of the nozzles 27 (refer to FIG. 11) within the ink jet head 22, for each nozzle individually. And the capping device 76 is a device for preventing the drying out of the nozzles 27 (refer to FIG. 11) when the ink jet head 22 is in the waiting state.

A head camera 81 is arranged in the vicinity of the ink jet head 22, in a relationship so as to shift integrally with this ink jet head 22. Furthermore, a camera 82 for the substrate plate, which is supported by a support device (not shown in the figures) provided upon the base 9, is arranged in a position to be able to photograph the motherboard 12.

The control device 24 shown in FIG. 9 comprises a computer main body portion 66 which houses a processor, a keyboard which functions as an input device 67, and a CRT (Cathode Ray Tube) display 68 which serves as a display device. The above described processor, as shown in FIG. 15, comprises a CPU (Central Processing Unit) 69 which performs calculation processing, and a memory which stores various types of information, in other words an information storage medium 71.

Figure 15:
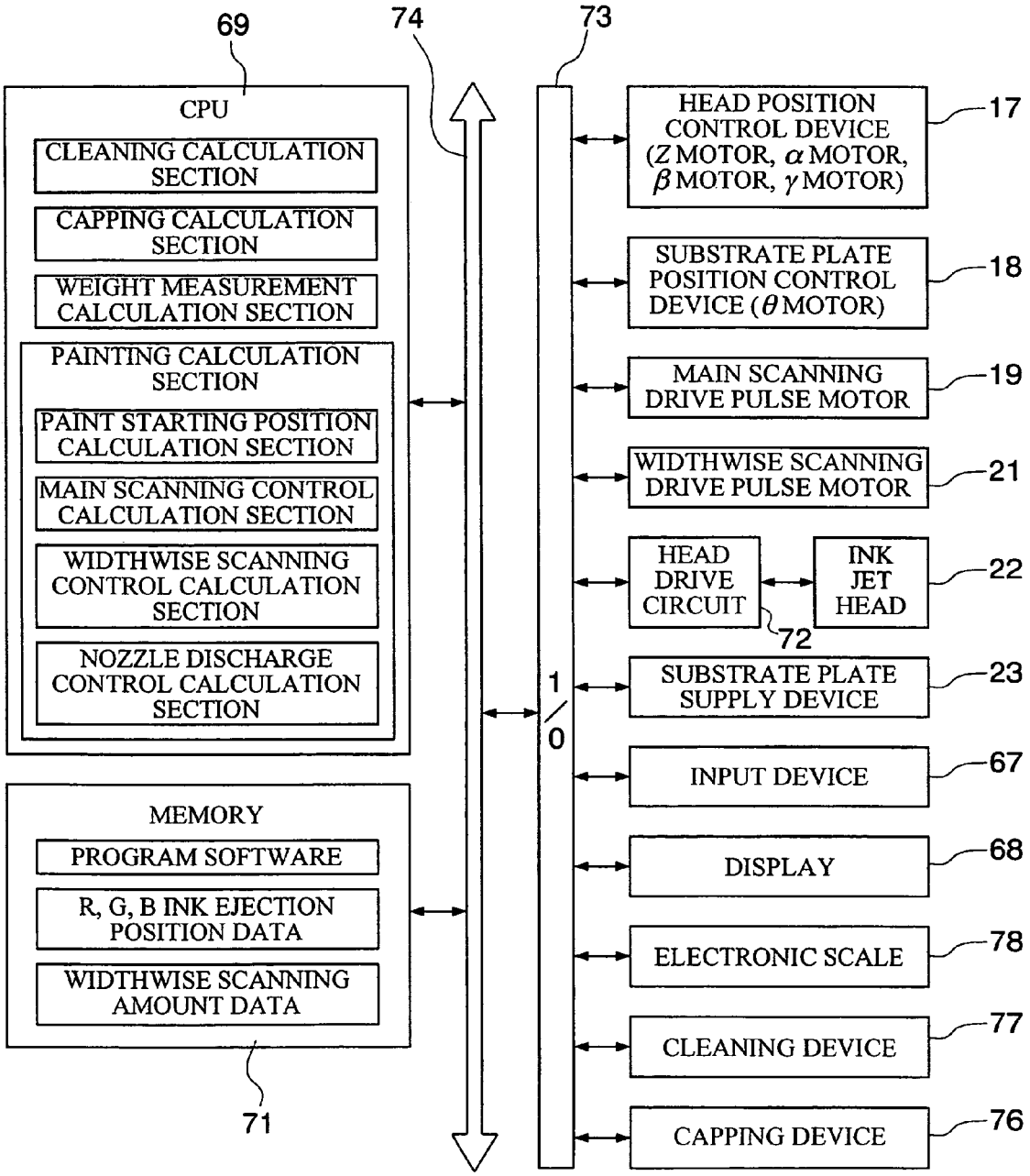
FIG. 15 is a block diagram showing an electrical control system which is used in the ink jet head device of FIG. 9.

Various sections, such as a head drive circuit 72 which drives the head position control device 17, the substrate plate position control device 18, the main scanning drive device 19, the widthwise scanning drive device 21, and the piezoelectric elements 41 (refer to FIG. 13(*b*)) within the ink jet head 22 are connected to the CPU 69 via an input and output interface 73 and a bus 74, as shown in FIG. 15. Furthermore, the substrate plate supply device 23, the input device 67, the CRT display 68, the electronic scale 78, the cleaning device 77, and the capping device 76 are also connected to the CPU 69 via the input and output interface 73 and the bus 74.

Conceptually, the memory which consists of the information storage medium 71 may be a semiconductor memory such as a RAM (Random Access Memory), a ROM (Read Only Memory) or the like, or a so called external storage device such as a hard disk, a readable CD-ROM device, or a disk type storage medium or the like; and, functionally, provides a storage region in which is stored program software which consists of a control procedure for operating this liquid drop discharge device 16, a storage region for storing discharge positions as coordinate data upon a motherboard 12 (refer to FIG. 6) for one color of R, G, and B for implementing the various types of R, G, and B arrays shown in FIG. 8, a storage region for storing widthwise scanning shift amounts upon the motherboard 12 in the widthwise scanning direction Y in FIG. 10, a region which functions as a work area for the CPU 69 and for storing temporary files and the like, and various other types of storage region.

The CPU 69 is arranged to execute control for discharging ink, in other words filter element material 13, at predetermined positions upon the surface of the motherboard 12 according to the program software which is stored in the memory which is the information storage medium 71. As concrete function implementation sections, it comprises a cleaning calculation section which performs calculations for implementing cleaning procedures, a capping calculation section for implementing capping procedures, a weight measurement calculation section which performs calculations for implementing weight measurement using the electronic scale 78 (refer to FIG. 9), and a painting calculation section which performs calculations for painting filter element material by the discharge of liquid drops.

To separate the paint calculation section in detail, it comprises various function calculation sections, such as a paint starting position calculation section which performs calculations for setting an initial position of the ink jet head 22 for painting, a main scanning control calculation section which performs calculations for control in order to perform scanning shifting of the ink jet head 22 at a predetermined speed in the main scanning direction X, a widthwise scanning control calculation section which performs calculations for control for shifting the motherboard 12 along the widthwise scanning direction Y by an exact predetermined widthwise scanning amount, and a nozzle discharge control calculation section which performs calculations for controlling whether or not to discharge ink, in other words filter element material 13, by operating one combination or another of the plurality of nozzles 27 in the ink jet head 22, and the like.

It should be understood that, although in the above preferred embodiment of the present invention the various functions described were implemented in software using the CPU 69, as an alternative, if it were possible to implement the above described functions using individual electronic circuits without using any CPU 69, it would also be possible to utilize such types of electronic circuits.

The operation of the liquid drop discharge device 16 which has the above described structure will now be explained with reference to the flow chart shown in FIG. 16.

First, when the operator turns on the electric power source and the liquid drop discharge device 16 starts to operate, initial settings are implemented in a step S1. In concrete terms, the head unit 26 and the substrate plate supply device 23 and the control device 24 are set into initial states which have been determined in advance.

Next, when the timing for weight measurement arrives (YES in a step S2), the head unit 26 of FIG. 10 is shifted by the main scanning drive device 19 to a position on the electronic scale 78 (in a step S3), and, using the electronic scale 78, a measurement is performed (in a step S4) of the amount of ink which is being discharged from a nozzle 27. And the voltage which is being supplied to the piezoelectric element 41 which corresponds to each nozzle 27 is adjusted (in a step S5) in accordance with the ink discharge characteristic of that nozzle 27.

After this, when the timing for cleaning arrives (YES in a step S6), the head unit 26 is shifted by the main scanning drive device 19 to a position on the cleaning device 77 (in a step S7), and the ink jet head 22 is cleaned by this cleaning device 77 (in a step S8).

If neither the timing for weight measurement nor the timing for cleaning has arrived (NO in the steps S2 and S6), or if one of these procedures has been completed, then (in a step S9) the substrate plate supply device 23 of FIG. 9 is operated and a motherboard 12 is supplied to the table 49. In concrete terms, a motherboard 12 in the substrate plate accommodation section 57 is picked up and held by the suction pad 64. Next, the motherboard 12 is transported to the table 49 by shifting the first arm 62 and the second arm 63, and furthermore is pushed on to a position determination pin 50 (refer to FIG. 10) which is provided in advance in a suitable position upon the table 49. It should be understood that it is desirable to fix the motherboard 12 to the table 49 by some means such as air suction in order to prevent variation of the position of the motherboard 12 upon the table 49.

Next, while observing the motherboard 12 with the camera 82 for the substrate plate, the position of the motherboard 12 is set (in a step S10) by rotating the table 49 in the horizontal plane through a minute unit angle by rotating the output shaft of the θ motor 51 through a minute unit angle. After this, while observing the motherboard 12 with the camera 81 for the head, the initial position for painting by the ink jet head 22 is determined by calculation (in a step S11). And then the ink jet head 22 is shifted to the initial painting position (in a step S12) by suitable operation of the main scanning drive device 19 and the widthwise scanning drive device 21.

Figure 1:
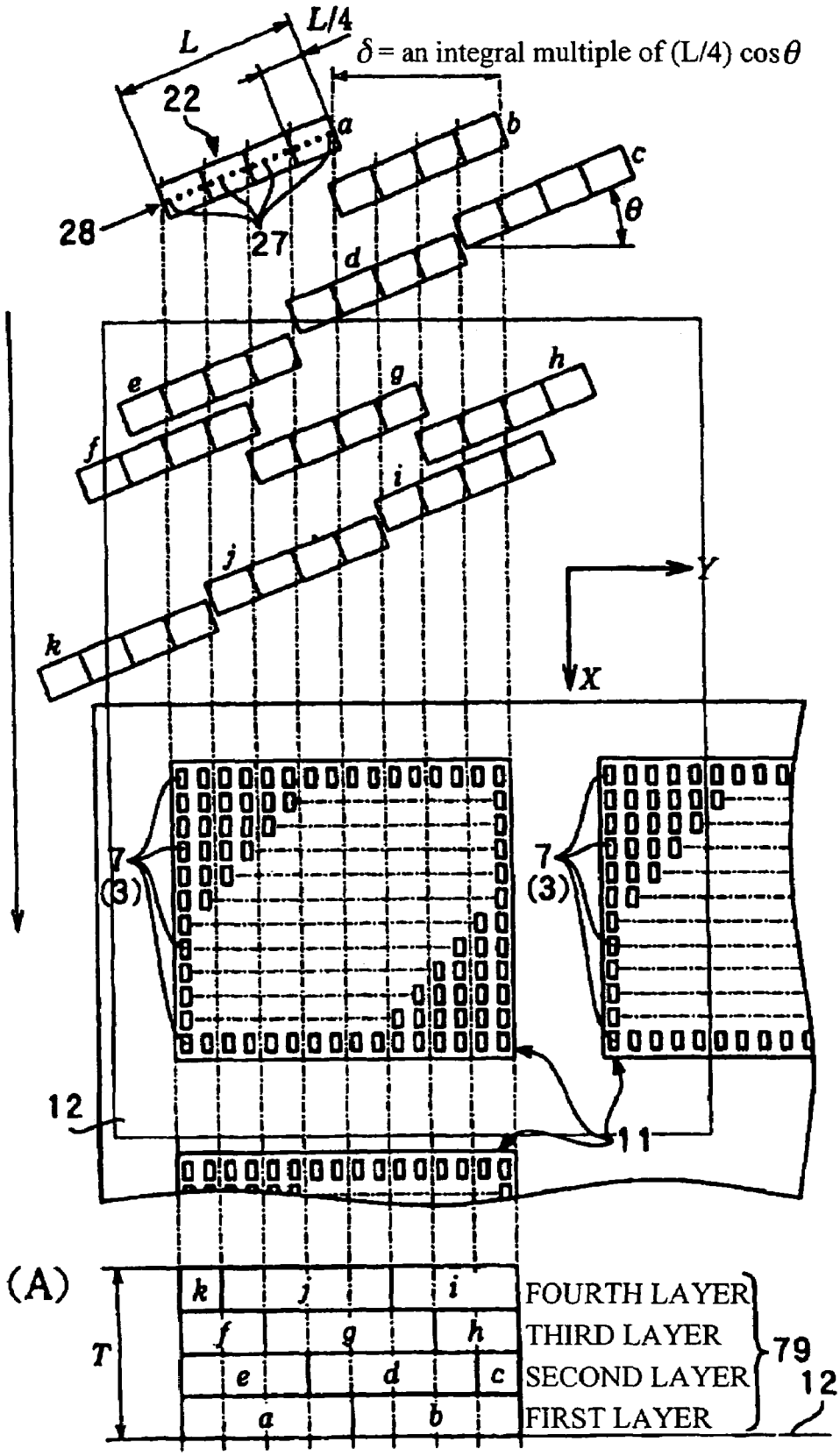
FIG. 1 is a plan view schematically showing a principal process of a preferred embodiment of the method of manufacture of the color filter according to the present invention.

At this time, the ink jet head 22 is arranged so that the row 28 of nozzles 27 is inclined at a certain angle θ with respect to the widthwise scanning direction Y of the ink jet head 22, as shown in the (a) position of FIG. 1. This is a measure which, because in the case of a conventional liquid drop discharge device the pitch between the nozzles, which is the interval between neighboring ones of the nozzles 27, and the element pitch which is the interval between neighboring ones of the filter elements 3, in other words between neighboring ones of the filter element formation regions 7, are often different, is taken in order to make the component of the pitch between the nozzles in the widthwise scanning direction when shifting the ink jet head 22 along the main scanning direction X become geometrically equal to the element pitch.

Figure 16:
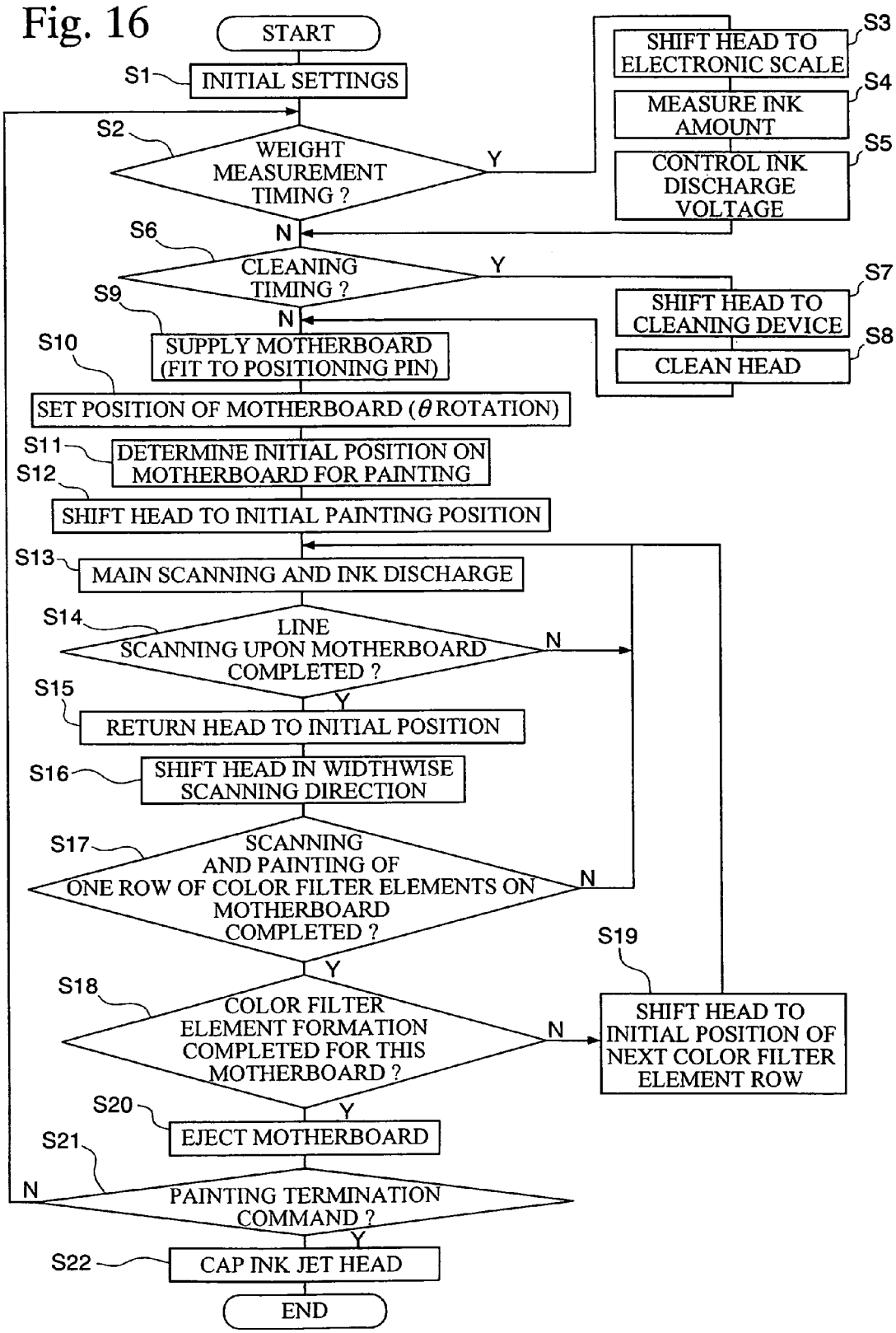
FIG. 16 is a flow chart showing the flow of control executed by the control system of FIG. 15.

When in the step S12 of FIG. 16 the ink jet head 22 has been positioned to its initial painting position, the ink jet head 22 is located at the position (a) as seen in FIG. 1. After this, main scanning is started in the main scanning direction X (in a step S13 of FIG. 16), and at the same time the discharge of ink is commenced. In concrete terms, the main scanning drive device 19 of FIG. 10 is operated and the ink jet head 22 is scan shifted along a straight line at a constant speed in the main scanning direction X, and, during this shifting, as and when the nozzles 27 arrive at positions which correspond to those filter element formation regions to which this color of ink is to be supplied, then ink, in other words filter element material, is discharged from these nozzles 27.

It should be understood that the ink discharge amount at this time is not an amount sufficient to fill in the entire volume of the filter element formation regions 7, but is a fraction of this entire volume—in this preferred embodiment, ¼ of the entire volume. This is because, as will be described hereinafter, the entire volume of each of the filter element formation regions 7 is not completely filled in by a single episode of ink discharge from the nozzle 27, but, rather, this entire volume is filled in by the superimposed discharge of several episodes of ink discharge—in this preferred embodiment of the present invention, four such episodes.

When the ink jet head 22 has completed one line of main scanning over the motherboard 12 (YES in a step S14), then it is shifted in the reverse direction and is returned to its initial position (in a step S15). And then, furthermore, the ink jet head 22 is driven (in a step S16) by the widthwise scanning drive device 21 so as to be shifted along the widthwise scanning direction Y by just a widthwise scanning amount δ (in this preferred embodiment, this distance is termed δ) which is determined in advance.

And, in this preferred embodiment of the present invention, the CPU 69 conceptually separates the plurality of nozzles 27 which constitute the row 28 of nozzles of the ink jet head 22 of FIG. 1 into a plurality of groups n. In this preferred embodiment n=4; in other words, the row 28 of nozzles of length L which is made up from 180 individual nozzles 27 is considered as being separated into four groups. By doing this, a single one of the groups of nozzles 27 is determined as containing 180/4=45 individual nozzles 27, and has a length L/n, i.e. L/4. The above described widthwise scanning amount δ is accordingly set to an integral number of times the length in the widthwise scanning direction of the above described nozzle group length L/4, in other words to (L/4)cos θ.

Accordingly the ink jet head 22, which has returned to the initial position (a) after having completed a single line of main scanning, is parallel shifted by just the distance δ in the widthwise scanning direction Y of FIG. 1, so as to be shifted to the position (b). It should be understood that this widthwise scanning shift amount δ is not always of a fixed magnitude; it may be varied according to requirements of control. Furthermore, although in FIG. 1 the position (k) is shown as being somewhat deviated from the position (a) with relation to the main scanning direction X, this is a measure adopted for the sake of making the explanation more easily understandable; in actuality, each of the positions from the position (a) to the position (k) is positioned the same with respect to the main scanning direction X.

After having been widthwise scanning shifted to the position (b), the ink jet head 22 repeats the execution of main scanning shift and ink discharge of the step S13. Furthermore, after this, the ink jet head 22 again repeats (in the steps S13 through S16) the execution of main scanning shift and ink discharge while repeating widthwise scanning shift through the positions (c) through (k), and thereby the process of adhering ink to a single row of color filter formation regions 11 upon the motherboard 12 is completed.

In this preferred embodiment of the present invention, since the widthwise scanning amount δ is determined by separating the row 28 of nozzles into four groups, when the above described one row of main scanning and widthwise scanning of the color filter formation regions 11 has been completed, each of the filter element formation regions 7 has received a total of four episodes of ink discharge processing, one by each of the four nozzle groups, and the entire predetermined required amount of ink, in other words filter element material, has been supplied into it, so as to fill its entire volume.

The manner in which this superimposed discharge of ink is performed is, in detail, as shown in FIG. 1(A). In FIG. 1(A) there are shown the layers of ink, in other words of filter element material, which are superimposed and adhered to the surface of the motherboard 12 by the row 28 of nozzles of the ink jet head 22 which is at each of the positions from the position "a" through the position "k". For example, the ink layer "a" of FIG. 1(A) is formed by ink discharge during main scanning by the row 28 of nozzles which is at the "a" position, the ink layer "b" of FIG. 1(A) is formed by ink discharge during main scanning by the row 28 of nozzles which is at the "b" position, and so on for positions "c", "d", . . . ; each of the ink layers "c", "d", . . . of FIG. 1(A) is formed by ink discharge during main scanning by the row 28 of nozzles which is at the "c" position, the "d" position, . . . .

In other words, in this preferred embodiment of the present invention, the four nozzle groups in the row 28 of nozzles perform main scanning four times in succession and discharge four superimposed layers of ink over the same color filter formation region 11 upon the motherboard 12, so that the total film thickness T finally becomes equal to the desired film thickness. Furthermore, a first layer in FIG. 1(A) of filter element material is formed by the main scanning of the row 28 of nozzles in the "a" position and the "b" position of FIG. 1, a second layer is formed by the main scanning of the row 28 of nozzles in the "c", "d", and "e" positions, a third layer is formed by the main scanning of the row 28 of nozzles in the "f", "g", and "h" positions, and a fourth layer is formed by the main scanning of the row 28 of nozzles in the "i", "j", and "k" positions, and thereby the entire layer 79 of filter element material is formed.

It should be understood that, by the first layer, the second layer, the third layer, and the fourth layer, is an expression for conveniently expressing the number of times of ink discharge for each main scan of the row 28 of nozzles, and in actual fact the various layers are not physically separated from one another; they meld with one another, so as to constitute, as a whole, a single unified layer 79 of filter element material.

Furthermore, in the preferred embodiment of the present invention shown in FIG. 1, as the row 28 of nozzles is widthwise scanning shifted in order from the "a" position to the "k" position, the track of the row 28 of nozzles in one position and the track of the row 28 of nozzles in the next position are not superimposed upon one another in the widthwise scanning direction Y, but rather, between each position, the row 28 of nozzles executes widthwise scanning shifting along the widthwise scanning direction Y, so that its tracks continue on from one another.

Furthermore, the widthwise scanning shift amount δ of the ink jet head 22 is set so that the boundary line of the row 28 of nozzles between the "a" position and the "b" position which form the first layer is not overlapped over the boundary line of the row 28 of nozzles between the "c" position, the "d" position, and the "e" position which form the second layer. In the same manner, the boundary lines between the second layer and the third layer, and also the boundary lines between the third layer and the fourth layer, are set so as not to be mutually overlapped. Although if, hypothetically for the sake of discussion, the boundary lines of the row 28 of nozzles between the various layers were (undesirably) not to be deviated in the widthwise scanning direction, in other words in the leftwards and rightwards direction as seen in FIG. 1(A), but were to be overlapped, then there would be a fear that a stripe would undesirably be formed in this boundary line portion, by contrast, if control is exerted as in this preferred embodiment of the present invention so as to cause some deviation of the boundary lines between the various layers, then no stripe can be generated, and moreover it becomes possible to form a filter element material layer 79 of uniform thickness.

Furthermore, in this preferred embodiment of the present invention, before forming the filter element material layer 79 of a predetermined film thickness T by repeatedly performing main scanning shifting and superimposed discharge of ink while widthwise scanning shifting the row 28 of nozzles by nozzle group units, first, the row 28 of nozzles is positioned to the "a" position and to the "b" position in FIG. 1, in other words, without overlapping the row 28 of nozzles, but by performing ink discharge connectedly in order, finally, in the beginning, a thin filter element material layer 79 comes to be formed uniformly upon the entire surface of the color filter formation region 11.

Generally, since the surface of the motherboard 12 is initially in a dry state and its dampness is low, there is a tendency for the stickiness of the ink to be bad, and accordingly, when a large quantity of ink is abruptly discharged locally upon the surface of the motherboard 12, it may become impossible to adhere the ink in a desirable manner, and there is a fear that the distribution of the concentration of the ink may become uneven. By contrast if, as in this preferred embodiment of the present invention, initially a wetted state is established over the entire color filter formation region 11, as much as possible, in which, without forming any boundary lines, ink is supplied thinly and uniformly, so that the entirety of said region 11 is wetted with an even concentration of ink, then it is possible to prevent boundary lines remaining before superimposed boundary portions of the ink in overlapping painting which is performed subsequently.

In this manner, when ink discharge for one row of the color filter formation region 11 upon the motherboard 12 of FIG. 6 has been completed (YES in a step S17), the ink jet head 22 is driven by the widthwise scanning drive device 21, and is transported (in a step S19) to the initial position at the beginning of the next row of the color filter formation region 11. And the processes of main scanning, widthwise scanning, and ink discharge are repeated (in steps S13 through S16) for this next row of the color filter formation region 11, so as to form the filter elements within the filter element formation region 7.

After this, when it is decided (YES in a step S18) that the formation of color filter elements 3 of one of the colors R, G, and B (in this example, of R) has been completed for all of the color filter formation regions 11 upon the surface of this motherboard 12, then the motherboard 12 is transported (in a step S20) by the substrate plate supply device 23 or by some other transport device, and this motherboard 12 upon which this stage of processing (painting of the R (red) filter material) has been completed is ejected to the outside of the device 16. After this, provided that no operation termination command from the operator has been received (NO in a step S21), the flow of control returns to the step S2 and the procedure of ink adhesion with ink of the single color R is repeated for another one of the motherboards 12.

When a command for termination of operation arrives from the operator (YES in the step S21), the CPU 69 transports the ink jet head 22 to the position of the capping device 76 in FIG. 9, and executes a capping procedure for the ink jet head 22 by this capping device 76 (in a step S22).

By the above, patterning for a first color, for example R (red), from among the three colors R, G, and B which make up the color filter 1 has been completed. After this, the motherboard 12 is transported to another one of the liquid drop discharge devices 16, in which patterning of this same motherboard 12 is performed, with now the filter element material 13G, for example, being used for painting on G (green) as the second one of the colors R, G, and B. Then, finally, the motherboard 12 is transported to a third one of the liquid drop discharge devices 16, in which patterning of this same motherboard 12 is performed, with now the filter element material 13B, for example, being used for painting on B (blue) as the third one of the colors R, G, and B. By doing this, a motherboard 12 is manufactured which consists of a plurality of color filters 1 (refer to FIG. 6(*a*)) each bearing a dot array with the desired arrangement of R, G, and B dots, such as a stripe array or the like. Finally this motherboard 12 is broken apart into its individual color filter formation regions 11, so as to produce a number of separate color filters 1.

It should be understood that, if it is supposed that this color filter 1 is one which will be utilized for a color display liquid crystal device, an electrode layer or an orientation layer or the like is additionally superimposed upon the surface of this color filter 1. In such a case, if the motherboard 12 were (undesirably) to be broken apart into the individual color filters 1 before superimposing this electrode layer or orientation layer or the like, and the electrode layer or the like were to be formed thereafter, this would be a very troublesome process indeed. Accordingly, in this type of case, it is desirable not to break the motherboard 12 apart immediately, but to complete the necessary supplementary processes such as forming an electrode layer or an orientation layer or the like, and thereafter to break the motherboard 12 apart into the individual color filters 1.

With the method of manufacture and the device for manufacture of the color filter 1 according to this preferred embodiment of the present invention as described above, each of the filter elements 3 within the color filter 1 shown in FIG. 6(*a*) is not formed by a single episode of main scanning X of the ink jet head 22 (refer to FIG. 1), but, rather, each individual one of the filter elements 3 is formed at its predetermined film thickness by being subjected to a number n (in this preferred embodiment n=4) of superimposed episodes of ink discharge by a plurality of nozzles 27 which are included in different nozzle groups. Due to this, even if hypothetically for the sake of discussion undesirable deviations were to exist in the ink discharge amounts between the various ones of the plurality of nozzles 27, it would be possible to prevent the occurrence of undesirable deviations in the film thickness between the various ones of the plurality of filter elements 3, and as a consequence, it is possible to ensure that the transparency characteristic of the color filter 1 is flat and uniform.

Of course, with this method of manufacture of this preferred embodiment of the present invention, since the filter element 3 is formed by ink discharge using the ink jet head 22, it is not necessary to perform any complicated process such as one which employs a photolithographic method, and furthermore there is no wastage of material.

Figure 53A:
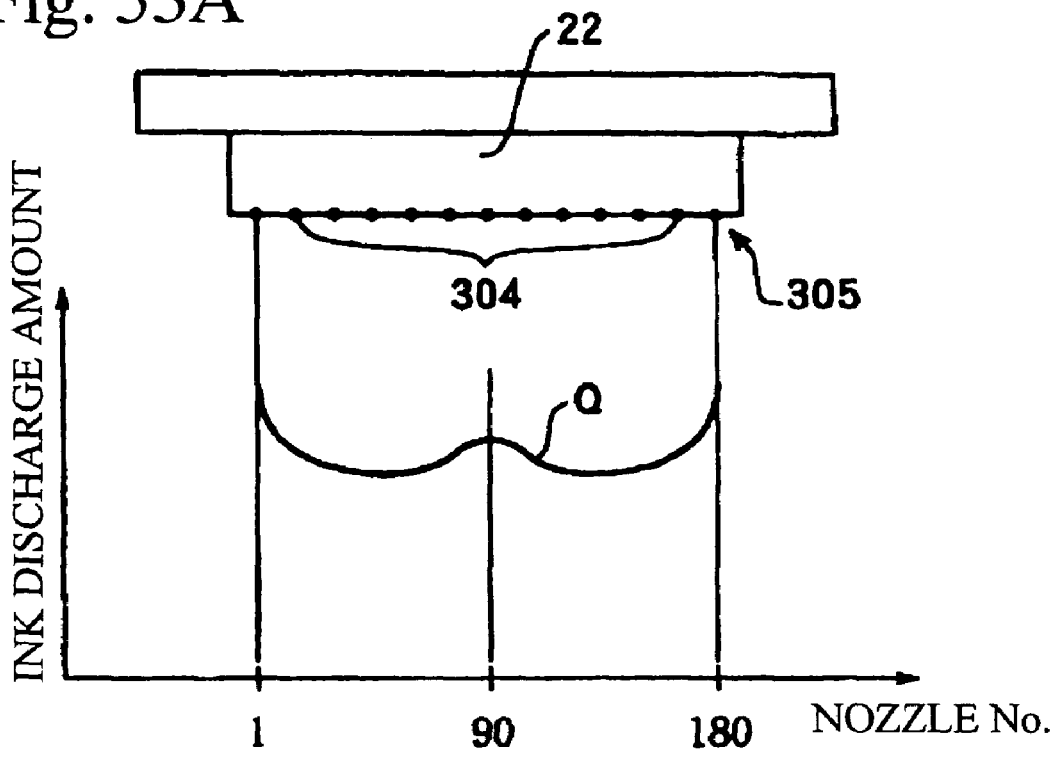
FIGS. 53(A)-53(B) are figures for explanation of the characteristics of a prior art color filter.
Figure 53B:
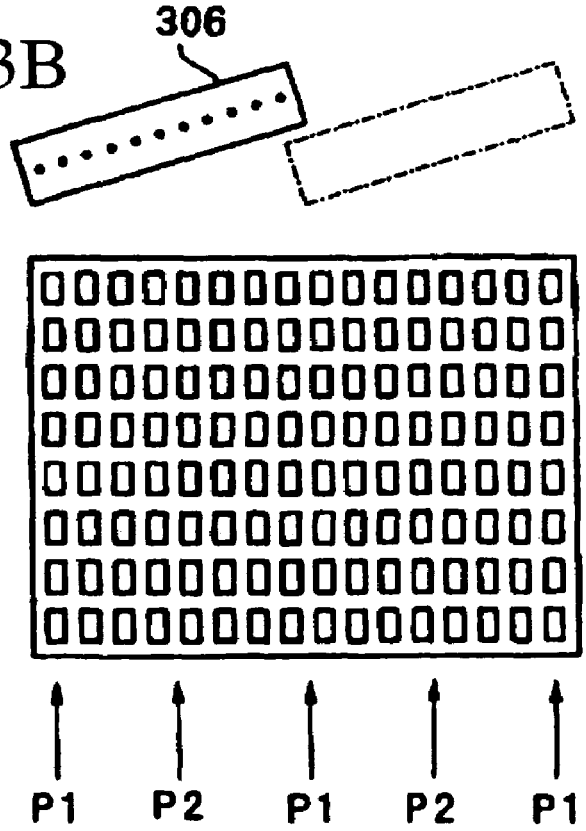

By the way, the way in which the distribution of the ink discharge amount from the plurality of nozzles 27 which constitute the row 28 of nozzles of the ink jet head 22 may become uneven is as explained in relation to FIG. 53(*a*). Furthermore in particular it may happen that, as described above, the ink discharge amount from a number of nozzles which are located at both the end portions of the row 28 of nozzles, for example from about ten nozzles at each of the end portions, may be particularly large. Use of nozzles 27 for which, in this manner, the ink discharge amount is particularly large as compared to the other nozzles 27 is not desirable in relation to making the film thickness of the ejected ink layer, i.e. of the filter element 3, uniform.

Figure 14:
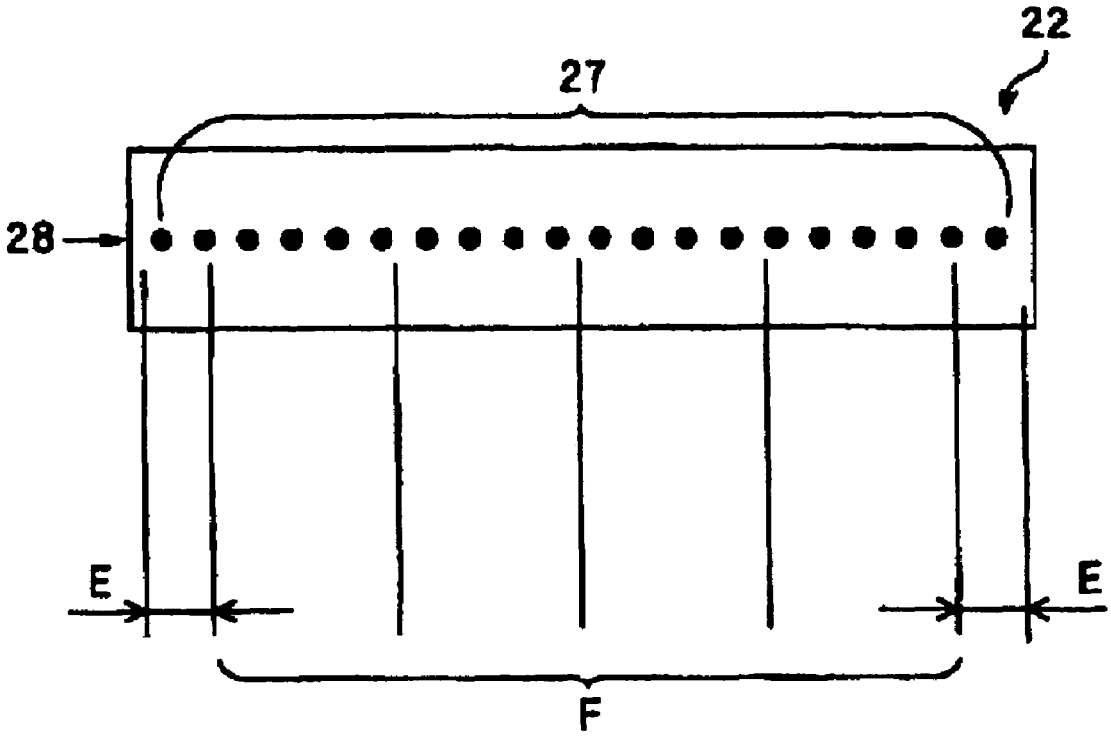
FIG. 14 is a plan view, showing another modified example of the ink jet head.

Accordingly, desirably, as shown in FIG. 14, among the plurality of nozzles 27 which make up the row 28 of nozzles, a number of nozzles which are located at the two ends E of the row 28 of nozzles, for example approximately ten thereof, may be set in advance to be ones from which ink is not discharged, and the rest of the nozzles 27 which are present in the remainder portion F of the row 28 of nozzles may be separated into a plurality of groups, for example four groups, and these nozzles may be widthwise scanning shifted by group units. For example, if the total number of nozzles 27 is 180, then the operational conditions such as the applied voltage are established so that ink is not discharged from ten nozzles at each end of the row 28 of nozzles, i.e. from a total of twenty nozzles, and the remaining 160 nozzles at the central portion of the row 28 of nozzles are conceptually divided into four groups, so that each of the nozzle groups is considered as being made up of 160/4=40 nozzles.

Although in this preferred embodiment of the present invention a non transparent resin material was utilized for the division walls 6, it would also, of course, be possible to utilize a transparent resin material to make division walls 6 which were transparent. In such a case, it would be appropriate to provide a metallic film such as Cr or a resin material, as a separate black mask which was able to intercept light, in positions which corresponded to the divisions between the filter elements 3, for example above the division walls 6, or below the division walls 6, or the like. Furthermore, a structure is also acceptable in which the division walls 6 are formed of a transparent resin material, without any such black mask being provided.

Furthermore, although in this preferred embodiment of the present invention the three colors R, G, and B were utilized for the filter elements 3, it is a matter of course that the colors of the filter elements are not to be considered as being limited to being R, G, and B; it would also be possible, for example, to utilize C (cyan), M (magenta), and Y (yellow). In such a case, it would be appropriate to utilize filter element materials which had the colors C, M, and Y, instead of the filter element materials having the colors R, G, and B which were utilized in the above described preferred embodiment.

Furthermore, although in this preferred embodiment of the present invention the division walls 6 were formed by photolithography, it would also be possible to form the division walls by an ink jet method, in the same way as the color filter 1.

Figure 2:
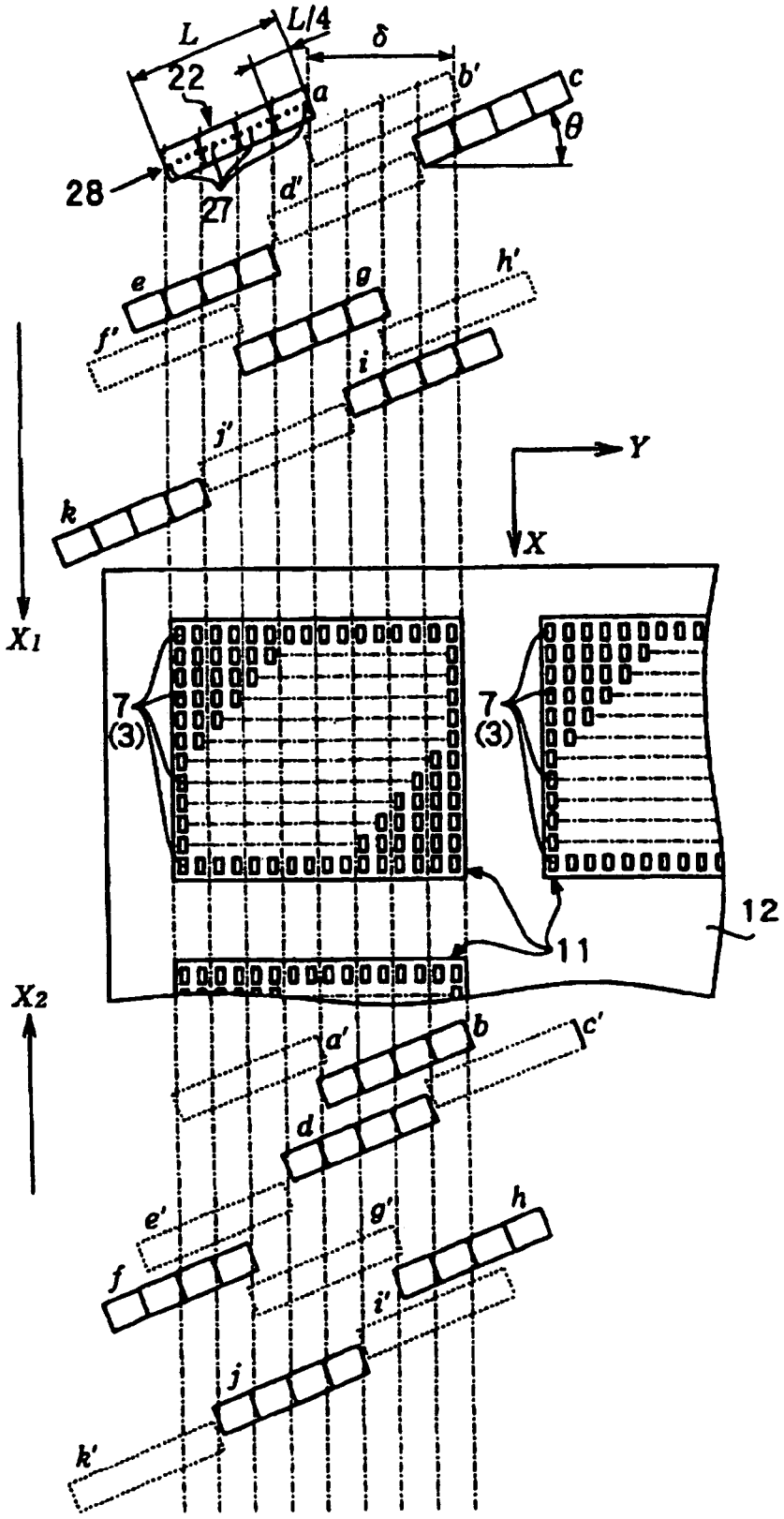
FIG. 2 is a plan view schematically showing a principal process of another preferred embodiment of the method of manufacture of the color filter according to the present invention.

Method of Manufacture of a Color Filter, and Device for Manufacturing the Same—Part 2 of the Explanation FIG. 2 is a figure for explanation of a variant example of the method of manufacture and the device for manufacture of the color filter 1 according to the present invention explained above, and schematically shows the situation in which the ink, in other words the filter element material 13, which is being supplied by discharge using the ink jet head 22 into each of the filter element formation regions 7 of the color region formation regions 11 upon the motherboard 12.

A summary of the process which is performed by this preferred embodiment is the same as the process shown in FIG. 7, and the liquid drop discharge device which is used for ink discharge and application is also, mechanically, the same as the device which was shown in FIG. 9 and described above. Furthermore, the CPU 69 of FIG. 15 conceptually divides the plurality of nozzles 27 which make up the row 28 of nozzles into n, for example, four, groups of length L/n, i.e. of length L/4, and determines the widthwise scanning amount δ in correspondence thereto, just as was done in the case of the FIG. 1 embodiment.

The point in which this variant preferred embodiment differs from the preferred embodiment shown with reference to FIG. 1 and described above, is that modifications are added to the program software which is stored in the memory, which is the information storage medium 71 of FIG. 15, and in concrete terms modifications are added to the main scanning control calculation and to the widthwise scanning control calculation which are performed by the CPU 69.

To explain in more concrete terms, in FIG. 2, the ink jet head 22 is not return shifted to its initial position after its scanning shifting along the main scanning direction X has been completed, but rather, directly after main scanning shift in a first direction has been completed, control is exerted so as to shift the ink jet head 22 along the widthwise scanning direction by just the shift amount δ which corresponds to a single nozzle group 1 so as to reach the position (b), and then scanning shifting is performed in the direction X2 which is opposite to the main scanning direction X1 for the previous scanning episode described above, until the ink jet head 22 returns to reach a position (b') which is displaced in the widthwise scanning direction from the initial position (a) by just the distance δ. It should be understood that also, of course, ink continues to be selectively discharged from the plurality of nozzles 27, both during the period of main scanning shifting of the ink jet head 22 from the position (a) to the position (a') and also during the period of main scanning shifting of the ink jet head 22 from the position (b) to the position (b').

In other words, in this variant preferred embodiment, the main scanning and the widthwise scanning of the ink jet head 22 are performed in a continuous manner, with the main scanning being performed in alternate directions along the main scanning direction, without the interposition of any episodes of return shifting the ink jet head 22 to its initial position along the main scanning direction without doing any actual ink ejection; and accordingly, by doing this, it is possible to shorten the working time period by the time period which was, in the first embodiment described previously, consumed by such return shifting episodes.

Figure 3:
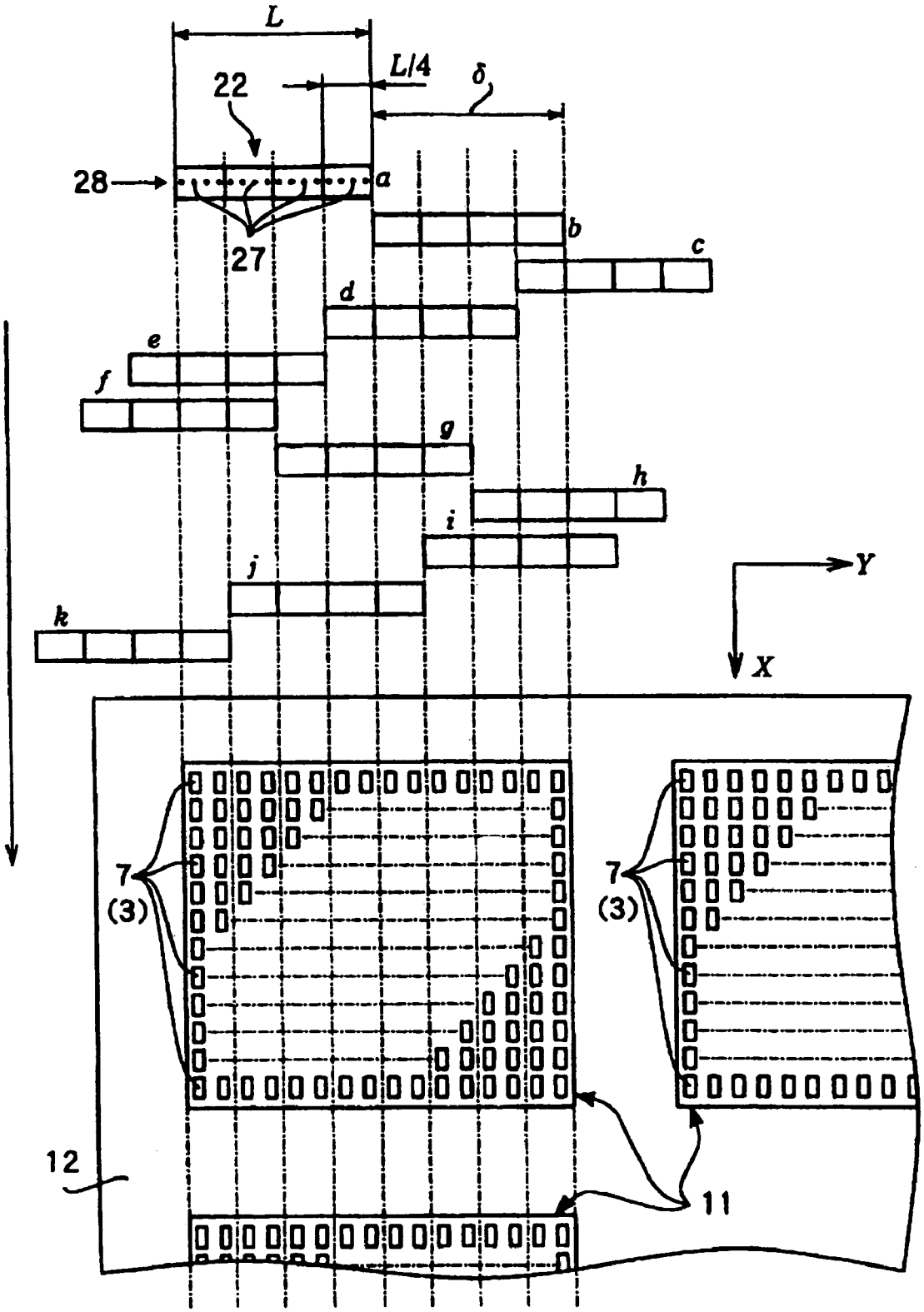
FIG. 3 is a plan view schematically showing a principal process of yet another preferred embodiment of the method of manufacture of the color filter according to the present invention.

Method of Manufacture of a Color Filter, and Device for Manufacturing the Same—Part 3 of the Explanation FIG. 3 is a figure for explanation of another variant example of the method of manufacture and the device for manufacture of the color filter 1 according to the present invention explained above, and schematically shows the situation in which ink, in other words filter element material 13, is supplied by discharge using the ink jet head 22 to each of the filter element formation regions 7 within the color filter formation regions 11 upon the motherboard 12.

A summary of the process which is performed by this preferred embodiment is the same as the process shown in FIG. 7, and the liquid drop discharge device which is used for ink discharge and application is also, mechanically, the same as the device which was shown in FIG. 9 and described above. Furthermore, the CPU 69 of FIG. 15 conceptually divides the plurality of nozzles 27 which make up the row 28 of nozzles into n, for example, four, groups of length L/n, i.e. of length L/4, and determines the widthwise scanning amount δ in correspondence thereto, just as was done in the case of the FIG. 1 embodiment.

The point in which this variant preferred embodiment differs from the preferred embodiment shown with reference to FIG. 1 and described above, is that, when in the step S12 of FIG. 16 the ink jet head 22 has been set to the initial painting position over the motherboard 12, this ink jet head 22 is, as shown in position (a) of FIG. 3, positioned so that the direction in which the row 28 of nozzles extend is parallel to the widthwise scanning direction Y This type of array structure for the nozzles is one which is beneficial if the pitch between the nozzles upon the ink jet head 22 and the pitch between the elements upon the motherboard 12 is the same.

With this preferred embodiment as well, while repeating scanning shifting along the main scanning direction X, return shifting back to the initial position, and widthwise scanning shifting along the widthwise scanning direction Y by the shift amount δ until the ink jet head 22 arrives from its initial position (a) to its final position (k), ink, in other words filter element material 13, is selectively discharged from the plurality of nozzles 27 during the periods of main scanning shifting. By doing this, the filter element material 13 is selectively adhered to the filter element formation regions 7 in the color filter formation regions 11 upon the motherboard 12.

It should be understood that, with this variant preferred embodiment, the row 28 of nozzles is set in position so as to be parallel to the widthwise scanning direction Y. Due to this, the widthwise scanning shift amount 6 is set to be equal to the length L/n, i.e. L/4, of each of the separate nozzle groups.

Figure 4:
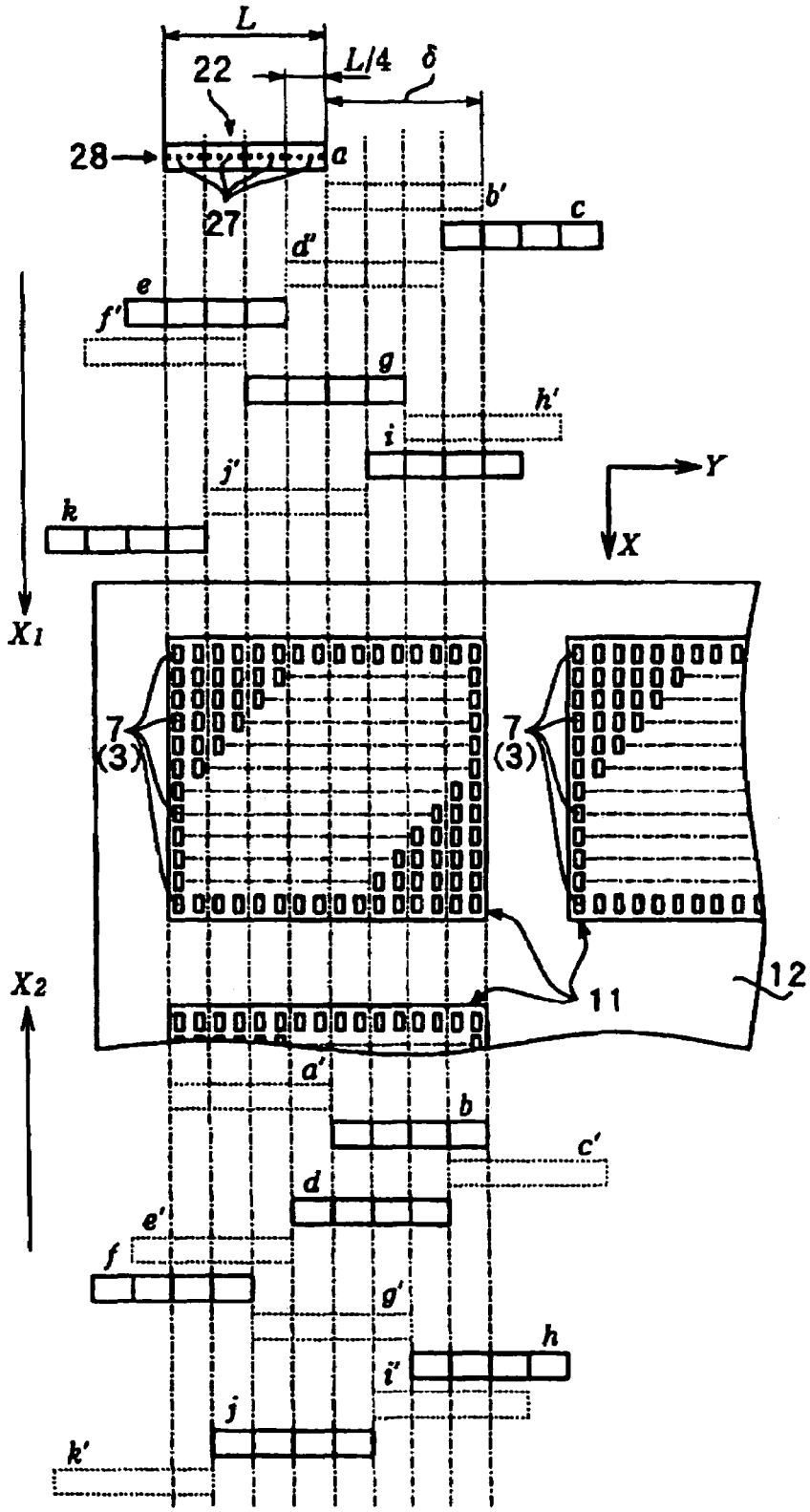
FIG. 4 is a plan view schematically showing a principal process of still yet another preferred embodiment of the method of manufacture of the color filter according to the present invention.

Method of Manufacture of a Color Filter, and Device for Manufacturing the Same—Part 4 of the Explanation FIG. 4 is a figure for explanation of yet another variant example of the method of manufacture and the device for manufacture of the color filter 1 according to the present invention which has been explained above, and schematically shows the situation in which ink, in other words filter element material 13, is supplied by discharge using the ink jet head 22 to each of the filter element formation regions 7 within the color filter formation regions 11 upon the motherboard 12.

A summary of the process which is performed by this preferred embodiment is the same as the process shown in FIG. 7, and the liquid drop discharge device which is used for ink discharge and application is also, mechanically, the same as the device which was shown in FIG. 9 and described above.

Furthermore, the CPU 69 of FIG. 15 conceptually divides the plurality of nozzles 27 which make up the row 28 of nozzles into n, for example, four, groups of length L/n, i.e. of length L/4, and determines the widthwise scanning amount δ in correspondence thereto, just as was done in the case of the FIG. 1 embodiment.

The points in which this variant preferred embodiment differs from the preferred embodiment shown with reference to FIG. 1 and described above, are: that, when in the step S12 of FIG. 16 the ink jet head 22 has been set to the initial painting position over the motherboard 12, this ink jet head 22 is, as shown in FIG. 4(*a*), positioned so that the direction in which the row 28 of nozzles extend is parallel to the widthwise scanning direction Y; and that, in the same manner as in the preferred embodiment of FIG. 2, main scanning operation and widthwise scanning operation of the ink jet head 22 are repeatedly alternatively performed without interposing any episodes of return operation.

Figure 12:
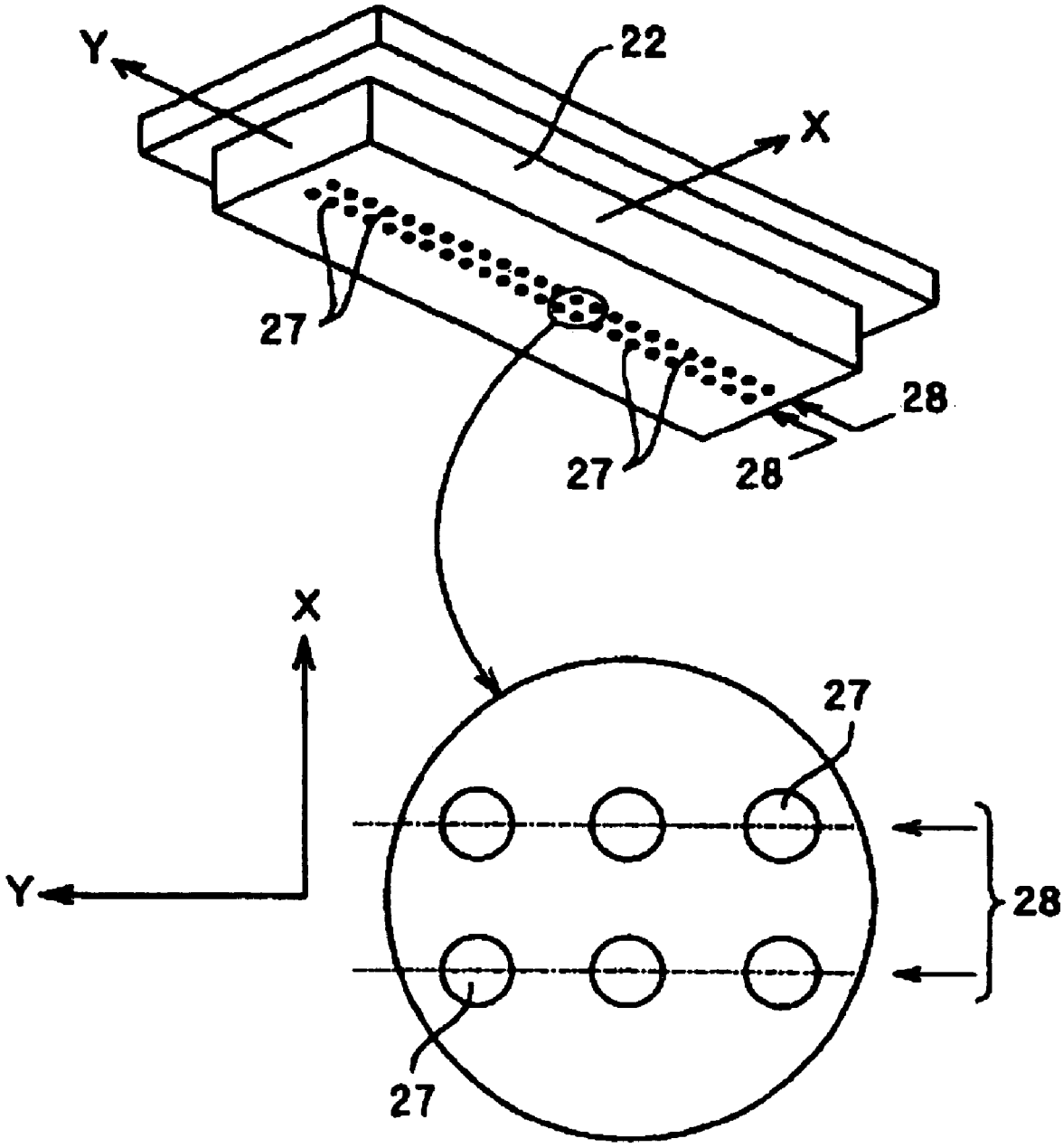
FIG. 12 is a perspective figure, showing a modified example of the ink jet head.

It should be understood that, with this preferred embodiment shown in FIG. 4 and the previously described preferred embodiment shown in FIG. 3, since the main scanning direction X is the direction which is perpendicular to the row 28 of nozzles, by providing two rows 28 of nozzles as shown in FIG. 12 along the main scanning direction X, it is possible to supply filter element material 13 to a single one of the filter element formation regions 7 by two of the nozzles 27 which are mounted along the same main scanning line.

Figure 5:
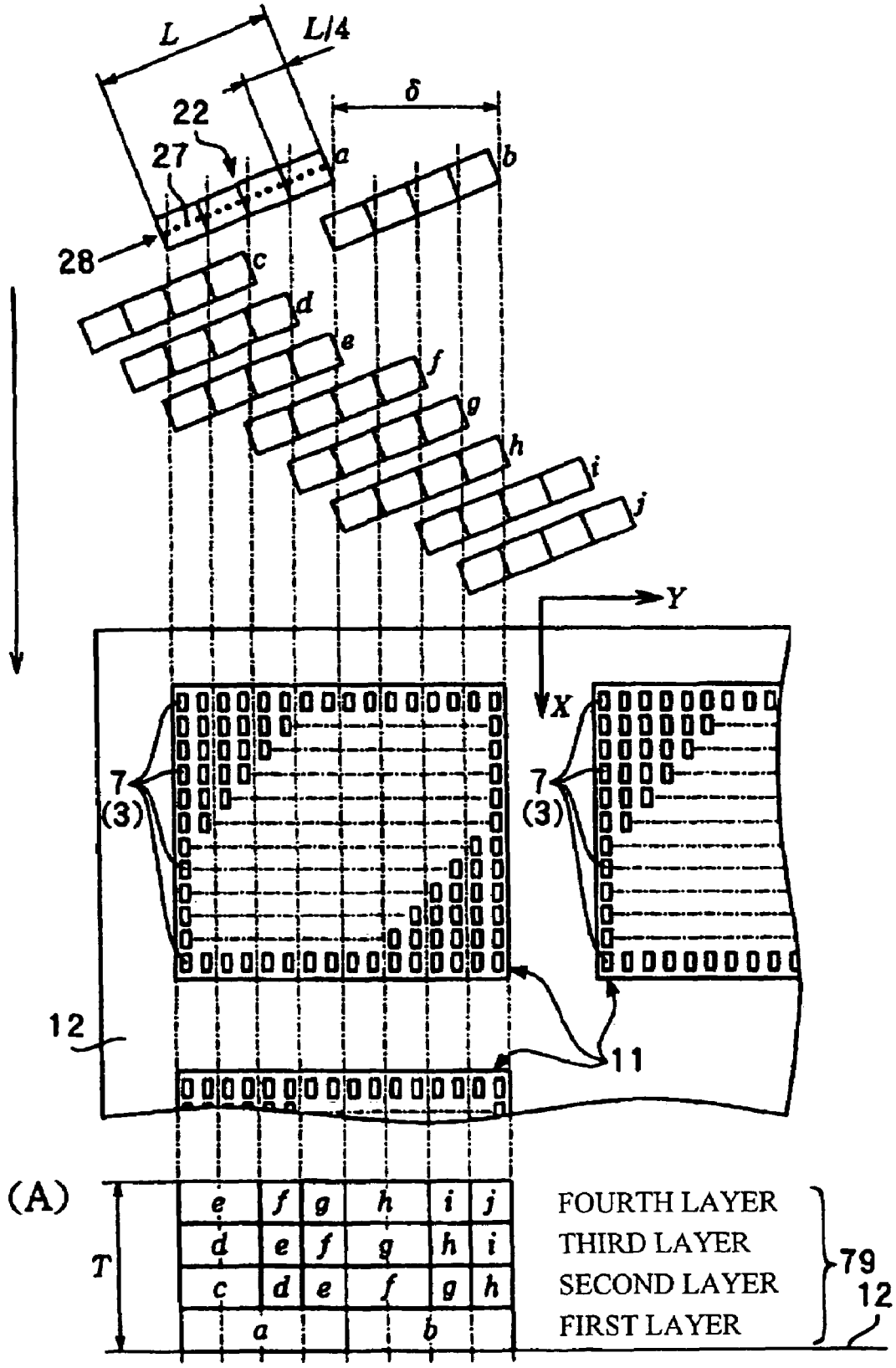
FIG. 5 is a plan view showing a preferred embodiment of a motherboard which constitutes a preferred embodiment of the color filter according to the present invention and its foundation.

Method of Manufacture of a Color Filter, and Device for Manufacturing the Same—Part 5 of the Explanation FIG. 5 is a figure for explanation of still yet another variant example of the method of manufacture and the device for manufacture of the color filter 1 according to the present invention which has been explained above, and schematically shows the case in which ink, in other words filter element material 13, is supplied by discharge using the ink jet head 22 to each of the filter element formation regions 7 within the color filter formation regions 11 upon the motherboard 12.

A summary of the process which is performed by this preferred embodiment is the same as the process shown in FIG. 7, and the liquid drop discharge device which is used for ink discharge and application is also, mechanically, the same as the device which was shown in FIG. 9 and described above. Furthermore, the CPU 69 of FIG. 15 conceptually divides the plurality of nozzles 27 which make up the row 28 of nozzles into n, for example, four, groups, just as was done in the case of the FIG. 1 embodiment.

With the preferred embodiment which was shown in FIG. 1, a first filter element material layer 79 was formed over the surface of the motherboard 12 at an even thickness by performing widthwise scanning shifting continuously without overlapping consecutive scans of the row 28 of nozzles, and a second layer, a third layer, and a fourth layer were superimposed upon this first layer in the same manner. By contrast to this, in the preferred embodiment shown in FIG. 5, although the method for forming the first layer is the same as in the case of FIG. 1(A), the second layer through the fourth layer are not superimposed in order as layers of the same thickness, but rather, formation of the second layer, the third layer, and the fourth layer is performed so as to proceed from the left side to the right side of FIG. 5(A) in order in a partially stepwise manner, so as finally to form the filter element material layer 79.

In this preferred embodiment shown in FIG. 5, since, for each of the first layer through the fourth layer, the boundary lines of the row 28 of nozzles are overlapped between each layer, it may happen that thick concentrated stripes of filter element material appear at these boundary portions. However, in this preferred embodiment as well, since it is arranged, after in the initial processing the dampness has been elevated by forming the first layer of even thickness over the entire surface of the color filter formation region 11, to perform superimposing of the second layer through the fourth layer over this one, accordingly the first layer whose thickness is even is not formed uniformly without mura over its entire surface, and, by comparison to the case of formation of the first layer through the fourth layer abruptly from the left side in a stepwise manner, it is possible to form a color filter 1 in which there is no concentration of mura, and with which stripes are only formed at the hair boundary portions with difficulty.

Figure 17:
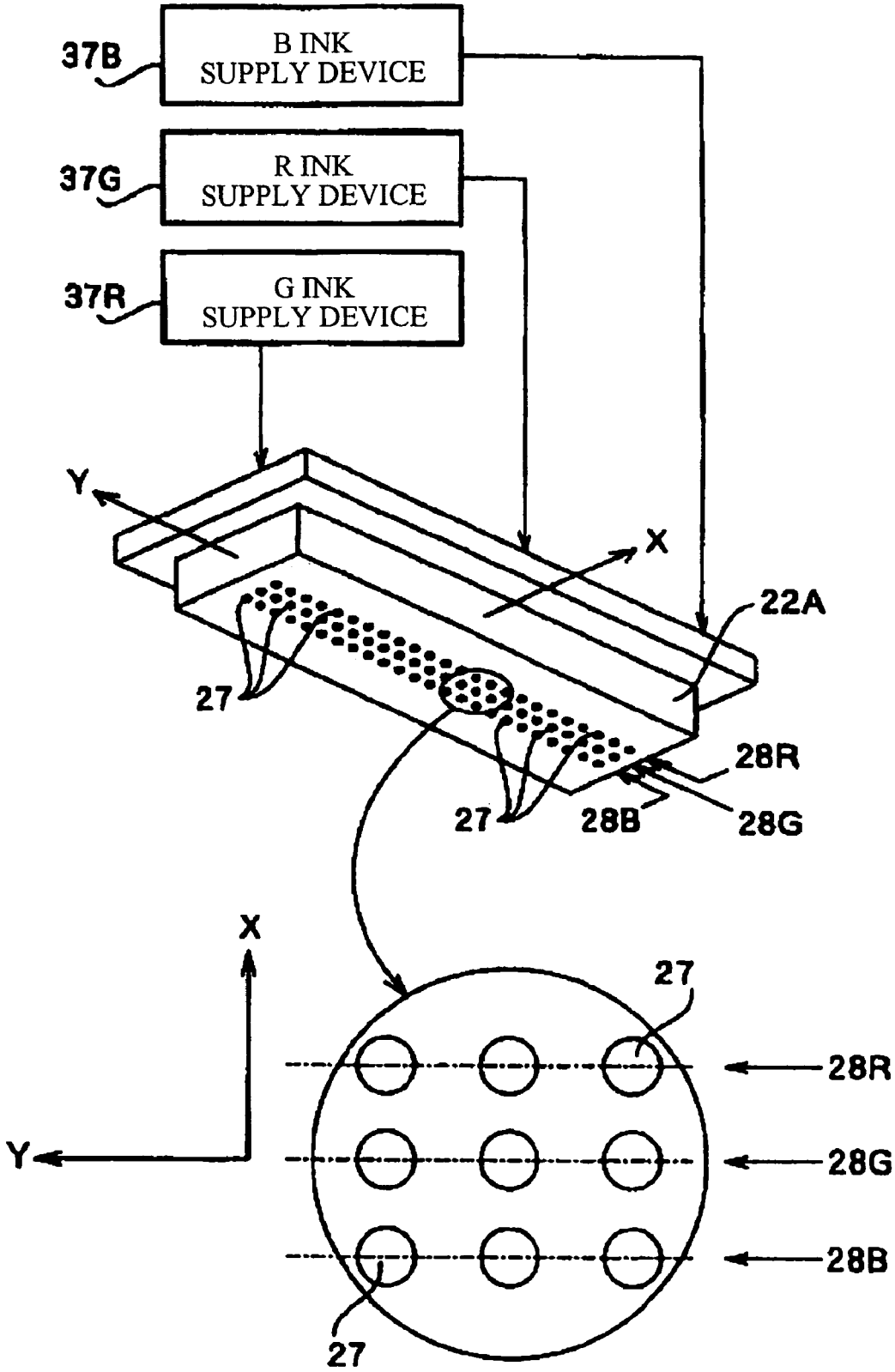
FIG. 17 is a perspective view showing yet another modified example of the ink jet head.

Method of Manufacture of a Color Filter, and Device for Manufacturing the Same—Part 6 of the Explanation FIG. 17 is a figure for explanation of a yet further variant example of the method of manufacture and the device for manufacture of the color filter 1 according to the present invention which has been explained above, and shows an ink jet head 22A. The point in which this ink jet head 22A differs from the ink jet head 22 shown in FIG. 10, is that three types of rows of nozzles 27 are provided in the one ink jet head 22A: a row 28R of nozzles for discharging R (red) color ink, a row 28G of nozzles for discharging G (green) color ink, and a row 28B of nozzles for discharging B (blue) color ink. An ink discharge system as shown in FIG. 13(*a*) and FIG. 13(*b*) is provided for each of these three rows of nozzles, and the ink discharge system which corresponds to the R row of nozzles 28R is connected to a R ink supply device 37R, while the ink discharge system which corresponds to the G row of nozzles 28G is connected to a G ink supply device 37G, and the ink discharge system which corresponds to the B row of nozzles 28B is connected to a B ink supply device 37B.

A summary of the process which is performed by this preferred embodiment is the same as the process shown in FIG. 7, and the liquid drop discharge device which is used for ink discharge and application is also, mechanically, the same as the device which was shown in FIG. 9 and described above. Furthermore, the CPU 69 of FIG. 15 conceptually divides the plurality of nozzles 27 which make up the rows 28R, 28G, and 28B of nozzles into n, for example, four, groups, and performs widthwise scanning shifting of the ink jet head 22A by the widthwise scanning shift amount δ for each of these nozzle groups, just as was done in the case of the FIG. 1 embodiment.

Since, in the preferred embodiment which was shown in FIG. 1, only a single row 28 of nozzles 27 of a single type was provided to the ink jet head 22, it was necessary to provide three such ink jet heads 22 shown in FIG. 9, one for each of the three colors R, G, and B, when making a color filter 1 with inks of the three colors R, G, and B. By contrast to this, in the case of utilizing the ink jet head 22A which is structured as shown in FIG. 17, it is only necessary to provide a single such ink jet head 22A when making such a three color filter 1, since it is possible to adhere inks of the three colors R, G, and B at the same time to the motherboard 12 in a single episode of main scanning by the ink jet head 22A along the main scanning direction X. Furthermore, by matching the intervals between the rows 28 of nozzles of the three different colors to the pitch of the filter element formation regions 7 upon the motherboard, it becomes possible to print the inks of the three colors R, G, and B at the same time.

Figure 18:
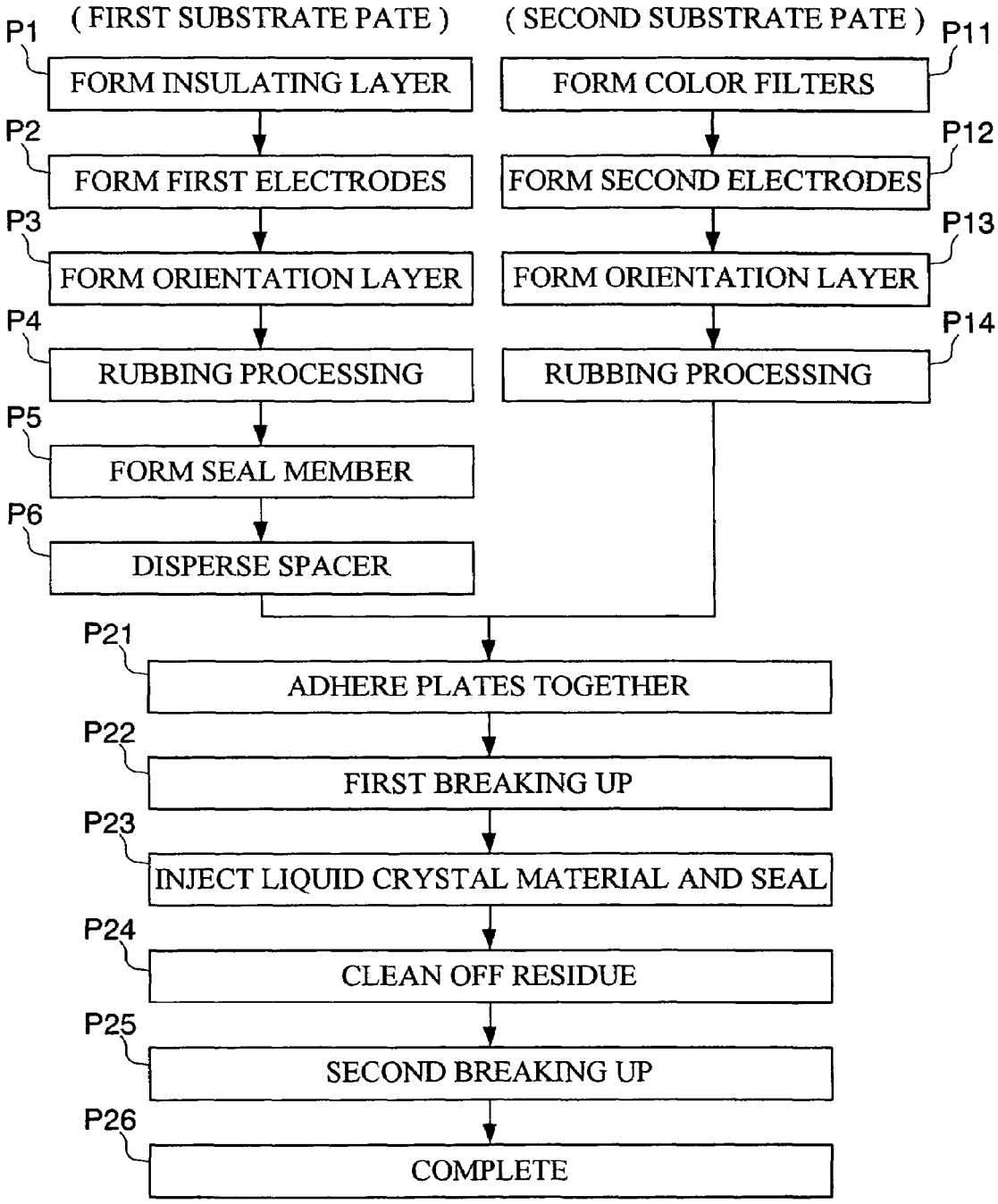
FIG. 18 is a process diagram showing a preferred embodiment of the method of manufacture of a liquid crystal device according to the present invention.
Figure 19:
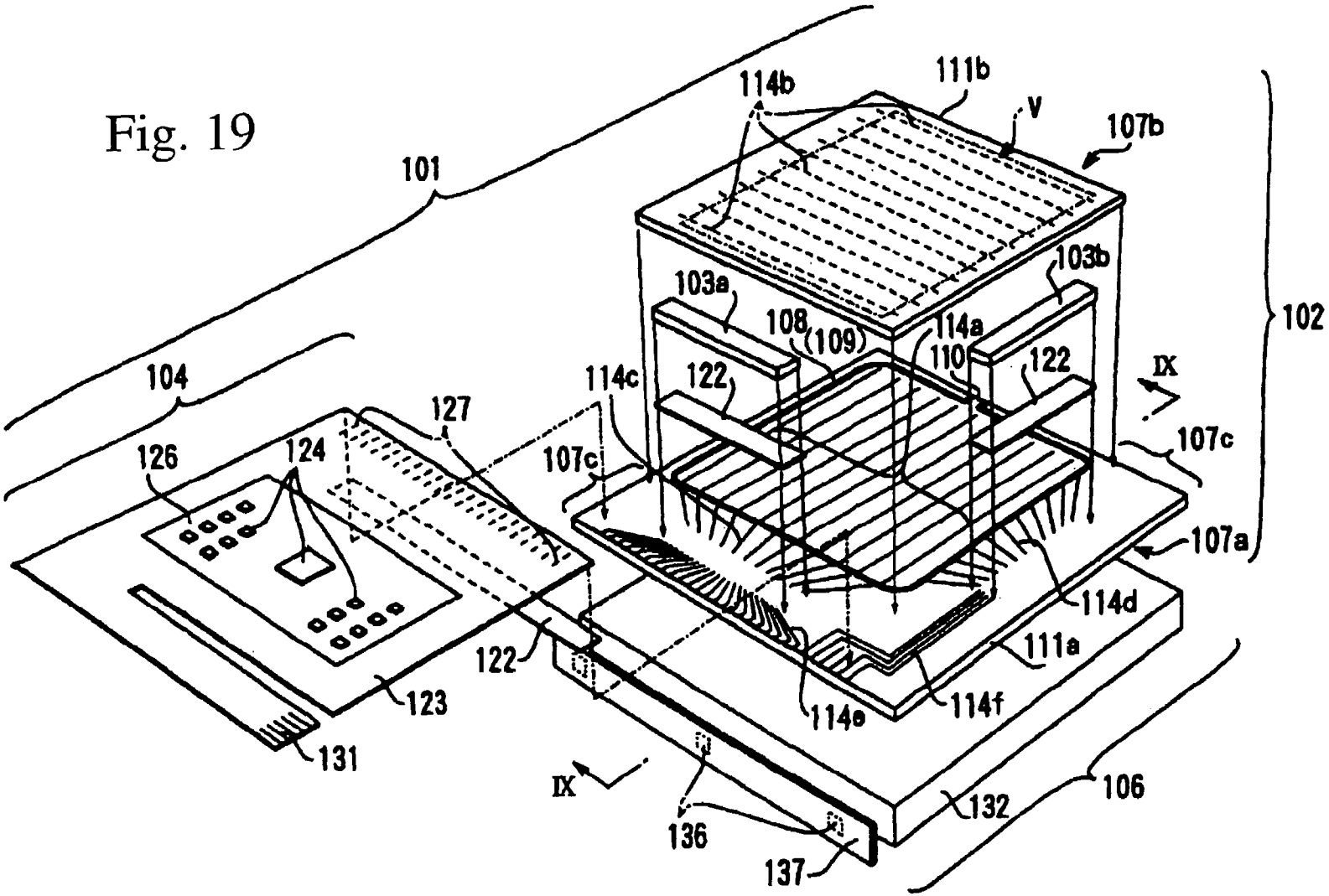
FIG. 19 is a perspective view showing one example of a liquid crystal device which is manufactured by the method of manufacture of a liquid crystal device according to the present invention, in an exploded state.
Figure 20:
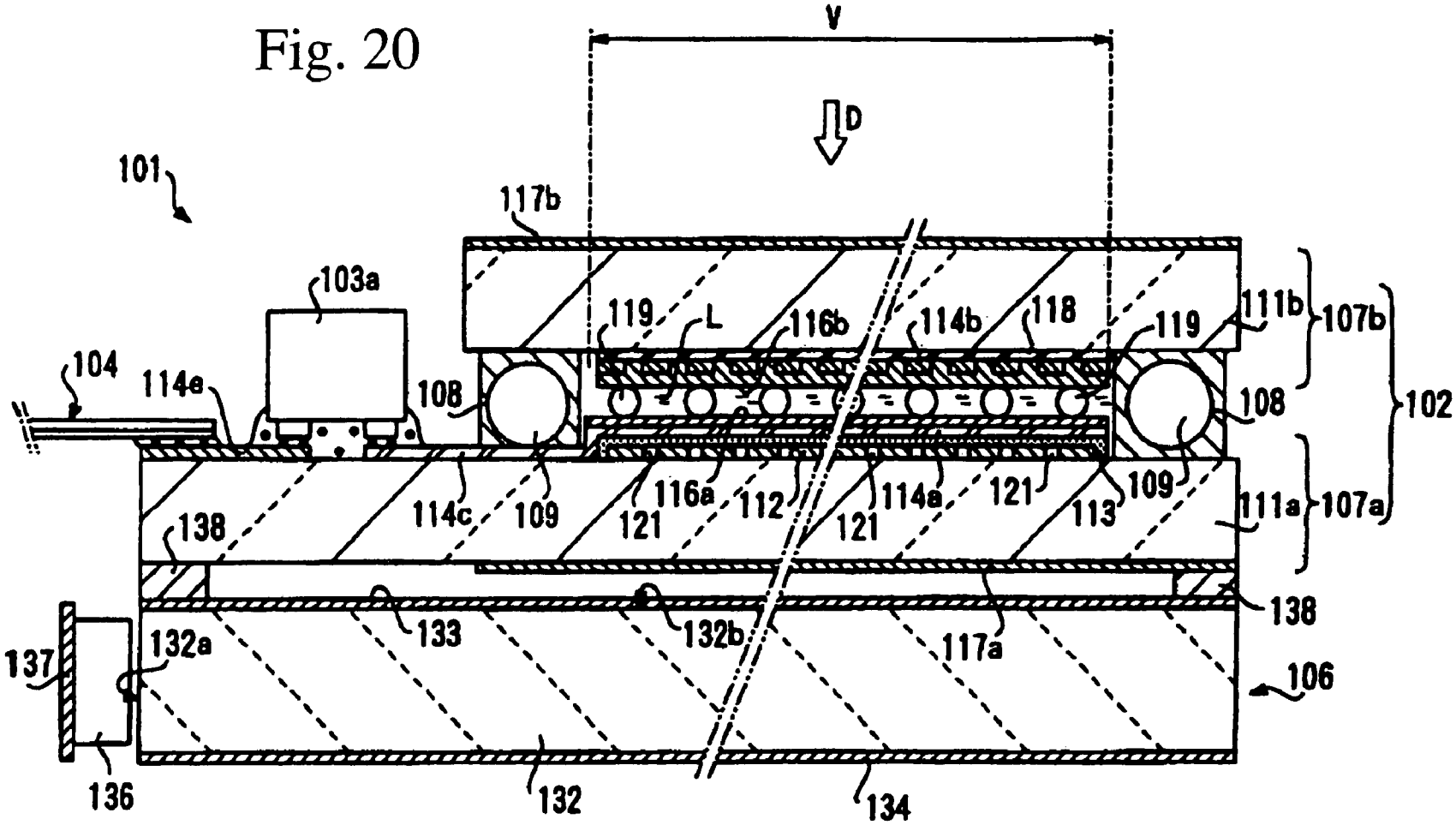
FIG. 20 is a sectional view showing the sectional structure of this liquid crystal device, taken in a sectional plane shown by the arrows IX-IX in FIG. 19.

Method of Manufacture of an Electro Optical Device Which Employs a Color Filter, and Device for Manufacturing the Same FIG. 18 is a figure for explanation of a preferred embodiment of the method of manufacture of a liquid crystal device as one example of an electro optical device according to the present invention. Furthermore, FIG. 19 shows a preferred embodiment of a liquid crystal device which is manufactured by this method of manufacture. Yet further, FIG. 20 is a sectional view of this liquid crystal device taken in a sectional plane shown by the arrows IX-IX in FIG. 19. Before explanation of the method of manufacture and the device for manufacture of this liquid crystal device, first one example will be presented and explained of such a liquid crystal device which is manufactured by this method of manufacture. It should be understood that the liquid crystal device of this preferred embodiment of the present invention is a liquid crystal device of a semi transparent reflective type which performs full color display of a simple matrix type.

Referring to FIG. 19, the liquid crystal device 101 comprises a liquid crystal panel 102, a liquid crystal drive IC 103*a* and a liquid crystal drive IC 103*b*, which are semiconductor chips, mounted upon the liquid crystal panel 102, and a FPC (Flexible Printed Circuit) 104, which is connected to the liquid crystal panel 102 and which serves as a lead wire connection element. Furthermore, the liquid crystal device 101 comprises an illumination device 106 which is provided upon the rear surface side of the liquid crystal panel 102 and which serves as a backlight.

This liquid crystal panel 102 is formed by adhering together a first substrate plate 107*a* and a second substrate plate 107*b* by a seal member 108. This seal member 108, for example, may be made by adhering an epoxy type resin by screen printing or the like in ring form upon the inner side surface of the first substrate plate 107*a* or of the second substrate plate 107*b*. Furthermore, in the interior of this seal member 108, as shown in FIG. 20, a continuous member 109 which is formed from an electro-conductive material is included in a dispersed state as balls or as a cylinder.

Referring to FIG. 20, the first substrate plate 107*a* comprises a backing 111*a* formed as a plate, which is made from transparent glass or transparent plastic or the like. A reflective film 112 is provided upon the inner side surface (the upper surface in FIG. 20) of this backing 111*a*; above this an insulating film 113 is superimposed as a layer; above this, first electrodes 114*a* are formed in stripe form as seen from the direction of the arrow D (refer to FIG. 19); and, above this, an orientation layer 116*a* is formed. Furthermore, a polarization plate 117*a* is fixed by adhesion or the like upon the outer side surface (the lower side surface in FIG. 20) of the backing 111*a*.

In FIG. 19, in order to make the arrangement of the first electrodes 114*a* easier to understand, their stripe interval is drawn as being wider than it is in actual fact, and accordingly, although the number of the first electrodes 114*a* is shown in this figure as being much less than in fact it is, really a much larger number of such first electrodes 114*a* are formed upon the backing 111*a*.

Referring to FIG. 20, the second substrate plate 107*b* comprises a backing 111*b* formed as a plate, which is made from transparent glass, transparent plastic, or the like. A color filter 118 is formed upon the inner side surface (the lower side surface in FIG. 20) of this backing 111*b*; above this, second electrodes 114*b* are formed in stripe form as seen from the direction of the arrow D (refer to FIG. 19), in a direction perpendicular to the above described first electrodes 114*a*; and, above this, an orientation layer 116*b* is formed. Furthermore, a polarization plate 117*b* is fixed by adhesion or the like upon the outer side surface (the upper side surface in FIG. 20) of the backing 111*b*.

In FIG. 19, in order to make the arrangement of the second electrodes 114*b* easier to understand, their stripe interval is drawn as being wider than it is in actual fact, just as was the case with the first electrodes 114*a*; and accordingly, although the number of the second electrodes 114*b* is shown in this figure as being much less than in fact it is, really a much larger number of such second electrodes 114*b* are formed upon the backing 111*b*.

Referring to FIG. 20, a quantity L of liquid crystal material, for example STN (Super Twisted Nematic) liquid crystal material, is contained in the volume which is defined by the first substrate plate 107*a*, the second substrate plate 107*b*, and the seal member 108, in other words in the cell gap which these members define. A large number of minute spherical spacers 119 are dispersed upon the inner side surfaces of the first substrate plate 107*a* and/or the second substrate plate 107*b*, and, due to the presence of these spacers 119 in the cell gap, the thickness of this cell gap is maintained uniform.

The first electrodes 114*a* and the second electrodes 114*b* are arranged in a mutually perpendicular relationship, and their points of intersection are arrayed in the form of a dot matrix, as seen from the direction of the arrow D in FIG. 19. And each of the intersection points of this dot matrix configuration constitutes one pixel. The color filter 118 is formed as an array which is patterned in a predetermined pattern of R (red), G (green), and B (blue) elements as seen from the direction of the arrow D; for example, it may be formed as a stripe array, a delta array, a mosaic array, or the like. Each of the above described single pixels corresponds to one of the R, G, or B color filter elements, and, together, three neighboring pixels—one of each of the colors R, G, and B—constitute one picture element.

An image consisting of letters, digits or the like is displayed at the outer side of the second substrate plate 107*b* of the liquid crystal panel 102 by selectively causing light to be emitted from a plurality of pixels, and accordingly of picture elements, which are arrayed in a dot matrix form. The region upon which an image is displayed in this manner is the available picture element region, and, in FIGS. 19 and 20, the planar rectangular region which is designated by the arrow V is the available display region.

Referring to FIG. 20, the reflective film 112 is made from some material which is endowed with the property of reflecting light, such as APC alloy, Al (aluminum), or the like, and it is formed with openings 121 at positions which correspond to each of the pixels, i.e. at the points of intersection of the first electrode 114*a* and the second electrode 114*b*. As a result, when the openings 121 are seen from the direction of the arrow D, the pixels are arranged in the same dot matrix arrangement.

The first electrode 114*a* and the second electrode 114*b* are made from a transparent electrically conductive substance such as, for example, ITO (Indium Tin Oxide). Furthermore, the orientation layers 116*a* and 116*b* are made by adhering a film of polyimide resin or the like of uniform thickness. Initial orientations for the liquid crystal molecules upon the surfaces of the first substrate plate 107*a* and the second substrate plate 107*b* are established by subjecting these orientation layers 116*a* and 116*b* to rubbing processing.

Referring to FIG. 19, the first substrate plate 107*a* is made to have a greater area than that of the second substrate plate 107*b*, so that, when these substrate plates are adhered together by the seal member 108, the first substrate plate 107*a* has a substrate plate projection portion 107*c* which projects to the outside of the second substrate plate 107*b*. And, on this substrate plate projection portion 107*c* various connecting wires are formed in an appropriate pattern, such as connecting wires 114*c* which extend from the first electrodes 114*a* and project outwards, connecting wires 114*d* which are connected to and project outwards from the second electrodes 114*b* upon the second substrate plate 107*b* via the continuous member 109 which is present inside the seal member 108 (refer to FIG. 20), metallic connecting wires 114*e* which are connected to input bumps, in other words to input terminals, of the liquid crystal drive IC 103*a*, metallic connecting wires 114*f* which are connected to input bumps of the liquid crystal drive IC 103*b*, and the like.

In this preferred embodiment, the connecting wires 114*c* which extend from the first electrodes 114*a* and the connecting wires 114*d* which are connected to the second electrodes 114*b* are made of ITO, which is the same material as that of those electrodes, in other words are made of an electro-conductive oxide material. Furthermore, the metallic connecting wires 114*e* and 114*f* which are the input side connecting wires of the liquid crystal drive ICs 103*a* and 103*b* are made from a metallic material which has a low value of electrical resistance, for example from APC alloy. This APC alloy is an alloy which mainly consists of Ag (silver) with accompanying Pd and Cu included—for example, 98% Ag, 1% Pd, and 1% Cu.

Connections between the liquid crystal drive ICs 103*a* and 103*b* and the surface of the substrate plate projection portion 107*c* are implemented with an ACF (Anisotropic Conductive Film) element 122. In other words, in this preferred embodiment of the present invention, a direct connection structure is implemented for the semiconductor chips upon the substrate plate, so as to form a liquid crystal panel of the so called COG (Chip On Glass) type. In this structure which is implemented as a COG type, the input side bumps of the liquid crystal drive ICs 103*a* and 103*b* and the metallic connecting wires 114*e* and 114*f* are connected together by conducting grains which are included within the ACF member 122, and the output side bumps of the liquid crystal drive ICs 103*a* and 103*b* and the extending connecting wires 114*c* and 114*d* are likewise connected together by such conducting grains.

Referring to FIG. 19, the FPC 104 comprises a flexible resin film 123, a circuit 126 which is made to include various chip components 124, and a metallic connecting wire terminal 127. The circuit 126 is directly mounted upon the surface of the resin film 123 by soldering or by another electrically conductive connection method. Furthermore, the metallic connecting wire terminal 127 is made from APC alloy, Cr, Cu, or another electrically conducting material. The portion upon the FPC where the metallic connecting wire terminal 127 is formed is connected by the ACF element 122 to the portion upon the first substrate plate 107 upon which the metallic connecting wires 114*e* and 114*f* are formed. And the metallic connecting wires 114*e* and 114*f* upon the substrate plate side and the metallic connecting wire terminal 127 upon the FPC side are connected together by the action of the conducting grains which are included within the ACF 122.

An external connection terminal 131 is formed at an edge portion of the FPC 104 upon its back side, and this external connection terminal 131 is connected to an external circuit which is not shown in the figures. And the liquid crystal drive ICs 103*a* and 103*b* are driven based upon signal which are transmitted from this external circuit, so as to supply to the first electrodes 114*a* and the second electrodes 114*b*, on the one hand a scan signal, and on the other hand a data signal. Due to this, voltage control is performed for each of the pixels in each of the picture elements which are arrayed in dot matrix form upon the available display region V, and as a result the orientation of the liquid crystal L is controlled for each picture element individually.

Referring to FIG. 19, an illumination device 106 which functions as a so called backlight, as shown in FIG. 20, comprises a transparent member 132 which is made from acrylic resin or the like, a diffusion sheet 133 which is provided upon the light emission surface 132*b* of this transparent member 132, a reflective sheet 143 which is provided upon the opposite surface of the transparent member 132 from this light emission surface 132*b*, and a LED (Light Emitting Diode) 136 which functions as a light emission source.

The LED 136 is supported by a LED substrate plate 137, and this LED substrate plate 137 is adhered to, for example, a support portion (not shown in the figures) which is formed integrally with the transparent member 132. By adhering the LED substrate plate 137 in a predetermined position upon the support portion, the LED 136 comes to be placed in a position which confronts the light receiving surface 132*a* which is the side edge surface of the transparent member 132. It should be understood that the reference symbol 138 denotes a buffer member for buffering shock from being transmitted to the liquid crystal panel 102.

When the LED 136 emits light, this light is received by the light receiving surface 132*a* and is conducted into the interior of the transparent member 132, and, during propagation while being reflected by the reflective sheet 134 and the wall surfaces of the transparent member 132, is emitted from the light emission surface 132*b* and passes through the diffusion sheet 133 to the exterior as a steady and uniform light source.

Since the liquid crystal device 101 according to this preferred embodiment of the present invention is structured as described above, if the external light such as sunlight or indoor light or the like is sufficiently bright, then (referring to FIG. 20) this external light is taken in to the interior of the liquid crystal panel 102 from the second substrate plate 107*b* side, and, after having passed through the liquid crystal L, this light is reflected by the reflective film 112 and is again supplied back in to the liquid crystal L. The liquid crystal L is orientation controlled for each R, G, and B picture element pixel individually by the use of the first and second electrodes 114*a* and 114*b* which sandwich it between them on opposite sides. Accordingly the light which is supplied to the liquid crystal L is modulated for each picture element pixel individually, and thus an image is displayed at the exterior of the liquid crystal panel 102 of letters, digits, or the like, formed by the pattern of the light which passes through the polarization plate 117*b* due to this modulation and of the light which cannot pass therethrough. This type of display is termed reflective type display.

On the other hand, if the intensity of the external light which is obtained is not sufficient, the LED 136 generates steady and uniform light which is emitted from the light emission surface 132*b* of the transparent member 132, and this light is supplied to the liquid crystal L through the openings 121 which are formed in the reflective film 112. At this time, the light which is supplied is modulated for each picture element pixel individually by the liquid crystal L being orientation controlled, in the same manner as in the case of the reflective type display described above. Due to this an image is displayed to the outside; and this type of display which is being performed is termed transmission type display.

The liquid crystal device 101 of the above described structure may be manufactured, for example, by a method of manufacture which is schematically shown in FIG. 18. In this method of manufacture, the series of processes P1 through P6 collectively constitute a process for making the first substrate plate 107*a*, while the series of processes P11 through P14 collectively constitute a process for making the second substrate plate 107*b*. The process for making the first substrate plate 107*a* and the process for making the second substrate plate 107*b* are normally performed independently.

First, to explain the process for making the first substrate plate 107*a*, the reflective film 112 is formed, using a photolithographic method or the like, at a plurality of portions for the liquid crystal panel 102 upon the surface of a mother raw material substrate plate of large area which is made from transparent glass or transparent plastic or the like. Furthermore, in a process P1, the insulating layer 113 is formed above this reflective film 112 using a per se conventional process of film formation. Next, in a process P2, the first electrodes 114*a*, the extension connecting wires 114*c* and 114*d*, and the metallic connecting wires 114*e* and 114*f* are formed using a photolithographic method or the like.

After this, in a process P3, the orientation layer 116*a* is formed upon the first electrodes 114*a* by application such as printing or the like, and then, in a process P4, an initial orientation for the liquid crystal material is determined by performing rubbing processing upon this orientation layer 116*a*. Next, in a process P5, the seal member 108 is formed in a ring shape by, for example, screen printing or the like, and then, in a process P6, the ring shaped spacer 119 is dispersed upon it. By doing this, a mother first substrate plate of large area is formed having a plurality of panel patterns upon the first substrate plate 107*a* of the liquid crystal panel 102.

Independently of the above process of formation of the first substrate plate 107*a*, a process of forming the second substrate plate 107*b* is performed (the processes P11 through P14 of FIG. 18). First, a mother raw material backing of large area is prepared by forming it from transparent glass or transparent plastic or the like, and then, in a process P11, a plurality of color filters 118 for liquid crystal panels 102 are formed upon its surface. The formation process for these color filters 118 is performed using the method of manufacture which was shown in FIG. 7, and the formation of the various R, G, and B filter elements during this method of manufacture is performed according to the control method for the ink jet head 22 which was shown in FIGS. 1 through 5, using the liquid drop discharge device 16 of FIG. 8. Since this method of manufacture of the color filter 118 and this control method for the ink jet head 22 are the same as those which have already been explained, their explanation will herein be curtailed.

When, as shown in FIG. 7(*d*), the color filters 1, in other words the color filters 118, have been formed upon the motherboard 12, in other words upon the mother raw material backing, next, in a process P12, the second electrodes 114*b* are formed using a photolithographic method or the like. And, after this, in a process P13, the orientation layer 116*b* is formed upon the first electrodes 114*a* by application such as printing or the like. Next, in a process P14, an initial orientation for the liquid crystal material is determined by performing rubbing processing upon this orientation layer 116*b*. By doing this, a mother second substrate plate of large area is formed having a plurality of panel patterns upon the second substrate plate 107*b* of the liquid crystal panel 102.

After the mother first substrate plate and the mother second substrate plate have been formed in the above manner, then, in a process P21, these motherboards are aligned together with the seal members 108 being sandwiched between them, in other words their positions are mutually set, and then they are adhered together. By doing this, a panel structure body is formed in the empty state, in which no liquid crystal material has yet been enclosed by being included in the plurality of panel portions of the liquid crystal panels.

Next, in a process P22, scribed grooves, in other words grooves for breaking, are formed at predetermined positions upon this empty panel structure which has been completed, and then the panel structure is broken apart, in other words is fractured, using these scribed grooves as guides. By doing this a plurality of empty panel structure bodies are formed, each being in a state in which an opening 110 for injection of liquid crystal material (refer to FIG. 19) of the seal member 108 of each liquid crystal panel portion is exposed to the outside, i.e. in a so called uncharged state.

After this, in a process P23, liquid crystal material L is injected into the internal cavity of each of these liquid crystal panel portions via this opening 110 for liquid crystal injection which is exposed, and then each of the liquid crystal injection openings 110 is closed up with resin or the like. The normal procedure for such injection of liquid crystal material is performed by, for example, storing a quantity of liquid material in a reservoir vessel, and putting this reservoir vessel containing this liquid crystal material and also an empty liquid crystal panel portion in the uncharged state into a vacuum chamber or the like. When this vacuum chamber or the like has been exhausted to the vacuum state, within the vacuum chamber, the empty panel is immersed in the mass of liquid crystal material. After this, the procedure is performed of opening up the chamber to the atmosphere. Since at this time the internal space within the empty panel is in the vacuum state or the like, the liquid crystal material which is now being subjected to atmospheric pressure is driven into said internal space of the panel through the opening for liquid crystal injection. Since the liquid crystal material adheres around the liquid crystal panel structure body after this liquid crystal injection process, the panel, which is now charged with liquid crystal material, is subjected to a process of cleaning after the liquid crystal injection procedure, in a process P24.

After this liquid crystal injection and cleaning procedure has been completed, again scribed grooves are formed in predetermined positions upon the mother panel which is now in the charged state. And then the panel in the charged state is broken apart using these scribed grooves as guides. By doing this, a plurality of individual liquid crystal panels 102 are individually produced (in a process P25). As shown in FIG. 19, upon each of these liquid crystal panels 102 which have thus been individually produced, liquid crystal drive ICs 103*a* and 103*b* are attached, an illumination device 106 is attached to serve as a backlight, and then, by connecting the FPC 104, the liquid crystal device 101 which is the object of the procedure is completed (in a process P26).

This method of manufacture and this device for manufacture of a liquid crystal device which have been explained above have the special characteristics which will now be described, with particular regard to the stage of manufacturing the color filter 1. That is to say, each of the filter elements 3 within the color filter 1 shown in FIG. 6(*a*), in other words within the color filter 118 of FIG. 20, is not formed by a single episode of scanning of the ink jet head 22 (refer to FIG. 1) along the main scanning direction X; but, rather, each individual one of the filter elements 3 is formed so as to have a predetermined film thickness by being subjected to n episodes, for example four episodes, of ink discharge by a plurality of nozzles 27 which are included in different nozzle groups. Due to this, if hypothetically undesirable deviations should be present between the ink discharge amounts from the plurality of nozzles 27, it is possible to prevent the occurrence of undesirable deviations in the film thickness between the different ones of the plurality of filter elements 3, and as a result, it is possible to make the light transmission characteristic of the color filter 1 flat and even. This means that, with the liquid crystal device 101 of FIG. 20, it is possible to obtain a clear color display with no color blurring.

Furthermore, with the method of manufacture and the device for manufacture of a liquid crystal device according to this preferred embodiment of the present invention, since the filter elements 3 are formed by utilizing the liquid drop discharge device 16 shown in FIG. 9 which performs ink discharge by using the ink jet head 22, it is not necessary to perform any complicated process such as one which utilizes a photolithographic method or the like, and furthermore it is possible to ensure that there is no waste of the raw material such as ink.

Another Example of an Electro Optical Device Which Employs a Color Filter

Figure 54:
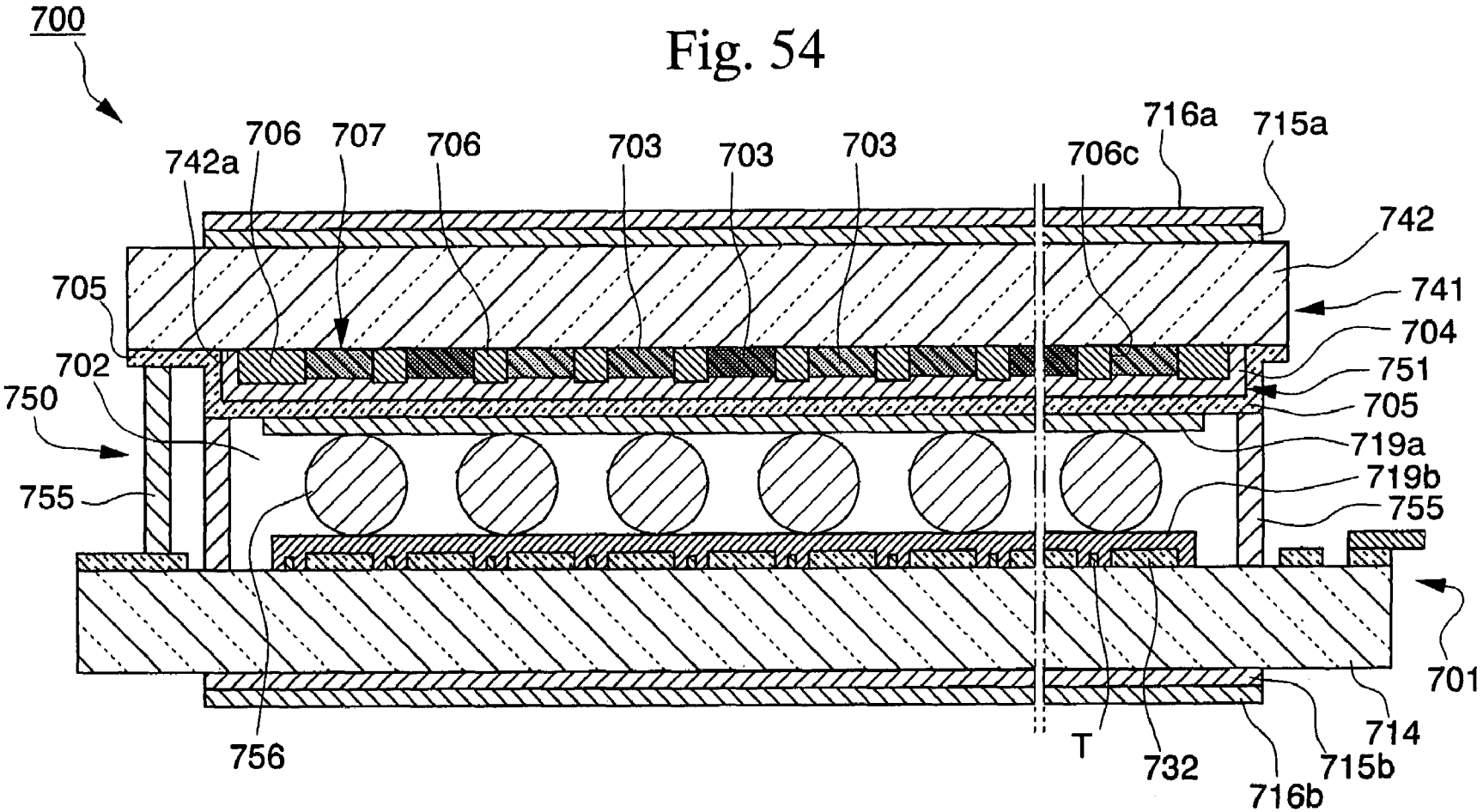
FIG. 54 is a sectional structural figure of a liquid crystal device which is equipped with a color filter which has been manufactured by a device for manufacture of a color filter according to the present invention.

Next, a color liquid crystal device of the active matrix type will be presented and explained below, as one example of an electro optical device which is fitted with a color filter according to the above described preferred embodiment of the present invention. FIG. 54 is a figure showing the sectional structure of a liquid crystal device which is equipped with a color filter according to this preferred embodiment.

The liquid crystal device 700 of this preferred embodiment of the present invention comprises, as its main element, a liquid crystal panel 750 which comprises a color filter substrate plate 741 and an active element substrate plate 701 which are arranged so as mutually to confront one another, a liquid crystal layer 702 which is sandwiched between these two substrate plates, a phase contrast plate 715*a* and a polarization plate 716*a* which are attached to the upper surface side (the observer's side) of the color filter substrate plate 741, and a phase contrast plate 715*b* and a polarization plate 716*b* which are attached to the lower surface side of the active element substrate plate 701. The liquid crystal device which is the final product is made by fitting peripheral devices such as driver chips for driving the liquid crystal material, various connecting wires for transmitting electrical signals a support member and the like to this liquid crystal panel 750.

The color filter substrate plate 741 is a display side substrate plate which is provided facing the side of the observer, and which has a light transparent substrate plate 742, while the active element substrate plate 701 is a substrate plate which is provided upon its opposite side, in other words upon its rear side.

This color filter substrate plate 741 principally comprises the light transparent substrate plate 742 which is made of a plastic film or a glass substrate plate of approximately 300 μm (0.3 mm) or the like, and a color filter 751 which is formed upon the lower side surface (in other words, upon the liquid crystal layer side surface) of this substrate plate 742.

The color filter 751 is made as a combination of division walls 706 which are formed upon the lower side surface (in other words, upon the liquid crystal layer side surface) of this substrate plate 742, filter elements 703 . . . , and a covering protective layer 704 which covers over the division walls 706 and the filter elements 703 . . . .

The division walls 706 are formed upon the one surface 742*a* of the substrate plate 742, and are built up in lattice form and are formed so as each to surround a filter element formation region 707, which is a region for formation of an adhered color layer which defines an individual filter element 703. These division walls 706 comprise a plurality of holes 706*c* . . . . Within each of the holes 706*c*, the surface of the substrate plate 742 is exposed. And the filter element formation regions 707 . . . are defined as compartments which are delimited by the inner walls of the division walls 706 (the wall surfaces of the holes 706*c*) and the surface of the substrate plate 742.

The division walls 706 are, for example, made from a black colored light sensitive resin layer, and, as such a black colored light sensitive resin layer, it is desirable for them to include, for example, at least one of a positive type or negative type light sensitive resin such as one which is used in a conventional photo-resist, and an black colored inorganic material such as carbon block or a black colored organic material. Since these division walls 706 include a black colored inorganic material or organic material, and are formed at all portions except those where the filter elements 703 are present, thus it is possible to intercept transmission of light between neighboring ones of the filter elements 703, and accordingly these division walls 706 are endowed with the function of serving as light interception layers.

The filter elements 703 are formed by injection according to an ink jet method, in other words by discharge, of filter element material of the various colors red (R), green (G), and blue (B) into the various filter element formation regions 707 which are defined across the substrate plate 742 between the inner surfaces of the division walls 706, and after this by drying out of this filter element material.

Furthermore an electrode layer 705 for liquid crystal drive, which is made from a transparent electrically conductive material such as ITO or the like, is formed upon the lower side (the liquid crystal layer side) of the protective layer 704, over substantially the entire surface of said protective layer 704. Moreover, an orientation layer 719*a* is provided to cover over this electrode layer 705 for liquid crystal drive upon its liquid crystal layer side, and also an orientation layer 719*b* is provided over a picture element electrode 732 upon the side of an opposite side active element substrate plate 701, which will be described hereinafter.

The active element substrate plate 701 is made by forming an insulating layer not shown in the figures upon a light transparent substrate plate 714, and by further forming, upon this insulating layer, a thin film transistor T which functions as a TFT type switching element and a picture element electrode 732. Furthermore, the structure includes a plurality of scan lines and a plurality of signal lines which are made, actually in the form of a matrix, upon the insulating layer which is formed upon the substrate plate 714; and one of the previously described picture element electrodes 732 is provided for each of the regions which are surrounded by these scan lines and signal lines, and a thin film transistor T is included at each position which electrically connects together each of the picture element electrodes 732 and its scan line and its signal line, so that, by applying an appropriate signal voltage to the scan line and the signal line, this thin film transistor T can be turned ON or OFF, thus performing control of the supply of electricity to its picture element electrode 732. Furthermore, the electrode layer 705 which is formed on the color filter substrate plate 741 upon the opposite side, in this preferred embodiment of the present invention, is made as a full surface electrode which covers the entire picture element region. It should be understood that various other possibilities for the connecting wire circuit for the TFTs, or for the picture element electrode configuration, may also be applied.

The active element substrate plate 701 and the color filter substrate plate (the opposing substrate plate) 741 are adhered together with a predetermined gap being maintained between them by the seal member 755 which is formed running around the outer peripheral edge of the color filter substrate plate 741. Furthermore, the reference symbol 756 denotes a spacer for holding the interval (the cell gap) between these two substrate plates fixed over the surfaces of the substrate plates. As a result, a rectangular liquid crystal enclosure region is defined as a compartment between the active element substrate plate 701 and the color filter substrate plate 741 by the seal member which, as seen in its plane, is roughly formed as a frame, and liquid crystal material is enclosed within this liquid crystal enclosure region.

Figure 50:
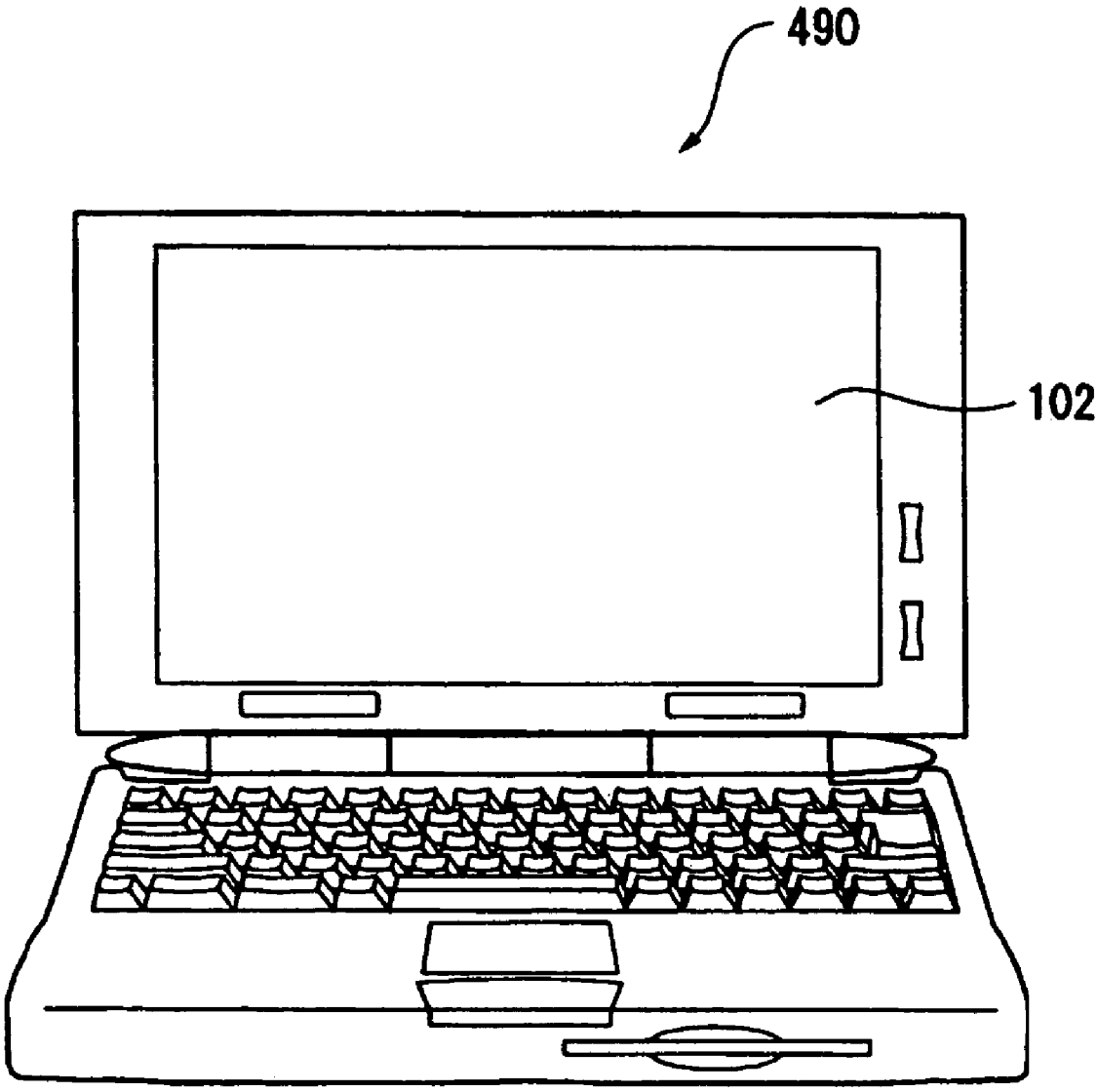
FIG. 50 is a perspective view showing a personal computer which is an electronic device equipped with the same electro optical device.

As shown in FIG. 50, the color filter substrate plate 741 is smaller than the active element substrate plate 701, so that, in the adhered state, the peripheral portion of the active element substrate plate 701 projects outwards further than the outer peripheral edge of the color filter substrate plate 741. Accordingly, it is possible to form the thin film transistors T for picture element switching and at the same time the TFTs for the drive circuit upon the active element substrate plate 701 at the outer peripheral side region of the seal member 455, and thus it becomes possible to provide both a scan lines drive circuit and a data lines drive circuit.

With this liquid crystal panel 750, the above described polarization plates (polarization sheets) 716*a* and 716*b* are disposed in predetermined orientations upon the light incident side and the light emitting side of the active element substrate plate 701 and of the color filter substrate plate 741, according to whether the device will be required to operate in the normally white mode or in the normally black mode.

In the liquid crystal panel 750 made according to the above structure, with the active element substrate plate 701, the orientation state of the liquid crystal material present between the picture element electrode 732 and the opposing electrode 718 is controlled for each picture element individually by the display signals which are supplied to the picture element electrodes 732 via the data lines (not shown in the figures) and the thin film transistors T, and a predetermined display is performed in correspondence to the display signals. For example, if the liquid crystal panel 750 is structured in the TN mode, then, when the rubbing directions when performing rubbing processing for the orientation layers 719*a* and 719*b* which are respectively provided between the pair of substrate plates (the active element substrate plate 701 and the color filter substrate plate 741) are set to mutually perpendicular directions, the liquid crystal material is orientated with a twist between the substrate plates, having an angle of 90 degree. This type of twist orientation is released by applying an electric field to the liquid crystal layer 702 between the substrate plates. Thus it is possible to control the orientation state of the liquid crystal material for each region which is formed upon the picture element electrode 732 individually (for each picture element individually), according to whether or not an electric field is applied from the outside between the substrate plates.

Because of this, if the liquid crystal panel 750 is to be used as a transparent type liquid crystal panel, the light from an illumination device (not shown in the figures) which is disposed at the lower side of the active element substrate plate 701, after having been made uniform as light of a predetermined linear polarization by the polarization plate 716*b* upon the incident side, passes through the phase contrast plate 715*b* and the active element substrate plate 701 and is incident upon the liquid crystal material layer 702, and on the one hand in some of the regions thereof this linearly polarized light passes through and is emitted with its polarization axis having been twisted by this transmission, while on the other hand in other regions this directly polarized light which passes through is emitted without its polarization axis having been twisted at all by this transmission. Due to this, if the polarization plate 716*b* on the incident side and the polarization plate 716*a* on the emission side are disposed so that their transmission polarization axes are mutually perpendicular (the normally white mode), then the light which passes through the polarization plate 716*a* which is disposed upon the emission side of the liquid crystal panel 750 is only the linearly polarized light whose transmission polarization axis has been thus twisted by transmission through the liquid crystal. By contrast, if the polarization plate 716*a* on the emission side is disposed so that its transmission polarization axis is parallel to the transmission polarization axis of the polarization plate 716*b* on the incident side (the normally black mode), then the light which passes through the polarization plate 716*a* which is disposed upon the emission side of the liquid crystal panel 750 is only the linearly polarized light whose transmission polarization axis has not been twisted by transmission through the liquid crystal. Accordingly, if the orientation state of the liquid crystal 702 is controlled for each picture element individually, it is possible to display any desired information.

With the liquid crystal device 700 of the above described structure, each of the filter elements 703 . . . of the color filter substrate plate 741 is formed by the ink jet method described with regard to the previous preferred embodiments of the present invention. In other words, during their formation, each of the filter elements 703 . . . is not formed by a single scanning episode of the ink jet head, but, rather, each of the filter elements 730 is formed to a predetermined film thickness by receiving ink discharge over a predetermined number n of episodes, for example four episodes, of ink discharge by a plurality of nozzles which belong to different nozzle groups. Due to this, even if, hypothetically, undesirable deviations are present in the ink discharge amounts between different ones of the plurality of nozzles 27, it is possible to prevent the occurrence of undesirable deviations in the film thickness between the plurality of filter elements, and, as a result, the light transmission characteristic of the color filter substrate plate 741 is made to be flat and uniform. Due to this, it becomes possible to obtain a clear color display with no color blurring.

Although in the above description it was assumed, by way of example, that the color filter was to be applied to a liquid crystal device, the color filter according to the present invention can, of course, also be utilized for various applications other than the one described above. For example, this color filter could be applied to a white colored organic electro-luminescent device. In other words, a color filter manufactured as described above may be disposed upon the front surface (the light emitting side) of a white colored organic electro-luminescent device. By utilizing such a structure, it is possible to provide an organic electro-luminescent device which presents a color display, while basically utilizing a white colored electro-luminescent device.

It should be understood that the light is controlled in the manner described below. An organic electro-luminescent device is made so as to be a source of white colored light, and the amount of light emitted by each picture element is adjusted by control of transistors which are provided to each picture element individually, and moreover the desired color display is provided by passing this light through the above described color filter.

Figure 21:
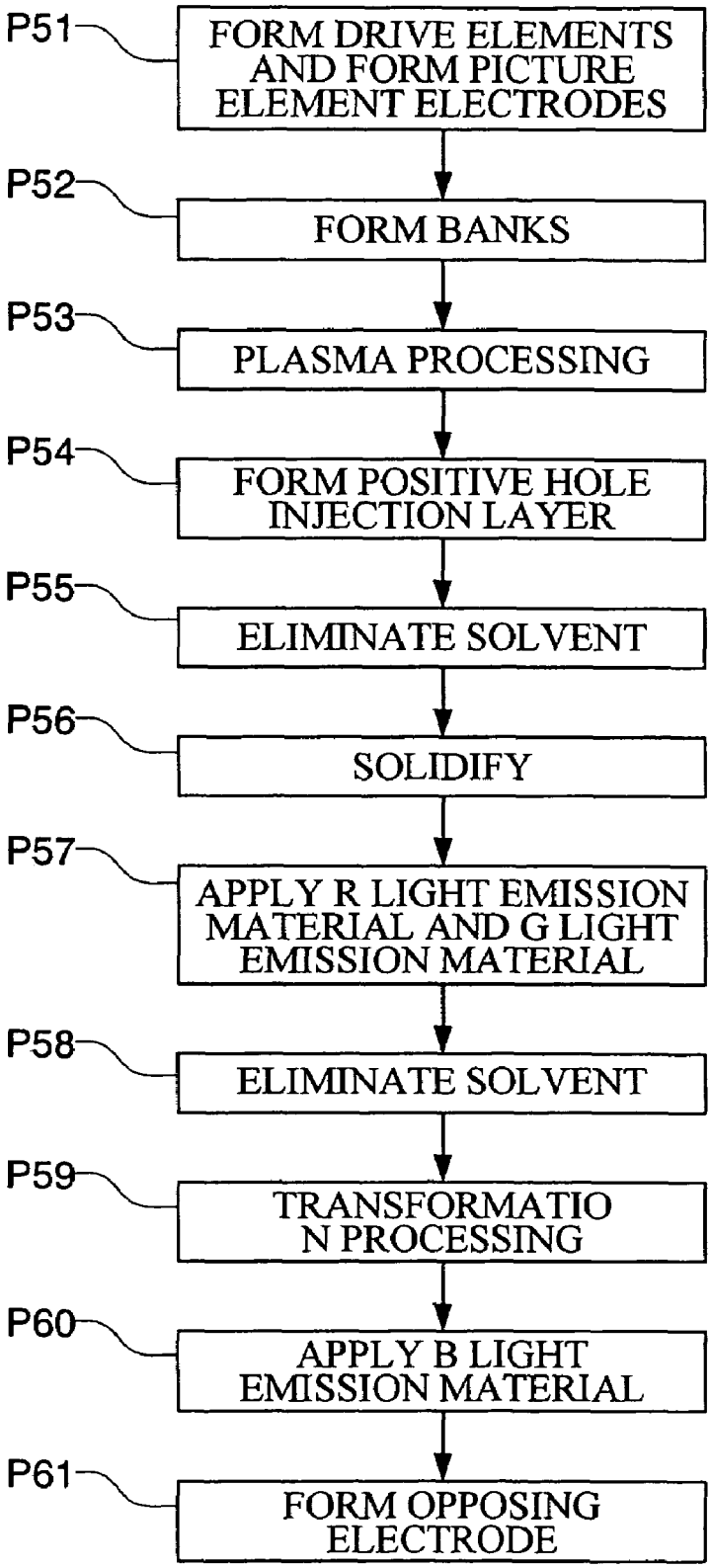
FIG. 21 is a process diagram showing a preferred embodiment of the method of manufacture of an electro-luminescent device according to the present invention.
Figure 22A:
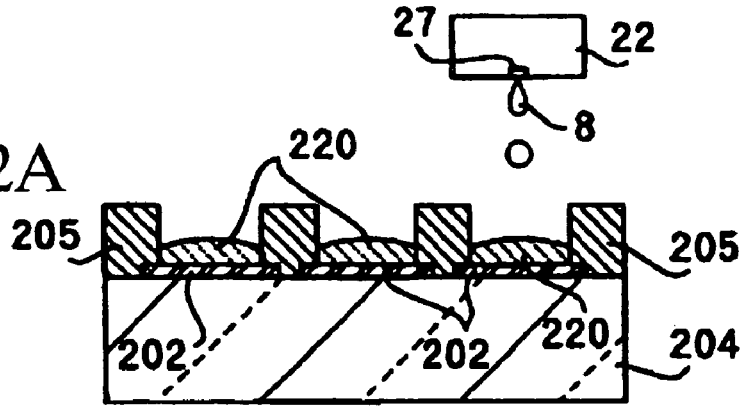
FIGS. 22(A)-22(D) are sectional views of the electro-luminescent device which corresponds to the process diagram shown in FIG. 21.
Figure 22B:
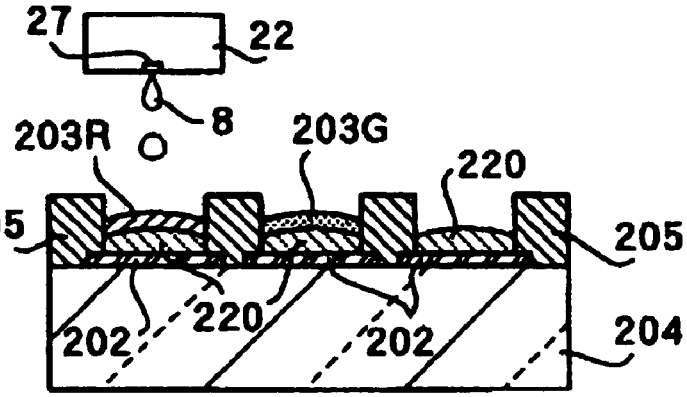
Figure 22C:
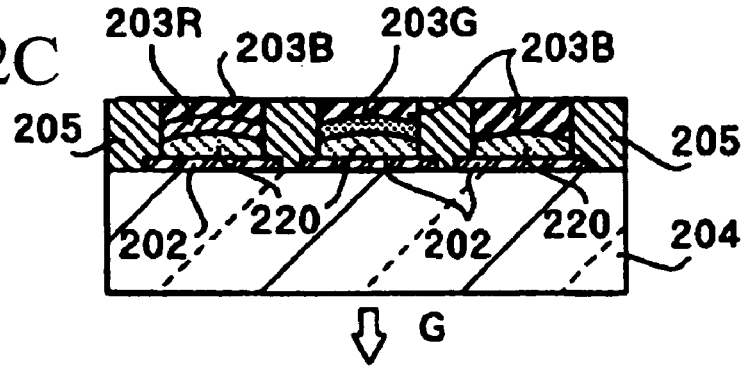
Figure 22D:
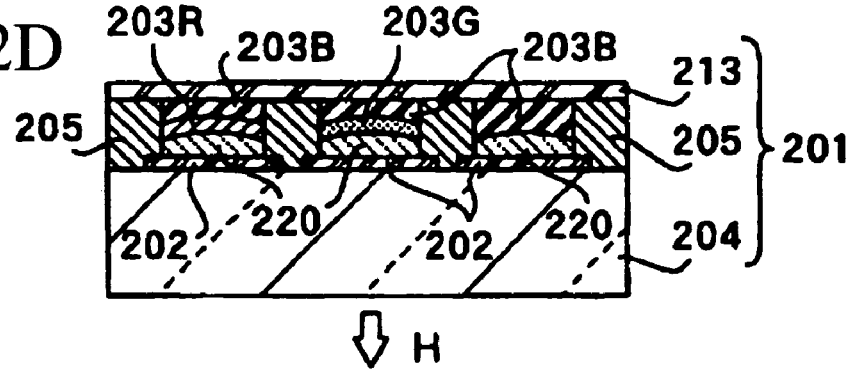

A Preferred Embodiment Related to a Method of Manufacture and a Device for Manufacture of an Electro Optical Device Which Employs an Electroluminescent Element FIG. 21 schematically shows a preferred embodiment of a method of manufacture of an electro-luminescent device, which constitutes one example of an electro optical device according to the present invention. Furthermore, FIG. 22 shows the main sectional structure of an electro-luminescent device which is being manufactured by this method of manufacture at various stages of said method, and the main sectional structure of the electro-luminescent device which is finally obtained thereby. As shown in FIG. 22(*d*), in the electro-luminescent device 201, a plurality of picture element electrodes 202 are formed over a transparent substrate plate 204, and between each pair of adjacent picture element electrodes 202 a bank 205 is formed, so that, as seen from the direction of the arrow G in the figure, these banks define a lattice shape. Positive hole injection layers 220 are formed in these concave portions defined by the lattice, and R colored light emitting layers 203R, G colored light emitting layers 203G, and B colored light emitting layers 203B are then formed within these concave portions defined by the lattice, over these positive hole injection layers 220, so as to constitute a predetermined array in stripe form or the like as seen from the direction of the arrow G. Furthermore, an opposing electrode 213 is formed over these layers, so as to constitute the electroluminescent device 201.

If the above described picture element electrode 202 is to be driven by a two terminal type active element such as a so called TFD (Thin Film Diode) element or the like, the above described opposite electrode 213 is formed in stripe form as seen from the direction of the arrow G. On the other hand, if the picture element electrode 202 is to be driven by a three terminal type active element such as a so called TFT (Thin Film Transistor) or the like, the above described opposite electrode 213 is formed as an electrode with a single surface.

Each of the regions which are sandwiched by the picture element electrodes 202 and the opposing electrode 213 constitutes one picture element pixel, and three of these picture element pixels, one each of the three colors R, G, and B, form a unit which constitutes a single picture element. The desired ones among this plurality of picture element pixels are selectively caused to emit light by appropriate control of the flow of electrical current to each of the picture element pixels, and, due to this, it is possible to provide a display of the desired full color image as seen from the direction of the arrow H.

The above described electro-luminescent device 201 may be manufactured, for example, by the method of manufacture shown in FIG. 21.

In detail, in a process P51 and as shown in FIG. 22(*a*), drive elements such as so called TFD elements or TFT elements are formed upon the surface of the transparent substrate plate 204, and furthermore the picture element electrodes 202 are formed. As the method for such formation, for example, a photolithographic method, a vacuum adhesion method, a spattering method, a pyrosol method or the like may be employed. As the material for the picture element electrodes 202, ITO (Indium Tin Oxide), tin oxide, a mixed oxide material consisting of indium oxide and zinc oxide, or the like may be employed.

Next, in a process P52 and as shown in FIG. 22(*a*), the division walls, in other words the banks 205, are formed by a per se conventional patterning method such as, for example, a photolithographic method, and the spaces between each of the picture element electrodes 202 are filled in by these banks 205. By doing this, it is possible to increase the contrast, to prevent mixing of the light emitting materials of different colors, and to prevent light leakage from between one picture element and the next. The material for making the banks 205 is not particularly limited, provided that it is endowed with the characteristic of resistance to the solvent which is used for the electro-luminescent materials; for example, it may be suitable to utilize an organic material such as acrylic resin, epoxy resin, a light sensitive polyimide or the like, reinforced with Teflon (a registered trademark) by fluorocarbon gas plasma processing.

Next, directly before the application of the ink for forming the positive hole injection layer as a functional liquid mass, continuous plasma processing is performed (in a process P53) upon the transparent substrate plate 204 with oxygen gas and fluorocarbon gas plasma. By doing this, the surface of the polymide is made to repel water (i.e. to be hydrophobic), while the surface of the ITO is made to attract water (i.e., to be hydrophilic), and it is possible to control the dampness of the substrate plate side in order minutely to perform patterning of the liquid drops. As a device for generating such a plasma, a device which generates plasma in vacuum may be utilized; or, in the same manner, it is possible to utilize a device which generates plasma in the atmosphere.

Next, in a process P54 and as shown in FIG. 22(*a*), the ink for the positive hole injection layer is discharged from the ink jet head 22 of the liquid drop discharge device of FIG. 9, and the operation of applying it in a pattern upon each of the picture element electrodes 202 is performed. As a concrete version of the control method for the ink jet head 22, any of the methods shown in FIGS. 1 through 5 may be employed. After this application, the solvent is eliminated (in a process P55) by subjecting the workpiece to a vacuum of about 1 torr at room temperature for about 20 minutes. Then heat processing at a temperature of about 20 degree Celsius is performed on a hot plate at atmospheric pressure for about 10 minutes, and thereby the positive hole injection layer 220 is solidified (in a process P56) so as to have no compatibility with respect to the ink for the light emission layer. Under the above described conditions, the film thickness comes to be about 40 nm.

Next, in a process P57 and as shown in FIG. 22(*b*), ink for a R light emission layer which functions as an electro-luminescent material which is a functional liquid mass, and ink for a G light emission layer which functions as an electro-luminescent material which is a functional liquid mass, are applied over the positive hole injection layer 220 within each of the respective R and G filter element formation regions 7 by using an ink jet method. Here as well, the ink for each of these two light emission layers is discharged from the ink jet head 22 of the liquid drop discharge device 16 shown in FIG. 9. As for a control method for the ink jet head 22, any one of the methods shown in FIGS. 1 through 5 may be employed. According to the ink jet method, it is possible to perform minute patterning conveniently and also in a short time period. Furthermore, it is also possible to vary the film thickness by varying the ink composition with regard to its solid component concentration, and by varying the discharge amount thereof.

After having applied the ink for these two light emission layers, next, in a process P58, the solvent is eliminated by processing under 1 torr of vacuum and at room temperature for a period of 20 minutes. Next, in a process P59, transformation is performed by heat processing in a nitrogen atmosphere and at a temperature of 150 degree Celsius for a period of four hours, and thereby the R colored light emission layers 203R and the G colored light emission layers 203G are formed. Under the above described conditions, the film thickness is about 50 nm. The light emission layer which has thus been transformed by heat processing is insoluble in the solvent.

It should be understood that it would also be acceptable to perform continuous plasma processing with oxygen gas and fluorocarbon gas plasma upon the positive hole injection layer 220 before forming the light emission layers. By doing this, a fluorinated material layer would be formed over the positive hole injection layer 220, and the positive hole injection efficiency would be enhanced by increasing the ionization potential, so that it would be possible to produce an organic electro-luminescent device of high light emission efficiency.

Next, in a process P60 and as shown in FIG. 22(*c*), a B colored light emission layer 203B which serves as an electro-luminescent material which is a functional liquid mass is formed within every one of the filter element formation regions 7, so that, in each of the filter element regions 7 which are destined to constitute B (blue) light sources, only this B colored light emission layer 203B is present over the positive hole injection layer 220; while, in each of the filter element regions 7 which are destined to constitute R (red) light sources, a B colored light emission layer 203B is superimposed over the R colored light emission layer 203R which itself lies over the positive hole injection layer 220; and similarly, in each of the filter element regions 7 which are destined to constitute G (green) light sources, a B colored light emission layer 203B is superimposed over the G colored light emission layer 203G which itself lies over the positive hole injection layer 220. By doing this it is possible, not only to form three sources of R, G, and B light, but also, using the additional B colored light emission layers 203B, to fill in level differences between the R colored light emission layers 203R and the G colored light emission layers 203G, and the banks 205, and to planate them. And, by doing this, it is possible securely to prevent shorting between the upper and lower electrodes. By adjusting the film thickness of the B colored light emission layer 203B, the B colored light emission layers 203B which are layered over the R colored light emission layer 203R and the G colored light emission layer 203G act as electron injection transport layers for the R colored light emission layer 203R and the G colored light emission layer 203G, and do not themselves generate any B colored light.

As the method for the above formation of the B colored light emission layer 203B, for example, a per se conventional spin coating method which functions as a wet type method may be employed, or alternatively it is possible to utilize an ink jet method of the same type as was employed for the formation of the R colored light emission layer 203R and the G colored light emission layer 203G.

Thereafter the opposing electrode 213 is formed in a process P61 and as shown in FIG. 22(*d*), and thereby the electro-luminescent device 201 which is the objective of manufacture is produced. If this opposing electrode 213 is a single surface electrode, then, for example, a material such as Mg, Ag, Al, Li or the like may be utilized, and a layer thereof may be formed by using an evaporation adhesion method, a spattering method, or the like. On the other hand, if this opposing electrode 213 is a stripe form surface electrode, then, for example, it may be formed by a patterning method such as a photolithographic method or the like.

Since, according to the above described method of manufacture and device for manufacture of the electro-luminescent device 201, any of the control methods described above and shown in FIGS. 1 through 5 may be utilized, accordingly the positive hole injection layers 220 and/or the R, G, and B light emission layers 203R, 203G, and 203B in each picture element pixel of FIG. 22 are not each formed by a single episode of scanning in the main scanning direction X by the ink jet head 22 (refer to FIG. 1), but, rather, each of these positive hole injection layers and light emission layers is formed to a predetermined film thickness in its picture element pixel by said pixel being subjected to a plurality of n superimposed episodes of ink discharge, for example 4 such episodes, by a plurality of nozzles 27 which are contained in different nozzle groups. Due to this, even if, hypothetically, undesirable deviations are present in the ink discharge amounts between different ones of the plurality of nozzles 27, it is possible to prevent the occurrence of undesirable deviations in the film thickness between the plurality of picture element pixels, and, as a result, the light generation distribution characteristic of the light generating surface of the electroluminescent device 201 is made to be uniform. This fact means that, with the electro-luminescent device 201 of FIG. 22(*d*), it becomes possible to obtain a clear color display with no color blurring.

Furthermore, by utilizing the liquid drop discharge device 16 shown in FIG. 9 in the method of manufacture and the device for manufacture of an electroluminescent device according to this preferred embodiment of the present invention, it is not necessary to perform any complicated process such as a method which employs photolithography or the like, and furthermore there is no waste of material, since each of the R, G, and B picture element pixels is formed by a process of ink discharge using the ink jet head 22.

Figure 35A:
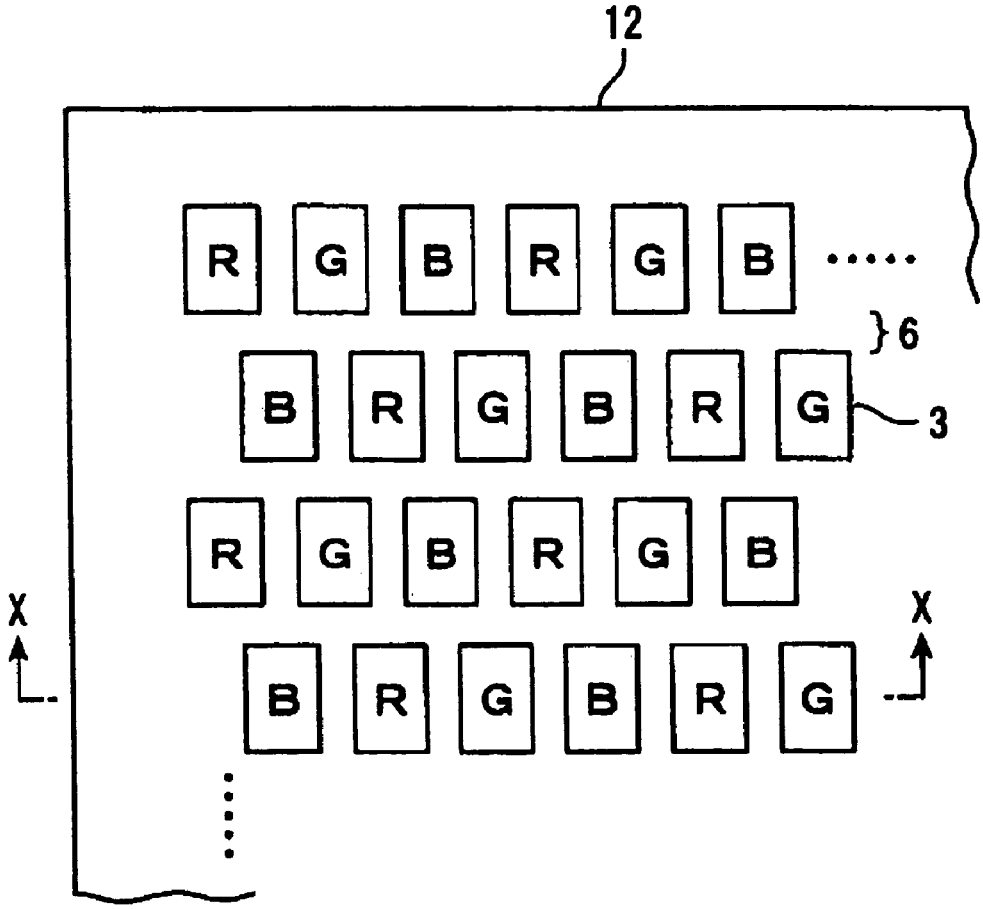
FIG. 35 is a general figure showing a color filter which has been manufactured by the same device for manufacturing a color filter; its view 35(A) is a plan view of the color filter, while its view 35(B) is a sectional view taken in a plane given by the arrows X-X in its view 35(A).

A Preferred Embodiment Related to a Method of Manufacture of a Color Filter, and a Device for Manufacturing the Same Next, a preferred embodiment of the device for manufacture of a color filter according to the present invention will be explained with reference to the figures. First, before explaing this device for manufacture of a color filter, the color filter which is to be manufactured will be explained. FIG. 35 is a figure which shows a portion of the color filter in a magnified view; its view 35(A) shows a plan view thereof, while the view 35(B) shows a sectional view thereof taken in a plane shown by the line X-X in FIG. 35(A). It should be understood that, with this color filter shown in FIG. 35, the portions for which the structure is the same as that of corresponding portions in the color filter of the preferred embodiment shown in FIGS. 6 and 7 are designated by the same reference symbols.

Structure of the Color Filter

Referring to FIG. 35(A), the color filter comprises a plurality of picture elements 1A arranged in the form of a matrix. The boundaries of these picture elements 1A are defined by division walls 6. Color filter element material 13, i.e. color filter material which is a liquid mass which is either red (R), green (G), or blue (B) ink, is distributed into each one of these picture elements 1A. Although, in the following explanation of this color filter which is shown in FIG. 35, it will be assumed that the red, green, and blue picture elements are arranged in a so called mosaic array, this is not intended to be limitative: the same explanation would also apply in the case of a stripe array, a delta array or the like being utilized for the arrangement of the picture elements.

Figure 35B:
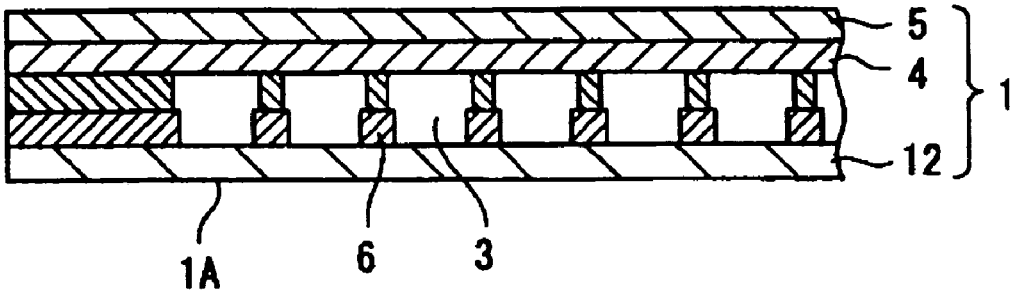

The color filter 1, as shown in FIG. 35(B), comprises a transparent substrate plate 12 and transparent division walls 6. The portions where these division walls 6 are not formed, in other words the portions where they are eliminated, constitute the above described picture elements 1A. The filter element material 13 of various colors which is supplied into these picture elements 1A constitute the filter elements 3 of various adhered color layers. A protective layer 5 and an electrode layer 5 are formed over the upper surfaces of the division walls 6 and the filter elements 3.

Structure of the Device for Manufacture of the Color Filter

Figure 23:
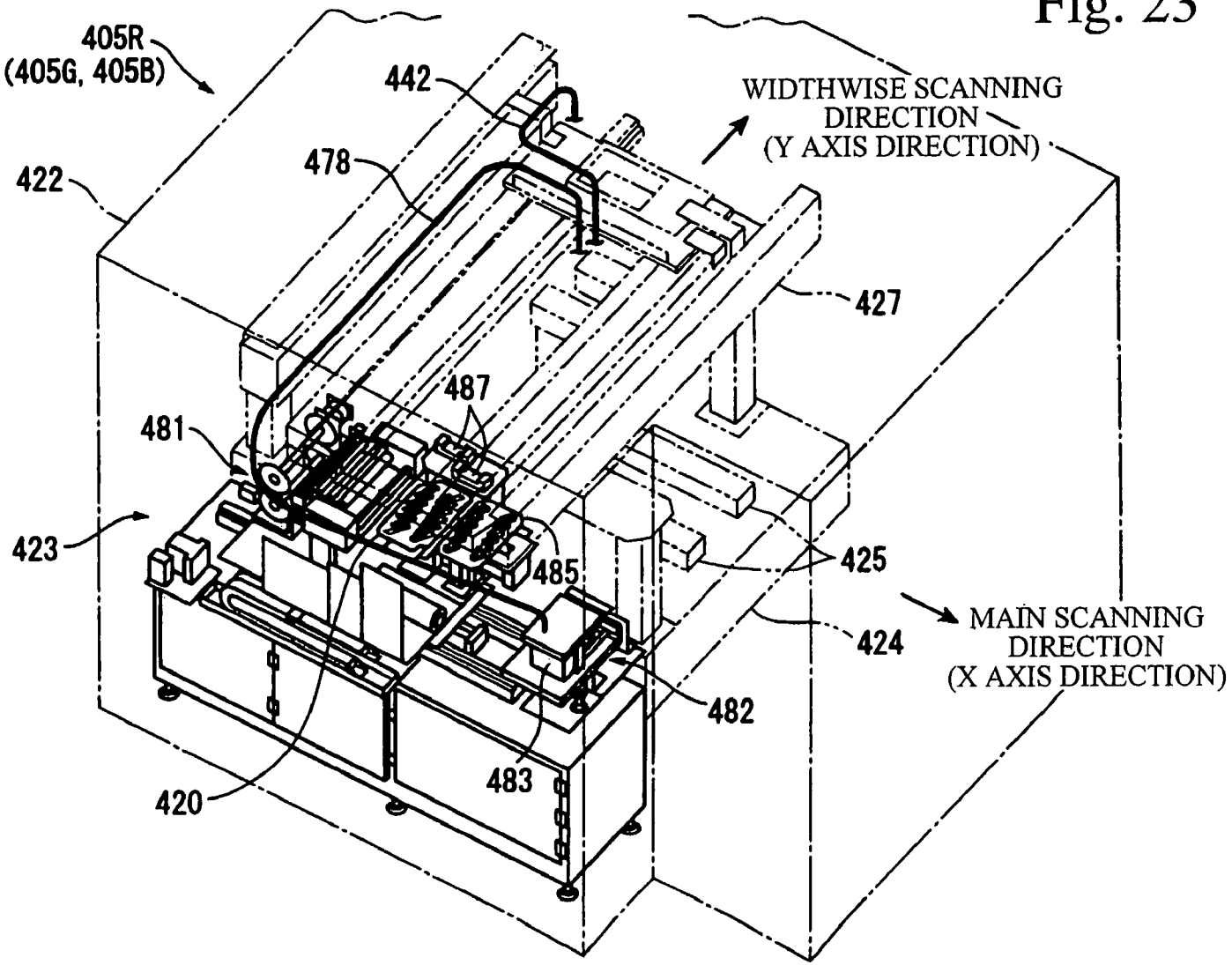
FIG. 23 is a perspective view showing a liquid drop discharge processing device of a liquid drop discharge device of a device for manufacture of a color filter according to the present invention, with a portion thereof cut away.

Next, the structure of a device for manufacturing the above described color filter will be explained with reference to the drawings. FIG. 23 is a perspective view showing a liquid drop discharge processing device of a device for manufacturing the color filter according to the present invention with one portion thereof cut away.

This device for manufacture of a color filter is adapted to manufacture a color filter which is to be incorporated in a color liquid crystal panel, which constitutes an electro optical device. This device for manufacture of a color filter comprises a liquid drop discharge device which is not shown in the figures.

Structure of the Liquid Drop Discharge Processing Device

And this liquid drop discharge device comprises three individual liquid drop discharge processing devices 405R, 405G, and 405B, as shown in FIG. 23, in the same manner as the liquid drop discharge devices of the various preferred embodiments described above. These liquid drop discharge processing devices 405R, 405G, and 405B correspond to the three colors R (red), G (green), and B (blue) of the filter element materials 13 of, for example, R, G, and B colors, which are the color filter materials, in other words the inks, which are to serve as liquid masses for being discharged against the motherboard 12. It should be understood that these liquid drop discharge processing devices 405R, 405G, and 405B are arranged approximately in series, thus making up the liquid drop discharge device. Furthermore, a control device for controlling the operation of various structural members, not shown in the figures, is provided integrally with each of the liquid drop discharge processing devices 405R, 405G, and 405B.

Moreover, it should be understood that each of the liquid drop discharge processing devices 405R, 405G, and 405B is connected to an individual transportation robot not shown in the drawings, each of which inserts and takes out motherboards 12, one at a time, into and from its respective liquid drop discharge processing devices 405R, 405G, and 405B. Furthermore, to each of the liquid drop discharge processing devices 405R, 405G, and 405B there is connected a multi stage baking furnace, not shown in the drawings, which is capable of accommodating, for example, six of the motherboards 12 at a time, and which subjects said motherboards 12 to heat processing by heating them up, for example at a temperature of 120 degree Celsius for a period of five minutes, for drying out the filter element material 13 which has been discharged against said motherboards 12.

And, as shown in FIG. 23, each of the liquid drop discharge processing devices 405R, 405G, and 405B comprises a thermal clean chamber 422 which is a hollow box shaped main body casing. In order to obtain properly stabilized painting by the ink jet method, the temperatures of the interiors of these thermal clean chambers 422 are adjusted to, for example, 20±0.5 degree Celsius, and they are formed so that dust or dirt cannot insinuate itself into them from the outside. The liquid drop discharge processing device main bodies 423 are housed within these thermal clean chambers 422.

The liquid drop discharge processing device main body 423 comprises an X axis air slide table 424, as shown in FIG. 23. A main scanning drive device 425, to which a linear motor not shown in the figures is provided, is disposed upon this X axis air slide table 424. This main scanning drive device 425 comprises a pedestal portion not shown in the figures to which the motherboard 12 is fixedly attached by, for example, suction, and this pedestal portion is shifted in the main scanning direction, which is the X axis direction, with respect to the motherboard 12.

As shown in FIG. 23, a widthwise scanning drive device 427 which serves as a Y axis table is disposed in the liquid drop discharge processing device main body 423 as positioned above the X axis air slide table 424. A head unit 420 which discharges filter element material 13, for example, in the vertical direction is shifted by this widthwise scanning drive device 427 along the widthwise scanning direction with respect to the motherboard 12, which is the Y axis direction. It should be understood that, in FIG. 23, the head unit 420 is shown by solid lines in its state in which it floats in the air, in order to clarify the various positional relationships.

Furthermore various cameras not shown in the drawings are provided in the liquid drop discharge processing device main body 423, and these are position detection means which detect various positions of various elements, for controlling the position of the ink jet head 421 and/or the position of the motherboard 12. It should be understood that it is possible to implement position control of the head unit 420 or of the pedestal portion by position control using pulse motors, or by feedback control using servo motors, or by some other control method, as may be appropriate.

Furthermore, as shown in FIG. 23, a wiping unit 481 which wipes off the surface of the head unit 420 which discharges filter element material 13 is provided to the liquid drop discharge processing device main body 423. In this wiping unit 481, a wiping member not shown in the figures in which, for example, a cloth member and rubber sheet are integrally superimposed is appropriately wound up from its one end, and the wiping unit 481 is arranged to wipe the surface which discharges filter element material 13 using new surfaces of this wiping member in order. By doing this, elimination of filter element material 13 which has adhered to the discharge surface is performed, and it is possible to prevent the occurrence of blockages of certain nozzles, which will be described hereinafter, in the surface which discharges filter element material 13.

Furthermore, as shown in FIG. 23, an ink system 482 is provided to the liquid drop discharge processing device main body 423. This ink system 482 comprises an ink tank 483 which stores filter element material 13, a supply conduit 478 which is capable of conducting this filter element material 13, and a pump not shown in the drawings which supplies filter element material 13 to the head unit 420 from the ink tank 483 via the supply conduit 478. It should be understood that the piping of the supply conduit 478 is only shown schematically in FIG. 23, and it is connected to the side of the widthwise scanning drive device 427 so as not to exert any influence from the ink tank 483 upon the shifting of the head unit 420, and so as to supply filter element material 13 to the head unit 420 from the vertical direction of the widthwise scanning drive device 427 which drives the head unit 420 to perform scanning.

Furthermore, a weight measurement unit 485 which detects the amount of discharge of filter element material 13 from the head unit 420 is provided to the liquid drop discharge processing device main body 423.

Yet further, a pair of dot missing detection units 487 are provided to the liquid drop discharge processing device main body 423, and these dot missing units 487 comprise, for example, optical sensors not shown in the drawings which detect the discharge state of filter element material 13 from the head unit 420. Moreover, these dot missing detection units 487 are arranged so that light sources and light reception portions of their optical sensors not shown in the figures are arranged along a crossing direction with respect to the direction in which the liquid mass is discharged from the head unit 420, for example along the X axis direction, and lie on either side of, and mutually oppose one another across, the space through which the liquid drops which have been discharged from the head unit 420 pass. Furthermore, these dot missing detection units 487 are arranged so as to be positioned on the Y axis direction side which is the transport direction of the head unit 420, and they detect dot missing by, for each episode of widthwise scanning shifting, detecting the discharge state of the head unit 420 for discharging the filter element material 13.

Although the details thereof will be described hereinafter, it should be understood that two rows of the head device 433 which discharges filter element material 13 are provided to the head unit 420. Due to this, a pair of the dot missing detection units 487 are also provided for detecting the discharge state, one for each row of these head devices.

Structure of the Head Unit

Figure 24:
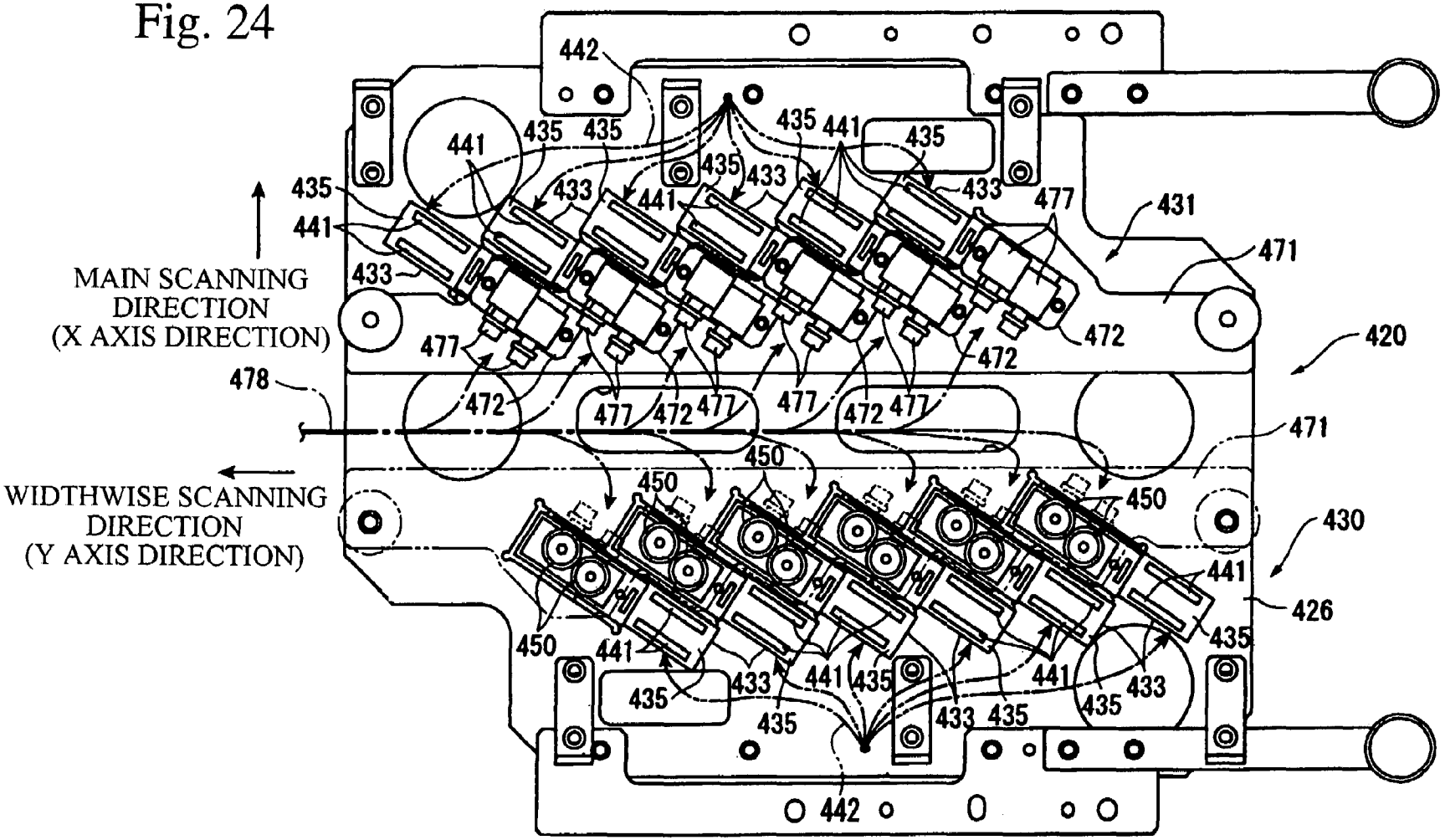
FIG. 24 is a plan view showing a head unit of the same liquid drop discharge processing device.
Figure 25:
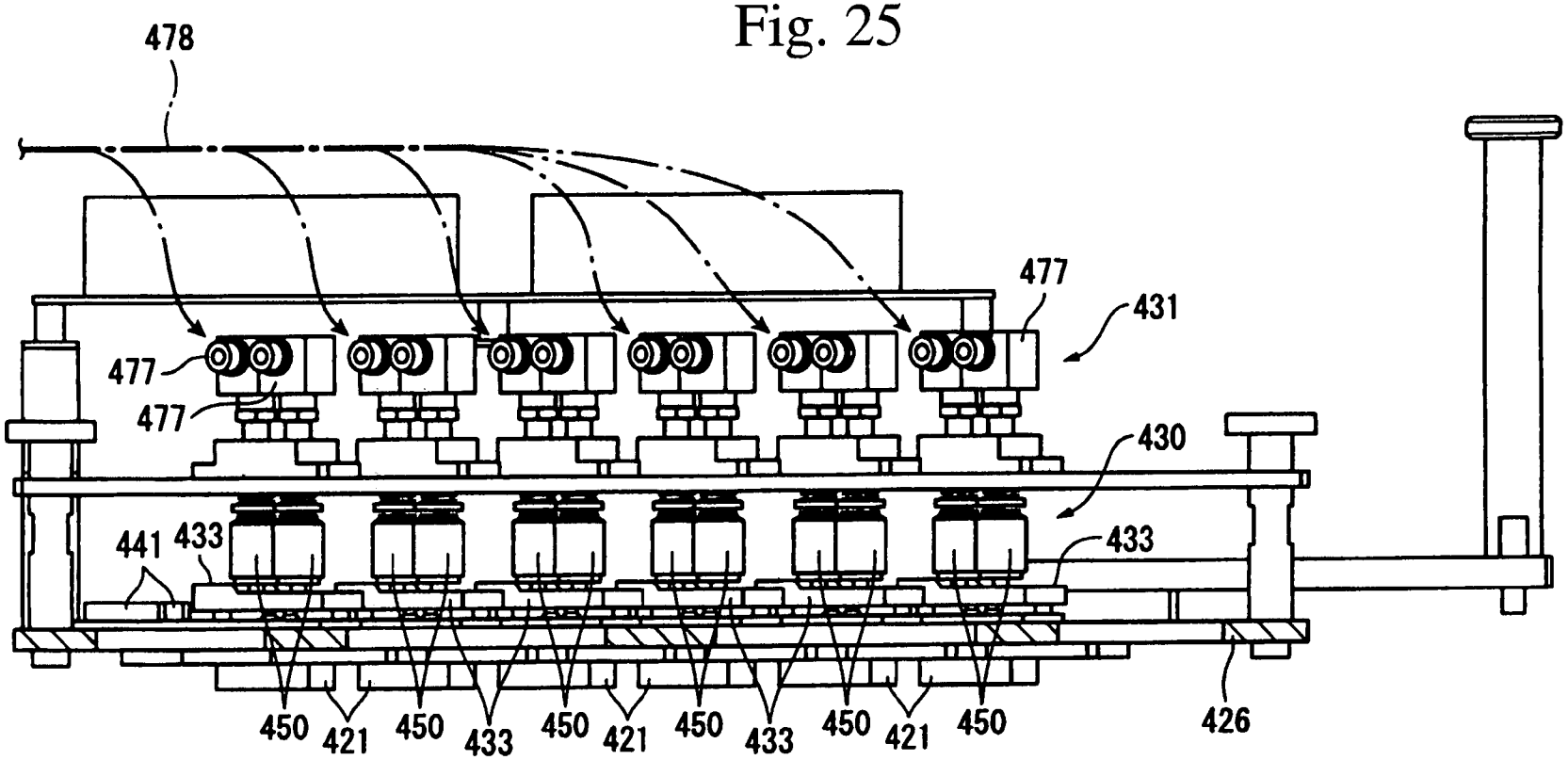
FIG. 25 is a side view of the same.
Figure 26:
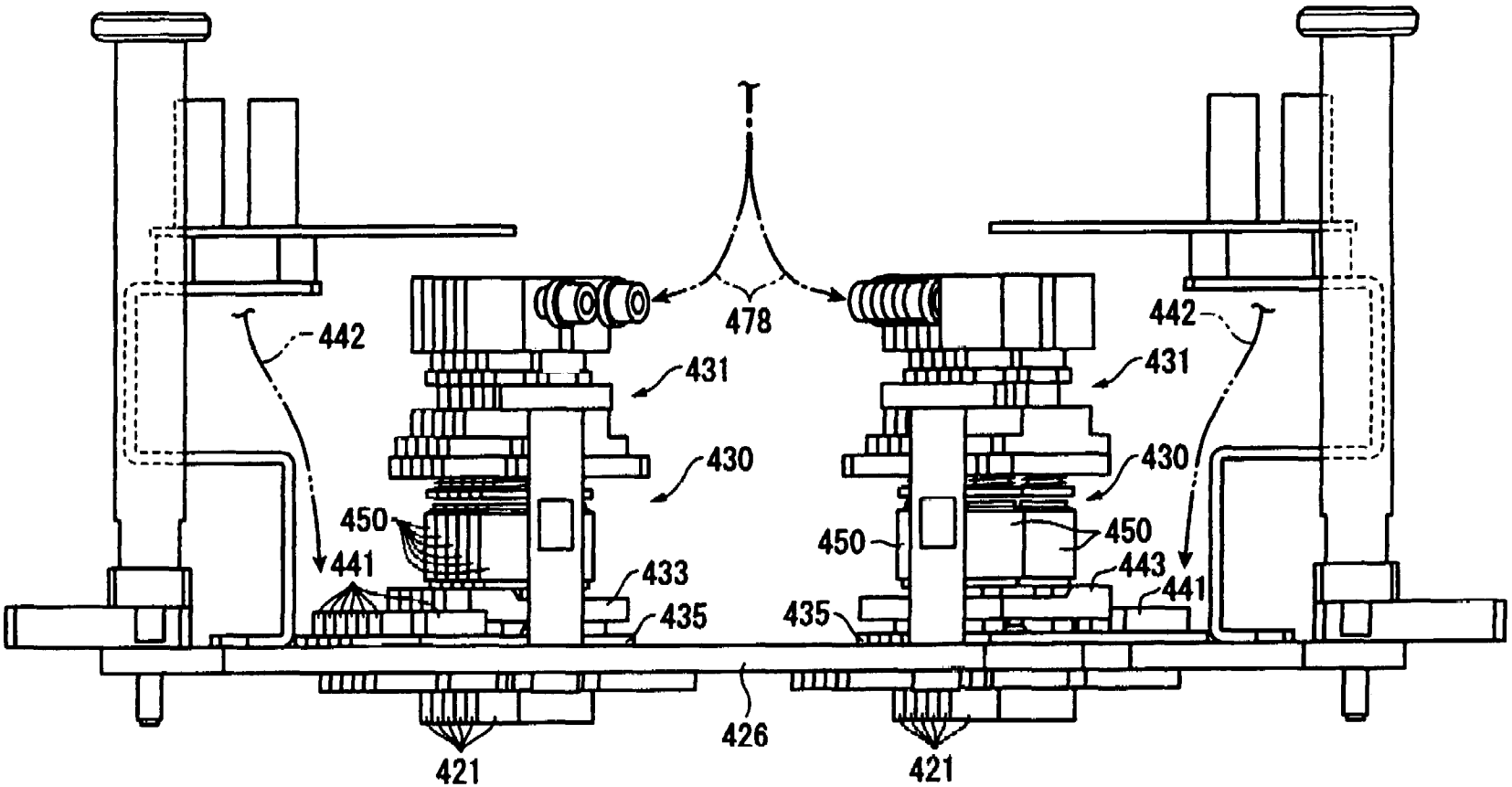
FIG. 26 is an elevation view of the same.
Figure 27:
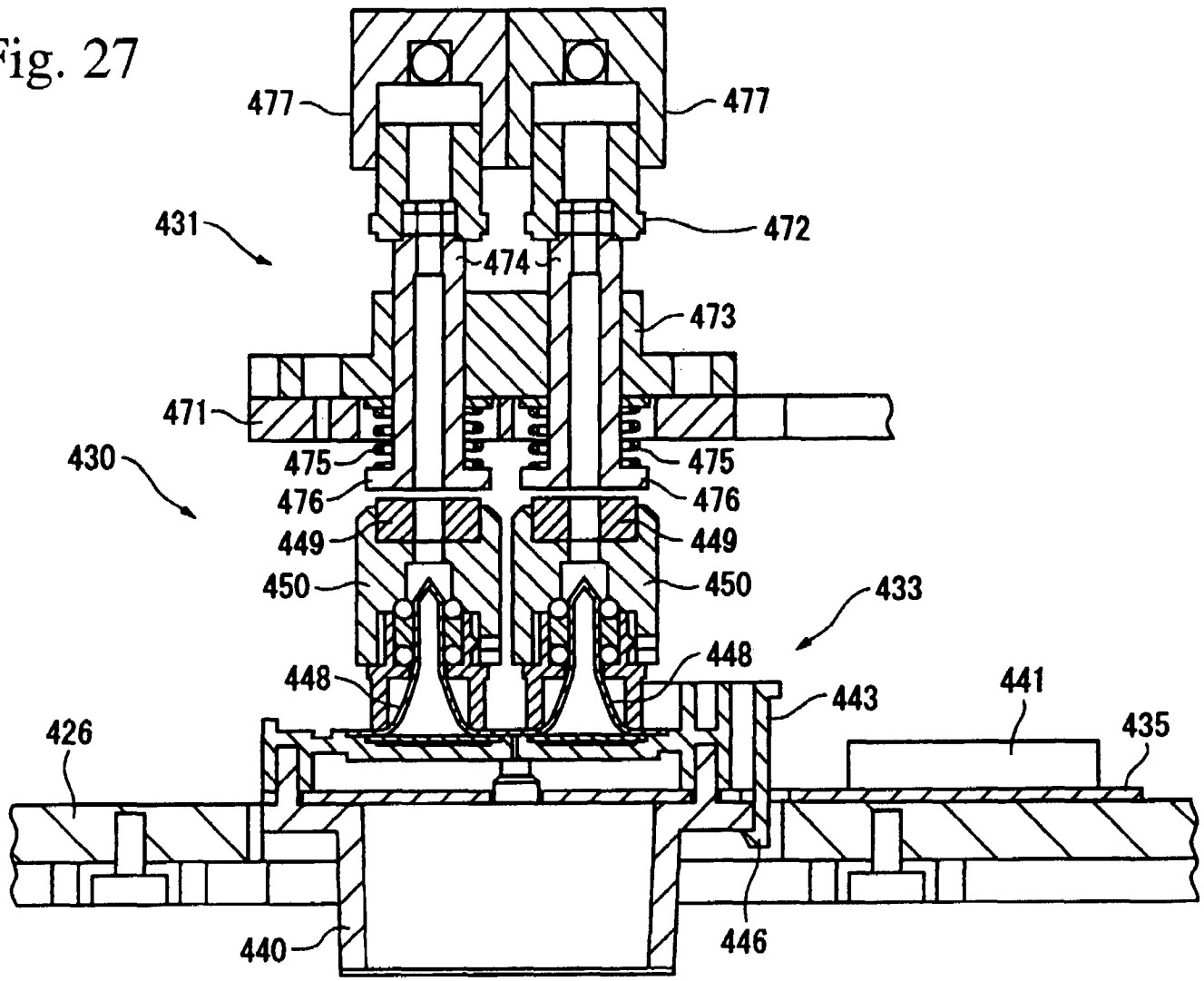
FIG. 27 is a sectional view of the same.

Next, the structure of the head unit 420 will be explained. FIG. 24 is a plan view showing the head unit 420, which is provided in each of the liquid drop discharge processing devices 405R, 405G, and 405B. FIG. 25 is a side view of this head unit 420. FIG. 26 is an elevation view of this head unit 420. And FIG. 27 is a sectional view showing this head unit 420.

As shown in FIGS. 24 through 27, the head unit 420 comprises a head main body portion 430 and an ink supply section 431. Furthermore, this head main body portion 430 comprises a planar carriage 426 and a plurality of head devices 433 fitted upon this carriage 426, all of which are, in practice, of roughly the same structure.

Structure of the Head Device

Figure 28:
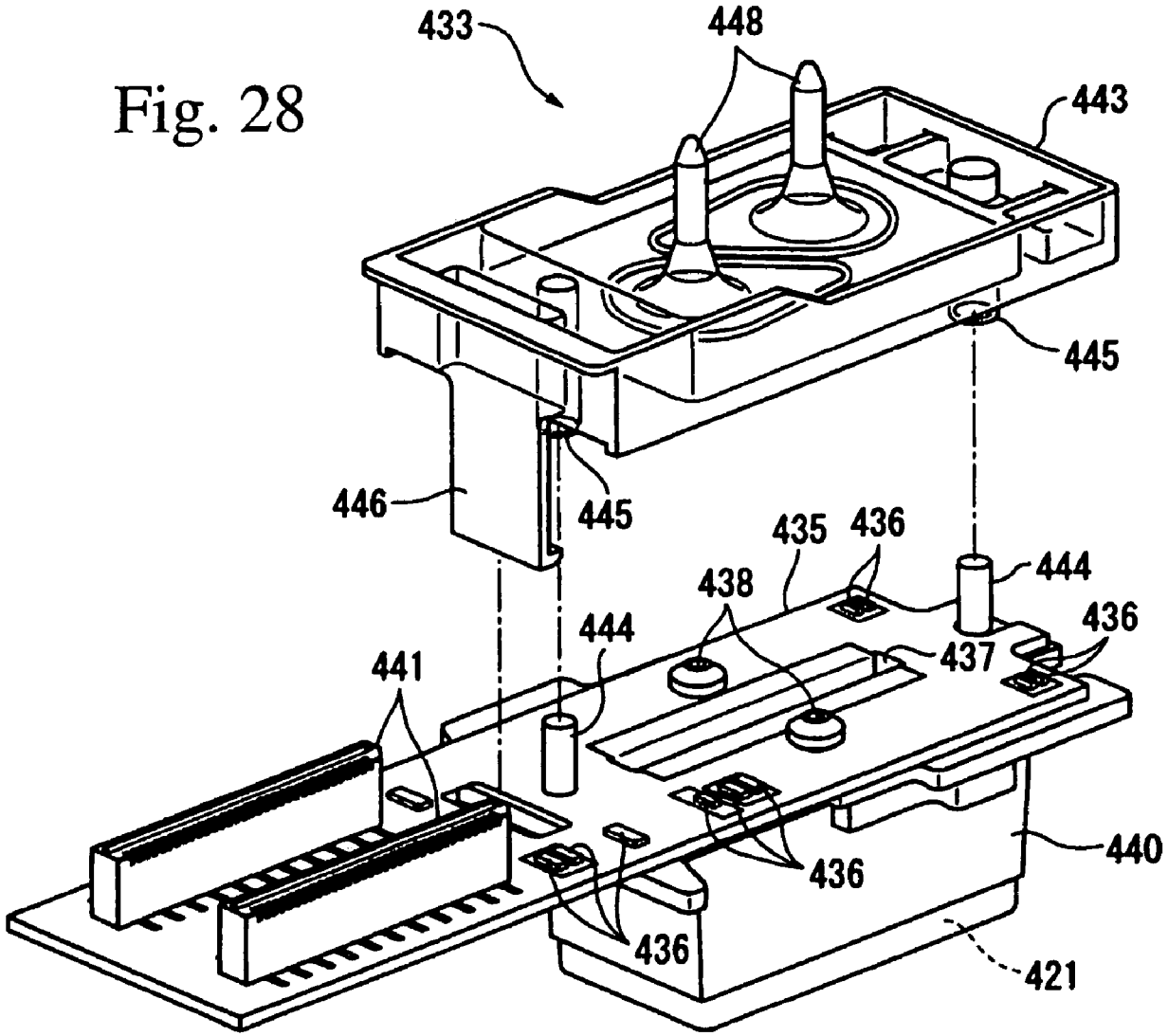
FIG. 28 is an exploded perspective view of the same head device.

FIG. 28 is an exploded perspective view showing a head device 433 which is provided to the head unit 420.

As shown in FIG. 28, this head device 433 comprises a print substrate plate 435 which is in the uncharged state. Electrical connecting wires which connect various electrical components 436 are provided upon this print substrate plate 435. Furthermore, a window portion 437 is formed through the print substrate plate 435, positioned at one end thereof (the right end in FIG. 28) along its longitudinal direction. Yet further, flow conduits 438 which are capable of carrying flows of filter element material 13, i.e. of ink, are provided in the print substrate plate 435 and are positioned at opposite sides of the window portion 437.

And an ink jet head 421 is integrally fitted by a fitting member 440 upon one surface side (the lower surface side in FIG. 28) of this print substrate plate 435, and is positioned approximately at one end thereof in its longitudinal direction (the right end in FIG. 28). This ink jet head 421 is formed in an elongated parallelepiped shape, and it is fixed to the print substrate plate 435 with its lengthwise direction running along the lengthwise direction of said plate 435. It should be understood that each of the ink jet heads 421 of each of the head devices 433 is in practice of approximately the same type, in other words, for example, may be a product made to a predetermined standard, or may be sorted to a predetermined quality, or the like. In concrete terms, each of these ink jet heads 421 comprises the same number of nozzles which will be described hereinafter, and it is desirable for the positions in which these nozzles are formed to be mutually the same, so that it is possible efficiently to perform the operation of assembling these ink jet heads 421 to the carriage 426, and so that, furthermore, it is possible to enhance the accuracy of that operation. Yet further, it is possible to reduce the cost if components are utilized which are produced via the same manufacturing and assembly process, since the requirement for manufacturing special components disappears.

Furthermore, connectors 441 for electrically connecting electrical connecting wires 442 to the ink jet head 421 are integrally fitted on the other surface side of the print substrate plate 435 (the upper side in FIG. 28), so as to be positioned approximately at the other end thereof (the left end in FIG. 28) in its longitudinal direction. As schematically shown in FIG. 23, electrical connecting wires 442 (including connecting wires from an electrical power source and connecting wires for carrying signals) which are connected to the widthwise scanning drive device 427 are connected to these connectors 441, so as not to exert any influence upon the shifting of the head unit 420. These connecting wires 442 are connected to a control device not shown in the figures, and to the head unit 420. In other words these electrical connecting wires 442, as schematically shown by the double dotted broken arrows in FIG. 24 and FIG. 27, are connected from the widthwise scanning drive device 427 to the connectors 441 which are connected to the outer peripheral sides of the head unit 420, which are on opposite sides of the direction (the longitudinal direction) in which the two rows of head device 433 of this head unit 420 are aligned, and thereby the generation of electrical noise is minimized.

Yet further, an ink supply section 443 is fitted to the other surface side of the print substrate plate 435 (the upper surface side in FIG. 28), approximately at one end thereof (the right end in FIG. 28) in its longitudinal direction, so as to correspond to the ink jet head 421. This ink supply section 443 comprises position determination tubular portions 445 of roughly cylindrical form which pass through the print substrate plate 435 and into which position determination pin portions 444 which are provided upon the fitting member 440 are fitted, and engagement claw portions 446 which engage with the print substrate plate 435.

Moreover a pair of connecting members 448 are provided so as to project from the ink supply section 443, and these members 448 are of approximately cylindrical form and have tapered ends. These connecting members 448 have through openings not shown in the figures which, at their base end portions which are presented towards the print substrate plate 435, connect in a substantially liquid tight manner to the flow conduits 438 of the print substrate plate 435, and their tip end portions (at their upper ends in FIG. 28) are provided with holes not shown in the figures through which flows of filter element material 13 may be conducted.

Still further, as shown in FIGS. 25 through 28, a sealing connecting member 450 is fitted to each to these connecting members 448, positioned at its tip. These sealing connecting members 450 are made in roughly cylindrical form, and their interior circumferences are fitted to the connecting members 448 in a substantially liquid tight fashion; and they are provided with seal members 449 at their tip end portions.

Structure of the Ink Jet Head

Figure 29:
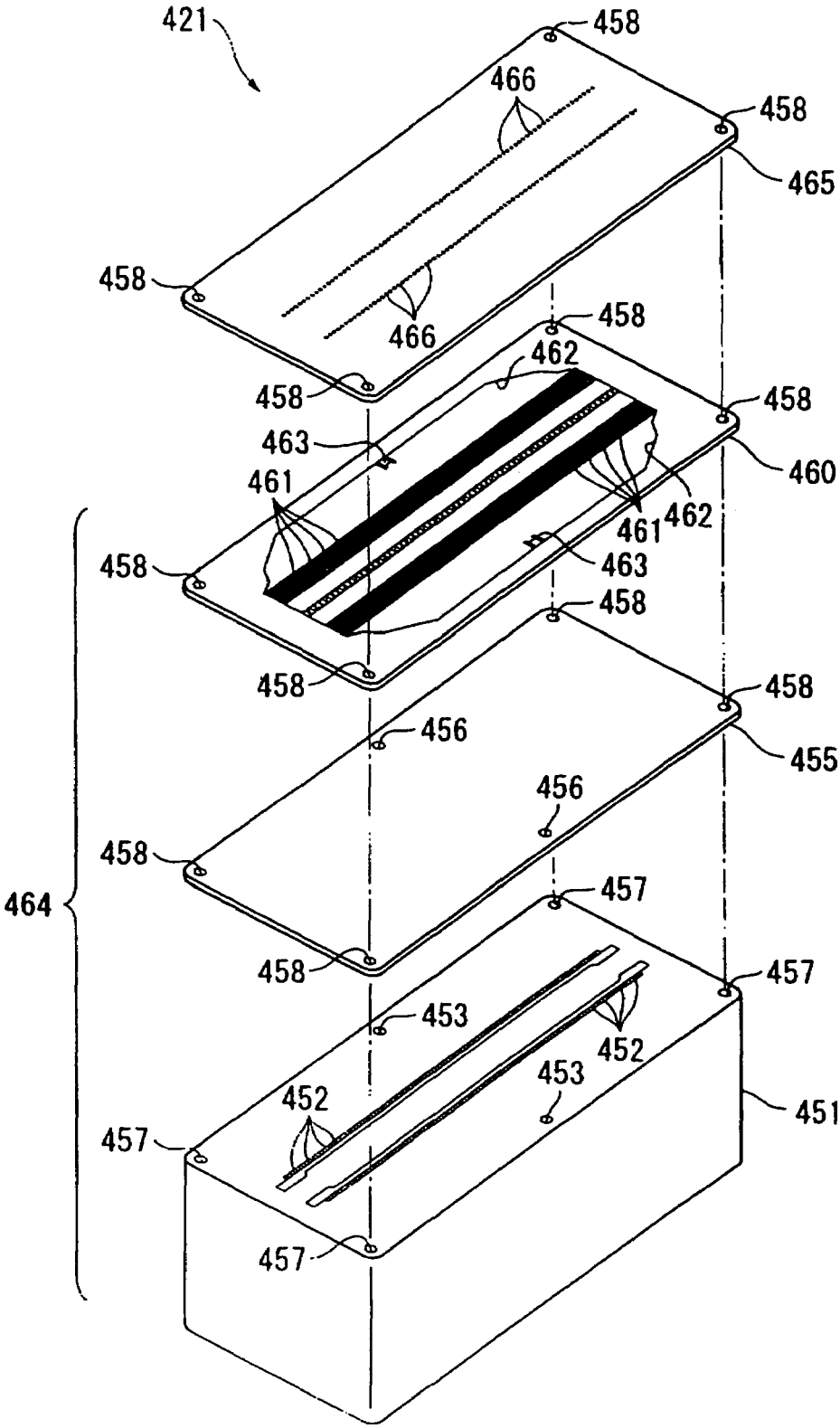
FIG. 29 is an exploded perspective view of the same ink jet head.
Figure 30A:
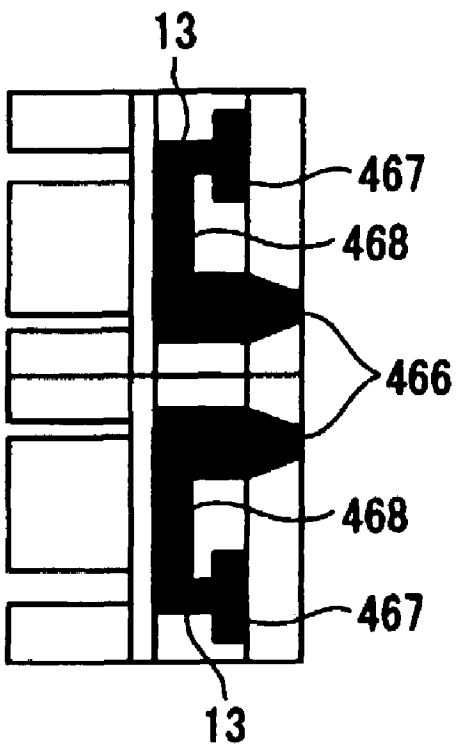
FIGS. 30(A)-30(C) are sets of explanatory views for explanation of the operation of the same ink jet head for discharging filter element material.
Figure 30B:
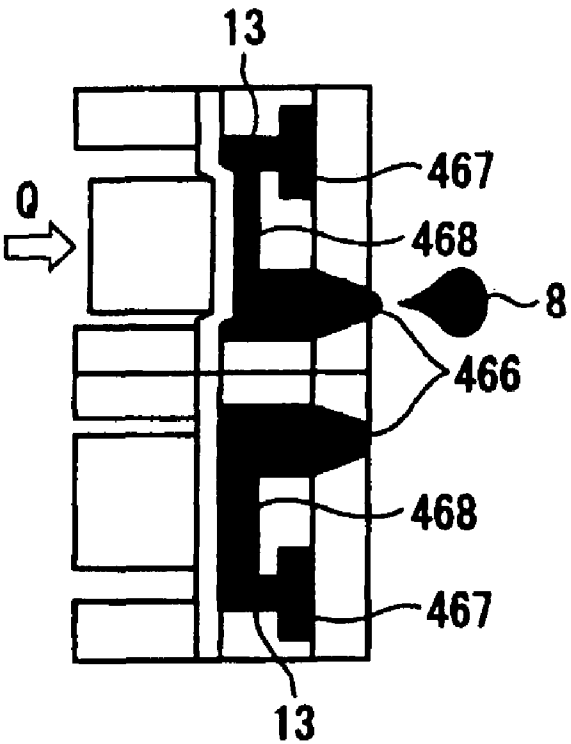
Figure 30C:
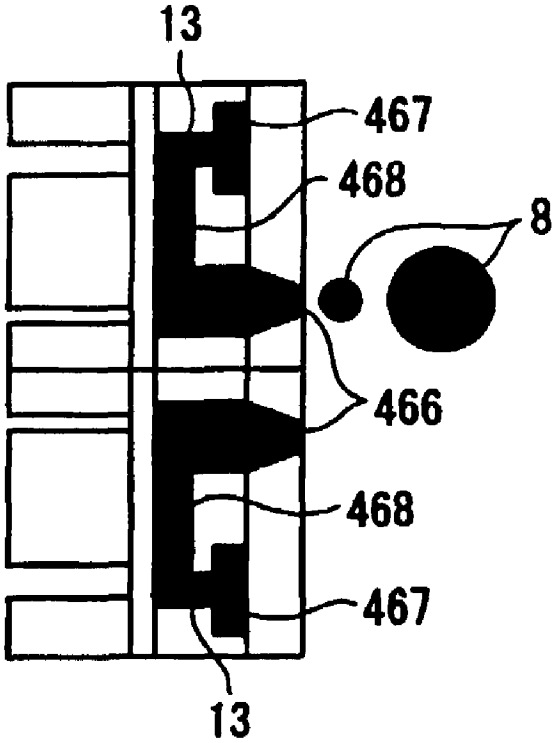
Figure 31:
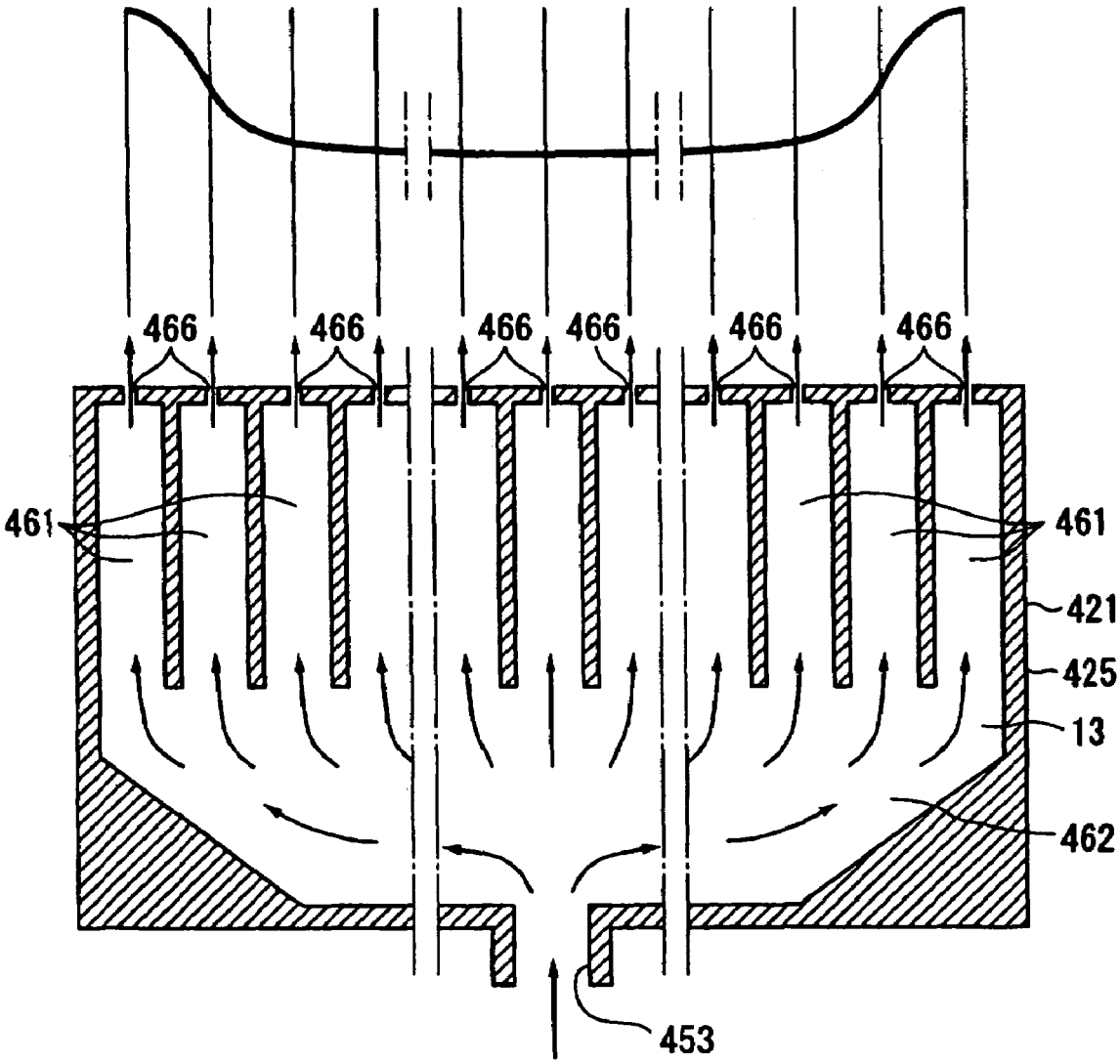
FIG. 31 is an explanatory view for explanation of the discharge amount of filter element material by the same ink jet head.
Figure 32:
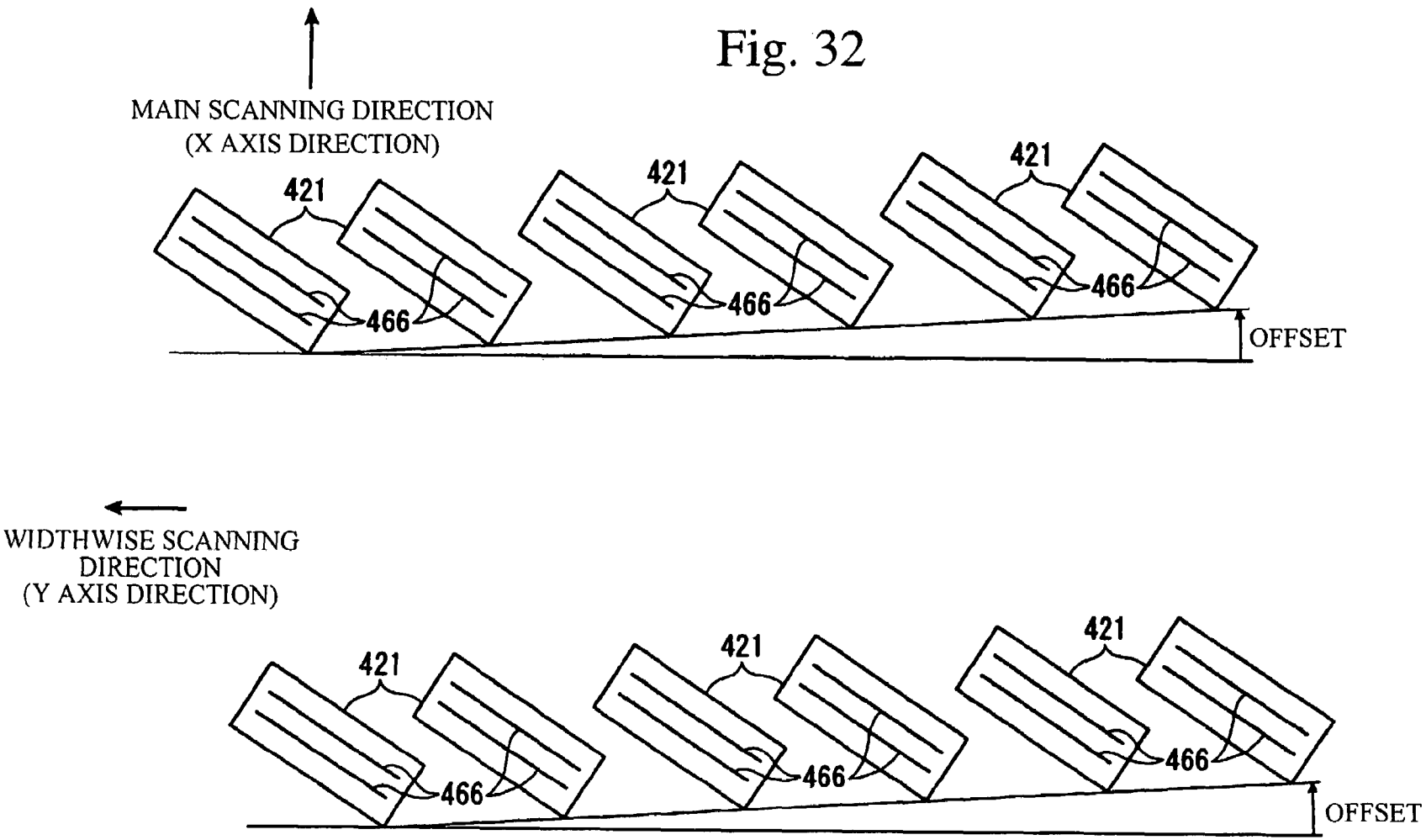
FIG. 32 is a schematic view for explanation of the way in which the same ink jet head is arranged.
Figure 33:
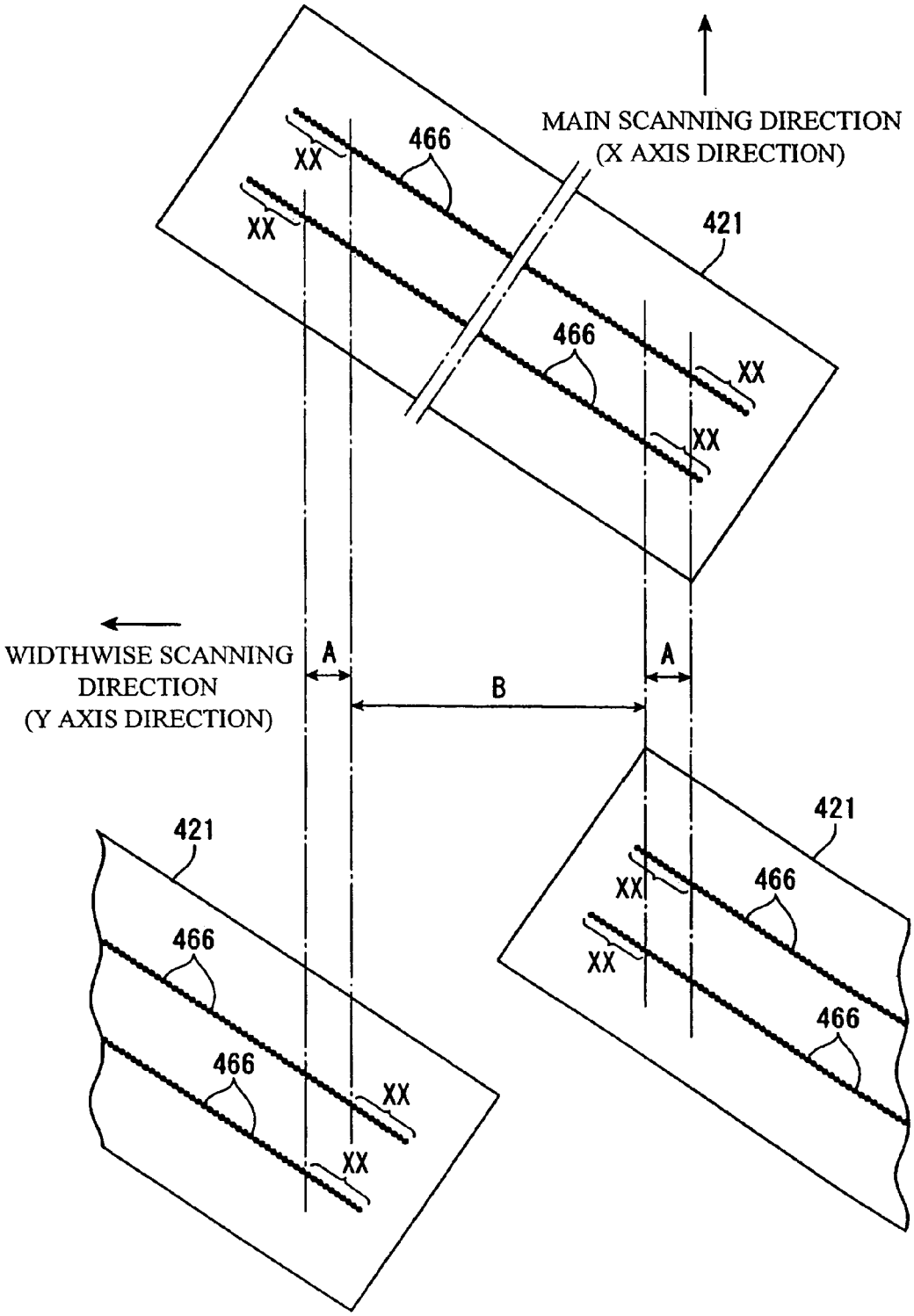
FIG. 33 is a partially magnified schematic view for explanation of the way in which the same ink jet head is arranged.

FIG. 29 is an exploded perspective view showing the ink jet head 421. FIG. 30 consists of schematic sectional views of the ink jet head 421 for explanation of the operation of said ink jet head 421 for discharge of filter element material 13, and, in detail, FIG. 30(A) shows the state of the ink jet head 421 before discharging filter element material 13, FIG. 30(B) shows its state when discharging filter element material 13 by contracting a piezoelectric drive element 452, and FIG. 30(C) shows its state directly after having discharged filter element material 13. FIG. 31 is an explanatory view for explanation of the discharge amount of filter element material by the ink jet head 421. And FIG. 32 is an overall schematic view for explanation of the situation of arrangement of the ink jet head 421. Moreover, FIG. 33 is a magnified view showing a portion of FIG. 32.

The ink jet head 421, as shown in FIG. 29, comprises a roughly rectangular shaped holder 451. In this holder 451 there are provided two rows of piezoelectric drive elements 452 which extend along the longitudinal direction, each including, for example, 180 individual piezo elements. Furthermore, through holes 453 are provided in the holder 451, roughly on both sides thereof in the center, for conducting flows of the filter element material 13, i.e. of the ink, and these through holes 453 connect to the flow conduits 438 of the print substrate plate 435.

Furthermore, as shown in FIG. 29, an elastic plate 455 which is made from composite resin in the form of a sheet is integrally provided upon the upper surface of the holder 451, which is the surface upon which the piezoelectric drive elements 452 are positioned. Communicating holes 456 which connect to the through holes 453 are provided upon this elastic plate 455. And engagement holes 458 are provided through this elastic plate 455 for engagement with position determination claw portions 457 which project from the upper surface of the holder 451, approximately at its four corners, so as to fix the position of the elastic plate 455 upon the upper surface of the holder 451 and to hold it integrally thereupon.

Furthermore, a planar flow conduit definition plate 460 is provided upon the upper surface of the elastic plate 455. In this flow conduit definition plate 460 there are provided: two rows of nozzle grooves 461, each formed as a line extending in the longitudinal direction of the holder 451 of 180 elements, elongated in the width direction of the holder 451, which correspond to the piezoelectric drive elements 452; two opening portions 462 which are provided in elongated form in the longitudinal direction of the holder on either side of these nozzle grooves 461; and two flow apertures 463 which connect to the communicating holes 456 of the elastic plate 455. And engagement holes 458 are provided in this planar flow conduit definition plate 460 for engagement with the position determination claw portions 457 which project from the upper surface of the holder 451 approximately at its four corners, and thereby the planar flow conduit definition plate 455 is fixed upon the upper surface of the holder 451 and is held integrally thereupon, along with the elastic plate 455.

Furthermore, a roughly planar nozzle plate 465 is provided upon the upper surface of the flow conduit definition plate 460. And two nozzle rows are provided in this nozzle plate 465 to extend in the longitudinal direction of the holder 451, each of these two rows, in this example, being about 25.4 mm (1 inch) long, and consisting of 180 roughly circular shaped nozzles 466 which correspond to the nozzle grooves 461 which are formed in the flow conduit definition plate 460. And engagement holes 458 are provided in the nozzle plate 465 for engagement with the position determination claw portions 457 which project from the upper surface of the holder 451 approximately at its four corners, and thereby this nozzle plate 465 is fixed upon the upper surface of the holder 451 and is held integrally thereupon, along with the elastic plate 455 and the planar flow conduit definition plate 460.

And, as schematically shown in FIG. 30, along with a liquid reservoir 467 being defined, by the elastic plate 455, the flow conduit definition plate 460 and the nozzle plate 465, as a compartment at the opening portions 462 of the flow conduit definition plate 460, this liquid reservoir 467 is connected via a liquid supply conduit 468 to each of the nozzle grooves 461. Due to this, the ink jet head 421 operates the piezoelectric drive elements 452 to magnify the pressure within the nozzle grooves 461, and discharges filter element material 13 from the nozzles 466 at a speed of 7±2 m/sec as liquid drops of mass 2-13 pl, for example about 10 pl. In other words, referring to FIG. 30, by supplying a predetermined supply voltage Vh in the form of pulses to the piezoelectric drive element 452, as shown in order in FIGS. 30(A), 30(B), and 30(C), the piezoelectric drive elements 452 are appropriately expanded and contracted along the direction of the arrow Q, and thereby pressure is applied to the filter element material 13, in other words to the ink, so as to discharge the filter element material from the nozzles 466 as liquid drops 8 of a predetermined mass.

Furthermore, with this ink jet head 421, as has also been explained with regard to the above described preferred embodiments, it may happen that the discharge amount at either or both of the end portions of the nozzle rows along the direction in which they extend may become great as shown in FIG. 31, so that undesirable deviations may occur in the amount of discharge. Due to this, control is exerted so as not to discharge filter element material 13 from the nozzles 466 for which the undesirable deviations of the discharge amounts are to be restrained within a range of, for example, 5%, in other words from about 10 of the nozzles 466 at each end of each row.

And, as shown in FIG. 23 through FIG. 27, the head main body portion 430 which is included in the head unit 420 comprises a plurality of head devices 433 which comprise ink jet heads 421, mutually arranged in a row. The arrangement of these head devices 433 upon the carriage 426 is that, as schematically shown in FIGS. 32 and 33, they are arrayed generally along the Y axis direction which is the widthwise scanning direction, while being offset along a direction which is inclined with respect to the X axis direction, which is the main scanning direction and is perpendicular to the Y axis direction. In other words, for example, six such head devices 433 are arranged in a row in a direction which is somewhat inclined from the Y axis direction which is the widthwise scanning direction, and several such rows are provided, for example two rows. This is a method for arrangement which has been conceived of due to the circumstance that it is necessary for the rows of nozzles 466 to be arrayed in a continuous series along the Y axis direction, while on the other hand it is not possible to shorten the space left open between each ink jet head 421 and the next one neighboring it, since the width in the longer direction of the head devices 433 is greater than that of the ink jet heads 421.

Furthermore, in the head main body portion 430, the head devices 433 are arranged roughly in point symmetry, with the longitudinal directions of the ink jet heads 421 being inclined to the direction (the Y axis direction) which is perpendicular to the X axis direction, and moreover with the connectors 441 being positioned at the opposite side to the relatively opposing direction.

These head devices 433 may be arranged so that the direction of provision of their nozzles 466, which is the longitudinal direction of the ink jet heads 421, is inclined at, for example, 57.1 degree with respect to the X axis direction.

Furthermore, the head devices 433 are arranged in roughly a staggered arrangement, in other words so that they are not positioned in a direct series along the direction in which they are arranged. In other words, as shown in FIGS. 24 through 27 and in FIG. 32, the ink jet heads 421 are arranged in two rows, with the nozzles 466 of the twelve (in this example) ink jet heads 421 being arranged continuously along the Y axis direction, and moreover with the orders in which they are arranged along their Y axis direction being arranged mutually differently, so that they alternate.

This matter will now be explained in concrete terms and in more detail, based upon FIG. 32 and FIG. 33. Therein, on the ink jet head 421, the direction in which the nozzles 466 are arrayed, which is the longitudinal direction, is tilted with respect to the X axis direction. Due to this, a region A (a region of non-discharging nozzles), which comes to be positioned within the ten nozzles which do not discharge on the other second row of the nozzles 466, is present (A in FIG. 33) upon the straight line in the X axis direction upon which the eleventh nozzle 466 in the first row among the two rows of nozzles 466 which are provided to the ink jet head 421, and which discharges filter element material 13, is positioned. In other words, with a single ink jet head 421, a region A occurs in which no two discharge nozzles 466 are present upon a straight line in the X axis direction.

Accordingly, as shown in FIG. 32 and FIG. 33, no other head devices 433 which form the row are positioned in a parallel state along the X axis direction over the region B (B in FIG. 33) in which two discharge nozzles 466 of a single ink jet head 421 are positioned upon a straight line in the X axis direction. Furthermore, the region A of a head device 433 which defines one row in which only one discharge nozzle 466 is positioned upon the straight line in the X axis direction, and the region A of a head device 433 which defines the other row in which only one discharge nozzle 466 is positioned upon the straight line in the X axis direction, are positioned in a state of being mutually parallel in the X axis direction, while, with an ink jet head 421 of one row, and an ink jet head 421 of the other row, the situation is that a total of two discharge nozzles 466 are positioned upon a straight line in the X axis direction.

In other words, over the region in which the ink jet heads 421 are arranged, they are arranged in a staggered manner (mutually differing) in two rows, so that, in whatever position, without any doubt, a total of two of the nozzles 466 are positioned upon any line in the X axis direction. It should be understood that the nozzles 466 in the regions XX in which the nozzles 466 do not discharge filter element material 13 are not counted as being included in the count of two nozzles 466 upon any straight line in the X axis direction.

In this manner, with regard to the X axis direction along which main scanning is performed, two of the nozzles 466 which actually discharge ink are positioned upon a fictitious straight line which extends along the scanning direction (the straight line itself is not something which actually exists); and, as will be described hereinafter, ink comes to be discharged upon a single spot from both of these two nozzles 466. If a single element is built up in this manner by discharge from several different ones of the nozzles 466, undesirable deviations of discharge between the various ones of the nozzles 466 are dispersed, and it becomes possible to anticipate an evening of the characteristic between the various elements and an enhancement of yield, since, when a single element is built up by discharge from only a single nozzle 466, undesirable deviations in the discharge amounts between different ones of the various nozzles 466 are linked with undesirable deviations in the characteristics of the elements and with a deterioration in the yield.

Furthermore, according to this type of arrangement of a plurality of ink jet heads 421, in the situation in which a plurality of ink jet heads 421 are arranged so as to position a plurality of discharge nozzles 466 upon a plurality of straight lines which are hypothesized along the main scanning direction, since this array of nozzles 466 becomes substantially continuous when the array of nozzles 466 is viewed along a direction perpendicular to the scanning direction, accordingly it is possible to perform the same type of liquid drop discharge as when manufacturing and using an ink jet head 421 of substantially a longitudinal dimension.

It should be understood that it is possible to perform scanning of such a discharge device in which a plurality of ink jet heads 421 are carried according to any of the scanning methods shown and described above with reference to FIGS. 1 through 5 (apart from whether or not the heads are slanted).

Figure 34A:
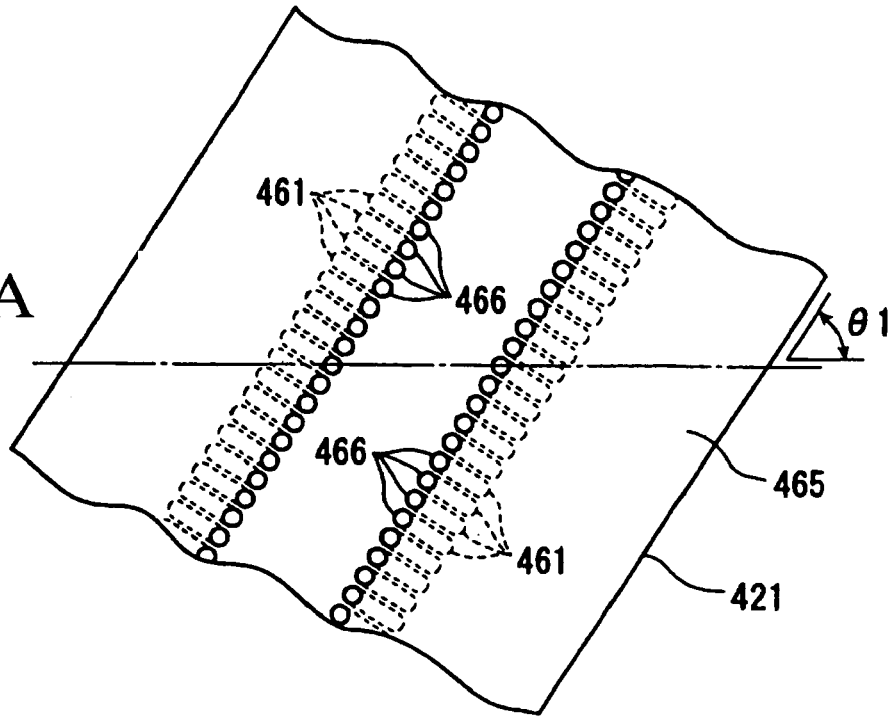
FIGS. 34(A)-34(B) are plan views showing the opening state of the nozzle when the inclination angle with respect to the relative shift direction of the same ink jet head is different.
Figure 34B:
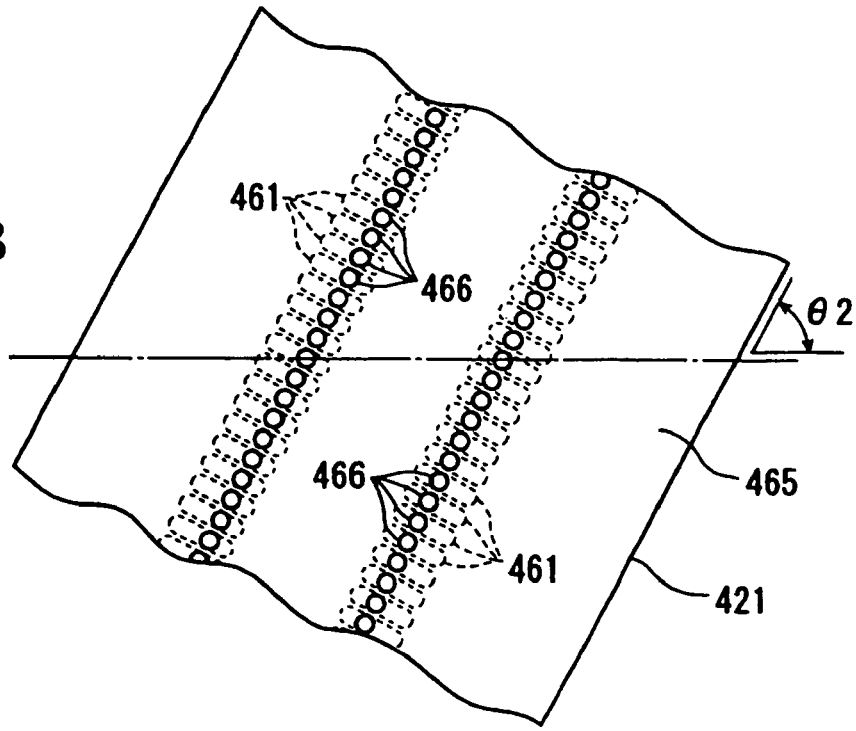

It should be understood that, when arranging this ink jet head 421, as shown in FIG. 34, the ink jet head 421 is in the situation in which it is inclined at the predetermined angle θ1 shown in FIG. 34(*a*) with respect to the main scanning direction X, or is inclined at the predetermined angle θ2 shown in FIG. 34(*b*), so that the pitch of the nozzles 466 along the widthwise scanning direction Y which is the direction perpendicular to the main scanning direction X which is the shifting direction of the head unit 420 relative to the motherboard 12 during painting, becomes equal to the pitch between the elements in the widthwise scanning direction Y of the filter element formation regions 7 which are being painted. In this state, a nozzle plate 465 is utilized in which openings are formed in the regions which correspond to the opening regions of the nozzle grooves 461 from side to side, i.e. in the state in which a plurality of the nozzles 466, in other words two, which is the number of the rows of the nozzles 466, are positioned upon a straight line extending along the main scanning direction X.

Structure of the Ink Supply Section

The ink supply section 431, as shown in FIGS. 24 through 27, comprises a pair of planar fitting plates 471 which are provided to correspond to the two rows of the head main body portions 430 respectively, and a plurality of supply main body portions 472 which are fitted to these fitting plates 471. And the supply main body portions 472 comprise reciprocating portions 474 which are generally shaped as thin cylinders. These reciprocating portions 474 are fitted with a fitting jig 473 so as to pass through the fitting plates 471 and so as to be shiftable along their axial directions. Furthermore, the reciprocating portions 474 of the supply main body portion 472 are fitted so as to be biased in the direction to shift away from the fitting plate 471 towards the head device 433 by, for example, coil springs 475 or the like. It should be understood that, in FIG. 24, only one of the two rows of head devices 433 is shown in the ink supply section 431, while the other of said rows of head devices 433 is omitted for the convenience of explanation.

Flange portions 476 are provided at the ends of these reciprocating portions 474 which oppose the head device 433. These flange portions 476 project like brims from the outer peripheral edges of the reciprocating portions 474, and their end surfaces contact against the seal members 449 of the ink supply section 443 of the head device 433, and are impelled by the biasing action of the coil springs 475 so that they form a substantially liquid tight seal thereagainst. Furthermore, joint portions 477 are provided at the opposite end portions of the reciprocating portions 474 to the ends where the flange portions 476 are provided. These joint portions 477 are connected to the one ends of supply conduits 478 which conduct flows of filter element material 13, as schematically shown in FIG. 23.

These supply conduits 478, as described above and as schematically shown in FIG. 23, are connected to the widthwise scanning drive device 427 so as not to influence the shifting of the head unit 420, and, as schematically shown by the single dotted broken lines in FIGS. 24 and 26, they are arranged from the widthwise scanning drive device 427 roughly centrally between the ink supply sections 431 which are arranged in two rows upon the head unit 420, and furthermore their tip ends radiate out from the pipe-work and are connected to the joint portions 477 of the ink supply sections 431.

And the ink supply sections 431 supply filter element material 13 which is conducted via the supply conduits 478 to the ink supply sections 443 of the head devices 433. Furthermore, the filter element material 13 which is supplied to the ink supply sections 443 is supplied to the ink jet heads 421, is discharged in the form of appropriate liquid drops from each of the nozzles 466 of the ink jet heads 421, according to electrical control.

Operation of Manufacture of the Color Filter

Preparatory Processing

Figure 36:
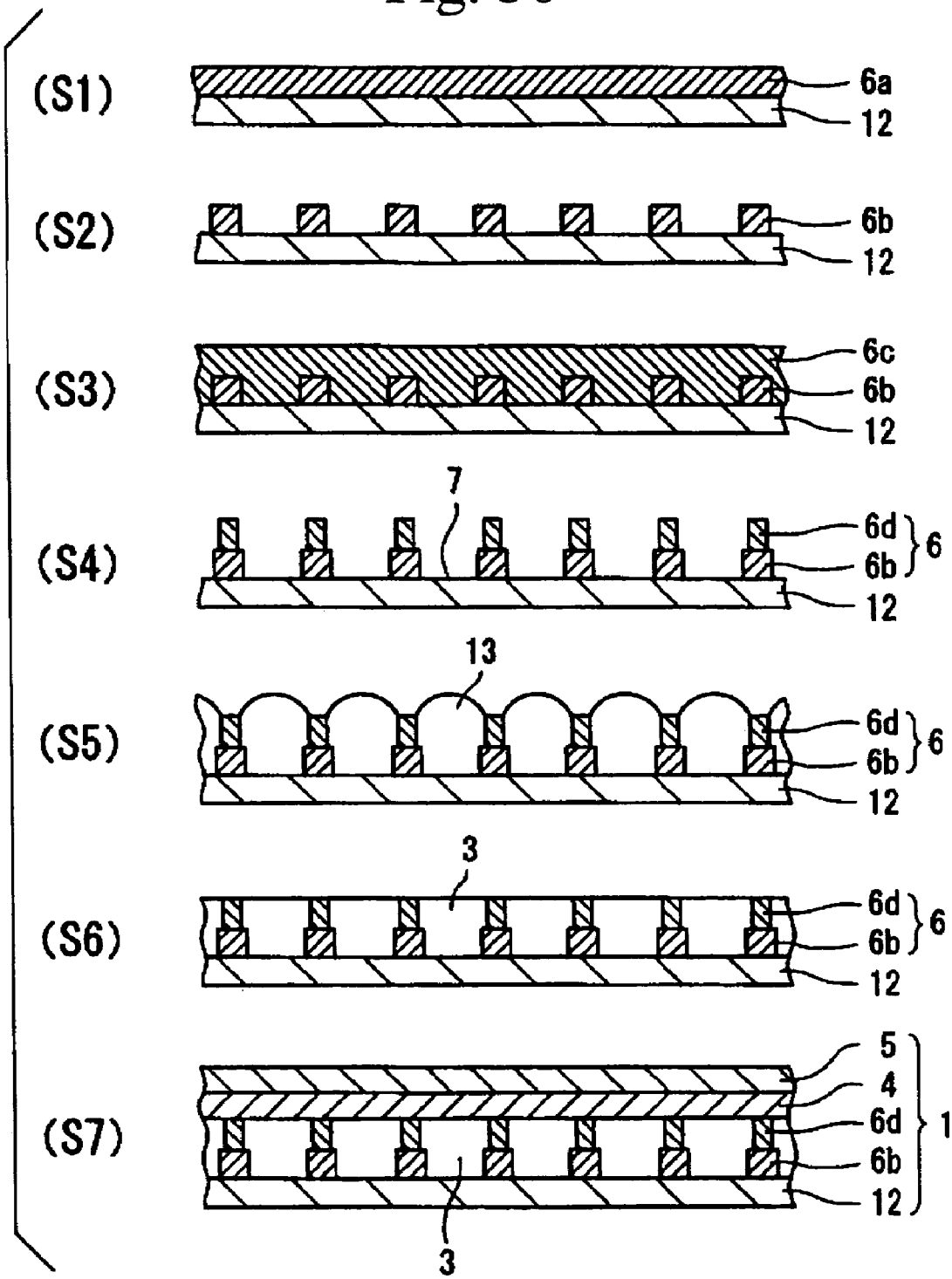
FIG. 36 is a manufacturing process sectional view for explanation of the procedure for manufacturing this color filter.

Next, the operation of manufacturing a color filter 1 using the above described device for manufacture of a color filter according to the above described preferred embodiment of the present invention will be explained with reference to the drawings. FIG. 36 is a manufacturing process sectional view for explanation of the procedure of manufacture of the color filter 1, using the above described device for manufacture of a color filter according to this preferred embodiment.

First the surface of a motherboard 12, which is a transparent substrate plate made from non-alkaline glass of dimensions, for example, 0.7 mm thick, 38 cm high, and 30 cm wide, is cleaned with a cleaning fluid which is 1% by mass of hydrogen peroxide added to hot sulfuric acid. After this cleaning, the plate is rinsed with water and dried in air, so that a clean surface is obtained. A chromium layer of average thickness 0.2 μm is formed upon the surface of this motherboard 12 (in a procedure S1 in FIG. 36) by, for example, a spattering method, so as to obtain a metallic layer 6*a*. After drying this motherboard 12 upon a hot plate at a temperature of 80 degree Celsius is for five minutes, a layer of photo-resist not shown in the figures is formed upon the metallic layer 6*a* by, for example, spin coating. A mask film not shown in the figures upon which is painted, for example, a required matrix pattern is adhered upon the surface of this motherboard 12, and the whole is then exposed to ultraviolet light. Next, this motherboard 12 which has been thus exposed is immersed in, for example, an alkaline developing fluid which contains 8% by mass of potassium oxide, and the non-exposed portion of the photo-resist is thereby eliminated, so that the resist layer is patterned. Next, the exposed portion of the metallic layer 6*a* is removed by etching with an etching liquid of which, for example, the main component is hydrochloric acid. By doing this, a reticulated light interception layer 6*b* is obtained (in a procedure S2 in FIG. 36); this layer 6*b* is in the form of a black matrix having the predetermined matrix pattern. It should be understood that the thickness of this light interception layer 6*b* is about 0.2 μm, while the widthwise dimension of the strands which make up this light interception layer 6*b* is about 22 μm.

Next, a negative type transparent acrylic type light sensitive resin composition material layer 6*c* is formed upon the motherboard 12 equipped with this light interception layer 6*b* by, for example, a spin coating method or the like (in a procedure S3 in FIG. 36). After pre-baking the motherboard 12 equipped with this light sensitive resin composition material layer 6*c* at a temperature of 100 degree Celsius for a period of 20 minutes, it is exposed to ultraviolet light using a mask film not shown in the figures which is painted thereon in the form of a matrix pattern. And the non exposed portion of the resin is developed by, for example, an alkaline developing fluid like the type described above, and, after the work-piece has been rinsed with pure water, it is spin dried. After-baking is then performed at, for example, a temperature of 200 degree Celsius for a period of 30 minutes, and thereby, when the resin portion has been sufficiently cured, a reticulated bank layer 6*d* is formed. The thickness of this bank layer 6*d* may be, for example, an average of 2.7 μm, and the widthwise dimension of the strands which make it up may be, for example, about 14 μm. The division walls 6 are constituted (in a procedure S4 in FIG. 36) by this bank layer 6*d* and the light interception layer 6*b*.

Next the work-piece is processed with dry etching, in other words with plasma processing, in order to improve the wettability by ink of the filter element formation regions 7 (and particularly of the exposed surfaces of the motherboard 12), which are the regions, destined for adhesion of a color filter material layer, into which the motherboard has been compartmented by the light interception layer 6*b* and the bank layer 6*d* which have been produced as described above. In concrete terms, the preliminary processing process of the motherboard 12 is completed by forming a plasma processing etching spot in which a high voltage is applied in a mixture gas consisting, for example, of helium with a 20% admixture of oxygen, and by passing the motherboard 12 through this etching spot which has been formed and etching it.

Discharge of the Filter Element Material

Next, filter element material 13 of each of the colors red (R), green (G), and blue (B) is fed by an ink jet method into the filter element formation regions 7 which have been defined by the division walls 6 by dividing up the motherboard 12 by the above described preliminary processing which has been thus performed; in other words, ink is discharged into these regions 7 (in a procedure S5 in FIG. 36).

When discharging this filter element material 13 by this ink jet method, the head unit 420 comprising the predetermined nozzle plate 465 of the above described specification is made and assembled in advance. And, in the liquid drop discharge devices of each of the liquid drop discharge processing devices 405R, 405G, and 405B, the discharge amount of the filter element material 13 which is discharged from a single one of the nozzles 466 of each of the ink jet heads 421 is adjusted to a predetermined amount, for example approximately 10 pl. On the other hand, the division walls 6 are formed in advance upon the one surface of the motherboard 12 in a lattice pattern.

And, first, the motherboard 12 which has been subjected to the above described preliminary processing is transported by a transport robot not shown in the figures to the interior of the liquid drop discharge processing device 405R for R color ink, and is placed upon the pedestal portion within this liquid drop discharge processing device 405R. The motherboard 12 is then fixed in position upon this pedestal portion by, for example, suction, so that its position is positively determined. And the position of the motherboard 12 held upon the pedestal portion is checked with various cameras and the like, and it is shifted by the main scanning drive device 425 and is controlled so as to be regulated to a suitable predetermined position. Furthermore, the head unit is suitably shifted by the widthwise scanning drive device 427, and its position is detected. After this, the head unit 420 is shifted in the widthwise scanning direction, and the discharge state of from the nozzles 466 is detected with the dot missing detection unit 487, and if it is detected that no improper discharge state is occurring, the head unit 420 is shifted into its initial position.

After this, the motherboard 12 is scanned in the X direction by the main scanning drive device 425 while being held upon the movable pedestal portion, and appropriate filter element material 13 is discharged from predetermined ones of the nozzles 466 of suitable ones of the ink jet heads 421 while shifting the head unit 420 relative to the motherboard 12, and is filled into the concave portions into which the motherboard 12 has been compartmented by the division walls 6. This discharge from the nozzles 466 is controlled by a control device not shown in the figures, so as not to discharge filter element material 13 from the nozzles 466 which are positioned in a predetermined region X at both end portions in the direction in which the nozzles 466 shown in FIG. 32 are arranged, for example from the 10 nozzles 466 at each end of this row arrangement, while on the other hand a comparatively uniform amount of the filter element material 13 is discharged from the 160 nozzles 466 (for example) which are positioned at the central portion of this row arrangement.

Furthermore, since two of the discharges from the nozzles 466 are positioned upon a straight line in the scanning direction, in other words, since two of the nozzles 466 are positioned upon a single scanning line, and since, during shifting, two dots—in more detail, two liquid drops of filter material 13 as one dot from a single nozzle 466—are discharged into a single concave portion (a single filter element formation region 7), accordingly a total of eight liquid drops are thus discharged. The state of discharge during each single episode of shifting scanning is detected by the dot missing detection unit 487, and it is checked that no missing of dots is taking place.

If the occurrence of dot missing is detected, the head unit 420 is shifted by a predetermined amount in the widthwise scanning direction, and the operation of discharging filter element material 13 is again repeated while shifting the pedestal portion which is holding the motherboard 12, so as to form the filter elements 3 in the predetermined filter element formation regions 7 of the predetermined color filter formation regions 11.

Drying and Curing

And, the motherboard 12 upon which the R color filter element material 13 has been discharged is taken out from the liquid drop discharge processing device 405R by a transport robot not shown in the figures, and then is put into a multi stage baking furnace also not shown in the figures, in which the filter element material is dried by, for example, heating the motherboard 12 up to 120 degree Celsius for five minutes. After this drying, the motherboard 12 is taken out from the multi stage baking furnace by a transport robot, and is transported while it cools down. After this, the motherboard is transported from the liquid drop discharge processing device 405R in order to a liquid drop discharge processing device 405G for G color filter element material 13, and then to a liquid drop discharge processing device 405B for B color filter element material 13, and therein G colored and B colored filter element material 13 is discharged in order into the predetermined filter element formation regions 7, in the same manner as was done for making the R colored filter portions. And the motherboard 12 upon which these three colors of filter element material 13 have been discharged, and which has been dried, is recovered and is subjected to heat processing, in other words is heated up so that the filter element material 13 is hardened and is better adhered (in a procedure S6 in FIG. 36).

Manufacture of the Color Filter

After this, a protective layer 4 is formed over substantially the entire surface of the motherboard 12 upon which the filter element 3 has been formed as described above. Furthermore, an electrode layer 5 made from ITO (Indium Tin Oxide) is formed in an appropriate pattern upon the upper surface of this protective layer 4. After this the motherboard is broken apart into the individual separate color filter formation regions 11, so as to form a plurality of color filters 1 (in a procedure S7 in FIG. 36). As has been explained in connection with previously described embodiments of the present invention, each of these substrate plates upon which a color filter 1 has been formed is utilized as one of the substrate plates for a liquid crystal device like the one shown in FIG. 19.

Effects of the Device For Manufacture of the Color Filter

According to this preferred embodiment shown in FIGS. 23 through 35, in addition to the beneficial operational effects which were obtained with the various previously explained preferred embodiments, the further beneficial operational effects now to be described are experienced.

In detail, the ink jet heads 421, upon one surface of which are arranged the plurality of nozzles 466 from which the filter element material 13, for example ink, which is a liquid mass which has a certain flowability, are shifted relatively to the motherboard 12, which constitutes an object against which liquid drops are to be discharged, so as to follow along its surface, in a state in which the surfaces of the ink jet heads 421 in which the nozzles 466 are provided are opposed to the surface of the motherboard 12 with a predetermined gap being present between them, and filter element material 13 is discharged from a plurality, for example from two, of the nozzles 466 which are positioned upon the same straight line which extends along this relative shifting direction. According to this, a structure is obtained which discharges filter element material 13 from two different nozzles in a superimposed manner, so that, even if hypothetically undesirable deviations are present in the discharge amounts between different ones of the plurality of nozzles 466, it is possible to average out the discharge amounts of the filter element material 13 which are discharged, and to prevent undesirable deviations of the total thereof, so that an even and uniform discharge for the color filter element is obtained, and it is possible to obtain an electro optical device which has a uniform and desirable characteristic with regard to the quality of all the color filter elements of the same color.

Furthermore, since the filter element material 13 is discharged from the nozzles 466 of a plurality of ink jet heads 421 which are positioned upon a hypothetical straight line along the relative shift direction, in the same manner, a structure is obtained which discharges filter element material 13 from two different nozzles in a superimposed manner, so that it is possible to flatten out and to prevent any undesirable deviations which may be present in the discharge amounts between different ones of the plurality of nozzles 466, and accordingly it is possible to obtain an electro optical device which has a uniform and desirable characteristic.

And since the longitudinal direction along which the nozzles 466 are provided in the plurality of rows, for example the two rows, of the ink jet heads 421, is inclined with respect to the relative shift direction, and moreover they are arranged mutually differently, and, in the regions in which the ink jet heads 421 are arranged, they are disposed so that, without fail, two of the nozzles are positioned there, accordingly a structure is reliably obtained with which ink can be discharged from the above described two different nozzles 466 in the region in which the ink jet heads are arranged so as to be superimposed upon the same position.

Furthermore, the ink jet heads 421 in which the nozzles 466 which discharge filter element material 13 are provided on a single surface upon a plurality of substantially straight lines, and this surface is shifted relatively along the surface of the motherboard 12 while maintaining the state in which a predetermined gap is kept between said surface upon which these nozzles 466 of the ink jet heads 421 are arranged and the surface of the motherboard 12, which is the object against which the liquid drops are to be discharged, and the filter element material 13 is discharged against the surface of the motherboard 12 from the nozzles which are positioned in the central portions of the rows, excluding the predetermined regions XX, in other words without discharging any filter element material from, for example, those ten nozzles 466 (the non discharge nozzles), among all the nozzles 466 of the ink jet heads 421, which are positioned in the predetermined regions XX at both ends of the direction in which these nozzles 466 are arranged. Since with this structure the filter element material 13 is discharged using the nozzles 466 in the central portion of each row where the discharge amounts are comparatively uniform, without discharging any liquid drops from the ten nozzles 466 at each end of each row, which are the predetermined regions positioned at both ends of the direction in which the nozzles 466 are arranged from which the discharge amounts would become particularly great, accordingly it is possible to discharge the filter element material against the surface of the motherboard 12 evenly and uniformly, and a uniform color filter 1 is obtained of an even quality, so that a desirable display is obtained from the resulting display device which is an electro optical device, using this color filter 1.

And, since no filter element material 13 is discharged from those nozzles 466 for which, if such discharge were to be performed, the discharge amounts would be more than about 10% greater than the average value of discharge amount of filter material, accordingly, even in the particular cases of using, as the liquid mass, a functional liquid mass of filter element material 13 for a color filter 1, or electro-luminescent material, or one including electrically charged grains for use in an electrical migration device or the like, no undesirable deviations occur in the performance characteristics, and it is possible reliably to obtain the desired characteristic for the electro optical device such as an electro-luminescent device or a liquid crystal device.

Furthermore, since the filter element material 13 is discharged from the various nozzles 466 in amounts which vary within ±10% of the average value, accordingly the discharge amounts are comparatively uniform, and the discharge upon the surface of the motherboard 12 is flat and uniform, so that it is possible to obtain an electro optical device whose characteristic is a desirable one.

And, by using ink jet heads 421 whose nozzles 466 are arranged upon a straight line at approximately equal intervals, it is possible easily to paint a structure upon the motherboard 12 according to any predetermined standard pattern, such as, for example, a stripe type pattern, a mosaic type pattern, a delta type pattern, or the like.

Furthermore since, with this structure of the ink jet heads 421 in which their nozzles 466 are arranged upon a straight line at approximately equal intervals, the nozzles 466 are provided at approximately equal intervals along the longitudinal directions of the ink jet heads 421 which are formed as elongated rectangles, accordingly it is possible to make the ink jet heads 421 more compact, and, since interference between adjacent portions of each ink jet head 421 and the neighboring ink jet head 421 is prevented, accordingly this size reduction can be performed easily.

Yet further, since the ink jet heads 421 are relatively shifted in a direction which intersects the direction in which the nozzles 466 are arranged in a state in which the direction of arrangement of the nozzles 466 is inclined to the shifting direction, accordingly the pitch between the elements, which is the interval at which the filter element material 13 is discharged, comes to be narrower than the pitch between the nozzles 466, so that, only by setting the state of inclination suitably, it is easily possible to make the pitch between the elements which is anticipated when discharging the filter element material 13 against the surface of the motherboard 12 in a dot pattern correspond to the desired such pitch, and it is no longer necessary to make the ink jet heads 421 in correspondence to the pitch between the elements, so that the general applicability is enhanced.

And, the plurality of ink jet heads 421 to which the plurality of nozzles 466 which discharge filter element material 13, for example ink, as a liquid mass which has a certain flowability are provided upon a single surface are relatively shifted along the surface of the motherboard 12 in a state in which the surface in which these nozzles 466 of the ink jet heads 421 are provided is opposed to the surface of the motherboard 12, which is the object against which liquid drops are to be discharged, with a predetermined gap being left therebetween, and the same filter element material 13 is discharged against the surface of the motherboard 12 from each of the nozzles 466 of the plurality of ink jet heads 421. Due to this, it becomes possible to discharge the filter element material 13 over a wide range by using ink jet heads 421 which have, for example, the same number of nozzles 466, and which are of the same specification, so that there is no requirement to use an ink jet head of a special longitudinal dimension, and accordingly it is possible to avoid using components of a plurality of different specifications, as was the case with the prior art, so that it is possible to lower the overall cost.

Furthermore, by for example appropriately setting the number of the ink jet heads 421 which are arranged along the direction in which they are provided, it becomes possible to make them correspond to the region over which the filter element material 13 is to be discharged, and accordingly it becomes possible to enhance the wideness of applicability. It is possible to reduce the cost by being able to substitute the use of the present invention for the use of components of a plurality of different specifications, as was the case with the prior art, because it is not necessary to use a special ink jet head of a special longitudinal (lengthwise) dimension. Since the manufacturing yield factor for an ink jet head which has a large lengthwise dimension is extremely low, and accordingly such a product becomes expensive, which is undesirable, while by comparison the manufacturing yield factor for an ink jet head which has a short lengthwise dimension is good, therefore with the present invention it is possible greatly to reduce the cost, because it is only necessary to use a plurality thereof, in order to obtain an ink jet head of substantially the required longitudinal dimension.

Yet further, by suitably setting, for example, the direction of arrangement of the array of ink jet heads 421 which are disposed in a row and the number thereof, and the number of the nozzles which are used for discharge and the interval between them (it is also possible to adjust to the pitch of the picture elements by using alternate nozzles, or only one nozzle in every n), it becomes possible to make them correspond to the regions upon which the filter element material 13 is to be discharged, even in the case of color filters which have different size or different picture element pitch or arrangement, and accordingly it is possible to enhance the universality of application. Furthermore, because no increase in the size of the row of ink jet heads or in the size of the carriage which holds them is involved since the ink jet head is inclined and is arranged so as to extend in a direction which intersects the main scanning direction, accordingly it is also possible to manage without increase in the overall size of the liquid drop discharge device.

Furthermore, since a plurality of ink jet heads 421 are provided, accordingly, even in the case, for example, that the region upon the motherboard 12 upon which the filter element material 13 is to be discharged is quite wide, or that it is necessary to discharge the filter material 13 several times upon the same spot in a superimposed manner, or the like, it is not necessary to shift the ink jet head 421 a plurality of times, and furthermore it is also not necessary to manufacture a special ink jet head, so that it is possible to discharge the filter element material 13 easily with a simple structure. Moreover, since the individual ink jet heads 421 are in a state of being individually inclined although the carriage 426 is not inclined as a whole, accordingly the distance from the nozzles 466 which are on the near side of the motherboard 12 to the nozzles 466 which are on the far side of the motherboard 12 is small as compared to the case in which the carriage 426 as a whole is inclined, so that it is possible to shorten the time period which is required for scanning, i.e. for shifting along the motherboard 12 with the carriage 426.

Even further, by utilizing components of the same format which have the same number of nozzles for the plurality of ink jet heads 421, by suitably arranging them, it becomes possible to make them correspond to the region over which the liquid mass is to be discharged, even though only a single type of ink jet head 421 is used, so that the structure is simplified, the manufacturability is enhanced, and also it is possible to reduce the cost.

Moreover, since the head unit 420 is made with the plurality of ink jet heads 421 arranged in the carriage 426 in the state in which all the respective arrangement directions of the nozzles 466 are roughly parallel to one another, accordingly, if for example the directions in which the nozzles 466 are arranged are substantially parallel, the region in which the nozzles 466 are arranged becomes wider, it becomes possible to discharge the filter element material 13 over a wider range, and the discharge efficiency is enhanced; and, further, if they are arranged so as to be parallel along the direction of shifting of the ink jet heads 421, it becomes possible to discharge the filter element material 13 from the different ink jet heads 421 upon a single spot in a superimposed manner, and it is possible easily to make the discharge amounts in the discharge region uniform, so that it is possible to obtain a desirably stabilized painting process.

And, because each of the plurality of ink jet heads 421 is inclined in a direction which intersects the main scanning direction, and moreover they are provided as being arranged in rows in a direction which is different from the longitudinal direction of the ink jet heads 421 so that the direction in which all of the nozzles 466 are arranged are mutually parallel, thereby the pitch between elements, in other words the interval between discharges of the filter element material 13, becomes shorter than the pitch between the nozzles, and, if for example the motherboard 12 against which the filter element material 13 is to be discharged is to be utilized as a display device or the like, it becomes possible to manufacture a finer display. Yet further, it is possible to prevent interference between neighboring ones of the ink jet heads 421, and accordingly a reduction in size can be anticipated. And, moreover, by suitably setting this inclination angle, it is possible suitably to set the pitch in which the dots are painted, so that it is possible to enhance the universality of applicability.

Furthermore, since the plurality of ink jet heads 421 are arranged in a plurality of rows, for example in two rows, which are mutually different (roughly in staggered form), accordingly it is not necessary to manufacture any special ink jet head having a special or a very long lengthwise dimension, and, even if ink jet heads 421 are used which are pre-existing components, not only do neighboring ink jet heads 421 not interfere with one another, but regions do not occur between ink jet heads 421 in which no filter element material 13 is discharged, and accordingly it becomes possible to discharge the filter element material continuously in a suitable manner, in other words to perform continuous painting.

Yet further, since the dot missing detection unit 487 is provided and detects the quality of the discharge of the filter element material 13 from the nozzles 466, accordingly it is possible to prevent mura in the discharge of the filter element material 13, and it becomes possible to discharge the filter element material accurately in a desirable manner, in other words to perform high quality painting.

And, since an optical sensor is provided to the dot missing detection unit 487, and the passage of the filter element material 13 in a direction which intersects the proper discharge direction for the filter element material 13 is detected by this optical sensor, accordingly it is possible to detect the state of discharge of the filter element material 13 accurately with a simple structure, and it becomes possible to prevent mura in the discharge of the filter element material 13, so that it becomes possible to discharge the filter element material accurately in a desirable manner, in other words to perform high quality painting.

Moreover, since the discharge situation is detected by the dot missing detection unit 487 both before and after the process of discharging the filter element material 13 from the nozzles 466 against the motherboard 12, accordingly it is possible to detect the state of discharge directly before and directly after the discharge of the filter element material 13 for painting, and thus the state of discharge is accurately detected, and it becomes possible to obtain a desirable quality of painting by accurately preventing the occurrence of dot missings. It should be understood that it would also, as an alternative, be acceptable to perform detection of the state of discharge only at a time point before, or only at a time point after, the actual discharge for painting the motherboard 12.

Furthermore, since the dot missing detection unit 487 is provided on the main scanning direction side of the head unit 420, accordingly it becomes possible to reduce the shifting distance of the head unit 420 due to the detection of the discharge state of the filter element material 13, and moreover it is possible to keep the shifting along the main scanning direction for discharge just as it is with a simple structure, and it is possible to detect dot missings at high efficiency with a simple structure.

And, since two of the ink jet heads 421 are provided in a point symmetric manner, accordingly it is possible to collect together all of the supply conduits 478 which supply the filter element material in the vicinity of the head unit 420, so that assembly and maintenance of the device can be performed easily. Also, the connection of the electrical connecting wires 442 for controlling the ink jet heads 421 is enabled to be from both sides of the head unit 420, so that it is possible to prevent the influence of electrical noise due to these electrical connecting wires 442, and accordingly it is possible to obtain a stabilized painting process, as is desirable.

Yet further, since the plurality of ink jet heads 421 are arranged at one side of the print substrate plate in the uncharged state, and the connectors 441 are provided at the other side thereof, thereby, even though the heads 421 are arranged upon a plurality of straight lines, it is possible to arrange them so that the connectors 441 do not interfere with one another, and accordingly, along with it being possible to make the structure more compact, it is also possible to obtain a continuous array of nozzles 466 in which there is no position along the main scanning direction in which none of the nozzles 466 are present, so that it is not necessary to utilize an ink jet head which is specially long.

And, since the connectors 441 are arranged so as to positioned upon opposite sides in a point symmetrical manner, it is possible to prevent any influence of electrical noise upon the portion including the connectors 441, and accordingly it is possible to obtain a stabilized painting process, as is desirable.

On the other hand, when the longitudinal direction of the nozzle main bodies 464 is inclined at a predetermined angle with respect to the scanning direction X, since the nozzle plate 465 is formed so that the plurality of nozzles 466 are positioned upon a straight line along the scanning direction X in the state in which the pitch between the nozzles in the widthwise scanning direction Y, which is the direction perpendicular to the scanning direction X which is the relative shift direction of relative shifting along the surface of the motherboard 12, becomes the same interval as the pitch between the elements in the widthwise scanning direction Y of the filter element formation regions 7 which are positioned in a dot pattern upon the surface of the motherboard 12 against which the filter element material 13 is to be discharged, accordingly, even if it is inclined to correspond to the pitch between the filter elements 3 which are to be painted in a dot pattern upon the surface of the motherboard 12, it is possible to use the nozzle main body 464 in common, only by selecting and using a predetermined nozzle plate 465 which corresponds to the position of the two nozzles 466, of which a plurality are upon a straight line which extends along the scanning direction X, and accordingly it becomes unnecessary to manufacture individual ink jet heads 421 to correspond to different painting tasks, so that the cost can be reduced.

It should be understood that the same corresponding beneficial operational results are offered with these preferred embodiments, as with the various above described preferred embodiments, if they have the same structure.

A Preferred Embodiment Related to a Method of Manufacture of an Electro Optical Device Which Uses an Electroluminescent Element Next, a method of manufacture of an electro optical device according to the present invention will be explained with reference to the drawings. It should be understood that, as such an electro optical device, an active matrix type display device which utilizes an electro-luminescent display element will be explained. Moreover, before explaining the method of manufacture of this display device, the structure of the display device which is to be manufactured will be explained.

Structure of the Display Device

Figure 37:
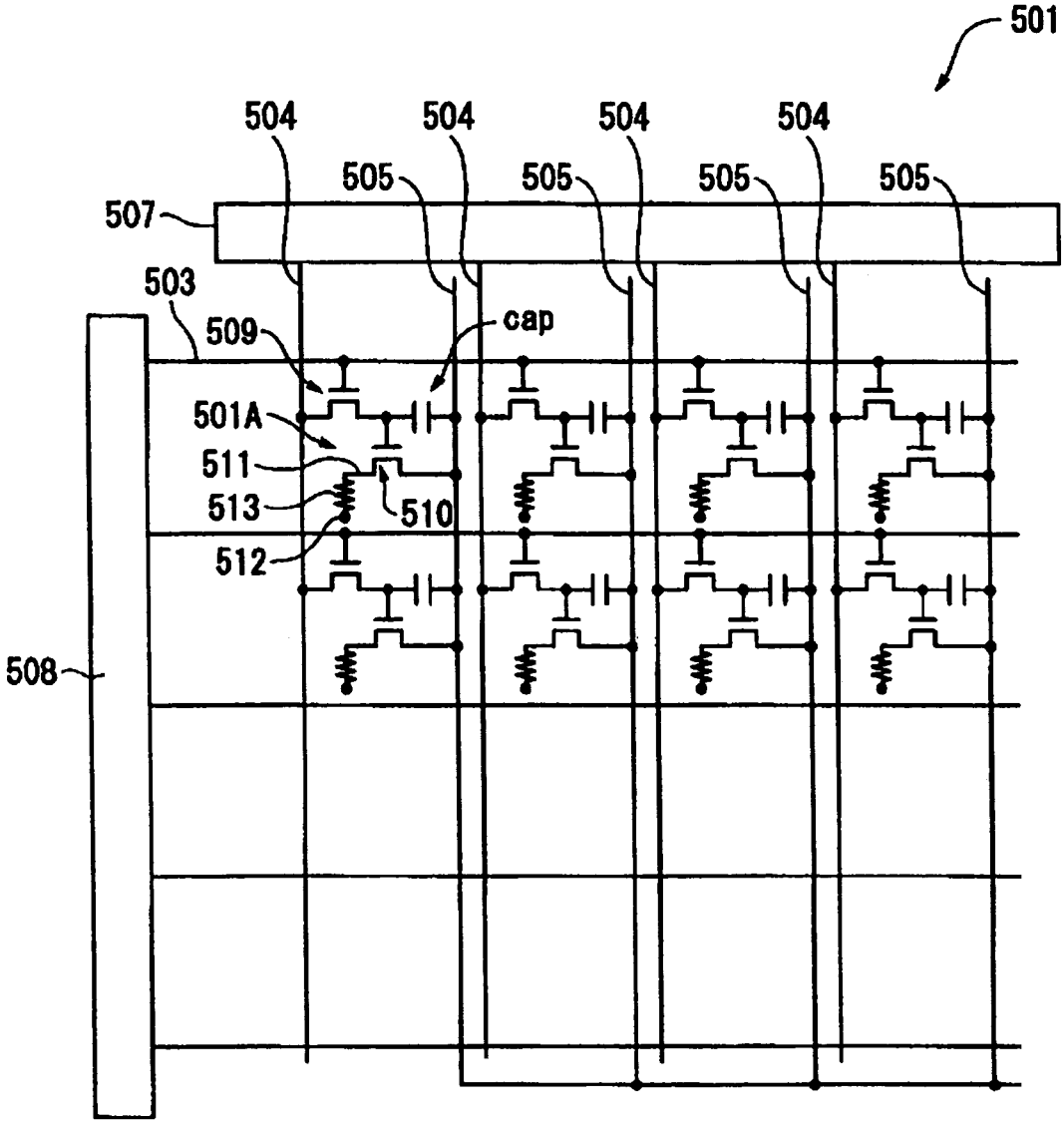
FIG. 37 is a circuit diagram showing one portion of a display device which employs an electro-luminescent display element which is an electro optical device according to the present invention.
Figure 38:
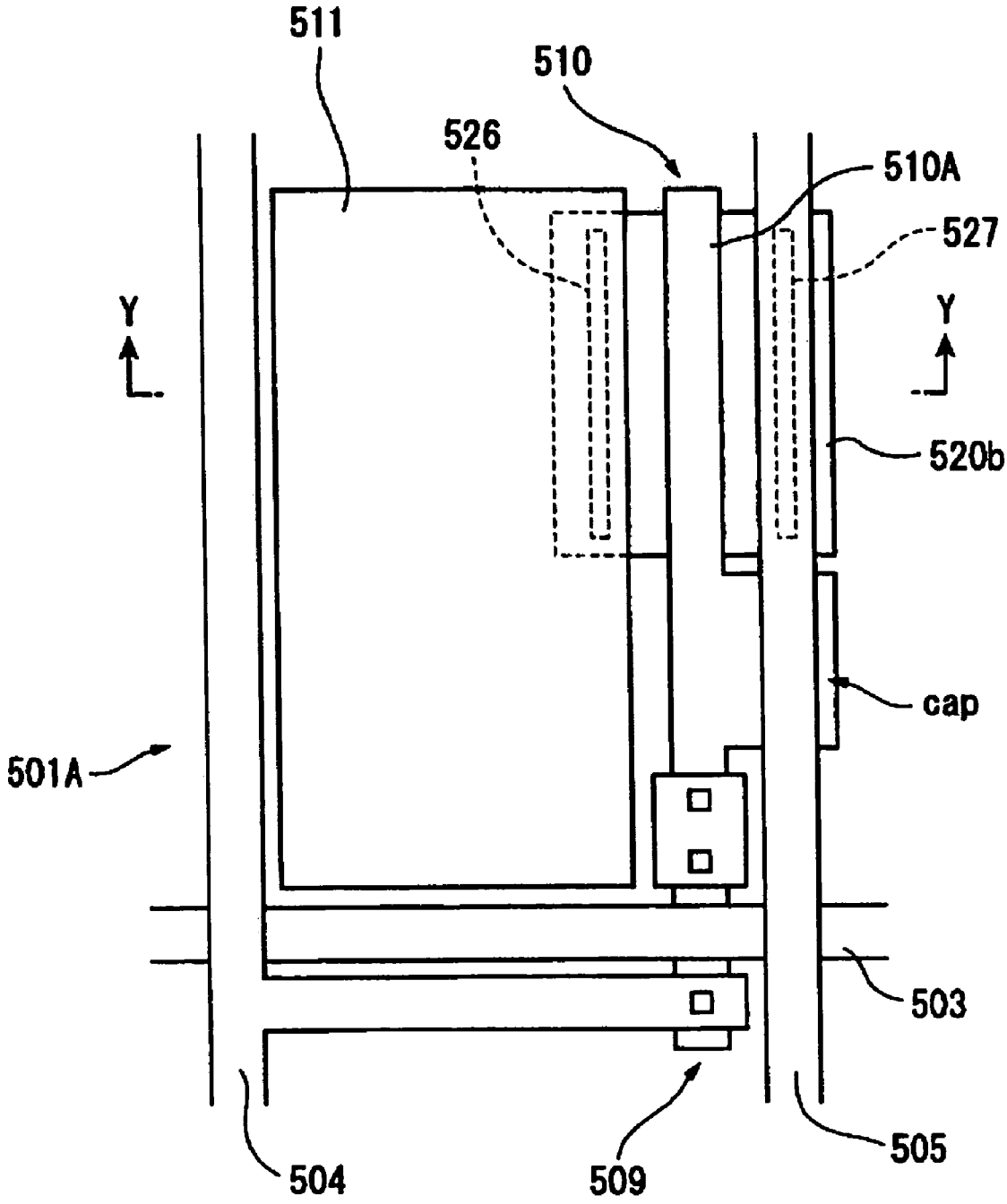
FIG. 38 is a magnified plan view showing the planar structure of a picture element region of the same display device.

FIG. 37 is a circuit diagram showing one portion of an organic electro-luminescent device made by a device for manufacturing an electro optical device according to the present invention. And FIG. 38 is a magnified plan view showing the planar structure of one picture element region of this display device.

In detail, referring to FIG. 37, the reference symbol 501 denotes a display device of the active matrix type which employs an electro-luminescent display element which is an organic electro-luminescent device; and this display device 501 comprises, upon a transparent display substrate plate 502 which functions as a substrate plate, a plurality of scan lines 503, a plurality of signal lines 504 which extend in a direction which is transverse to these scan lines 503, a plurality of common power supply lines 505 which extend parallel to these signal lines 504, and connecting wires for all these. And a picture element region 501A is provided at each of the points of intersection of the scan lines 503 and the signal lines 504.

A data side drive circuit 507 is provided for the signal lines 504, and comprises a shift register, a level shifter, a video line, and an analog switch. Furthermore, a scan side drive circuit 508 is provided for the scan lines 503, and comprises a shift register and a level shifter. And each of the picture element regions 501A is provided with a switching thin film transistor 509 which is supplied with a scan signal at its gate electrode via a scan line 503, a capacitor cap which accumulates and holds a picture signal which is supplied from a signal line 504 via this switching thin film transistor 509, a current thin film transistor 510 which is supplied at its gate electrode with the picture signal which has been held by this capacitor cap, a picture element electrode 511 into which drive electrical current flows from a common power supply line 505 when it is electrically connected to the common power supply line 505 via this current thin film transistor 510, and a light emitting element 513 which is sandwiched between this picture element electrode 511 and a reflecting electrode 512.

According to this structure, when the switching thin film transistor 509 which is driven by the scan line 503 is ON, the voltage at this time upon the signal line 504 is held in the capacitor cap. The ON or OFF state of the current thin film transistor 510 is determined according to the state of this capacitor cap. And electrical current flows to the picture element electrode 511 from the common power supply line 505 via the channel of the current thin film transistor 510, and furthermore electrical current flows through the light emitting element 513 to the reflecting electrode 512. By doing this, the light emitting element 513 emits light according to the magnitude of this flow of current.

As shown in FIG. 38 which is a magnified plan view showing the picture element region 501A in a state in which the reflecting electrode 512 and the light emitting element 513 have been removed, the four sides of the rectangular picture element electrode 511, as seen in a planar state, are arranged so as to be surrounded by the signal line 504, the common power supply line 505, the scan line 503, and the scan line 503 for another neighboring picture element electrode 511 not shown in the figure

Process of Manufacture of the Display Device

Next, various procedures of a manufacturing process for manufacture of a display device of the active matrix type using the above described electro-luminescent display element will be explained. FIGS. 39 through 41 are manufacturing process sectional views showing various procedures of a manufacturing process for manufacture of a display device of the active matrix type using the above described electro-luminescent display element. It should be understood that, as a liquid drop discharge device and a scanning method for forming an electro-luminescent layer by the discharge of liquid drops, the same ones may be employed as have already been explained above with reference to other preferred embodiments of the present invention.

Preliminary Processing

Figure 39A:
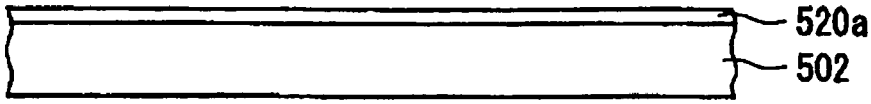
FIGS. 39(A)-39(E) are manufacturing process sectional views showing a procedure for preliminary processing of the process of manufacture of the same display device.

First, as shown in FIG. 39(A), according to requirements, a protective backing layer not shown in the drawings, which consists of a silicon oxide film of thickness dimension about 2000 to 5000 angstroms, is formed upon the transparent display substrate plate 502 by a plasma CVD (Chemical Vapor Deposition) process, using tetraethoxysilane (TEOS) or oxygen gas or the like as source gas. Next, the temperature of the display substrate plate 502 is set to about 350 degree Celsius, and a semiconductor film layer 502*a*, which is an amorphous silicon layer of thickness dimension about 300 to 700 angstroms, is formed upon the surface of the protective backing layer by a plasma CVD method. After this, a crystallization process of laser annealing or a solid growth method or the like is performed upon the semiconductor film 520*a*, so that the semiconductor film 520*a* is crystallized into a poly-silicon layer. Here by laser annealing is meant a process of utilizing, for example, an line beam from an excimer laser of wavelength about 400 nm at an output intensity of about 200 mJ/cm$^2$. With regard to this line beam, the line beam is scanned along its shorter direction so that, for each region, the portions which correspond to about 90% of the peak value of the laser intensity are superimposed.

Figure 39B:
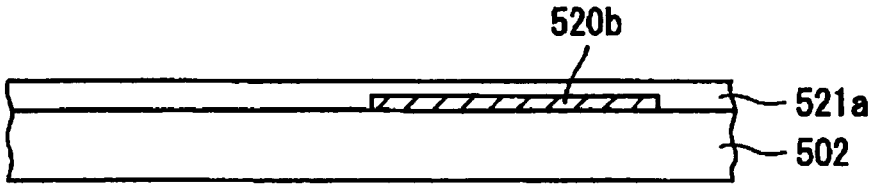

And, as shown in FIG. 39(B), the semiconductor film 520*a* is formed by patterning into a blob shaped semiconductor film 520*b*. A gate insulating layer 521*a* which is a silicon oxide film or a nitrate layer of thickness dimension of about 600 to 1500 angstroms is formed upon the display substrate plate 502 which is provided with this semiconductor film 520*b* by a plasma CVD method, using TEOS or oxygen gas or the like as source gas. It should be understood that, although this semiconductor film 520*b* is the one which will constitute the channel region and the source and drain regions for the current thin film transistor 510, in another sectional position there is also formed a semiconductor film not shown in the figures which will constitute the channel region and the source and drain regions for the switching thin film transistor 509. In other words, although the switching thin film transistor 509 and the current thin film transistor 510 which are of two types are formed at the same time in the manufacturing process shown in FIGS. 39 through 41, nevertheless, in the following explanation, only the formation of the current thin film transistor 510 will be explained, while the explanation of the switching thin film transistor 509 will be curtailed, since it is formed by the same procedure.

Figure 39C:
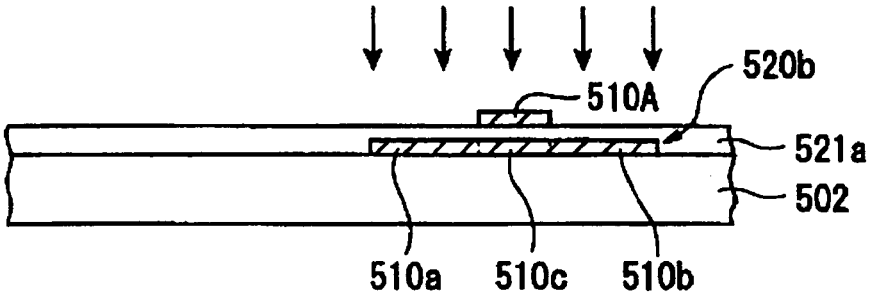

After this, as shown in FIG. 39(C), and after a conductive film, which is a metallic film made from aluminum, tantalum, molybdenum, titanium, tungsten or the like, has been formed by a spattering method, the gate electrode 510A shown in FIG. 38 is formed by patterning. In this state the work-piece is bombarded by phosphorus ions, so as to form upon the semiconductor film 520*b* the source and drain regions 510*a* and 510*b* which mutually match with the gate electrode 510A. It should be understood that the portion into which the impurities have not been introduced constitutes the channel region 510*c*.

Figure 39D:
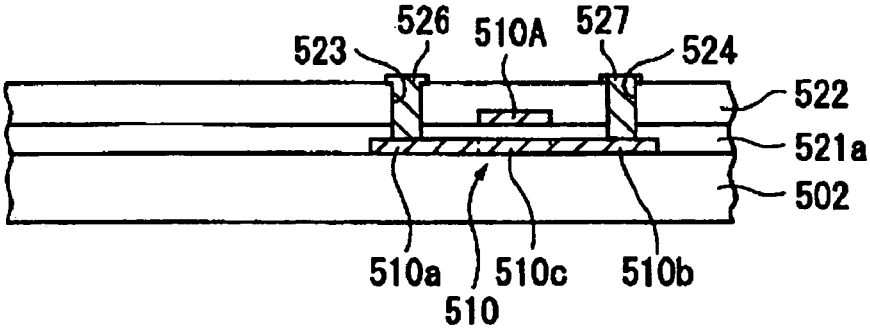

Next, as shown in FIG. 39(D), after an inter layer insulating layer 522 has been formed, contact holes 523 and 524 are formed therein, and junction electrodes 526 and 527 are embedded in these contact holes 523 and 524. Furthermore, as shown in FIG. 39(E), a signal line 504, a common power supply line 505, and a scan line 503 (not shown in FIG. 39) are formed above the inter layer insulating layer 522.

At this time, the various lead wires for the signal line 504, the common power supply line 505, and the scan line 503 are formed of sufficient thickness, without being prejudiced by the necessary thickness dimension for lead wires. In concrete terms, it will be acceptable to form each of these lead wires, for example, with a thickness dimension of approximately 1 to 2 μm. Here, it will be acceptable to form the junction electrode 527 and the various lead wires by the same process. At this time, a junction electrode 526 is formed from an ITO layer which will be described hereinafter.

And an inter layer insulating layer 530 is formed to cover the upper surfaces of the various lead wires, and a contact hole 532 is formed in a position which corresponds to the junction electrode 526. An ITO layer is formed so as to fill in this contact hole 532, and this ITO layer is patterned, so as to form the picture element electrode 511 which is electrically connected to the source and drain region 510*a* in a predetermined position which is surrounded by the signal line 504, the common power supply line 505, and the scan line 503.

Figure 39E:
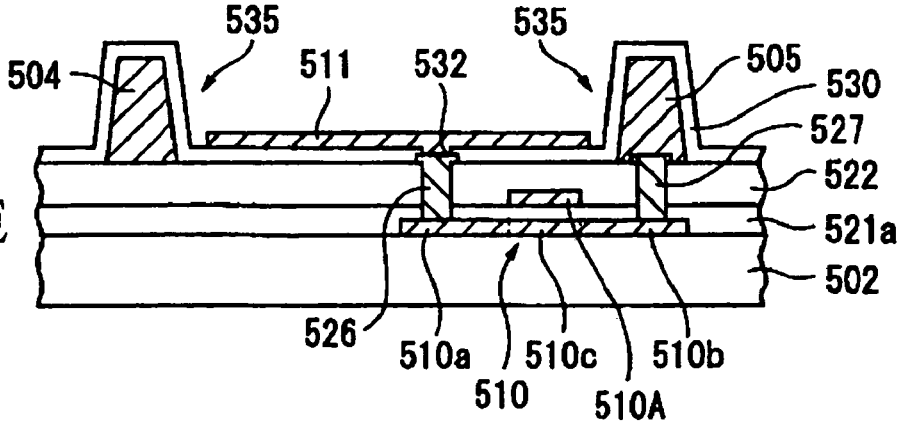

Here, in FIG. 39(E), the portion which is sandwiched between the signal line 504 and the common power supply line 505 is the one which corresponds to a predetermined position into which optical material is selectively to be provided. And steps 535 are formed by the signal line 504 and the common power supply line 505 between this predetermined position and its surroundings. In concrete terms, this predetermined position is lower than its surroundings, and is defined as a concave portion by the steps 535.

Discharge of the Electro-Luminescent Material

Figure 40A:
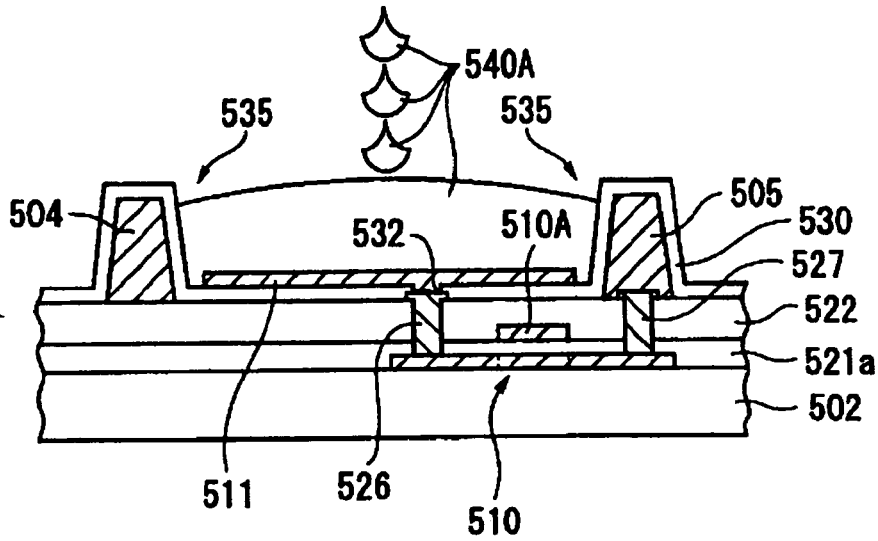
FIGS. 40(A)-40(C) are manufacturing process sectional views showing a procedure for discharge of electro-luminescent material in the process of manufacture of the same display device.

Next an electro-luminescent material, which is a functional liquid mass, is discharged by an ink jet method against the display substrate plate 502 upon which the above described preliminary processing has been performed. In other words, as shown in FIG. 40(A), in a state in which the upper surface of the display substrate plate 502 upon which the above described preliminary processing has been performed is facing upwards, an optical material mass 540A, which is a precursor in the form of a solution, dissolved in a solvent, and which serves as a functional liquid mass for forming a positive hole injection layer 513A which touches the lower layer portion of the light emitting element 140, is discharged by an ink jet method, in other words by using a device according to one of the preferred embodiments of the present invention described above, and thus is selectively applied to certain ones of the regions surrounded by the steps 535 which are located in certain predetermined positions.

As the optical material 540A which is to be discharged for forming this positive hole injection layer 513A, poliphenylenevinylene which polymer precursor is polytetrahydrothiophenylphenylen, 1,1-bis-(4-N,N-ditlylaminophenyl) cyclohexane, tris(8-hydroxyquinolinole) Aluminum or the like may be used.

It should be understood that, since during this discharge process the optical material 540A, which is a liquid mass which has a certain flowability, has a high flowability just as in the case of discharging the filter element material 13 against the division walls which was described above with reference to various other preferred embodiments, accordingly, even though this optical material 540A may attempt to spread out in the sideways direction, since the steps 535 are formed so as to surround the positions where this optical material 540A has been applied, it is possible to prevent the optical material 540A getting over the steps 535 and spreading to the outside of the predetermined positions where it is supposed to be applied, provided that the amount of discharge of the optical material 540A in one discharge episode is not extremely increased.

Figure 40B:
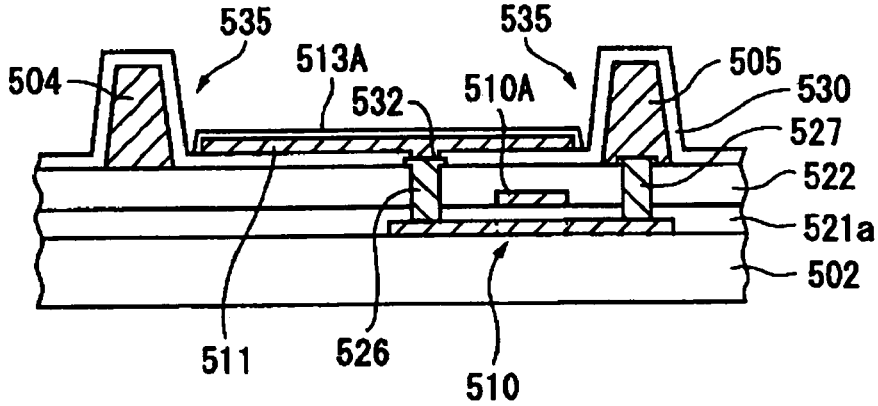
Figure 40C:
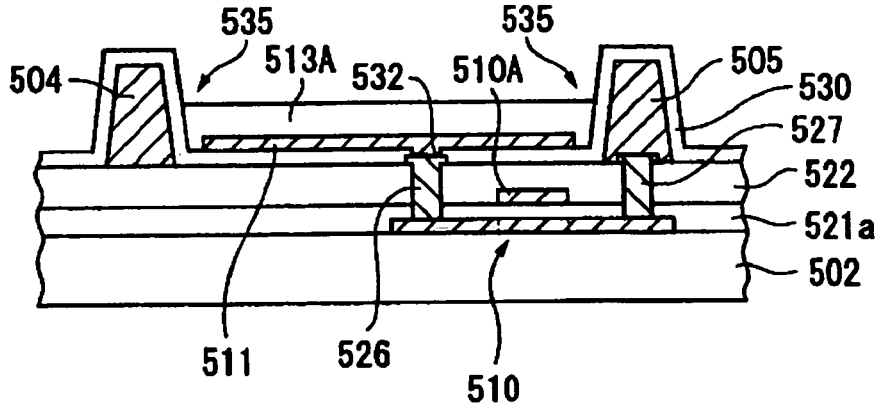

And, as shown in FIG. 40(B), the liquid in the optical material 540A is vaporized by being heated up or by being illuminated or the like, so as to form a thin solid positive hole injection layer upon the picture element electrode 511. The processes of FIGS. 40(A) and (B) are repeated for the necessary number of times, until, as shown in FIG. 40(C), a positive hole injection layer 513A of sufficient extent in the thickness dimension has been formed.

Figure 41A:
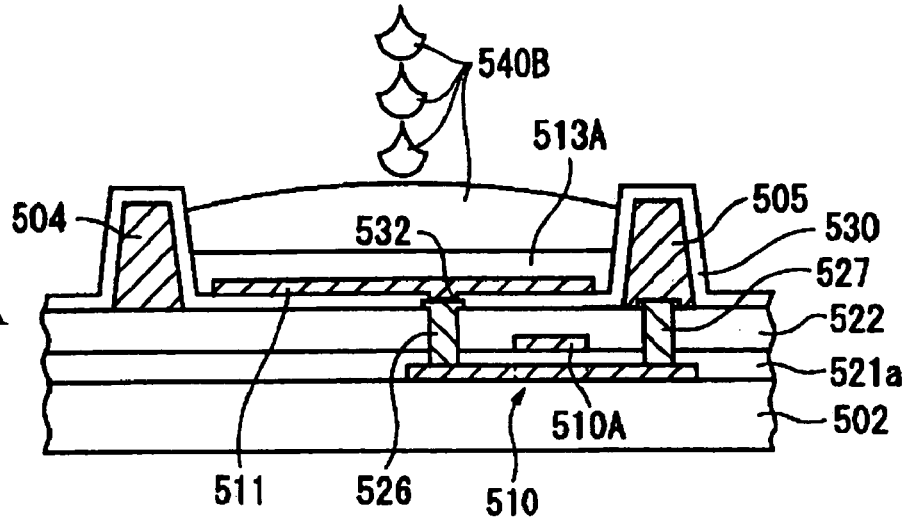
FIGS. 41(A)-41(D) are other manufacturing process sectional views showing a procedure for discharge of electro-luminescent material in the process of manufacture of the same display device.

Next, as shown in FIG. 41(A), in the state in which the upper surface of the display substrate plate 502 is facing upwards, an optical material mass 540B, which is an organic fluorescent material in the form of a solution, dissolved in a solvent, and which serves as a functional liquid mass for forming an organic semiconductor film 513B as a layer above the light emitting element 513, is discharged by an ink jet method, in other words by using a device according to one of the preferred embodiments of the present invention described above, and thus is selectively applied to certain ones of the regions surrounded by the steps 535 which are located in certain predetermined positions. It should be understood that this optical material 540B is prevented from overflowing over the steps 535 and spreading to the outside of the predetermined positions in the same way as in the case of the discharge of the optical material 540A, as has been described above.

As the optical material 540B which is to be discharged for forming this organic semiconductor film 513B, cyanopolypheniyphenilenevinylene, polyphenylvinylene, polyalkylphenilene, 2,3,6,7-tetrahydro-11-oxo-1H.5H.11H(1)benzopyrano[6,7,8-ij]-quinolysine-10-carboxylicacid, 1,1-bis(4-N,N-ditolylaminophenyl)cyclohexane, 2-13.4'-dihydroxyphenil-3,5,7-trihydroxy-1-benzopyryliumperchlorate, tris(8-hydroxyquinoquinol) aluminum, 2,3.6.7-tetrahydro-9-methyl-11-oxo-1H.5H.11H(1)benzopyrano[6,7,8-ij]-quinolisine, aromaticdiaminederivative(TDP), oxydiazoledimer(OXD), oxydiazolederivetive(PBD), distilarylenederivative(DSA), quinolinol-metallic-complex, beryllium-benzoquinolinol-complex(Bebq), triphenylaminederivetive(MTDATA), distyllylderivative, pyrazolinedimer, rublene, quinacridone, triazolederivetive, polyphenylene, polyalkylfluorene, polyalkylthiophene, azomethynezinccomplex, polyphyrinzinc-complex, benzooxazolezinccomplex, phenanthrolineeuropiumcomplex or the like may be used.

Figure 41B:
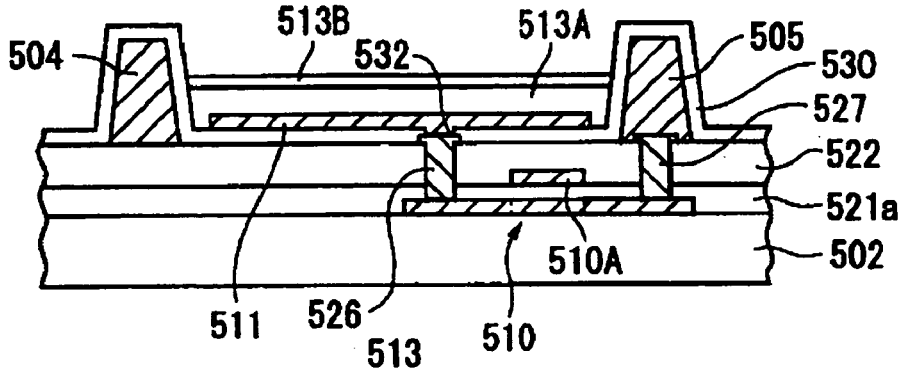
Figure 41C:
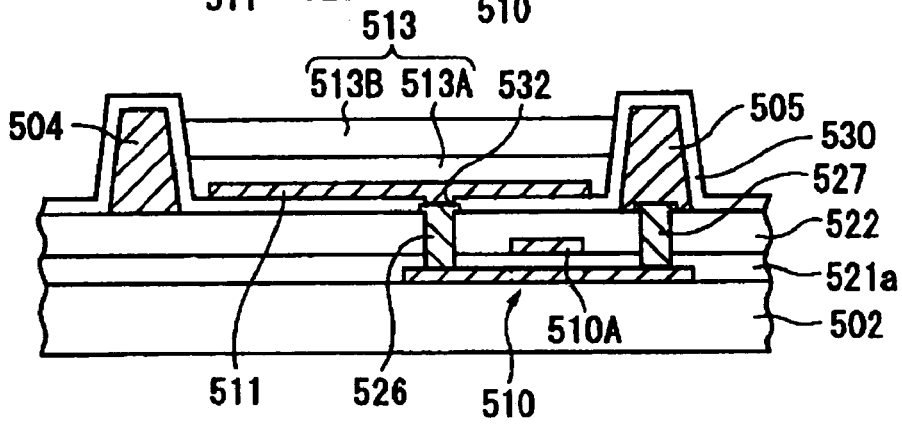
Figure 41D:
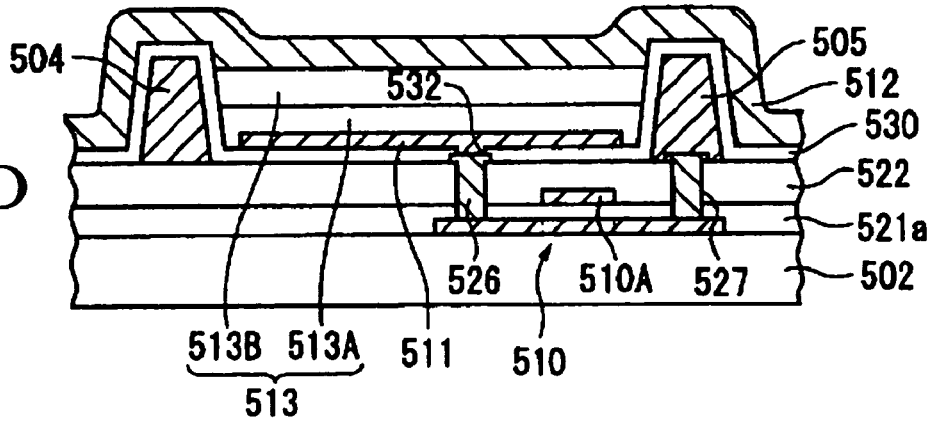

Next, as shown in FIG. 41(B), the solvent in the optical material 540B is vaporized by being heated up or by being illuminated or the like, so as to form a thin organic semiconductor film 513B above the positive hole injection layer 513A. The processes of FIGS. 41(A) and (B) are repeated for the necessary number of times, until, as shown in FIG. 41(C), an organic semiconductor film 513B of sufficient extent in the thickness dimension has been formed. The positive hole injection layer 513A and the organic semiconductor film 513B together constitute a light emitting element 513. Finally, as shown in FIG. 41(D), a reflecting electrode 512 is formed upon the entire surface of the display substrate plate 502, or in stripe form, and thereby the display device 501 is manufactured.

With this preferred embodiment shown in FIGS. 37 through 41 as well, it is possible to reap the same operational benefits as in the other preferred embodiments described earlier, by performing an ink jet method in the same manner. Furthermore, when selectively applying the functional liquid masses, it is possible to prevent them flowing out from the regions where they are supposed to be deposited, so that it is possible to perform patterning at high accuracy.

It should be understood that although the color display according to this preferred embodiment shown in FIGS. 37 through 41 has been explained in terms of its principal application to an active matrix type display device which uses an electro-luminescent display element, the structure shown in FIGS. 37 through 41 could also, for example, be applied to a display device which incorporates a monochrome display.

Figure 42:
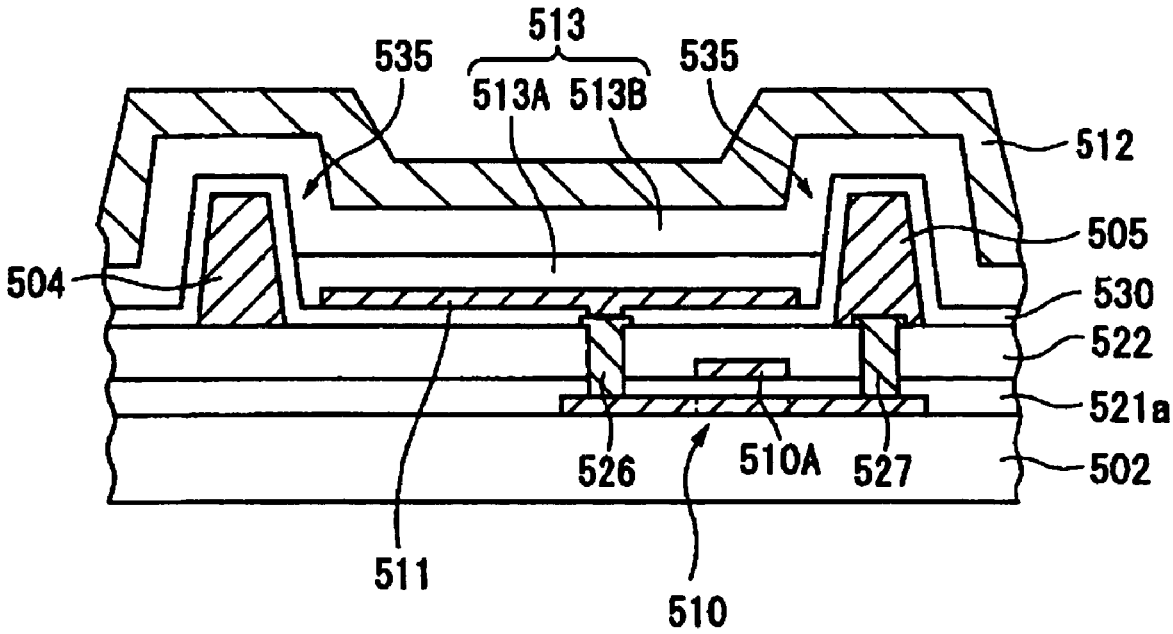
FIG. 42 is a sectional view showing a picture element region of a display device which employs an electro-luminescent display element which is an electro optical device according to the present invention.

In detail, it would also be acceptable to form the organic semiconductor film 513B uniformly over the entire surface of the display substrate plate 502. However even in this case it is extremely effective to take advantage of the steps 111, since it is necessary to provide the positive hole injection layer 513A selectively in each of the predetermined positions in order to prevent cross-talk. It should be understood that, in this FIG. 42, to structural elements which are the same as in the previous preferred embodiment shown in FIGS. 37 through 4, the same reference symbols are affixed.

Figure 43A:
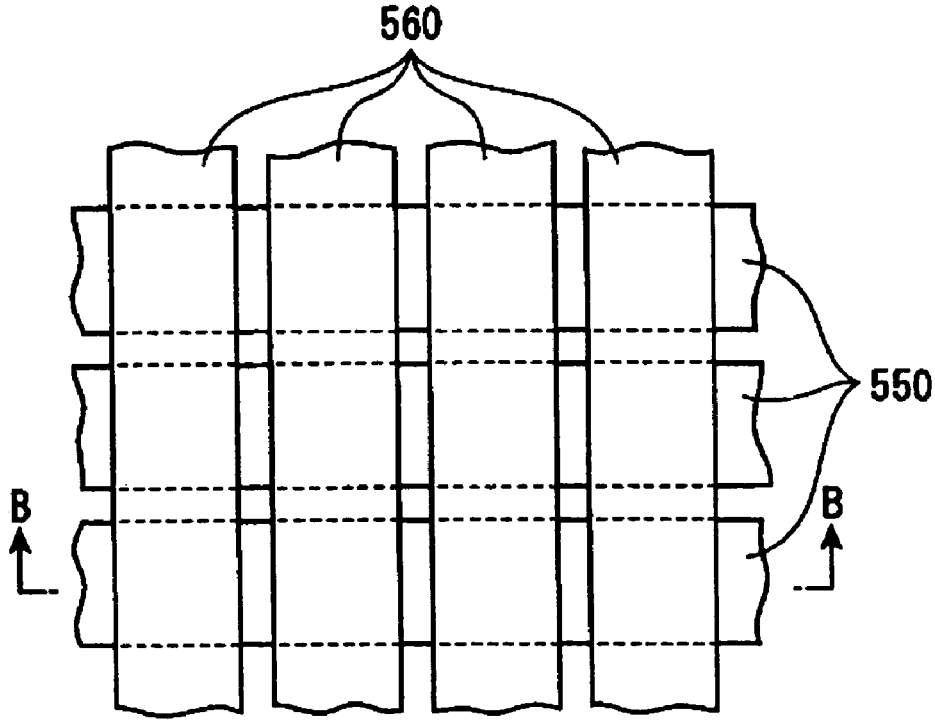
FIG. 43 is a magnified figure showing the structure of a picture element region of a display device which employs an electro-luminescent display element which is an electro optical device according to the present invention; its view 43(A) shows the planar structure thereof, while its view 43(B) is a sectional view taken in a plane shown by the arrows B-B in its view 43(A).
Figure 43B:
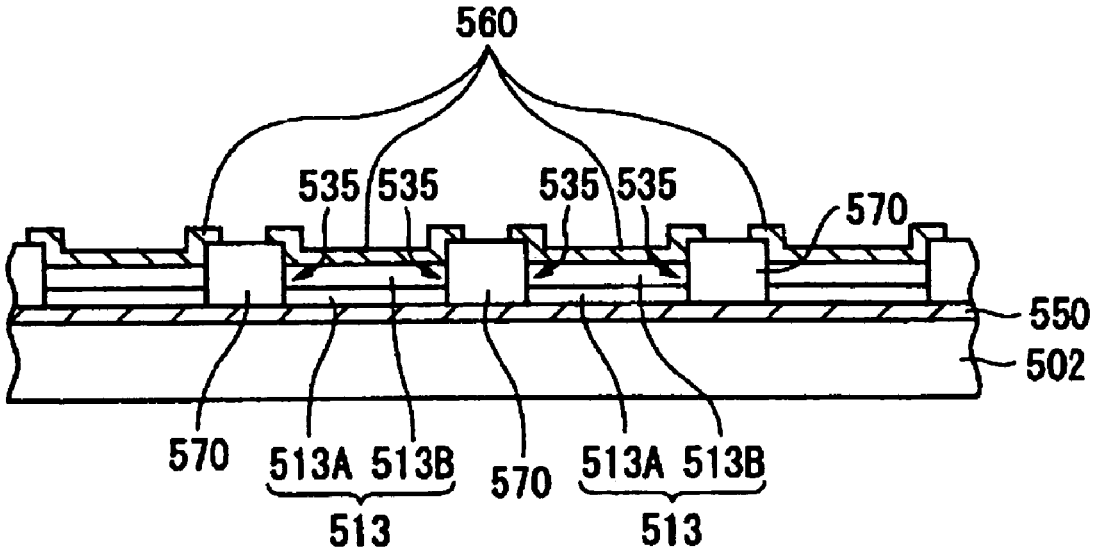

Furthermore, this type of display device which uses an electro-luminescent display element is not limited to the active matrix type; for example, it could also be a display device of the passive matrix type shown in FIG. 43. FIG. 43 shows an electro-luminescent device made by a device for manufacture of an electro optical device according to the present invention, and its FIG. 43(A) is a plan view showing the arrangement relationship of a plurality of first bus lead wires 550 and a plurality of second bus lead wires 560 which are arranged in the direction perpendicular to these first bus lead wires 550, while its FIG. 43(B) is a sectional view thereof taken in a plane shown by the arrows B-B in FIG. 43(A). In this FIG. 43, to structural elements which are the same as in the previous preferred embodiment shown in FIGS. 37 through 41, the same reference symbols are affixed, and the description thereof will herein be curtailed in the interests of brevity of description. Furthermore, since the details of the manufacturing process for this embodiment are the same, mutates mutandi, as those for the previous preferred embodiment shown in FIGS. 37 through 41, figures and description thereof will herein be curtailed.

This preferred embodiment display device shown in FIG. 43 is one in which an insulating layer 570 made of, for example, $SiO_2$ is provided so as to surround the predetermined positions in which the light emitting elements 513 are provided, and by doing this steps 535 are formed between these predetermined positions and their surroundings. Due to this, when selectively applying the functional liquid mass, it is possible to prevent it from flowing out of the areas where it is supposed to be deposited, and accordingly it is possible to perform patterning at high accuracy.

Furthermore, even in the case of an active matrix type display device, the present invention is not limited to the structure of the preferred embodiment shown in FIGS. 37 through 41. In other words, it would be possible to utilize a device of the structure shown in FIG. 44, of the structure shown in FIG. 45, of the structure shown in FIG. 46, of the structure shown in FIG. 47, of the structure shown in FIG. 48, of the structure shown in FIG. 49, or the like.

Figure 44:
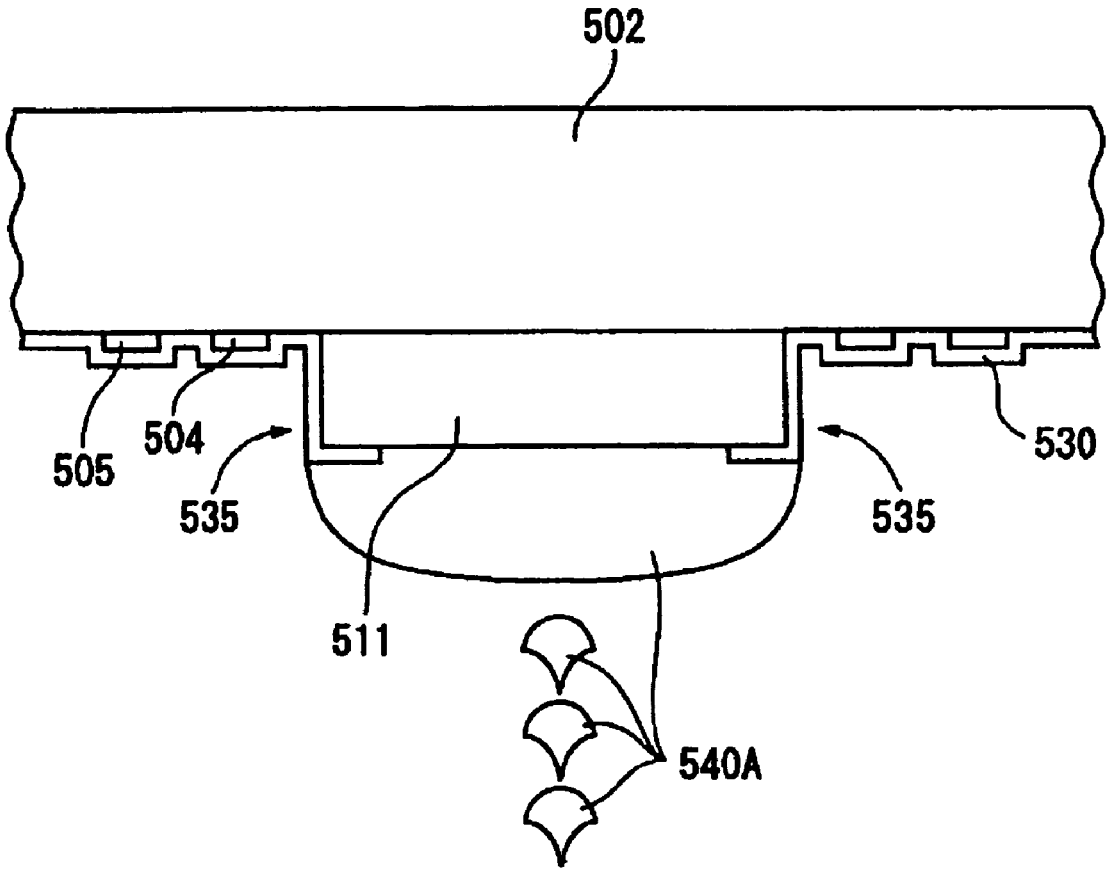
FIG. 44 is a manufacturing process sectional view showing a process of manufacture for manufacturing a display device which employs an electro-luminescent display element which is an electro optical device according to the present invention.

By forming the steps 535 by taking advantage of the picture element electrode 511, the display device shown in FIG. 44 is made so as to be capable of high accuracy patterning. FIG. 44 is a sectional view showing an intermediate stage in the manufacturing process for this display device, and, since the stages before and after this stage are substantially the same as in the case of the preferred embodiment shown in FIGS. 37 through 41, description thereof and figures illustrating the same will herein be curtailed.

With this display device shown in FIG. 44, the picture element electrode 511 is formed to be thicker than normal, and thereby the steps 535 are formed between it and its surroundings. In other words, with this display device shown in FIG. 44, the convex type steps are formed so that the picture element electrode 511, to which the optical material will be applied afterwards, becomes higher than its surroundings. And the optical material 540A, which is a precursor for forming the positive hole injection layer 513A, which touches the lower layer portion of the light emitting element 513, is discharged by an ink jet method in the same manner as in the case of the preferred embodiment described above with reference to FIGS. 37 through 41, and is thereby applied to the upper surface of the picture element electrode 511.

However, the difference from the case of the preferred embodiment described above and shown in FIGS. 37 through 41 is that the optical material 540A is discharged and is applied in a state in which the display substrate plate 502 is reversed in the vertical direction, in other words in a state in which the upper surface of the picture element electrode 511 to which the optical material 540A is applied is facing downwards. Because of this configuration, due to gravity and surface tension, the optical material 540A accumulates upon the upper surface of the picture element electrode 511 (its lower surface as seen in FIG. 44), and does not spread to the surroundings thereof. Accordingly, if it is solidified by being heated up or by being exposed to light or the like, it is possible to form a thin positive hole injection layer 513A in the same manner as in FIG. 40(B), and, if this is repeated, the positive hole injection layer 513A is formed. The organic semiconductor film 513B is formed by the same procedure. Due to this feature, it is possible to perform patterning at high accuracy while taking advantage of the convex form steps. It should be understood that this concept is not limited to the exploitation of gravity and surface tension; it would also be acceptable to adjust the amount of the optical materials 540A and 540B by taking advantage of inertial force such as centrifugal force.

Figure 45:
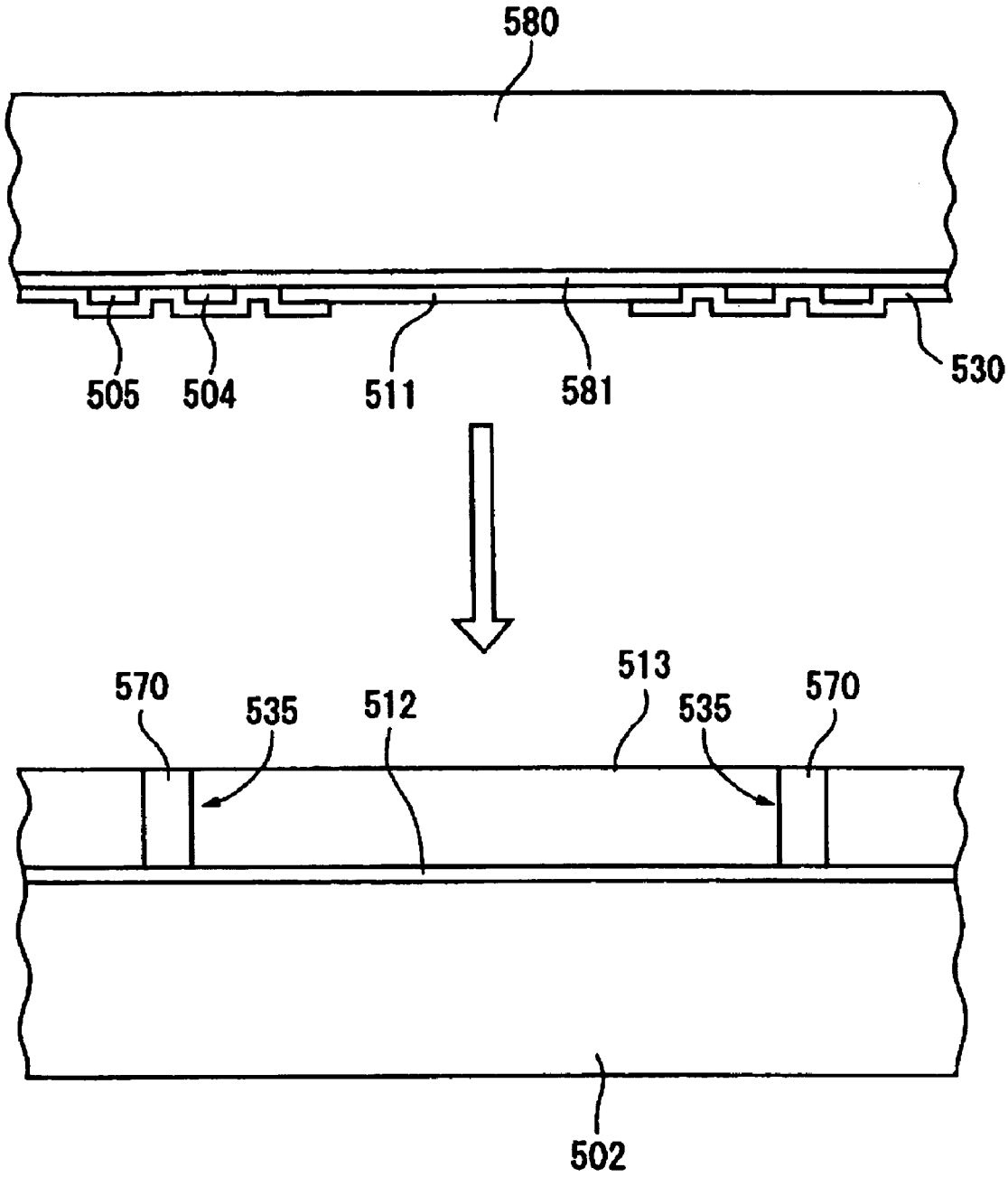
FIG. 45 is another manufacturing process sectional view showing a process of manufacture for manufacturing a display device which employs an electro-luminescent display element which is an electro optical device according to the present invention.

The display device shown in FIG. 45 is also a display device of the active matrix type. FIG. 45 is a sectional view showing an intermediate stage in the manufacturing process for this display device, and, since the stages before and after this stage are substantially the same as in the case of the preferred embodiment shown in FIGS. 37 through 41, description thereof and figures illustrating the same will herein be curtailed.

With this display device shown in FIG. 45, first, a reflecting electrode 512 is formed upon the display substrate plate 502, and then afterward an insulating layer 570 is formed upon this reflecting electrode 512 so as to surround the predetermined positions in which the light emitting elements 513 are to be provided, and, by doing this, concave type steps 535 are formed so that these predetermined positions become lower than their surroundings.

And, in the same manner as in the case of the preferred embodiment shown in FIGS. 37 through 41, the optical materials 540A and 540B are selectively discharged and applied to the regions surrounded by the steps 535 by an ink jet method as functional liquid masses, and thereby the light emitting elements 513 are formed.

On the other hand, a scan line 503, a signal line 504, a picture element electrode 511, a switching thin film transistor 509, a current thin film transistor 510, and an inter layer insulating layer 530 are formed upon a stripping layer 581 which is laid upon a substrate plate for stripping 580. Finally, the structure which has been stripped from the stripping layer 581 upon the substrate plate for stripping 580 is transferred to the surface of the display substrate plate 502.

With this preferred embodiment of FIG. 45 reduction of the damage due to application of the optical material 540A, 540B to the scan line 503, the signal line 504, the picture element electrode 511, the switching thin film transistor 509, the current thin film transistor 510, and the inter layer insulating layer 530 can be anticipated. It should be understood that this concept can also be applied to a passive matrix type display element.

Figure 46:
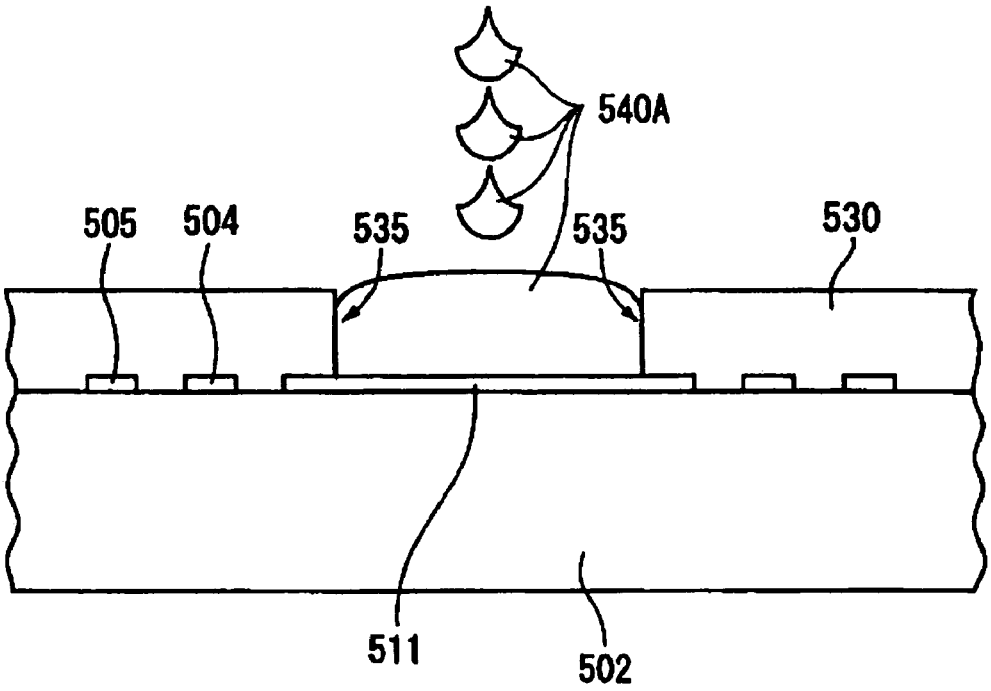
FIG. 46 is yet another manufacturing process sectional view showing a process of manufacture for manufacturing a display device which employs an electroluminescent display element which is an electro optical device according to the present invention.

The display device shown in FIG. 46 is a display device of the active matrix type. FIG. 46 is a sectional view showing a stage partway through the manufacturing process for manufacture of this display device, and, since the stages before and after this stage are substantially the same as in the case of the preferred embodiment shown in FIGS. 37 through 41, description thereof and figures illustrating the same will herein be curtailed.

This display device shown in FIG. 46 is one in which the concave formed steps 535 are made by taking advantage of the inter layer insulating layer 530. Due to this, there is no requirement to add any further special process, and it is possible to take advantage of the inter layer insulating layer 530, so that it is possible to prevent great further complication of the process of manufacture. It should be understood that, along with forming the inter layer insulating layer 530 from $SiO_2$, it would also be acceptable to irradiate its surface with ultraviolet light or with a plasma such as $O_2$, $CF_3$, Ar or the like, and thereafter to expose the surface of the picture element electrode 511, and selectively to apply the optical material liquid 540A, 540B by discharging it. By doing this a strong distribution of liquid repulsion is formed along the surface of the inter layer insulating layer 530, and it becomes easy to accumulate the optical material liquid 540A, 540B in the predetermined positions by the liquid repulsion operation both of the surface level differential portion 535 and also of the inter layer insulating layer 530.

Figure 47:
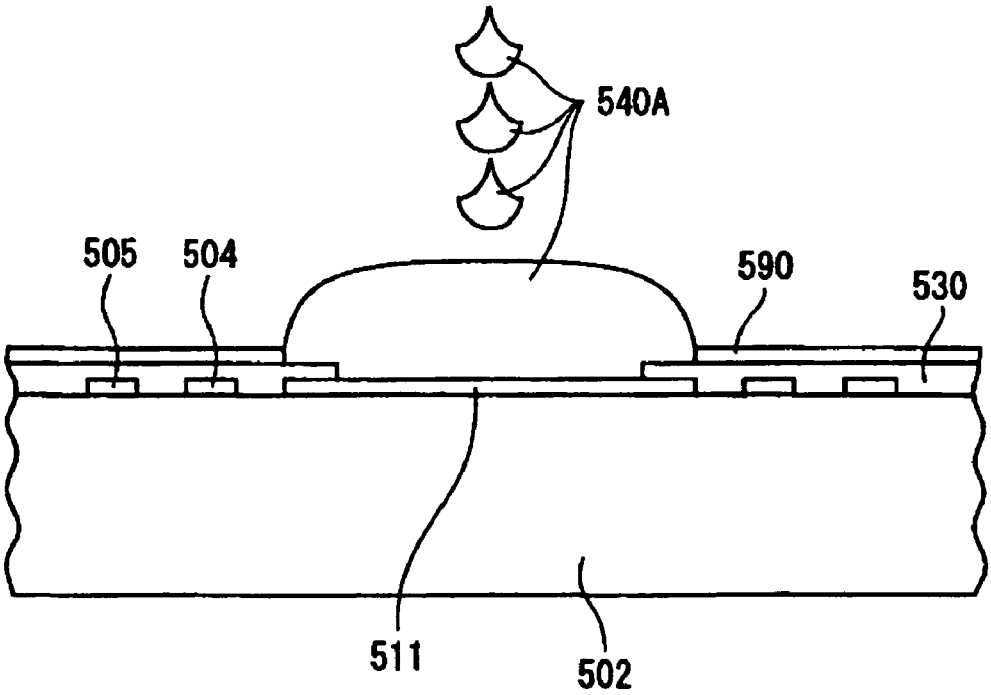
FIG. 47 is still yet another manufacturing process sectional view showing a process of manufacture for manufacturing a display device which employs an electro-luminescent display element which is an electro optical device according to the present invention.

With the display device shown in FIG. 47, it is arranged to prevent the optical material 540A, 540B which is applied from spreading to its surroundings, by making the hydrophilic characteristic of the predetermined positions to which this optical material 540A, 540B, which is a liquid mass, is applied to be relatively stronger than the hydrophilic characteristic of their surroundings. FIG. 47 is a sectional view showing an intermediate stage in the manufacturing process for this display device, and, since the stages before and after this stage are substantially the same as in the case of the preferred embodiment shown in FIGS. 37 through 41, description thereof and figures illustrating the same will herein be curtailed.

With this display device shown in FIG. 47, after forming the inter layer insulating layer 530, an amorphous silicon layer 590 is formed upon its upper surface. Since the hydrophobic characteristic of this amorphous silicon layer 590 is stronger than that of the ITO from which the picture element electrode 511 is made, accordingly, here, a distinctly defined distribution of hydrophobic characteristics and hydrophilic characteristics is created, with the hydrophilic characteristic of the surface of the picture element electrode 511 being relatively stronger than the hydrophilic characteristic of its surroundings. And then, in the same manner as in the case of the preferred embodiment shown in FIGS. 37 through 41, the light emitting element 513 is formed by selectively discharging the optical material liquid 540A, 540B by an ink jet method and applying it against the upper surface of the picture element electrode 511; and finally the reflecting electrode 512 is made.

Moreover, it is also possible to apply this preferred embodiment shown in FIG. 47 to a display element of the passive matrix type. Furthermore, as in the preferred embodiment shown in FIG. 45, it would also be acceptable to include a process of transferring a structure which has been formed with a stripping layer 581 upon a substrate plate for stripping 580 to the display substrate plate 502.

And, with regard to the hydrophilic and hydrophobic distribution, it would also be acceptable to form the insulating layer of metal, anodized oxide film, or polyimide or silicon oxide or the like from some different material. It should also be understood that in the case of a display element of the passive matrix type it would be acceptable to form it from the first bus connecting wires 550, while in the case of a display element of the active matrix type, it would be acceptable to form it from the scan line 503, the signal line 504, the picture element electrode 511, the insulating layer 530, or the light interception layer 6*b*.

Figure 48:
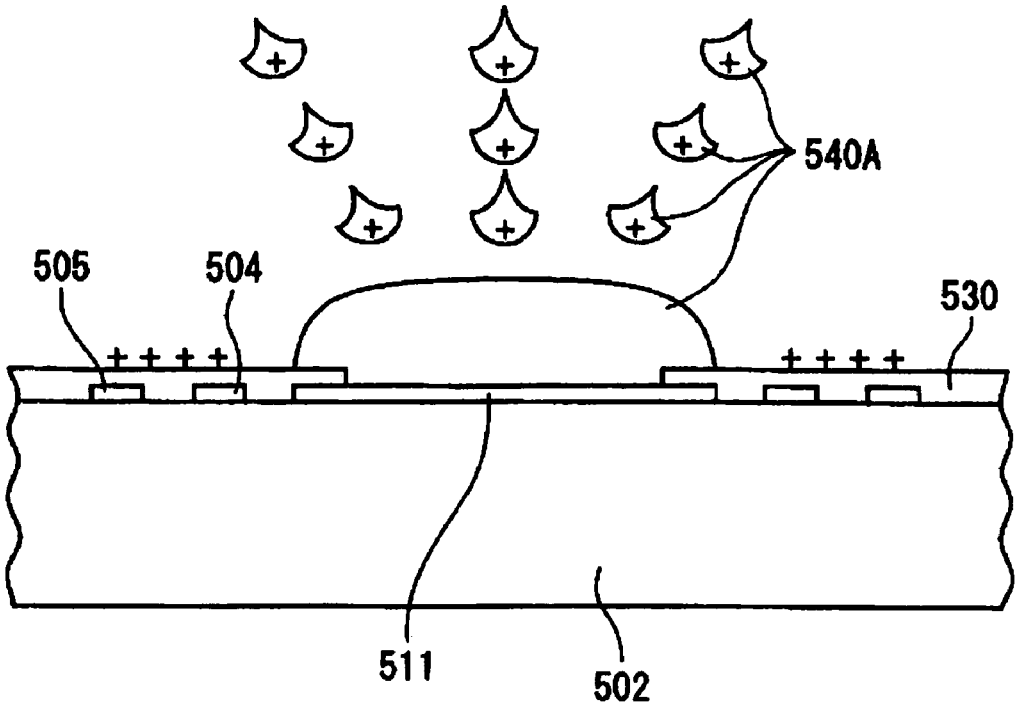
FIG. 48 is yet a further manufacturing process sectional view showing a process of manufacture for manufacturing a display device which employs an electro-luminescent display element which is an electro optical device according to the present invention.

The display device shown in FIG. 48 is one in which it is contemplated, not to enhance the accuracy of the patterning by taking advantage of the steps 535 or the distribution of hydrophobic and hydrophilic characteristics or the like, but, rather, to enhance the accuracy of the patterning by taking advantage of attraction and repulsion and the like due to electrical potential. FIG. 48 is a sectional view showing a stage partway through the manufacturing process for manufacture of this display device, and, since the stages before and after this stage are substantially the same as in the case of the preferred embodiment shown in FIGS. 37 through 41, description thereof and figures illustrating the same will herein be curtailed.

With this display device shown in FIG. 48, along with driving the signal line 504 and the common power supply line 505, an electrical potential distribution is formed by suitably turning ON and OFF a transistor not shown in the figures, so as to bring the picture element electrode 511 to a minus electrical potential, and so as to bring the inter layer insulating layer 530 to a plus electrical potential. And the optical material liquid 540A, 540B which is charged to a positive electrical potential is selectively discharged by an ink jet method, so as to be applied in the predetermined position. By doing this, since the optical material 540A, 540B is charged up, it is also possible to take advantage of static electrical charging rather than spontaneous electrical polarization, and accordingly it is possible to enhance the accuracy by which the patterning is performed.

It should be understood that this preferred embodiment shown in FIG. 48 can also be applied to a passive matrix type display element. Furthermore, just like the preferred embodiment shown in FIG. 45, it would also be acceptable to include a process of transferring a structure formed via a stripping layer 581 upon a substrate plate for stripping 580 to the display substrate plate 502

Figure 49:
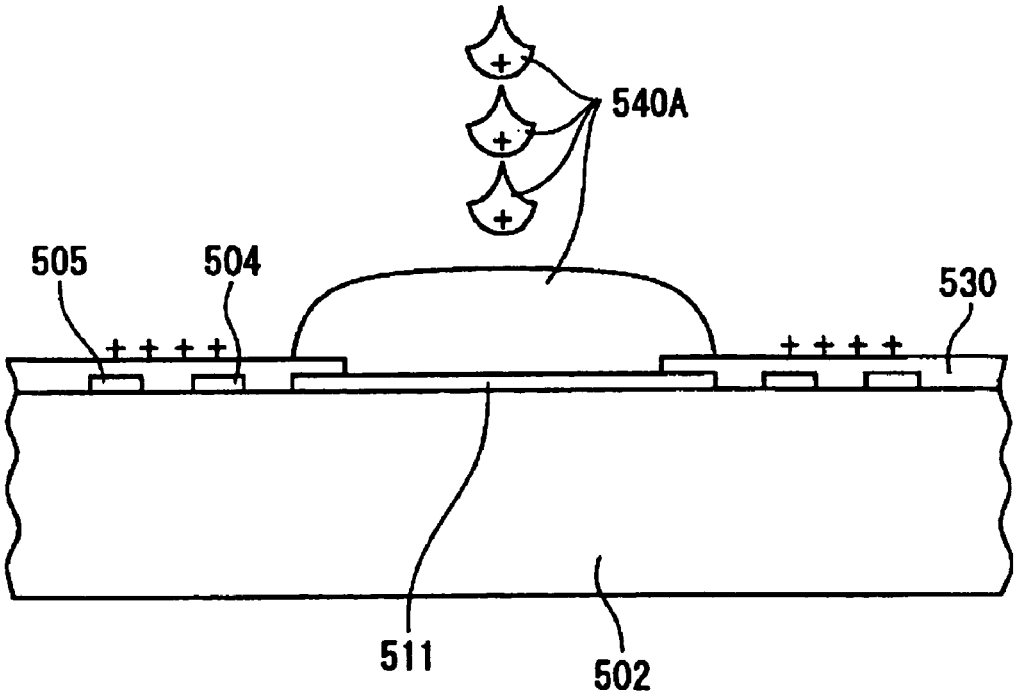
FIG. 49 is a still yet further manufacturing process sectional view showing a process of manufacture for manufacturing a display device which employs an electro-luminescent display element which is an electro optical device according to the present invention.

Furthermore, although voltage is supplied to both the picture element electrode 511 and the inter layer insulating layer 530 which surrounds it, the present invention is not to be considered as being limited by this feature; for example, as shown in FIG. 49, it would also be acceptable, without supplying any voltage to the picture element electrode 511, to supply a positive voltage only to the inter layer insulating layer 530, and to thus bring the optical material liquid 540A to a positive electrical potential by induction. Since, according to this structure shown in FIG. 49, the optical material liquid 540A can reliably be maintained in this state at a positive induced potential even after application, accordingly it is possible more reliably to prevent the optical material liquid 540A flowing out to the surrounding portions, due to the repulsive force between it and the surrounding inter layer insulating layer 530.

Another Preferred Embodiment Related to a Method of Manufacture of an Electro Optical Device Which Uses an Electroluminescent Element Next, another preferred embodiment of the method of manufacture of an electro optical device according to the present invention will be explained with reference to the drawings. In the following, the fact that this invention is applied to an electro optical device which is a display device of the active matrix type and which employs an electroluminescent display element is the same as in the case of the above described preferred embodiment, and also its circuit structure is the same as that of the previous preferred embodiment described above and shown in FIG. 37.

Structure of the Display Device

Figures 55A, 55B:
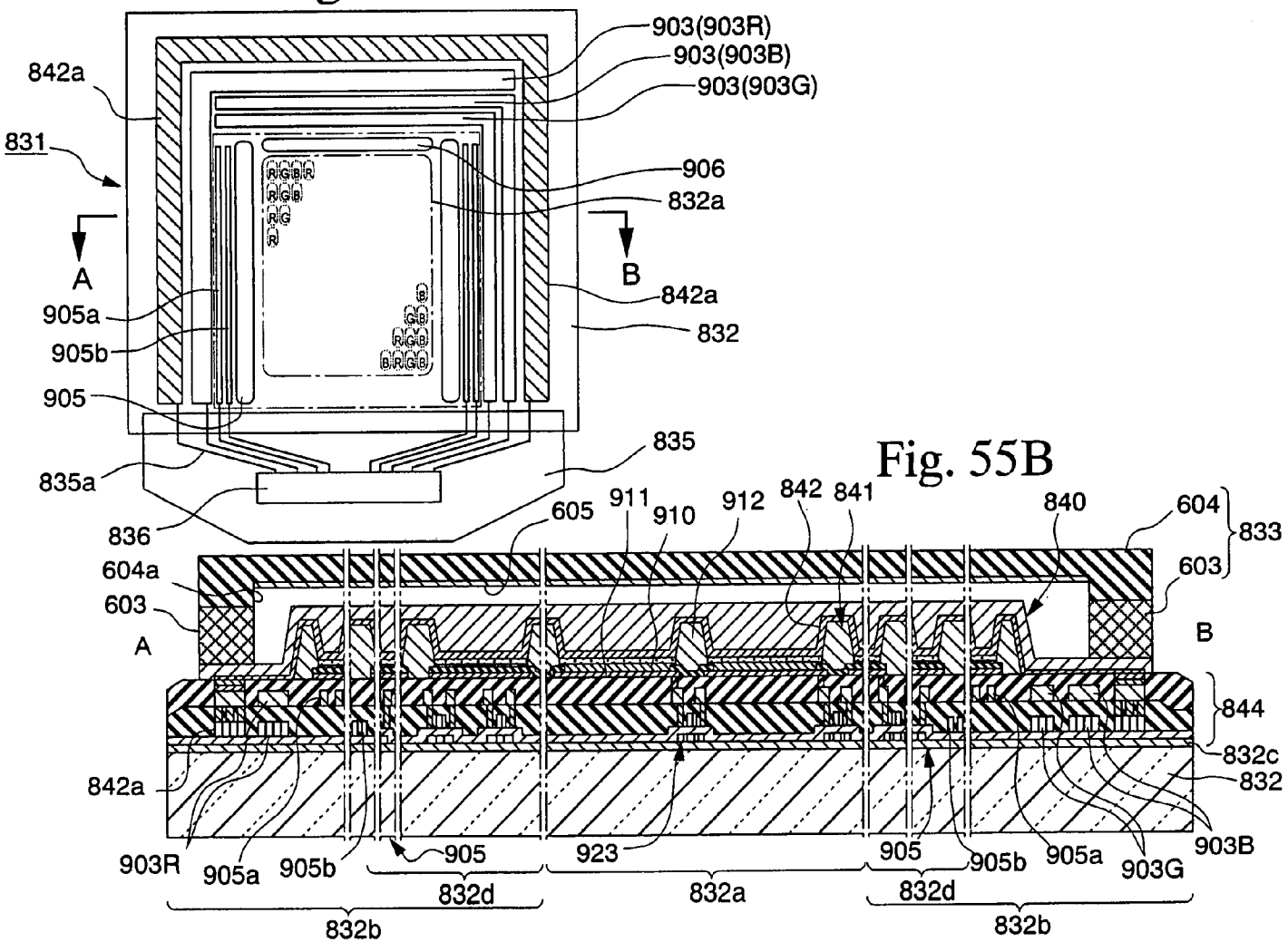
FIG. 55 is a view showing a display device according to another preferred embodiment of the electro optical device according to the present invention; its view 55(*a*) is a schematic plan view, while its view 55(*b*) is a sectional schematic figure taken in a plane shown by the arrows AB in its view 55(*a*).

FIG. 55(*a*) is a schematic plan view of the display device of this preferred embodiment, while FIG. 55(*b*) is a schematic sectional view taken in a plane shown by the arrows A-B in FIG. 55(*a*). As shown in these figures, the display device 831 according to this preferred embodiment of the present invention comprises a transparent base plate 832 which is made from glass or the like, a set of light emitting elements which are arranged in the form of a matrix, and a sealing substrate plate. The light emitting elements which are formed upon the base plate 832 are constituted by a picture element electrode, a functional layer, and a negative electrode 842. The base plate 832 is a transparent substrate plate made of, for example, glass or the like, and is compartmented into a display region 832*a* which is positioned centrally upon the base plate 832, and a non display region 832*b* which is positioned around the peripheral edge of the base plate 832, disposed on the outside of the display region 832*a*.

The display region 832*a* is a region which is made up from light emitting elements which are arranged in the form of a matrix, i.e. is a so called available for display region. Furthermore, the non display region 832*b* is formed on the outside of the display region 832*a*. And a dummy display region 832*d* is formed in this non display region 832*b*, adjacent to the display region 832*a*.

Furthermore, as shown in FIG. 55(*b*), a circuit element portion 844 is provided between light emitting element portions 841, which are made up from light emitting elements and bank portions, and the base plate 832; and the previously mentioned scan lines, signal lines, hold capacity, switching thin film transistors, and thin film transistors 923 for drive and the like are provided to this circuit element portion 844.

Furthermore, one end of the negative electrode 842 is connected to a negative electrode connecting wire 842*a* which is formed upon the base plate 832, and the one tip portion of this connecting wire 842*a* is connected to a connecting wire 835*a* upon a flexible substrate plate 835. Furthermore, the connecting wire 835*a* is connected to a drive IC (drive circuit) 836 which is provided upon the flexible substrate plate 835.

Yet further, as shown in FIG. 55(*a*) and FIG. 55(*b*), electrical power supply lines 903 (903R, 903G, and 903B) are connected to the non display region 832*b* of the circuit element portion 844.

Furthermore, the previously mentioned scanning side drive circuits 905, 905 are provided at both sides as seen in FIG. 55(*a*) of the display region 832*a*. These scanning side drive circuits 905, 905 are provided within the circuit element portion 844 of the lower side of the dummy region 832*d*. Moreover, drive circuit control signal lead wires 905*a* which are connected to the scanning side drive circuits 905, 905 and drive circuit electric power source lead wires 905*b* are provided within the circuit element portion 844. And furthermore, a checking circuit 906 is provided at the upper side of the display region 832*a* as seen in FIG. 55(*a*). By the use of this checking circuit 906, it is possible to perform checking of the quality of the display device during manufacture and before shipping, and to detect any defects in it.

Furthermore, as shown in FIG. 55(*b*), a sealing portion 833 is provided over the light emitting element portions 841. This sealing portion 833 is made up from a sealing resin 603*a* which is applied upon the base plate 832, and a covering and sealing substrate plate 604. The sealing resin 603 may consist of a heat curing resin or an ultraviolet light curing resin or the like, and in particular, it is desirable for it to be an epoxy resin, which is one type of heat curing resin.

This sealing resin 603 is applied in the form of a ring around the periphery of the base plate 832; for example, it may be applied by using a micro dispenser or the like (not shown in the figures). Since this sealing resin 603 bonds the base plate 832 and the covering and sealing cover plate 604 together, the entry of water or oxygen into the internal portion under the covering and sealing substrate plate 604, between it and the base plate 832, is positively prohibited, and accordingly oxidization of the negative electrode 842 or of a light emission layer, not shown in the figures, which is formed in the light emitting element portions 841 is prevented.

Since the covering and sealing substrate plate 604 is made from glass or a metallic material, and it is adhered to the base plate 832 with the sealing resin 603, accordingly a concave portion 604*a* is defined, in the inside of which the display element 840 is received. Furthermore, a getter element 605 which absorbs water or oxygen or the like is provided within this concave portion 604*a*, and accordingly it becomes possible to absorb any water or oxygen or the like which has penetrated to the internal portion of the device, below the sealing substrate plate 604. It should be understood that this getter material may be omitted, without departing from the scope of the present invention.

Figure 56:
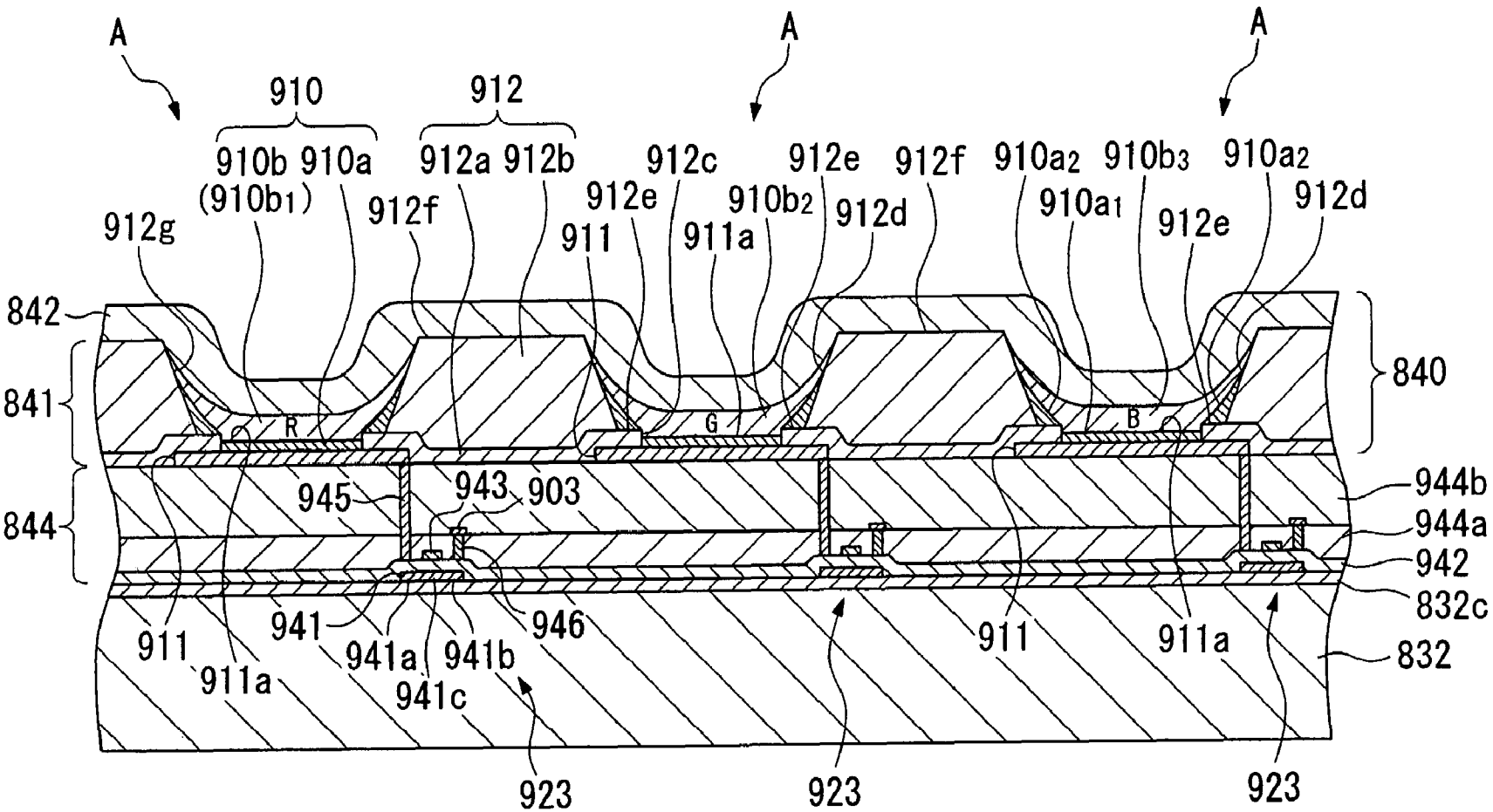
FIG. 56 is a view showing an essential portion of the same display device.

Next, a magnified view of the sectional structure of the display region of this display device is shown in FIG. 56. This figure includes three of the picture element regions A. This display device 831 comprises a circuit element portion 844 which is made of a circuit such as TFT or the like, and a light emitting portion 841 within which a functional layer 910 is formed, superimposed in order as layers upon the base plate 832.

With this display device 831, light which has been emitted from the functional layer 910 towards the side of the base plate 832 passes through the circuit element portion 844 and the base plate 832 and is emitted on the lower side of the base plate 832 (the observer side), and also the light which has been emitted from the functional layer 910 towards the side which is opposite to the base plate 832 is reflected by the negative electrode 842, and then passes through the circuit element portion 844 and the base plate 832, thus also coming to be emitted on the lower side of the base plate 832 (the observer side).

It should be understood that it would be possible for light to be emitted from the negative electrode side of the display device by using a transparent material for the negative electrode 842. It would be possible to use, as this transparent material, ITO, Pt, Ir, Ni, or Pd. It is desirable to make the film thickness be about 75 nm; or, alternatively, it may be desirable to make the film thickness even thinner.

In the circuit element portion 844, upon the base plate 832, there is formed a protective backing layer 832*c* which is made from silicon oxide film, and islands (blobs) of semiconductor film 941 which are made from polycrystalline silicon are formed upon this protective backing layer 832*c*. It should be understood that source regions 941*a* and drain regions 941*b* are formed in the semiconductor films 941 by high concentration P ion bombardment. Furthermore, a portion into which P has not been injected constitutes a channel region.

Furthermore, a transparent gate insulating layer 942 which covers over the protective backing layer 832*c* and the semiconductor films 941 is formed in the circuit element portion 844, gate electrodes 943 (the scan lines 901) made from Al, Mo, Ta, Ti, W or the like are formed over this gate insulating layer 942, and a transparent first inter layer insulating layer 944*a* and a transparent second inter layer insulating layer 944*b* are formed over the gate electrodes 943 and the gate insulating layer 942. The gate electrodes 943 are provided in positions which correspond to the channel regions 941*c* of the semiconductor films 941.

Furthermore, contact holes 945 and 946 for respectively connecting to the source and the drain regions 941*a* and 941*b* of the semiconductor films 941 are pierced through the first and the second inter layer insulating layers 944*a* and 944*b*.

And transparent picture element electrodes 911 which are made from ITO or the like are formed upon the second inter layer insulating layer 944*b* by patterning in a predetermined pattern, and the one set of contact holes 945 are connected to these picture element electrodes 911.

Furthermore, the other set of contact holes 946 are connected to the electric power source leads 903.

By this construction, in the circuit element portion 844, a thin film transistor 923 is connected to each of the picture element electrodes 911 for driving it.

It should be understood that, although thin film transistors 912 for the above described hold capacity and switching are also formed in the circuit element portion 844, they are not shown in FIG. 56, and their description will herein be curtailed.

Next, as shown in FIG. 56, the light emitting element portions 841 principally comprise functional layers 910 which are superimposed as layers over each of the plurality of picture element electrodes 911, bank portions 912 which are provided between each of the picture element electrodes 911 and the functional layers 910 and which compartment up the various functional layers 910, and the negative electrode 842 which is formed over these functional layers 910. These picture element electrodes (first electrodes) 911, functional layers 910, and the negative electrode 842 (the opposing electrode) together constitute the light emitting element.

Here, the picture element 911 is formed in a substantially rectangular pattern as seen in plan view by, for example, being formed from ITO. It is desirable for the thickness of this picture element region 911 to be from 50 to 200 nm, and more particularly it may be about 150 nm. The bank portions 912 are provided between each of these picture element electrodes 911 . . . .

The bank portions 912, as shown in FIG. 56, are each made by the superposition of an inorganic material bank layer 912*a* (the first bank layer) which is positioned on the side towards the base plate 832, and an organic material bank layer 912*b* (the second bank layer) which is positioned further from the base plate 832.

The inorganic material bank layers 912*a* and the organic material bank layers 912*b* are formed so as to ride up over the edge portions of the picture element electrodes 911. As seen in plan view, the structure is such that the surroundings of the picture element electrodes 911 and the inorganic material bank layers 912*a* are arranged so as to be superimposed upon one another. Furthermore, in the same manner, the organic material bank layers 912*b* are also, in plan view, superimposed over the one portions of the picture element electrodes 911. Furthermore, the inorganic material bank layers 912*a* are formed so that edge portions 912*e* thereof extend more towards the centers of the picture element electrodes 911 than do the organic material bank layers 912*b*. According to this construction, by these edge portions 912*e* of the inorganic material bank layers 912*a* being formed so as to extend more towards the centers of the picture element electrodes 911, lower opening portions 912*c* are formed which correspond to the positions where the picture element electrodes 911 are formed.

Furthermore, upper opening portions 912*d* are formed in the organic material bank layers 912*b*. These upper opening portions 912*d* are provided so as to correspond to the positions in which the picture element electrodes 911 are formed, and to the lower opening portions 912*c*. The upper opening portions 912*d*, as shown in FIG. 56, are made to be wider than the lower opening portions 912*c* and narrower than the picture element electrodes 911. Furthermore, it may be the case that the positions of the tops of the upper openings 912*d* and of the tip portions of the picture element electrodes 911 are made to be almost in the same position. In this case, as shown in FIG. 56, the sections of the upper openings 912*d* of the organic material bank layer 912*b* are formed so as to be inclined.

And, by connecting together the lower opening portions 912*c* and the upper opening portions 912*d* in the bank portions 912, opening portions 912*g* are defined which are pierced through the inorganic material bank layers 912*a* and the organic material bank layers 912*b*.

Furthermore, it is desirable to make the inorganic material bank layers 912*a* from an inorganic material such as, for example, SiO2, $TiO_2$, or the like. The film thickness of this inorganic material bank layer 912*a* is desirably in the range from 50 to 200 nm, and in particular may be 150 nm. If the film thickness is less than 50 nm, the inorganic material bank layers 912*a* becomes thinner than a positive hole injection/transport layer which will be described hereinafter, which is not desirable, since it becomes impossible to ensure the flatness of the positive hole injection/transport layer. On the other hand, if the film thickness is greater than 200 nm, then the steps due to the lower opening portions 912*c* become large, and this is not desirable, because it becomes impossible to ensure the flatness of a light emission layer which will be described hereinafter which is superimposed over the positive hole injection/transport layer.

Furthermore, the organic material bank layers 912*b* are formed of a material which is heat resistant and solvent resistant, such as acrylic resin, polyimide resin, or the like. The thickness of these organic material bank layers 912*b* is desirably in the range of from 0.1 to 3.5 μm, and in particular may be about 2 μm. If their thicknesses are less than 0.1 μm, then the organic material bank layers 912*b* become thinner than the total thickness of the positive hole injection/transport layer and the light emission layer which will be described hereinafter, and this is not desirable, because there is a danger that the light emission layer might overflow from the upper opening portions 912*d*. On the other hand, if the thicknesses of the organic material bank layers 912*b* are less than 0.1 μm, then the steps due to the upper opening portions 912*d* become large, and this is not desirable, because it becomes impossible to ensure the step coverage of the negative electrode 842 which is formed upon the organic material bank layer 912*b*. Furthermore, if the thicknesses of the organic material bank layers 912*b* are greater than 0.2% m, this is desirable from the point of view that it becomes possible to enhance the insulation with respect to the thin film transistors for drive 923.

Furthermore, both regions which exhibit hydrophilic characteristics and regions which exhibit hydrophobic characteristics are formed upon the bank portions 912.

The regions which exhibit hydrophilic characteristics are the first layered portions of the inorganic material bank layers 912*a* and the electrode surfaces 911*a* of the picture element electrodes 911, and these regions are surface processed so as to have hydrophilic characteristics by plasma processing using oxygen as the processing gas. On the other hand, the regions which exhibit hydrophobic characteristics are the wall surfaces of the upper opening portions 912*d* and the upper surfaces 912*f* of the organic material bank layers 912, and these regions are surface processed so as to have hydrophobic characteristics by plasma processing using Tetrafluoromethane or Tetrafluorocarbon as the processing gas. It should be understood that it would also be acceptable to make the organic material bank layers from a material which included a fluorinated polymer.

Next, as shown in FIG. 56, the functional layer 910 is made from a positive hole injection/transport layer 910*a* which is superimposed over the picture element electrode 911, and a light emission layer 910*b* which is formed adjacent to and over this positive hole injection/transport layer 910*a*. It should be understood that it would also be acceptable to form yet another functional layer, adjacent to the light emission layer 910*b*, which was endowed with the function of acting as an electron injection/transport layer and the like.

The positive hole injection/transport layer 910*a*, along with being endowed with the function of injecting positive holes into the light emission layer 910*b*, also is endowed with the function of transporting these positive holes within the internal portion of this positive hole injection/transport layer 910*a*. By providing this type of positive hole injection/transport layer 910*a* between the picture element electrode 911 and the light emission layer 910*b*, the light emission efficiency of the light emission layer 910*b*, and the characteristics of this display component such as its service lifetime and the like, are enhanced. Furthermore, in the light emission layer 910*b*, the positive holes which have been injected from the positive hole injection/transport layer 910*a* and the electrons which have been injected from the negative electrode 842 are united with one another, and thereby light emission is obtained.

The positive hole injection/transport layer 910*a* is made up from flat portions 910*a*1 which are formed over the picture element electrode surfaces 911*a* which are positioned within the lower opening portions 912*c*, and peripheral edge portions 910*a*2 which are formed over the first superimposed layer portions 912*e* of the inorganic material bank layers which are positioned within the upper opening portions 912*d*. Furthermore, due to its structure, the positive hole injection/transport layer 910*a* is positioned over the picture element electrodes 911, and moreover it is only formed between the inorganic material bank layers 912*a*, i.e. the lower opening portions 910*c* (there are also possible embodiments in which it is only made in the flat portions which have been previously described).

The thickness of these flat portions 910*a*1 is made to be constant, and to fall, for example, in the range from 50 to 70 nm.

If the peripheral edge portions 910*a*2 are formed, these peripheral edge portions 910*a*2, along with being positioned over the first superimposed portions 912*e*, are tightly adhered to the wall surfaces of the upper openings 912*d*, in other words to the organic material bank layers 912*b*.

Furthermore, the thickness of the peripheral edge portions 910*a*2 is thinner at their sides closer to the electrode surfaces 911*a*, and increases along the direction away from the electrode surfaces 911*a*, and is at its thickest near to the wall surfaces of the lower opening portions 912*d*.

The reason that the peripheral edge portions 910*a*2 exhibit the above type of shape, is because the positive hole injection/transport layer 910*a* is formed by discharging a first mixture material containing the source material for the positive hole injection/transport layer and a polar solvent, into the opening portions 912, and then by eliminating the polar solvent by vaporization, and this vaporization of the polar solvent principally takes place over the first superimposed layer portions 912*e* of the inorganic material bank layers 912*a*, so that the source material for the positive hole injection/transport layer is thickened and deposited over these first superimposed layer portions 912*e*, so as to be concentrated therein.

Furthermore, the light emission layers 910*b* are formed over the surfaces of the flat portions 910*a*1 and the peripheral edge portions 910*a*2 of the positive hole injection/transport layer 910*a*, and their thicknesses over the flat portions 912*a*1 are in the range of from 50 to 80 nm.

The light emission layers 910*b* are of three types—a red colored light emission layer 910*b*1 which emits red (R) colored light, a green colored light emission layer 910*b*2 which emits green (G) colored light, and a blue colored light emission layer 910*b*3 which emits blue (B) colored light; and these various light emission layers 910*b*1 through 910*b*3 are, in this embodiment, arranged in stripe form.

As has been described above, since the peripheral edge portions 910*a*2 of the positive hole injection/transport layers 910*a* are tightly contacted against the wall surfaces of the upper opening portions 912*d* (the organic material bank layers 912*b*), thus the light emission layers 910*b* do not directly contact against the organic material bank layers 912*b*. Accordingly, the possibility of water which is included as an impurity in the organic material bank layers 912*b* shifting to the side of the light emission layers 910*b* can be positively blocked by the peripheral edge portions 910*a*2, and thus it is possible to prevent oxidization of the light emission layers 910*b* by such percolating water.

Furthermore, since the peripheral edge portions 910*a*2 are formed in uneven thickness over the first superimposed layer portions 912*e* of the inorganic material bank layers, accordingly the peripheral edge portions 910*a*2 come to be in the state of being insulated from the picture element electrodes 911 by the first superimposed layer portions 912*e*, and thus positive holes are not injected from the peripheral edge portions 910*a*2 into the light emission layers 910*b*. Due to this, the electric current only flows from the picture element electrodes 911 into the flat portions 912*a*, and it is possible to ensure that the transport of positive holes from the flat portions 912*a*1 into the light emission layers 910*b* is even, so that, along with light only being emitted from the central portions of the light emission layers 910*b*, also it is possible to make the amount of light which is generated by the light emission layers 910*b* to be constant.

Yet further, since the inorganic material bank layers 912*a* are extended yet further towards the centers of the picture element electrodes 911 than the organic material bank layers 912*b*, accordingly it is possible to perform trimming of the shapes of the portions where the picture element electrodes 911 and the flat portions 910*a*1 are connected together by these inorganic material bank layers 912*a*, and thus it is possible to repress deviation in light generation strength between the various light emission layers 910*b*.

Even further, since the electrode faces 911*a* of the picture element electrodes 911 and the first superimposed layer portions 912*e* of the inorganic material bank layers both exhibit hydrophilic characteristics, accordingly the functional layers 910 are uniformly sealed against the picture element electrodes 911 and the inorganic material bank layers 912*a*, and the functional layer 910 does not become extremely thin over the inorganic material bank layers 912*a*, so that it is possible to prevent short circuiting between the picture element electrodes 911 and the negative electrode 842.

Again, since the upper surfaces 912*f* of the organic material bank layers 912*b* and the wall surfaces of the upper opening portions 912*d* both exhibit hydrophobic characteristics, the tightness of contact between the functional layers 910 and the organic material bank layers 912*b* becomes low, and it does not happen that the functional layers 910 are made to overflow from the opening portions 912*g*.

Moreover, as the material for making the positive hole injection/transport layer, for example, dispersion liquid of a mixture of polythiophenederivetive etc., for instance polyethylenedioxythiophene, and polystilenesuofonic acid etc. (PEDOT/PSS) may be used. Furthermore, as the material for making the light emission layer 910*b*, for example, polyfluorenederivative, polyphenylenederivative, polyvinylcarbazole, polythiophenederivative, or doped materials by doping perylene group pigments, coumaline group pigments, rhodamine group pigments, for instance, rublene, perylene, 9,10-diphenylanthracene, tetraphenylbutadiene, neilred, coumalin 6, quinacridone with the above polymers may be used.

Next, the negative electrode 842 is formed over the entire surface of the light emitting element portions 841, and, as a pair with the picture element electrodes 911, it fulfils the function of conducting electrical current to the functional layers 910. This negative electrode 842 may be made, for example, as a superposition of a calcium layer and an aluminum layer. At this time, it is desirable to provide the one whose work function is the lower to the negative electrode on the side which is closer to the light emission layer, and in particular, in this embodiment, to directly contact it to the light emission layer 910*b*, so as to fulfill the function of injecting electrons into the light emission layer 910*b*. Furthermore, it sometimes is the case that it is desirable to provide LiF between the light emission layer 910 and the negative electrode 842, since lithium fluoride is efficient at causing light to be emitted from the material for the light emission layer.

Furthermore, the material for the red colored (R) and the green colored (G) light emission layers 910*b*1 and 910*b*2 is not limited to being lithium fluoride; it would be acceptable to employ some other material. Accordingly, in this case, it would be acceptable to make only the blue colored (B) light emission layer 910*b*3 from lithium fluoride, and to superimpose thereupon the other red colored (R) and the green colored (G) light emission layers 910*b*1 and 910*b*2 which were made from some other material than lithium fluoride. Furthermore, it would also be acceptable not to form any lithium fluoride over the red colored (R) and the green colored (G) light emission layers 910*b*1 and 910*b*2, but to make them only from calcium.

Moreover, the thickness of the lithium fluoride is desirably in the range of, for example, 2 to 5 nm, and in particular it may be approximately 2 nm. Furthermore, the thickness of the calcium is desirably in the range of, for example, 2 to 50 nm, and in particular it may be approximately 20 nm.

Furthermore, since the aluminum of which the negative electrode 842 is made reflects light which is emitted from the light emission layer 910*b* towards the side of the base plate 832, it is desirable for it to include some layer other than aluminum, such as an Ag layer or a superimposed combination of Al and Ag, or the like. Furthermore, it is desirable for the thickness of this layer to be within the range of, for example, 100 to 1000 nm, and in particular it is desirable for it to be approximately 200 nm.

Yet further, it would also be acceptable to provide a protective layer for preventing oxidization made from SiO, $SiO_2$, SiN or the like upon the aluminum negative electrode 842.

Moreover, the sealing cover plate 604 may be provided over this light emitting element which has been made in the above manner. As shown in FIG. 55(*b*), this sealing cover plate 604 may be adhered with the sealing resin 603, so as to form the display device 831.

Method of Manufacture of the Display Device

Next, a method of manufacture of this display device according to this preferred embodiment of the present invention will be explained with reference to the figures.

A method of manufacture of the display device 831 of this preferred embodiment, for example, may consist of (1) a process of formation of the bank portions; (2) a process of plasma processing (which may include a process of hydrophilization or water repellentation); (3) a process of forming the positive hole injection/transport layer (a process of forming the functional layer); (4) a process of formation of the light emission layer (a process of forming the functional layer); (5) a process of formation of the opposing electrode (the negative electrode); and (6) a process of sealing. It should be understood that the method of manufacture of the display device 831 is not necessarily limited to the combination of the above processes performed in the above order; according to requirements, various ones of these processes could be omitted, or some others could be added.

(1) The Process of Formation of the Bank Portions

The process of formation of the bank portions is a process of forming the bank portions 912 in predetermined positions upon the base plate 832. In these bank portions 912, the inorganic material bank layers 912*a* are formed as first bank layers, and the organic material bank layers 912*b* are formed as second bank layers. The method of formation of these bank layers will now be explained.

(1)-1 The Process of Forming the Inorganic Material Bank Layers 912*a*

Figure 57:
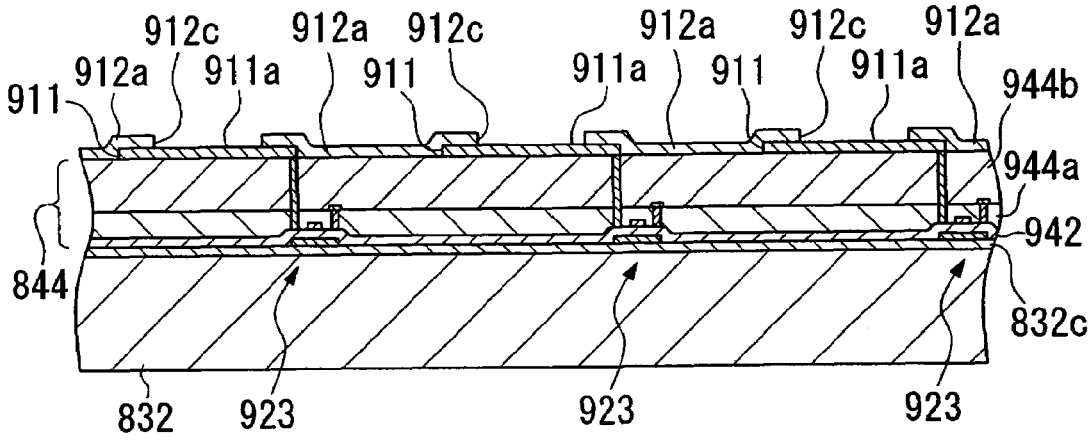
FIG. 57 is a process diagram for explanation of the method of manufacture of the same display device.

First, as shown in FIG. 57, the inorganic material bank layers 912*a* are formed upon the substrate in the predetermined positions. These positions in which the inorganic material bank layers 912*a* are formed are upon the second inter layer insulating layer 144*b* and upon the electrode (here, the picture element electrode) 911. It should be understood that the second inter layer insulating layer 144*b* is formed on top of the circuit element portion 844 in which the various components such as the thin film transistors, the scan lines, the signal lines, and on are provided.

The inorganic material bank layers 912*a*, for example, may be made as inorganic material layers using SiO2, TiO2 or the like. These materials may be formed, for example, using a CVD method, a coating method, a spattering method, a vacuum evaporation method, or the like.

Furthermore, it is desirable for the film thickness of the inorganic material bank layers 912*a* to be in the range from 50 to 200 nm, and in particular it may be 150 nm.

First, the inorganic material bank layers 912*a* are formed as an inorganic material layer over the entire surfaces of the inter layer insulating layer 914 and the picture element electrode 911, and, after this, the inorganic material bank layers 912*a* are formed by patterning this inorganic material layer by a photolithographic method or the like, so as to create opening portions. These opening portions are located in positions corresponding to the positions of formation of the electrode surfaces 911*a* of the picture element electrodes 911, and accordingly, as shown in FIG. 57, are provided as the lower opening portions 912*c*.

At this time, the inorganic material bank layers 912*a* are formed so as to overlay the peripheral edge portions (the one portions) of the picture element electrodes 911. As shown in FIG. 57, it is possible to control the light emission region of the light emission layer 910 by thus forming the inorganic material bank layers 912*a* so that the one portions of the picture element electrodes 911 and the inorganic material bank layers 912*a* overlap.

(1)-2 The Process of Forming the Organic Material Bank Layers 912*b*

Next, the organic material bank layers 912*b* are formed as second bank layers.

Figure 58:
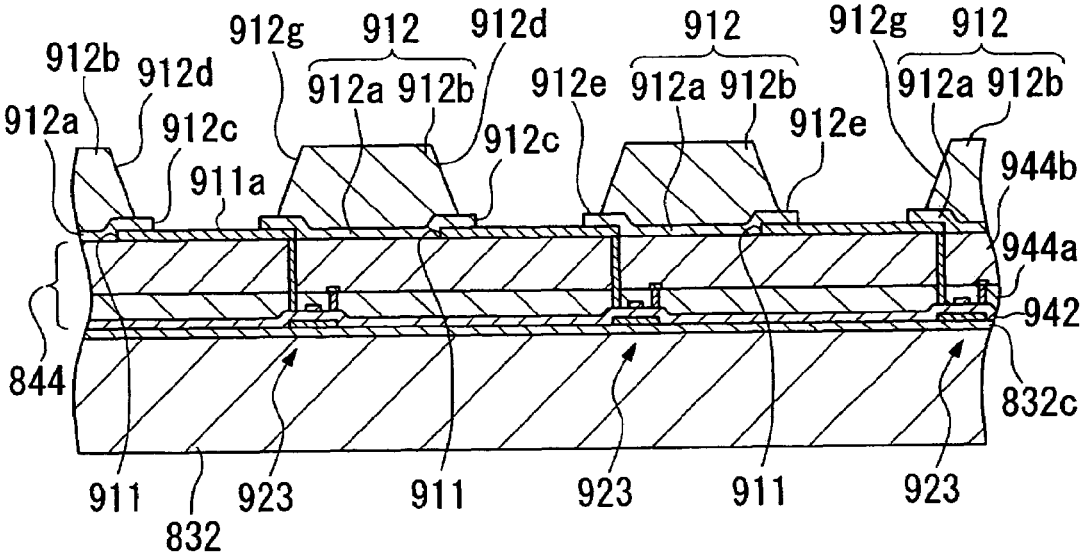
FIG. 58 is another process diagram for explanation of the method of manufacture of the same display device.

As shown in FIG. 58, the organic material bank layers 912*b* are formed upon the inorganic material bank layers 912*a*. These organic material bank layers 912*b* should be made from a material which is heat resistant and solvent resistant, such as, for example, acrylic resin, polyimide resin or the like. Using such a material, the organic material bank layers 912*b* are formed by patterning employing a technique such as photolithography or the like. It should be understood that the upper opening portions 912*d* are formed in these organic material bank layers 912*b* during this patterning. These upper opening portions 912*d* are provided in positions which correspond to the positions of the electrode faces 911*a* and the lower opening portions 912*c*.

It is desirable for the upper opening portions 912*d* to be made, as shown in FIG. 58, wider than the lower opening portions 912*c* which were formed in the inorganic material bank layer 912*a*. Furthermore, it is desirable for the organic material bank layer 912*b* to be formed as tapered, in other words, it is desirable for the opening portions of the organic material bank layers to be formed narrower than the width of the picture element electrodes 911, while, at the uppermost surface of the organic material bank layers 912*b*, these organic material bank layers 912*b* are formed so as to have almost the same widths as the widths of the picture element electrodes 911.

According to this, the first layer superimposed portions 912*e* which surround the lower opening portions 912*c* of the inorganic material bank layers 912*a* come to be formed so as to extend further towards the centers of the picture element electrodes 911 than the organic material bank layers 912*b*.

By juxtaposing together the upper opening portions 912*d* which are formed in the organic material bank layers 912*b* and the lower opening portions 912*c* which are formed in the inorganic material bank layers 912*a* in this manner, the opening portions 912*g* are formed so as to pierce through the inorganic material bank layers 912*a* and the organic material bank layers 912*b*

Furthermore, it is desirable for the film thickness of the organic material bank layers 912*b* to be in the range from 0.1 to 3.5 μm, and in particular it may be about 2 μm. The reason why this range is employed will now be explained.

That is to say, if the thickness of the organic material bank layers 912*b* is less than 0.1 μm, the inorganic material bank layers 912*b* become thinner than the total of the thicknesses of the positive hole injection/transport layer and the light emission layers which will be described hereinafter, and there is a danger that the light emission layers 910*b* will overflow from the upper opening portions 912*d*, which would be most undesirable.

Furthermore, if the thickness of the organic material bank layers 912*b* is greater than 3.5 μm, the steps become bigger than the upper opening portions 912*d*, and this is not desirable, since it becomes impossible to guarantee the step coverage of the negative electrode 842 at the upper opening portions 912*d*. Furthermore, it is desirable for the thickness of the organic material bank layers to be made to be greater than 2 μm, from the point of view of being able to enhance the degree of insulation between the negative electrode 842 and the thin film transistors 123 for driving.

(2) The Plasma Processing Process

The following plasma processing process is performed with the objective of activating the surfaces of the picture element electrodes 911, and also with the objective of performing surface processing of the surfaces of the bank portions 912. In particular, the activation process is performed with the principal objectives of cleaning the surface of the picture element electrodes 911 (ITO), and also of adjusting the work function thereof. Furthermore, a process of making the surfaces of the picture element electrodes to be hydrophilic (a hydrophilization process) and a process of making the surfaces of the bank portions 912 to be hydrophobic (a water repellentation process) are performed.

This plasma processing process can generally, for example, be separated into the following processes: (2)-1 a preliminary heating up process; (2)-2 an activation processing process (a process of hydrophilization); (2)-3 a hydrophobic processing process (a process of water repellentation); and (2)-4 a process of cooling. It should be understood that the plasma processing process is not necessarily limited to the combination of the above processes performed in the above order; according to requirements, various ones of these processes could be omitted, or some others could be added.

Figure 59:
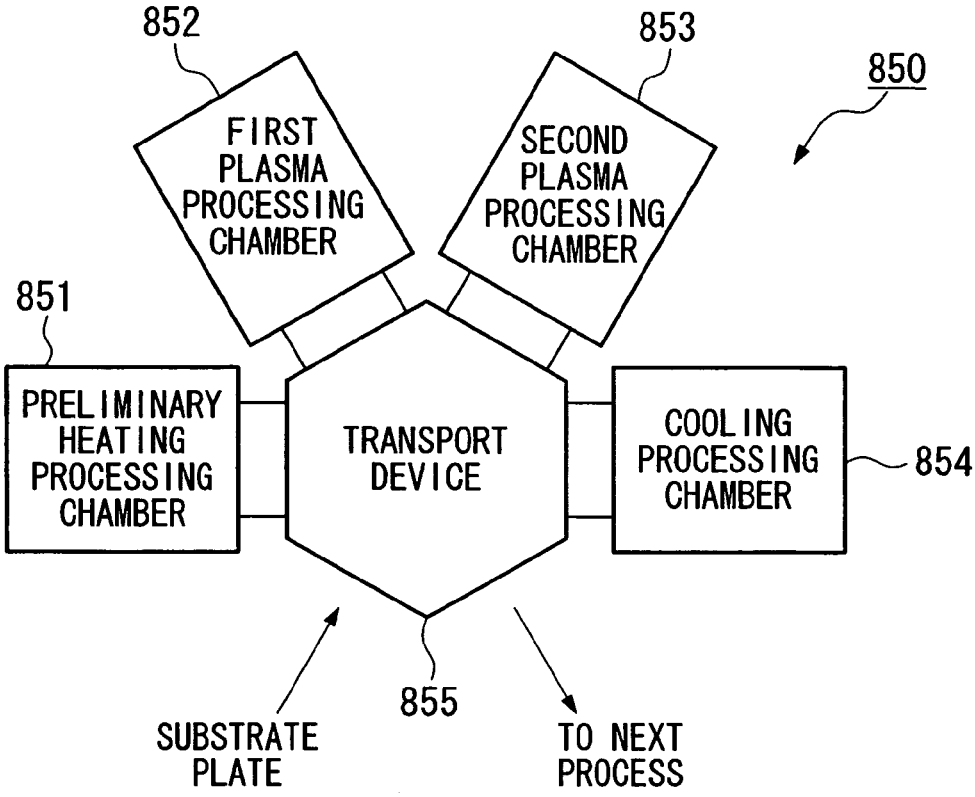
FIG. 59 is a schematic plan view showing one example of a plasma processing device which is utilized in the manufacture of the same display device.

First, FIG. 59 shows a plasma processing device which is used for this plasma processing process.

The plasma processing device 850 shown in FIG. 59 comprises a preliminary heating processing chamber 851, a first plasma processing chamber 852, a second plasma processing chamber 853, a cooling processing chamber 854, and a transport device 855 which transports the base plate 832 into each of these processing chambers 851 through 854. These processing chambers 851 through 854 are arranged radially around the transport device 855, which is at the center.

First, the overall process which employs these devices will be explained.

The preliminary heating up process is performed in the preliminary heating processing chamber 851 shown in FIG. 59. And the base plate 832 which has been transported from the previous bank portion formation process is heated up to a predetermined temperature in this preliminary heating processing chamber 851.

After the preliminary heating up process, a hydrophilization processing process and a water repellentation processing process are performed. That is to say, the work-piece is transported in order to the first plasma processing chamber 852 and then to the second plasma processing chamber 853, and plasma processing is performed upon the bank portions 912 in each of these plasma processing chambers 852 and 853, so as to subject them to hydrophilization. After this hydrophilization process, water repellentation processing is performed. After this water repellentation process, the work-piece is transported to the cooling processing chamber 854, and in this cooling processing chamber 854 the work-piece is cooled to room temperature. After this cooling process, the work-piece is transported by the transport device to the positive hole injection/transport layer formation process, which is the next major process in order to be performed.

In the following, these various processes will be explained in detail.

(2)-1 The Preliminary Heating Up Process

This preliminary heating up process is performed by the preliminary heating processing chamber 851. In this processing chamber 851, the base plate 832 which includes the bank portions 912 is heated up to a predetermined temperature.

As a method of heating up the base plate 832, for example, the means may be employed of fitting a heater upon a stage upon which the base plate 832 is mounted in the processing chamber 851, and of heating up the base plate 832 together with the stage by this heater. It should be understood that it would also be possible to utilize various other methods, as appropriate.

The base plate 832 is heated up in the preliminary heating processing chamber 851 to, for example, a temperature of 70 degree celsius to 80 degree Celsius. This temperature is the processing temperature for the plasma processing which is the next process, and the base plate 832 is heated up as a preparation for this next process, with the objective of eliminating variations in the temperature of the base plate 832.

If hypothetically this preliminary heating up process were not to be applied, then, during the plasma processing process, the processing would be performed while the temperature was always varying from the start of the process to the end of the process, as the base plate 832 was heated up from room temperature to the above type of temperature. Accordingly, due to performing the plasma processing while the work-piece temperature was varying, there would be a possibility that the characteristic of the resulting organic electro-luminescent display element might be uneven. Therefore the preliminary heating up process is performed, in order to maintain constant processing conditions, and in order to obtain a uniform characteristic for the resultant product.

In this connection, when, in the plasma processing process, a hydrophilization process or a water repellentation process is performed in the state in which the base plate 832 is held upon the stage within the first and second plasma processing devices 852 and 853, it is desirable for the preliminary heating up temperature to be almost the same temperature as the temperature of the sample stage 856 upon which the hydrophilization process or the water repellentation process is continuously performed.

Thus, by raising the temperature of the sample stage within the first and second plasma processing devices 852 and 853 so as to perform preliminary heating up of the base plate 832 in advance to a temperature of, for example, 70 degree Celsius to 80 degree Celsius, it is possible to keep the plasma processing conditions almost constant from directly after the start of the processing until just before the end of the processing, even in the case that plasma processing is being performed continuously upon a large number of work-pieces. Due to this, the processing conditions upon the surface of the base plate 832 are made constant, and it is possible to keep the dampness of the material of which the bank portions 912 are composed more uniform, so that it becomes possible to manufacture a display device which is of constant quality.

Furthermore, by thus performing preliminary heating up of the base plate 832 in advance, it becomes possible to shorten the processing time period which is required for the subsequent plasma processing.

(2)-2 The First Activation Processing Process (the Process of Hydrophilization)

Next, activation processing is performed in the first plasma processing chamber 852. This activation processing includes adjusting and controlling the work function of the picture element electrodes 911, cleaning the surfaces of the picture element electrodes 911, and performing hydrophilization processing of the surfaces of the picture element electrodes 911.

Figure 60:
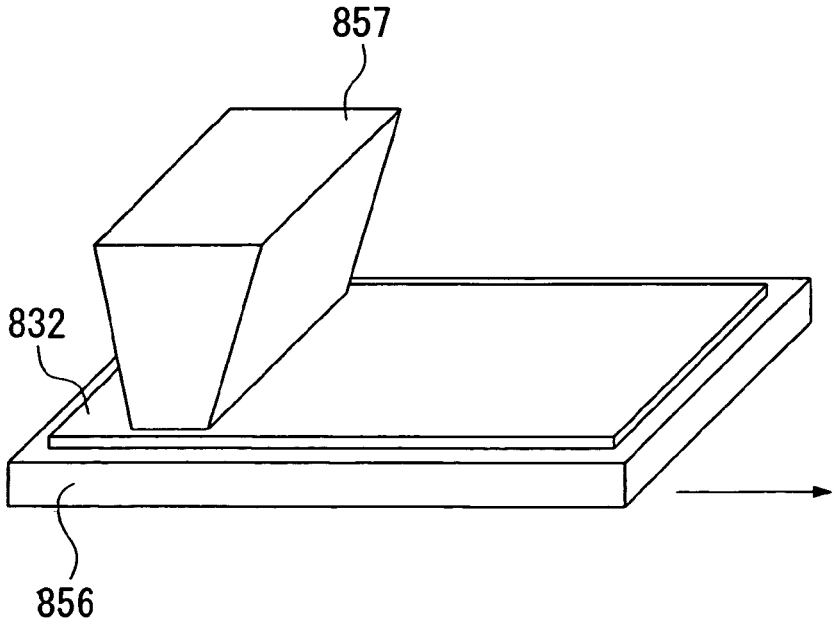
FIG. 60 is a schematic view showing an internal structure of a first plasma processing chamber of the plasma processing device shown in FIG. 59.

As a hydrophilization process, plasma processing is performed in an ambient atmosphere using oxygen as the processing gas (so called O2 plasma processing). In FIG. 60, this first plasma processing process is schematically shown. As shown in FIG. 60, the base plate 832 including the bank portions 912 is loaded upon the sample stage 856 which includes a heater, and a plasma electrical discharge electrode 857 is arranged to oppose the base plate 832 at a distance or gap interval of approximately 0.5 to 2 mm from the upper side of said base plate 832. The base plate 832 is transported by the sample stage 856 at a predetermined transport speed in the direction of the arrow in the figure while being heated up by the sample stage 856, and during this transportation the base plate 832 is irradiated with oxygen in the plasma state.

The conditions of this O2 plasma processing, for example, may be: plasma power 100 to 800 kW, oxygen gas flow rate 50 to 100 ml/min, base plate transport speed 0.5 to 10 mm/sec, and work-piece temperature 70° C. to 90° C. It should be understood that the heating up by the sample stage 856 is principally performed in order to maintain the temperature of the base plate 832 which has been previously subjected to preliminary heating up, as explained above.

Figure 61:
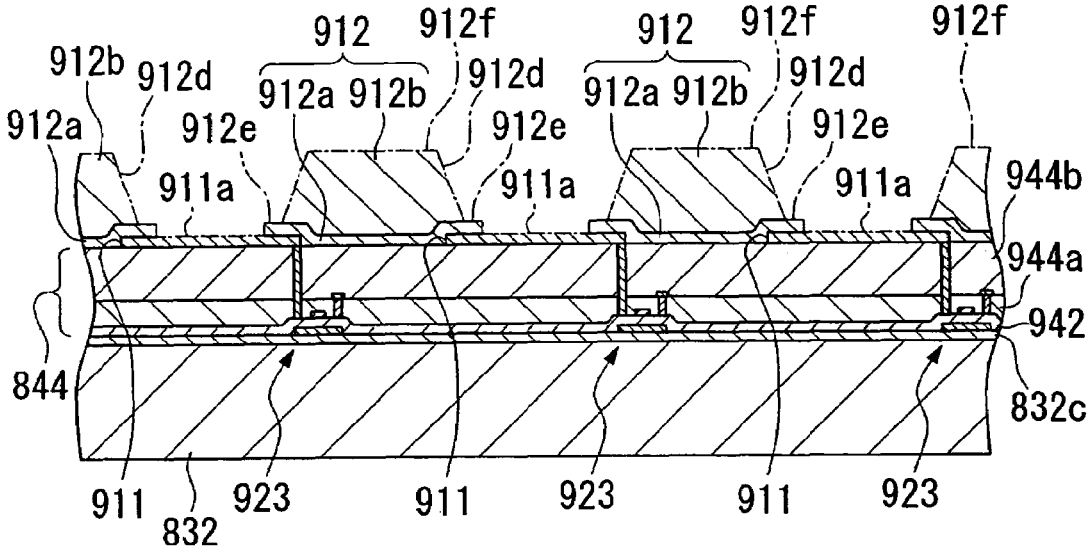
FIG. 61 is a process diagram for explanation of the method of manufacture of the same display device.

By this O2 plasma processing, as shown in FIG. 61, the electrode surfaces 911*a* of the picture element electrodes 911, the first superimposed layer portions 921*e* of the inorganic material bank layers 912*a*, and the wall surfaces of the upper opening portions 912*d* and the upper surfaces 912*f* of the organic material bank layers 912*b* are processed to be hydrophilic. Hydroxyl groups are introduced into these various surfaces by this hydrophilization processing, so as to endow them with hydrophilic characteristics.

The portions which have been subjected to hydrophilization processing are shown in FIG. 61 by the single dotted broken lines.

It should be understood that this O2 plasma processing does not only impart a hydrophilic characteristic to the subject surfaces; by the above described processing, it also serves to clean the ITO which constitutes the picture element electrodes, and also to adjust its work function.

(2)-3 The Second Hydrophobic Processing Process (the Process of Water Repellentation)

Next, as a water repellentation process, plasma processing is performed in the second plasma processing chamber 853 in an ambient atmosphere, using tetrafluoromethane as the processing gas (so called $CF_4$ plasma processing). The internal structure of the second plasma processing chamber 853 is the same as the internal structure of the first plasma processing chamber 852 shown in FIG. 60. In other words, the base plate 832 is transported by the sample stage at a predetermined transport speed while being heated up by the sample stage 856, and during this transportation the base plate 832 is irradiated with tetrafluoromethane ($CF_4$) in the plasma state.

The conditions of this CF4 plasma processing, for example, may be: plasma power 100 to 800 kW, $CF_4$ gas flow rate 50 to 100 ml/min, work-piece transport speed 0.5 to 1020 mm/sec, and work-piece temperature 70 degree Celsius to 90 degree Celsius. It should be understood that, just as was the case in the first plasma processing chamber 852, the heating up by the sample stage is principally performed in order to maintain the temperature of the base plate 832 which has been previously subjected to preliminary heating up, as explained above.

Moreover, it should be understood that the processing gas is not limited to being tetrafluoromethane; it would also be possible to utilize some other fluorocarbon type gas.

Figure 62:
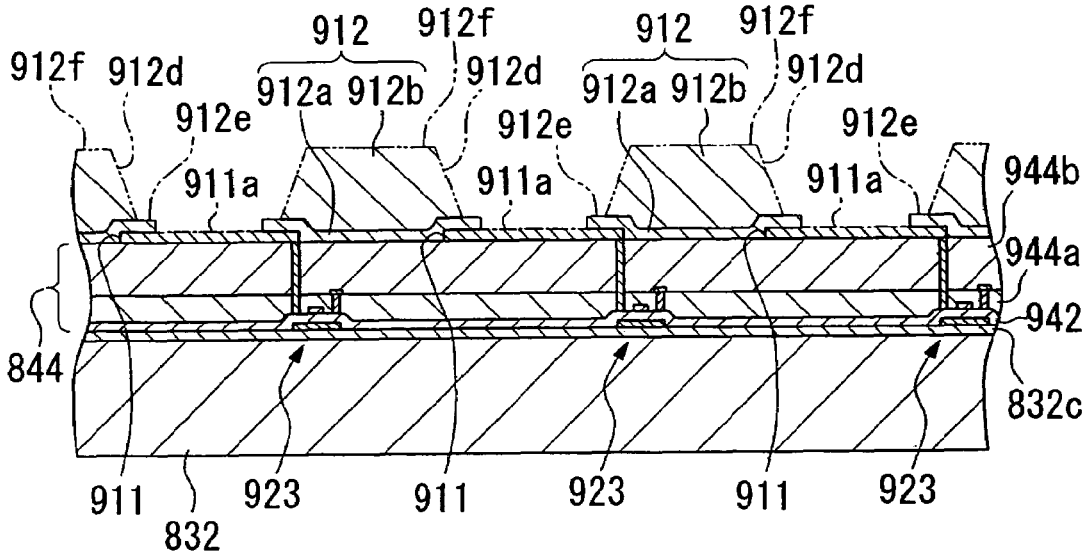
FIG. 62 is another process diagram for explanation of the method of manufacture of the same display device.

By this CF4 plasma processing, as shown in FIG. 62, the wall surfaces of the upper opening portions 912*d* and the upper surfaces 912*f* of the organic material bank layers are processed to be hydrophobic. Fluorine groups are introduced into these various surfaces by this water repellentation processing, so as to endow them with hydrophilic characteristics. The portions which have been subjected to water repellentation processing are shown in FIG. 62 by the double dotted broken lines. The organic material such as acrylic resin, polyimide resin or the like of which the organic material bank layers 912*b* are composed can be easily hydrophobized by irradiation with fluorocarbon in the plasma state. Furthermore, this preferred embodiment of the present invention is particularly effective, because the particular characteristic is exhibited that the portions which have been subjected to preliminary processing with $O_2$ plasma can more easily be fluoridized.

It should be noted that, although the electrode surfaces 911*a* of the picture element electrodes 911 and the first superimposed layer portions 912*e* of the inorganic material bank layers 912*a* are also subjected to the influence of this $CF_4$ plasma processing to a greater or lesser extent, very little influence is exerted upon their dampness. In FIG. 62, The portions which exhibit hydrophilic characteristics are shown by the single dotted broken lines.

(2)-4 The Process of Cooling

Next, as a cooling process, the base plate 832 which was heated up for the plasma processing processes is cooled to a controlled temperature using the cooling processing chamber 854. In other words, this process is performed for cooling the work-piece to the suitable operating temperature for a liquid drop discharge process (a functional layer formation process) which is the subsequent process.

This cooling processing chamber 854 comprises a plate for holding the base plate 832, and this plate is made to include a water cooling device, so as to cool the base plate 832.

Furthermore, by cooling the base plate 832 after the plasma processing to room temperature or to a predetermined temperature (for example, the operating temperature for the liquid drop discharge process), the temperature of the base plate 832 becomes constant in the subsequent process of formation of the positive hole injection/transport layer, and it is possible to perform the subsequent processes at an even temperature with the base plate 832 not being subject to temperature variations. Accordingly, by adding this type of cooling process, it is possible to form uniformly the material which is discharged by the discharge means such as a liquid drop discharge method or the like.

For example, when discharging a first composite material which includes a material for forming the positive hole injection/transport layer, it is possible to discharge this first composite material continuously at a constant volume, so that it is possible to form a uniform positive hole injection/transport layer.

In the above described plasma processing processes, it is possible easily to provide the desired regions of hydrophilic characteristics and the regions of hydrophobic characteristics upon the bank portions 912, by processing the organic material bank layers 912*b* and the inorganic material bank layers 912*a* by $O_2$ plasma processing and $CF_4$ plasma processing in sequence.

Figure 63:
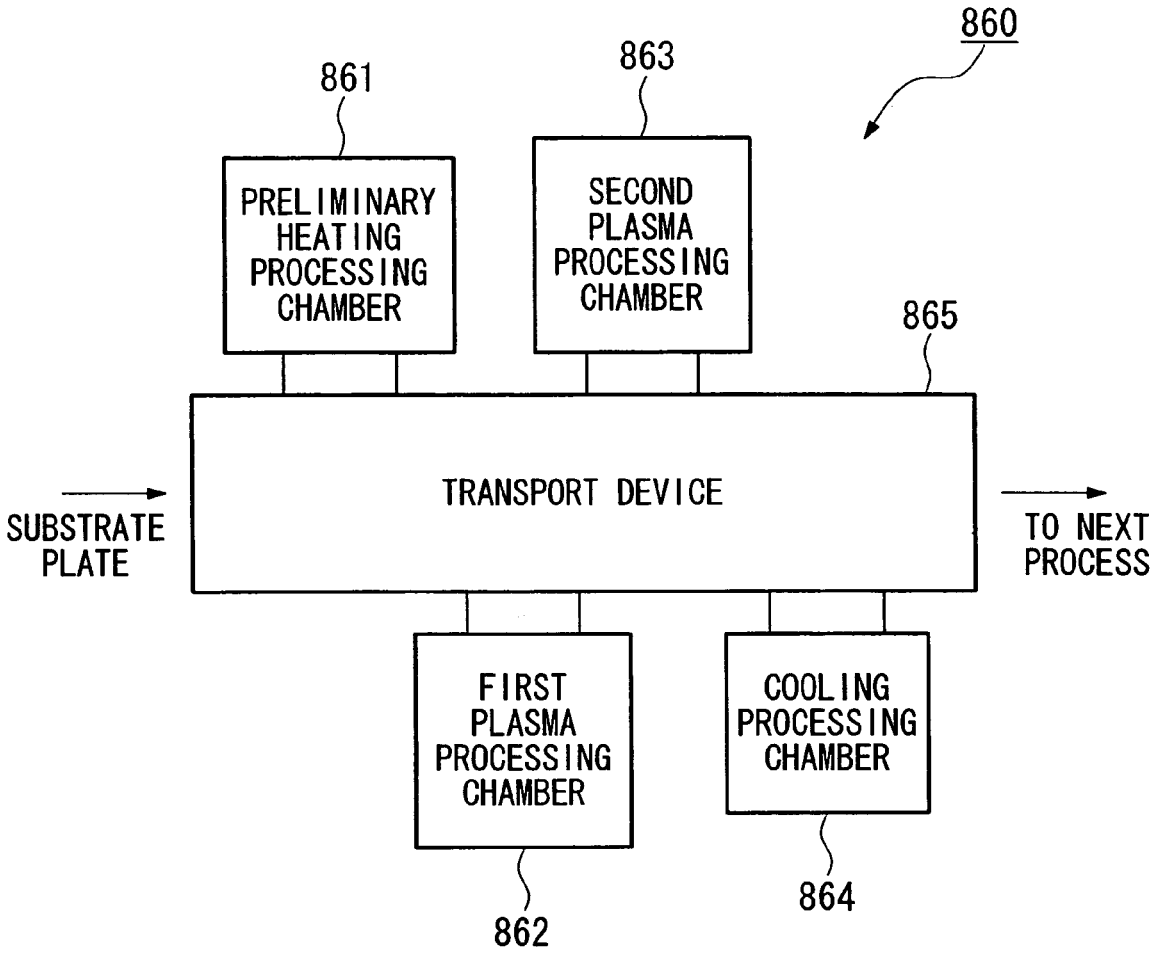
FIG. 63 is a schematic plan view showing another example of a plasma processing device which is utilized in the manufacture of the same display device.

It should be understood that the plasma processing device which is to be used for the plasma processing processes is not to be considered as being limited to the device shown in FIG. 59; for example, it would also be possible to utilize the plasma processing device 860 shown in FIG. 63.

The plasma processing device 860 shown in FIG. 63 comprises a preliminary heating processing chamber 861, a first plasma processing chamber 862, a second plasma processing chamber 863, a cooling processing chamber 864, and a transport device 865 which transports the base plate 832 into each of these processing chambers 861 through 864; and these processing chambers 861 through 864 are arranged linearly upon both sides of the transport direction of the transport device 865 (i.e. on both sides of the direction shown by the arrow in the figure).

With this plasma processing device 860, in the same manner as with the plasma processing device 850 which was shown in FIG. 59, the base plate 832 which has been transported from the bank portion formation process is transported in order to the preliminary heating processing chamber 861, the first plasma processing chamber 862, the second plasma processing chamber 863, and the cooling processing chamber 864, and, after the same processes have been performed by these various processing chambers in the same manner as described above, the base plate 832 is transported to the subsequent positive hole injection/transport layer formation process.

Furthermore, for the above described plasma device, rather than a device which operated in the ambient atmosphere, a plasma processing device could also be utilized which operated in a vacuum.

(3) The Process of Forming the Positive Hole Injection/Transport Layer (the Process of Forming the Functional Layer)

In the process of formation of the positive hole injection/transport layer, a first composite material which includes a material for forming the positive hole injection/transport layer is discharged over the picture electrode surfaces 911*a* by utilizing, for example, a liquid drop discharge device for liquid drop discharge. Drying processing and heat processing are performed after this discharge process, and thereby the positive hole injection/transport layer 910*a* is formed over the picture element electrodes 911 and the inorganic material bank layers 912*a*. It should be understood that the inorganic material bank layers 912*a* upon which this positive hole injection/transport layer 910*a* has been formed are termed the first superimposed layer portions 912*e*.

It is desirable for the following processes, which include this positive hole injection/transport layer formation process, to be performed in an atmosphere which contains no water or oxygen. For example, it is desirable for them to be performed in an inert gas atmosphere such as a nitrogen atmosphere, an argon atmosphere, or the like.

It should be understood that the positive hole injection/transport layer may not be formed over the first superimposed layer portions 912*e*. In other words, there are some embodiments of the present invention in which the positive hole injection/transport layer is only formed over the picture element electrodes 911.

The method of manufacture by liquid drop discharge is as follows.

As a desirable type of liquid drop discharge head for use in the method of manufacture of a display device according to this preferred embodiment of the present invention, a head unit 920 (refer to FIG. 64) which has almost the same basic structure as the head unit according to the previous preferred embodiment shown in FIG. 23 may be used. Furthermore, with regard to the arrangement of the work-piece and the above described head unit, the arrangement shown in FIG. 64 is desirable.

Figure 64:
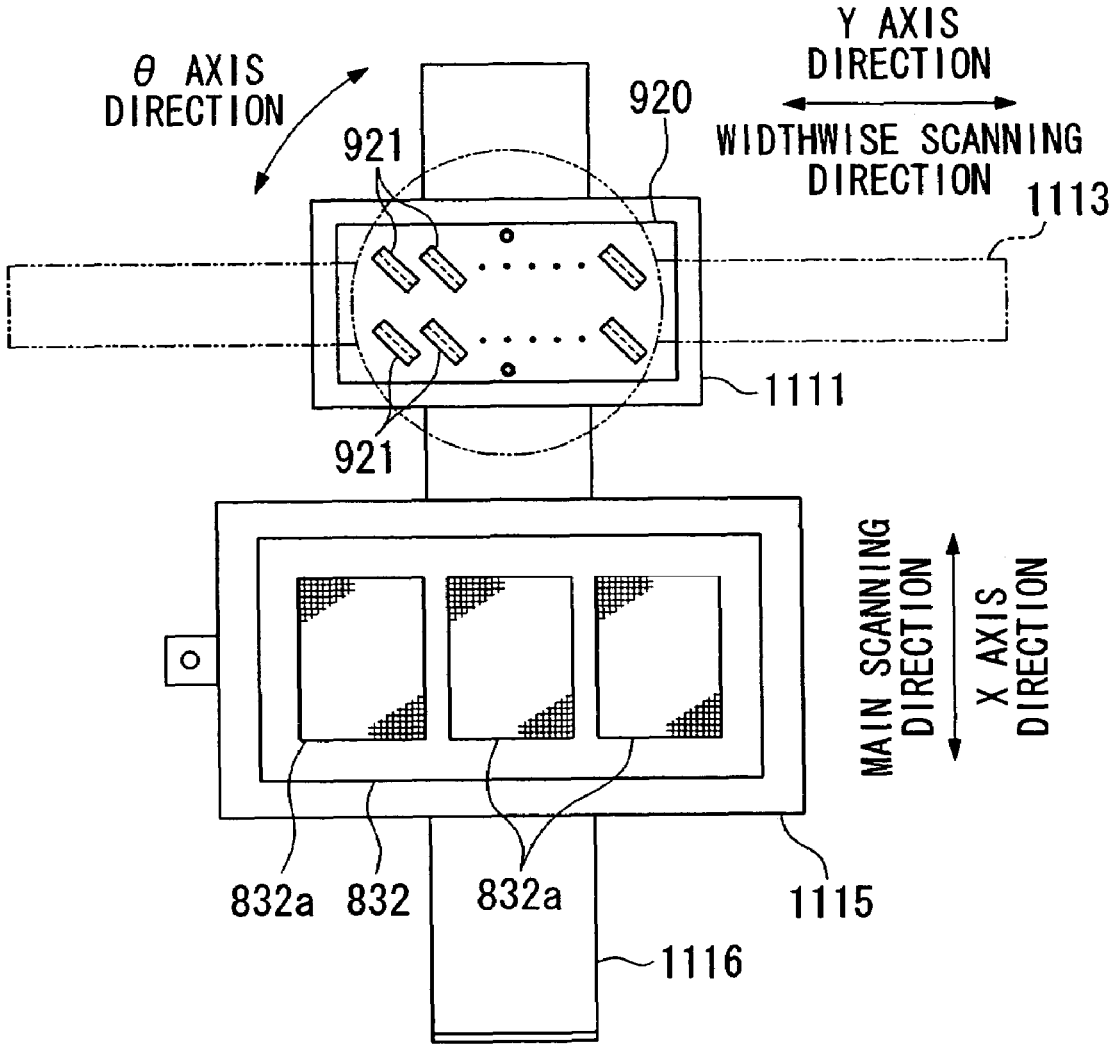
FIG. 64 is a plan view showing a liquid drop discharge device which is utilized in the manufacture of the same display device.

In the liquid drop discharge device shown in FIG. 64, there is included a head unit 920 which has almost the same structure as the one shown in FIG. 23. Furthermore, the reference symbol 1115 denotes a stage upon which the base plate 832 is mounted, while the reference symbol 1116 denotes a pair of guide rails which guide the stage 1115 along the X axis direction in the figure (the main scanning direction). And the head unit 920 is arranged to be capable of being shifted, via a support member 1111, in the Y axis direction in the figure (the widthwise scanning direction) along guide rails 1113, and moreover this head unit 920 is arranged to be rotatable around the θ axis direction as shown in the figure, so that ink jet heads 921 may be inclined to a predetermined angle with respect to the main scanning direction.

The base plate 832 shown in FIG. 64 is made as a plurality of chips disposed upon a motherboard. In other words, a single region containing chips corresponds to a single display device. Although in the figure it is shown that three display regions 832*a* have been formed, this is not to be considered as being limitative of the present invention. For example, when applying the composite material upon the left side display region 832*a* upon the base plate 832, along with shifting the heads 921 along the guide rails 1113 to the left side in the figure, they are also shifted along the guide rails 1116 to the upper side in the figure, and the composite material is applied while scanning the base plate 832. Next the heads 921 are shifted to the central position in the figure, and the composite material is applied to the central display region 832*a* of the work-piece. The same procedure, mutatis mutandis, is applied for applying the composite material to the right side display region 832*a* in the figure.

It should be understood that the head unit and the liquid drop discharge device shown in FIG. 64 are not limited to use in the positive hole injection/transport layer formation process; they may also be used for the light emission layer formation process.

Figure 65:
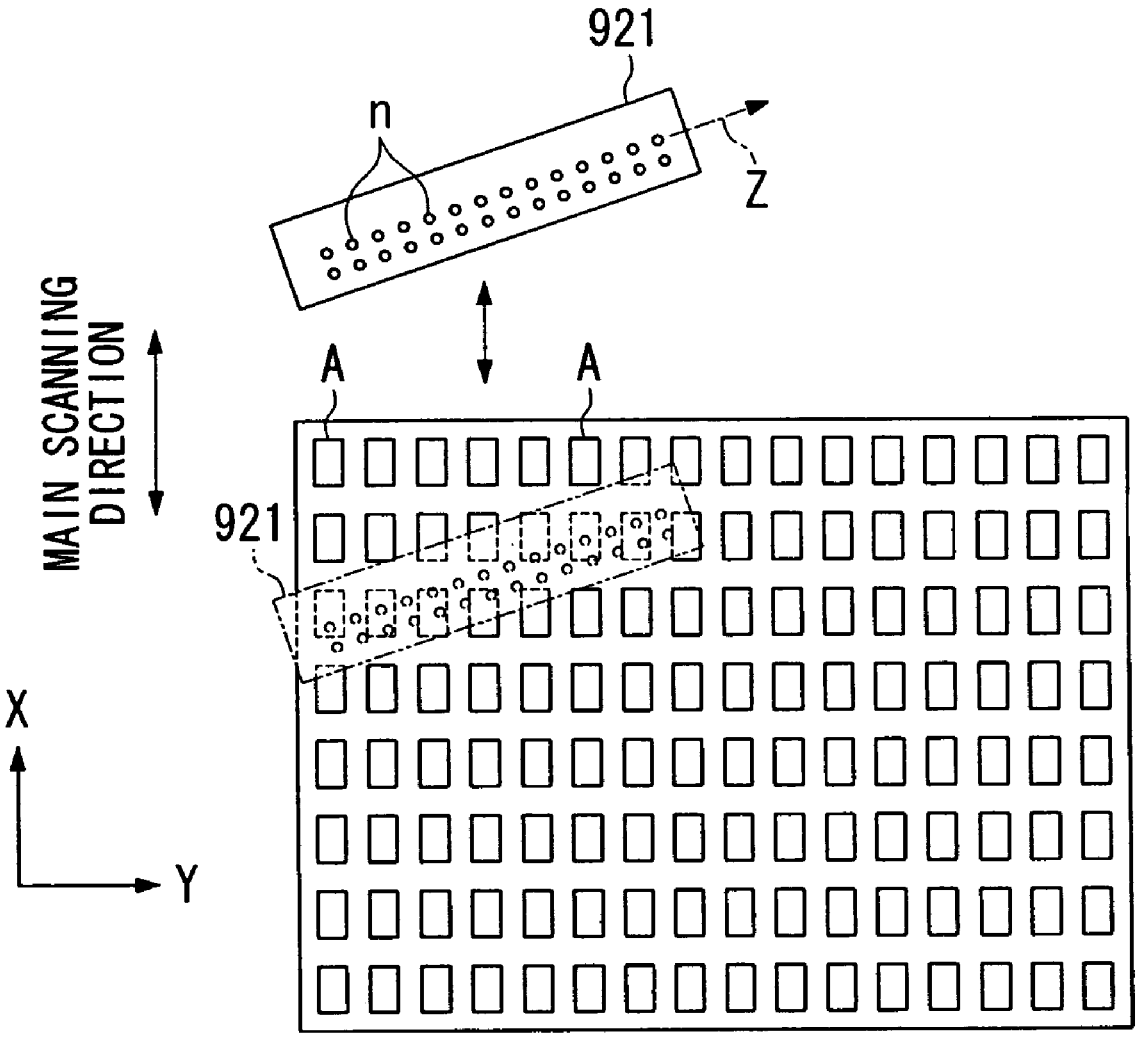
FIG. 65 is a plan view showing the state in which an ink jet head is arranged upon a base member.

FIG. 65 shows the state in which a ink jet head 921 is being scanned with respect to the base plate 832. As shown in this figure, although the first composite material is discharged while relatively shifting the ink jet heads 921 along the X direction in the figure, at this time, the direction Z of arrangement of the nozzles is in the state of being inclined with respect to the main scanning direction (along the X direction). By arranging the direction of arrangement of the nozzles n of the ink jet head 921 to be inclined with respect to the main scanning direction in this manner, it is possible to make the pitch of the nozzles correspond to the pitch of the picture element regions A. Furthermore, by adjusting the angle of inclination, it is possible to make the pitch of the nozzles correspond to the pitch of any type of picture element regions A.

Next, the process of forming the positive hole injection/transport layer 910*a* in each of the picture element regions A by scanning the ink jet head 921 will be explained. For this process there are three possibilities: (1) a method which is performed with a single scanning episode of the ink jet head 921; (2) a method which is performed with a plurality of scanning episodes of the ink jet head 921, and moreover by using a plurality of nozzles during those scanning episodes; and (3) a method which is performed with a plurality of scanning episodes of the ink jet head 921, and moreover by using a separate nozzle in each of those scanning episodes. In the following, each of these three methods (1) through (3) will be explained in order.

(1) A Method Performed with a Single Scan of the Ink Jet Head 921

Figure 66A:
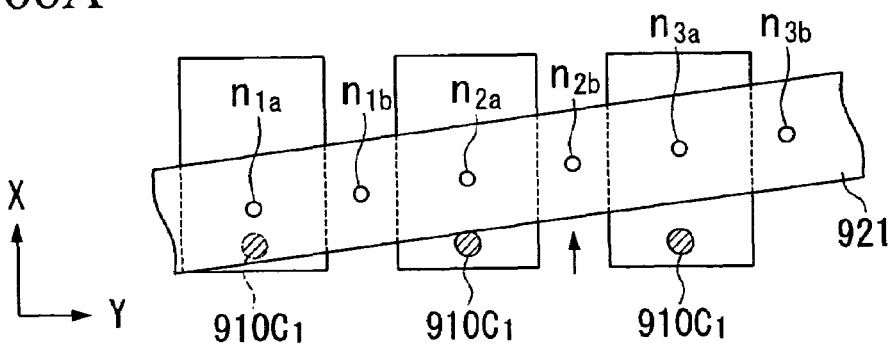
FIGS. 66(A)-66(C) are process diagrams showing a process when forming a positive hole injection and transport layer with one scanning of an ink jet head.
Figure 66B:
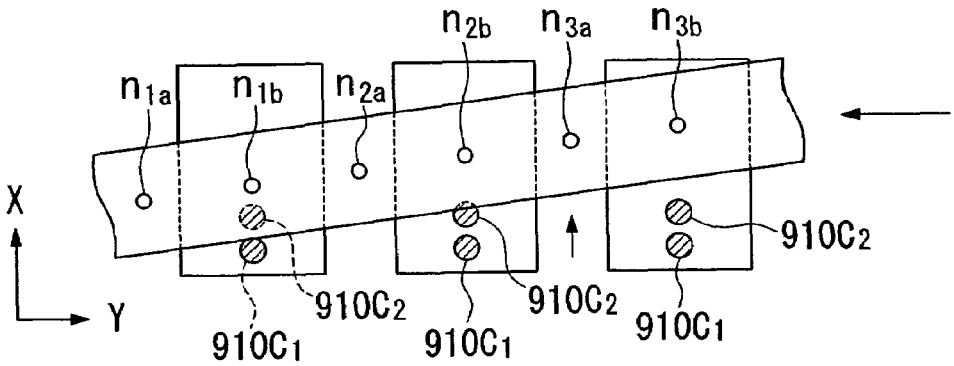
Figure 66C:
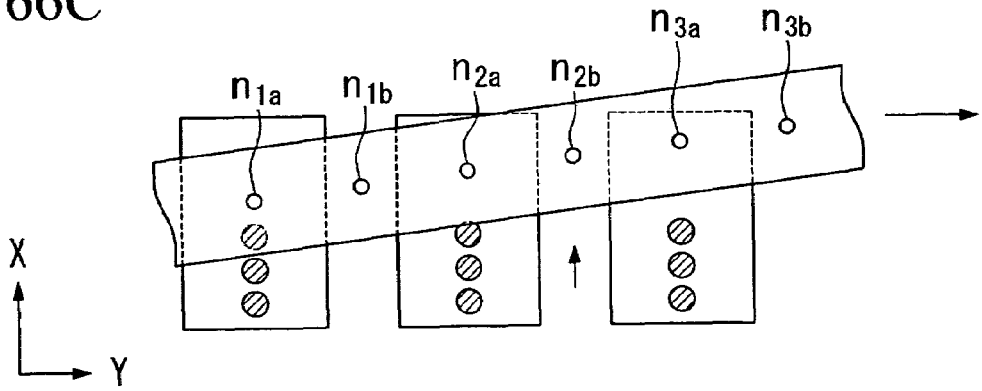

FIG. 66 is a process diagram showing this process when forming the positive hole injection/transport layer 910*a* upon the various picture element regions A1 . . . with a single scan of the ink jet head 921. FIG. 66(*a*) shows the situation after the ink jet head 921 has scanned from the position shown in FIG. 65 along the X direction in the figure; FIG. 66(*b*) shows the situation when, from the situation shown in FIG. 66(*a*), the ink jet head 921, along with scanning a little along the X direction in the figure, has also shifted in the direction opposite to the Y direction in the figure; and FIG. 66(*c*) shows the situation when, from the situation shown in FIG. 66(*b*), the ink jet head 921, along with scanning a little along the X direction in the figure, has also shifted in the Y direction in the figure.

Figure 69:
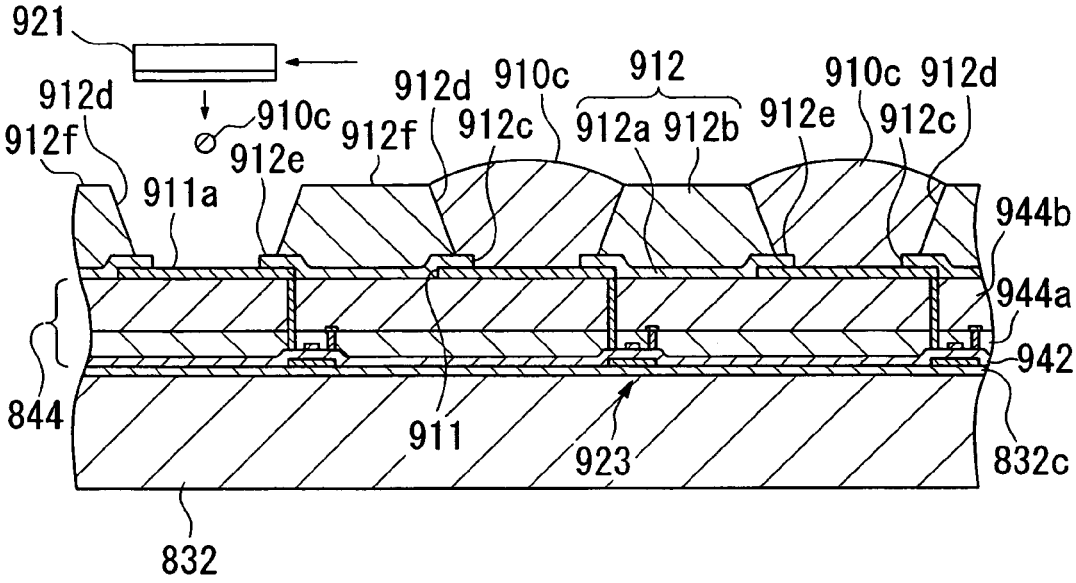
FIG. 69 is a process diagram showing a method of manufacture of a display device which is another embodiment of an electro optical device according to the present invention.

Furthermore, in FIG. 69 there is shown a schematic sectional view of the picture element regions A and of the ink jet head. Six of the nozzles which are provided to one portion of the ink jet head 921 are shown in FIG. 66 and are designated by the reference symbols n1*a* through n3*b*. Three of these six nozzles, the ones designated as n1*a*, n2*a*, and n3*a*, are arranged so as to be respectively positioned over picture element regions A1 through A3 when the ink jet head 921 is shifted in the X direction as seen in the figure, while the other three of the six nozzles, i.e. the ones designated as n1*b*, n2*b*, and n3*b*, are arranged so as to be positioned between adjacent ones of the picture element regions A1 through A3 when the ink jet head 921 is shifted in the X direction as seen in the figures.

In FIG. 66(*a*), among the nozzles which are included in the ink jet head 921, the first composite material which is included in the material which is to form the positive hole injection/transport layer is discharged upon the picture element regions A1 through A3 from the three nozzles n1*a* through n3*a*. It should be understood that in this preferred embodiment of the present invention the first composite material is discharged by scanning the ink jet head 921 over the base plate 832, but it would also be acceptable, as an alternative, to scan the base plate 832 under the ink jet head 921.

Furthermore, it would also be possible to discharge the first composite material by shifting the ink jet head 921 and the base plate 832 relatively to one another. Moreover, it should be understood that this point explained above also applies to the other processes described hereinafter in relation to this liquid drop discharge head.

The discharge from the ink jet head 921 takes place as described below. That is to say, as shown in FIG. 66(*a*) and in FIG. 69, the nozzles n1*a* through n3*a* which are formed in the ink jet head 921 are arranged to oppose the electrode surfaces 911*a*, and an initial liquid drop 910*c*1 of the first composite material is discharged from each of the nozzles n1*a* through n3*a*. The picture element regions A1 through A3 are formed from the picture element electrodes 911 and the banks 912 which compartment around the peripheries of the said picture element electrodes 911, and the initial liquid drops 910*c*1 of the first composite material are discharged from the nozzles n1*a* through n3*a* against these picture element regions A1 through A3 with the amount of liquid per each drop being controlled.

Next, as shown in FIG. 66(*b*), while scanning the ink jet head 921 a little along the X direction as seen in the figure, each of the nozzles n1*b* through n3*b* is positioned over the corresponding one of the picture element regions A1 through A3 respectively by shifting the ink jet head 921 along the direction opposite to the Y direction as seen in the figure. And second liquid drops 910*c*2 of the first composite material are discharged against the picture element regions A1 through A3 from the nozzles n1*b* through n3*b* respectively.

Furthermore, as shown in FIG. 66(*c*), while scanning the ink jet head 921 a little along the X direction as seen in the figure, each of the nozzles n1*a* through n3*a* is again positioned over the corresponding one of the picture element regions A1 through A3 respectively by shifting the ink jet head 921 along the Y direction as seen in the figure. And third liquid drops 910*c*3 of the first composite material are discharged against the picture element regions A1 through A3 from the nozzles n1*a* through n3*a* respectively.

By doing this, i.e. by shifting the ink jet head a little to and fro along the Y direction as seen in the figure while scanning the ink jet head 921 along the X direction as seen in the figure, liquid drops of the first composite material are discharged against a single picture element region A in order from two of the nozzles. The total number of liquid drops which are discharged against a single picture element region A can be in the range, for example, from 6 to 20, but this range will vary according to the area of the picture elements, and in some circumstances the most appropriate number of drops may be greater or less than this stated range. The total amount of the first composite material which is discharged against each of the picture element regions (upon each of the electrode surfaces 911*a*) is determined according to the sizes of the lower opening portions 912*c* and the upper opening portions 912*d*, according to the thickness of the positive hole injection/transport layer which it is desired to form, according to the concentration of the material for forming the positive hole injection/transport layer within the first composite material, and the like.

In this manner, for the case of forming the positive hole/transport layer in a single scan, the nozzles are changed over every time the first composite material is discharged, and, since the first composite material is discharged against each of the picture element regions A1 through A3 from two of the nozzles, accordingly, by comparison with the case of discharging the first composite material against each of the picture element regions A a plurality of times from a single nozzle as in the prior art, it is possible to perform mutual cancellation between undesirable deviations in the discharge amounts between the nozzles, so that undesirable deviations in the discharge amounts of the first composite material upon each of the picture element electrodes 911 . . . are reduced, and it is possible to form the positive hole injection/transport layer of a uniform film thickness. By doing this, it is possible to ensure that the amount of emitted light from each of the picture elements should be uniform, and accordingly it is possible to manufacture a display device which is endowed with a superior display quality.

Figure 67A:
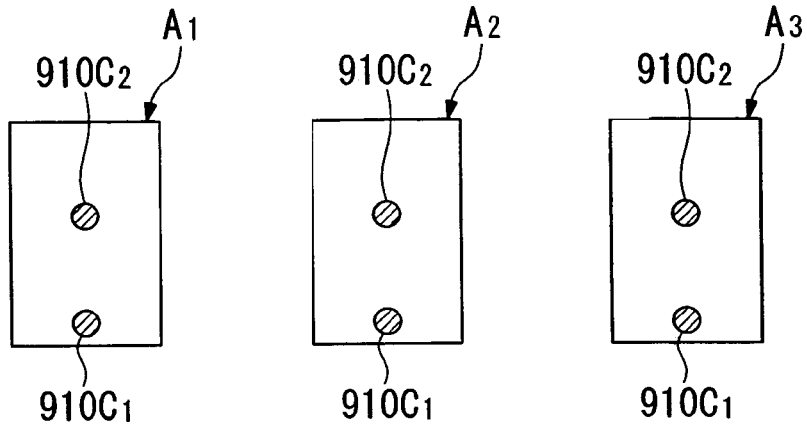
FIGS. 67(A)-67(C) are process diagrams showing a process when forming a positive hole injection and transport layer 910*a* with three times of scanning of an ink jet head.
Figure 67B:
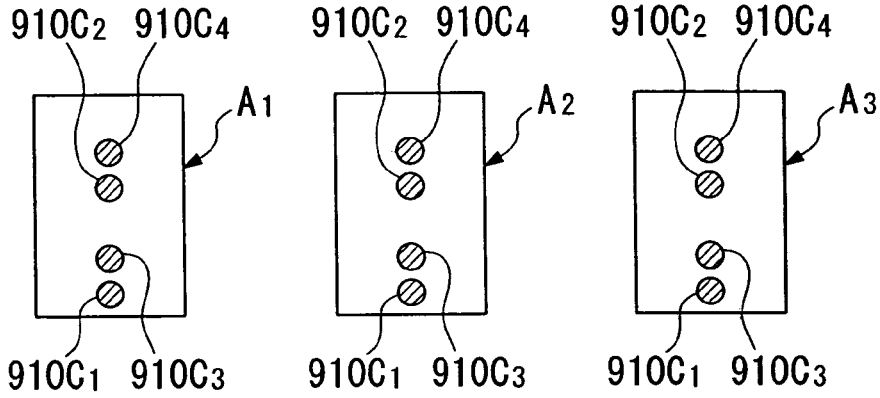
Figure 67C:
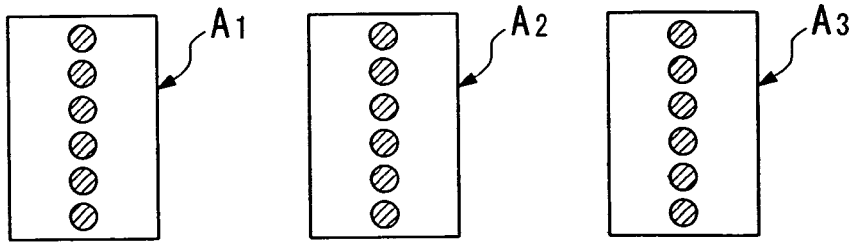

(2) A Method Performed with a Plurality of Scans of the Ink Jet Head 921, and by Using a Plurality of Nozzles During Those Scans FIG. 67 is a process diagram showing this process when forming the positive hole injection/transport layer 910*a* upon the various picture element regions A1 . . . with three scanning episodes of the ink jet head 921. FIG. 67(*a*) shows the situation after the ink jet head 921 has completed its first scanning episode; FIG. 67(*b*) shows the situation after the ink jet head 921 has completed its second scanning episode; and FIG. 67(*c*) shows the situation after the ink jet head 921 has completed its third and last scanning episode.

In the first scanning episode, among the various nozzles of the ink jet head 921 shown in FIG. 66, the initial liquid drops 910*c*1 of the first composite material are discharged from the nozzles n1*a* through n3*a* against the picture element regions A1 through A3 which these nozzles respectively oppose, and then the ink jet head 921 is shifted a little in the widthwise scanning direction and the second liquid drops 910*c*2 of the first composite material are discharged from the nozzles n1*b* through n3*b* against the picture element regions A1 through A3 which these nozzles respectively oppose. By doing this, as shown in FIG. 67(*a*), the two liquid drops 910*c*1 and 910*c*2 are discharged against each of the picture element regions A1 through A3. It should be understood that each of these first and second liquid drops 910*c*1 and 910*c*2 may be discharged against its one of the picture element regions A1 through A3 with an interval being opened up between them, as shown in FIG. 67(*a*); or, alternatively, they may be discharged over one another.

Next, in the second scanning episode, in the same manner as during the first scanning episode, among the various nozzles of the ink jet head 921 shown in FIG. 66, the third liquid drops 910*c*3 of the first composite material are discharged from the nozzles n1*a* through n3*a* against the picture element regions A1 through A3 which these nozzles respectively oppose, and then again the ink jet head 921 is shifted a little in the widthwise scanning direction and the fourth liquid drops 910*c*4 of the first composite material are discharged from the nozzles n1*b* through n3*b* against the picture element regions A1 through A3 which these nozzles respectively oppose. By doing this, as shown in FIG. 67(*b*), the further two liquid drops 910*c*3 and 910*c*4 are discharged against each of the picture element regions A1 through A3. It should be understood that each of these third and fourth liquid drops 910*c*3 and 910*c*4 may be discharged against its one of the picture element regions A1 through A3 with an interval being opened up mutually between them and also with an interval being opened up between them and the first and second liquid drops 910*c*1 and 910*c*2 so that none of these four liquid drops are mutually superimposed, as shown in FIG. 67(*b*); or, alternatively, they may be discharged over one another and over the first and second liquid drops 910*c*1 and 910*c*2.

Next, in the third scanning episode, in the same manner as during the first and second scanning episodes, among the various nozzles of the ink jet head 921 shown in FIG. 66, the fifth liquid drops 910*c*5 of the first composite material are discharged from the nozzles n1*a* through n3*a* against the picture element regions A1 through A3 which these nozzles respectively oppose, and then again the ink jet head 921 is shifted a little in the widthwise scanning direction and the sixth liquid drops 910*c*6 of the first composite material are discharged from the nozzles n1*b* through n3*b* against the picture element regions A1 through A3 which these nozzles respectively oppose. By doing this, as shown in FIG. 67(*c*), the further two liquid drops 910*c*5 and 910*c*6 are discharged against each of the picture element regions A1 through A3. It should be understood that each of these fifth and sixth liquid drops 910*c*5 and 910*c*6 may be discharged against its one of the picture element regions A1 through A3 with an interval being opened up mutually between them and also with an interval being opened up between them and the first four liquid drops 910*c*1 through 910*c*4 so that none of these six liquid drops are mutually superimposed, as shown in FIG. 67(*c*); or, alternatively, they may be discharged over one another and over the first through the fourth liquid drops 910*c*1 through 910*c*4.

Since in this manner, when forming the positive hole injection/transport layer with a plurality of scans, the nozzles are changed over between each scan and the next, and the first composite material is discharged against each of the picture element regions A1 through A3 from its own two ones of the nozzles, accordingly, by comparison with the case of discharging the first composite material against each of the picture element regions a plurality of times from a single nozzle as in the prior art, it is possible to perform mutual cancellation between undesirable deviations in the discharge amounts between the nozzles, so that undesirable deviations in the discharge amounts of the first composite material upon each of the picture element electrodes 911 . . . are reduced, and it is possible to form the positive hole injection/transport layer of a uniform film thickness. By doing this, it is possible to ensure that the amount of emitted light from each of the picture elements is maintained as uniform, and accordingly it is possible to manufacture a display device which is endowed with a superior display quality.

Figure 68A:
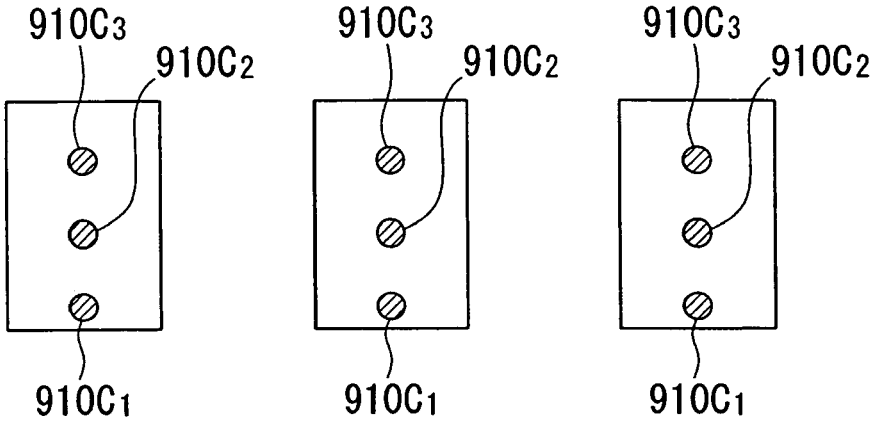
FIGS. 68(A)-68(C) are process diagrams showing a process when forming a positive hole injection and transport layer 910*a* with two times of scanning of an ink jet head.
Figure 68B:
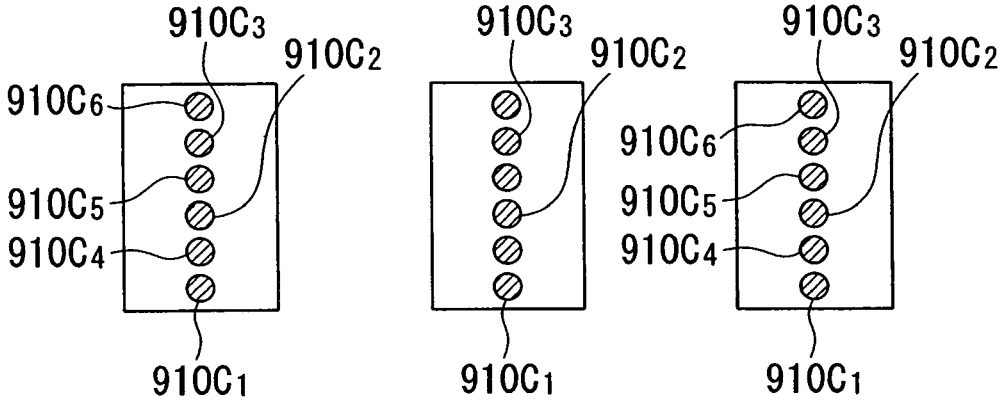
Figure 68C:
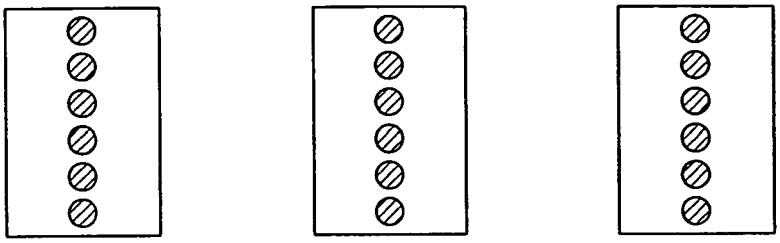

(3) A Method Performed with a Plurality of Scans of the Ink Jet Head 921, and by Using a Different Nozzle in Each of Those Scans FIG. 68 is a process diagram showing this process when forming the positive hole injection/transport layer 910*a* upon the various picture element regions A1 . . . with two scanning episodes of the ink jet head 921. FIG. 68(*a*) shows the situation after the ink jet head 921 has completed its first scanning episode; FIG. 68(*b*) shows the situation after the ink jet head 921 has completed its first scanning episode; and FIG. 68(*c*) shows another possible situation after the ink jet head 921 has completed its first and second scanning episodes.

In the first scanning episode, among the various nozzles of the ink jet head 921 shown in FIG. 66, the initial liquid drops 910*c*1 and the second and third liquid drops 910*c*2, and 910*c*3 of the first composite material are discharged in order from each of the nozzles n1*a* through n3*a* against each of the picture element regions A1 through A3 which these nozzles respectively oppose. By doing this, as shown in FIG. 66(*a*), the three liquid drops 910*c*1, 910*c*2, and 910*c*3 are discharged against each of the picture element regions A1 through A3. It should be understood that each of these liquid drops 910*c*1 through 910*c*3 may be discharged against its one of the picture element regions A1 through A3 with an interval being opened up between them, as shown in FIG. 66(*a*); or, alternatively, they may be discharged over one another, so that they are mutually superimposed.

Then, in the second scanning episode, the ink jet head 921 is shifted a little in the widthwise scanning direction and the fourth, fifth, and sixth liquid drops 910*c*4, 910*c*5, and 910*c*6 of the first composite material are discharged in order from the nozzles n1*b* through n3*b* against the picture element regions A1 through A3 which these nozzles respectively oppose. By doing this, as shown in FIG. 68(*b*), the further three liquid drops 910*c*4 through 910*c*6 are discharged against each of the picture element regions A1 through A3. It should be understood that each of these fourth through sixth liquid drops 910*c*4, 910*c*5, and 910*c*6 may be discharged against its one of the picture element regions A1 through A3 with an interval being opened up mutually between them and also with an interval being opened up between them and the first three liquid drops 910*c*1 through 910*c*3 so that none of these six liquid drops are mutually superimposed, as shown in FIG. 68(*b*); or, alternatively, they may be discharged over one another and over the first through the third liquid drops 910*c*1 through 910*c*3.

Furthermore, FIG. 68(*c*) shows a different situation after the first and second scanning episodes. In FIG. 68(*c*) the number of scanning episodes is supposed to have been two, and, with regard to the point that the first through the third liquid drops are discharged in the first scanning episode, and that, in the second scanning episode, the fourth through the sixth liquid drops are discharged from different ones of the nozzles after the ink jet head 921 has been shifted, the situation is the same as in the case of FIG. 68(*a*) and FIG. 68(*b*).

However the point in which the situation of FIG. 68(*c*) differs from the situation of FIGS. 68(*a*) and 68(*b*) is that the discharge position of each of the liquid drops is different. In detail, in FIG. 68(*c*), the liquid drops 910*c*1 through 910*c*3 which are discharged in the first scanning episode are all located in the lower half portion in the figure of each of the picture element regions A1 through A3, while the liquid drops 910*c*4 through 910*c*6 which are discharged in the second scanning episode are all located in the upper half portion in the figure of each of the picture element regions A1 through A3; in other words, the liquid drops 910*c*1 through 910*c*3 which are discharged in the first scanning episode are not interleaved with the liquid drops 910*c*4 through 910*c*6 which are discharged in the second scanning episode, as was the case with the process shown in FIGS. 68(*a*) and 68(*b*).

It should be understood that although, in FIGS. 67 and 68, the total number of liquid drops which are discharged against a single picture element region A was supposed to be six, it may be in the range, for example, from 6 to 20; but, since this range will vary according to the area of the picture elements, in some circumstances the most appropriate number of drops may be greater or less than this stated range. The total amount of the first composite material which is discharged against each of the picture element regions (i.e., upon each of the electrode surfaces 911*a*) is determined according to the sizes of the lower opening portions 912*c* and the upper opening portions 912*d*, according to the thickness of the positive hole injection/transport layer which it is desired to form, according to the concentration of the material for forming the positive hole injection/transport layer within the first composite material, and the like.

Since in this manner, when forming the positive hole injection/transport layer with a plurality of scanning episodes, the nozzles are changed over between each scan and the next, and the first composite material is discharged against each of the picture element regions A1 through A3 from its own two ones of the nozzles, accordingly, by comparison with the case of discharging the first composite material against each of the picture element regions A a plurality of times from a single nozzle as in the prior art, it is possible to perform mutual cancellation between undesirable deviations in the discharge amounts between the nozzles, so that undesirable deviations in the discharge amounts of the first composite material upon each of the picture element electrodes 911 . . . are reduced, and it is possible to form the positive hole injection/transport layer of a uniform film thickness. By doing this, it is possible to ensure that the amount of emitted light from each of the picture elements is maintained as uniform, and accordingly it is possible to manufacture a display device which is endowed with a superior display quality.

It should be understood that it would be acceptable, when performing scanning of the ink jet head 921 a plurality of times, to perform each pass of the ink jet head 921, i.e. each scan, in the same direction; or, alternatively, each pass of the ink jet head 921 might be performed in an opposite direction to the previous one.

As shown in FIG. 69, the liquid drops 910*c* of the first composite material which have been discharged from the ink jet head 921 finally spread out over the electrode surfaces 911*a* and the first superimposed layer portions 912*e* which have been subjected to hydrophilic processing, and fill up the lower opening portions 912*c* and the upper opening portions 912*d*. On the other hand, even if one of the liquid drops 910*c* of the first composite material has wandered from its predetermined discharge position and has been discharged against an upper surface 912*f*, the upper surface 912*f* is not wetted by this first composite material drop 910*c*, and the first composite material drop 910*c* is shed off from the upper surface 912*f* and finally slides to one of the lower opening portions 912*c* or one of the upper opening portions 912*d*.

As the first composite material which may be used here, for example, it is possible to utilize a composite material consisting of a mixture of polythiophene-derivetive, for instance polyethylenedioxithiophene (PEDOT) or the like, and polystyrenesulfonic acid (PSS) or the like dissolved in a polar solvent. As such a polar solvent, for example, it is possible to suggest isopropyl alcohol (IPA), normalbutanol, γ-butyrolactone, N-methylpyrolidone (NMP), 1,3-dimethyl-2-imidazolidinone (DMI), and its derivative, carbitol, buthylcarbitolacetate, glycolethers, or the like.

In more concrete terms, as an exemplary composition for the first composite material, it is possible to utilize a material consisting of a mixture of PEDOT and PSS (with the PEDOT/PSS ratio being 1:20) to the amount of 22.4% by weight, PSS to the amount of 1.44% by weight, IPA to the amount of 10% by weight, NMP to the amount of 27.0% by weight, and DMI to the amount of 50% by weight. It should be understood that it is desirable for the viscosity of the first composite material to be in the range from 2 to 20 cPs, and in particular it is desirable for it to be in the range from 4 to 12 cPs.

By using the above described first composite material, it is possible to perform stable discharge through the discharge nozzles H2, without any danger of occurrence of blockages.

Moreover, with regard to the material for forming the positive hole injection/transport layer, it will be acceptable to use the same material for each of the red (R), green (G), and blue (B) light emission layers 910*b*1 through 910*b*3; or, alternatively, it could be different for each of these light emission layers.

Figure 70:
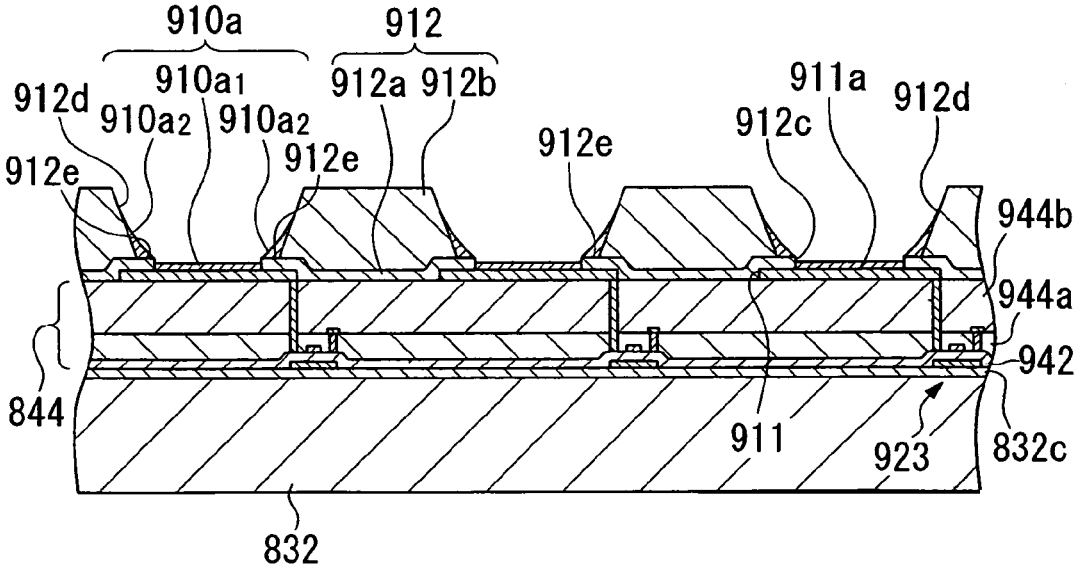
FIG. 70 is a process diagram for explanation of the method of manufacture of the same display device.

Next, a drying process such as the one shown in FIG. 70 is performed.

By performing this drying process, the first composite material is dried after having been discharged, the polar solvent which was contained in the first composite material is vaporized, and thereby the positive hole injection/transport layer 910*a* is formed.

When performing this drying process, the vaporization of the polar solvent which is contained in the first composite material drops 910*c* principally occurs at positions which are close to the inorganic material bank layers 912*a* and the organic material bank layers 912*b*, and the material which constitutes the positive hole injection/transport layer is thickened and deposited along with the vaporization of the polar solvent.

Due to this, as shown in FIG. 70, the peripheral edge portions 910*a*2 which are made from the material which constitutes the positive hole injection/transport layer are formed over the first superimposed layer portions 912*e*. These peripheral edge portions 910*a*2 closely adhere to the wall surfaces of the upper opening portions 912*d* (the organic material bank layers 912*b*), and their thickness becomes thinner towards the electrode surfaces 911*a*, while they become thicker away from the electrode surfaces 911*a*, in other words towards the organic material bank layers 912*b*.

Furthermore, at the same time as this is happening, the vaporization of the polar solvent takes place over the electrode surfaces 911*a* due to the drying process, and due to this the flat portions 910*a*1 are formed over the electrode surfaces 911*a* from the material which is to constitute the positive hole injection/transport layer. Since the speed of vaporization of the polar solvent over the electrode surfaces 911*a* is almost uniform, the material which is to constitute the positive hole injection/transport layer is thickened almost uniformly over the electrode surfaces 911*a*, and due to this the flat portions 910*a* are formed of substantially uniform thickness.

By doing this, the positive hole injection/transport layer 910*a* which consists of the peripheral edge portions 910*a*2 and the flat portions 910*a*1 is formed.

It should be understood that a variant preferred embodiment would also be acceptable, as an alternative, in which the peripheral edge portions 910*a*2 were not formed, but the positive hole injection/transport layer was only formed over the electrode surfaces 911*a*.

The above described drying procedure is performed, for example, in a nitrogen atmosphere, at room temperature, and at a pressure of, for example, approximately 133.3 to 13.3 Pa (1 to 0.1 torr). If the pressure were to be reduced abruptly, the first composite material drops 910*c* would be caused to collide with one another, which would be undesirable; and accordingly it is desirable to reduce the pressure slowly and steadily. Furthermore, it the temperature is raised to a high temperature, the speed of vaporization of the polar solvent would be elevated to a level which would be undesirable, and it would become impossible to form an even positive hole injection/transport layer. Accordingly a working temperature in the range of from 30 degree Celsius to 80 degree Celsius is considered to be desirable.

After the drying procedure, it is desirable to remove any polar solvent or water which may remain in the positive hole injection/transport layer 910*a* by performing heat processing by heating up the work-piece in vacuum to a temperature of approximately 200 degree Celsius and by keeping it there for about 10 minutes.

In the above described process of forming the positive hole injection/transport layer, the liquid drops 910*c* of the first composite material which have been discharged are on the one hand filled into the lower opening portions 912*c* and the upper opening portions 912*d*, while any quantities of the first composite material which may have landed upon the organic material bank layers 912*b* which have been subjected to water repellentation processing are repelled thereby and are transferred to within the lower opening portions 912*c* and the upper opening portions 912*d*. Due to this, the liquid drops 910*c* of the first composite material which have been discharged can be reliably and inescapably caused to be filled into the lower opening portions 912*c* and the upper opening portions 912*d*, so that it is possible to form the positive hole injection/transport layer 910*a* upon the electrode surfaces 911*a*.

Furthermore, according to the above described formation process for the positive hole injection/transport layer, since the liquid drops 910*c*1 of the first composite material which are initially discharged into each of the picture element regions A are contacted against the wall surfaces 912*h* of the organic material bank layers 912*b*, because these liquid drops are transferred from these wall surfaces 912*h* to the first superimposed layer portions 912*e* and to the electrode surfaces 911*a*, accordingly, as a priority, the liquid drops 910*c* of the first composite material wet and spread out over the entire range of the picture element electrodes 911, and it is possible to apply the first composite material without any blurring, so that thereby it is possible to form the positive hole injection/transport layer 910*a* with a substantially uniform film thickness.

(4) The Process of Formation of the Light Emission Layer

Next, the process of forming the light emission layer includes a surface modification process, a light emission layer formation material discharge process, and a drying process.

First, a surface modification process is performed for modifying the surface of the positive hole injection/transport layer 910*a*. This process will be described in detail hereinafter. Next, a second composite material is discharged upon the positive hole injection/transport layer 910*a* by a liquid drop discharge method which may be the same as that employed for the process of formation of the positive hole injection/transport layer 910*a* which was described above. After this, a process of drying processing (and heat processing) of this second composite material which has been discharged is performed, and thereby the light emission layer 910*b* is formed over the positive hole injection/transport layer 910*a*.

Next, as a process for forming the light emission layer, after a second composite material which contains a light emission layer formation material has been discharged upon the positive hole injection/transport layer 910*a* by a liquid drop discharge method, a drying procedure is performed, and thereby the light emission layer 910*b* is formed over the positive hole injection/transport layer 910*a*.

Figure 71:
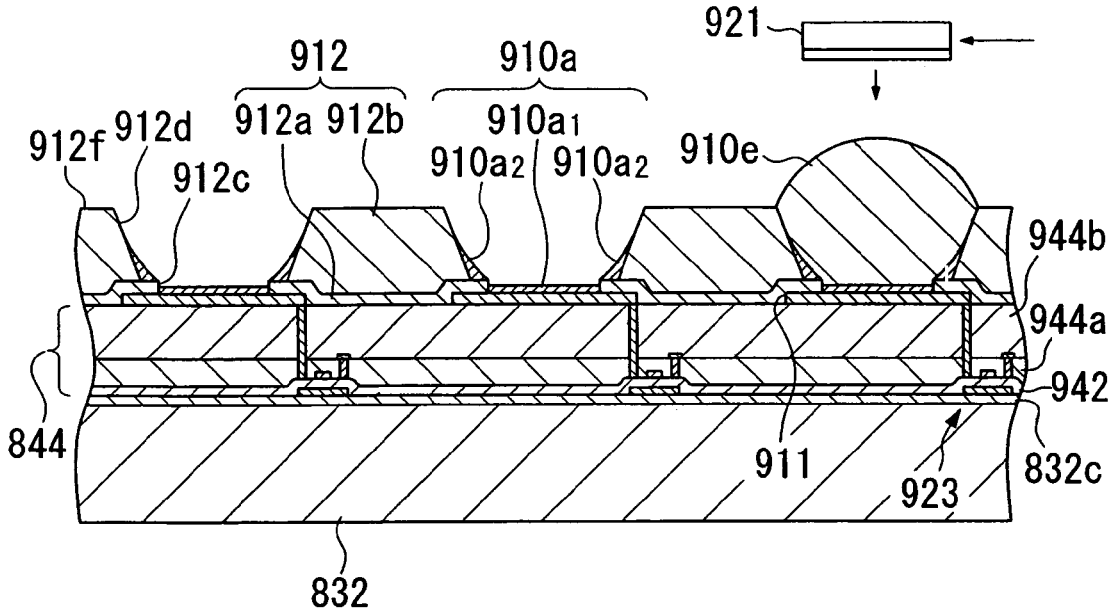
FIG. 71 is a process diagram for explanation of the method of manufacture of the same display device.

The liquid drop discharge method is shown in outline in FIG. 71. As shown in FIG. 46, the ink jet head 431 and the base plate 832 are shifted relatively to one another, and the second composite material which includes light emission layer formation material of various colors (for example blue (B) colored light emission layer formation material) is discharged from the discharge nozzles which are formed in the ink jet head 431.

During this discharge, the discharge nozzles oppose the positive hole injection/transport layers 910*a* which are positioned within the lower opening portions 912*c* and the upper opening portions 912*d*, and the second composite material is discharged while shifting the ink jet head 431 and the base plate 832 relatively to one another. The liquid amounts for each of the drops which are discharged from the discharge nozzles are controlled for each drop individually. The liquid (the second composite material drops 910*e*) of which the liquid amount has been controlled in this manner is discharged from the discharge nozzles, and these second composite material drops 910*e* are discharged against and over the positive hole injection/transport layer 910*a*.

The process of formation of the light emission layer proceeds in the same manner as did the process of forming the positive hole injection/transport layer, so that the second composite material is discharged from a plurality of the nozzles against a single one of the picture element regions.

In other words, in the same manner as in the cases shown in FIG. 66, FIG. 67, and FIG. 68, the ink jet head 921 is scanner and the light emission layer 910*b* is formed over each of the positive hole injection/transport layers 910*a*. In this process, For this process there are three possibilities: (4) a method which is performed with a single scanning episode of the ink jet head 921; (5) a method which is performed with a plurality of scanning episodes of the ink jet head 921, and moreover by using a plurality of nozzles during those scanning episodes; and (6) a method which is performed with a plurality of scanning episodes of the ink jet head 921, and moreover by using a separate nozzle in each of those scanning episodes. In the following, a summary of each of these three methods (4) through (6) will be explained.

(4) A Method Performed with a Single Scan of the Ink Jet Head 921

With this method, a light emission layer is formed upon each of the picture element regions (over the positive hole injection/transport layer 910*a*) in the same manner as in the case of FIG. 66. In detail, in the same manner as in the case of FIG. 66(*a*), the nozzles n1*a* through n3*a* of the ink jet head 921 are arranged to oppose the positive hole injection/transport layers 910*a*, and initial liquid drops of the second composite material are discharged from these nozzles n1*a* through n3*a* against the positive hole injection/transport layers 910*a*. Next, in the same manner as in the case of FIG. 66(*b*), along with scanning the ink jet head 921 a little along the main scanning direction, each of the nozzles n1*b* through n3*b* is positioned over the corresponding one of these positive hole injection/transport layers 910*a* by shifting the ink jet head 921 along the direction opposite to the widthwise scanning direction, and second liquid drops of the second composite material are discharged from the nozzles n1*b* through n3*b* against the positive hole injection/transport layers 910*a*. Then, in the same manner as in the case of FIG. 66(*c*), while scanning the ink jet head 921 a little along the main scanning direction, each of the nozzles n1*a* through n3*a* is again positioned over its positive hole injection/transport layer 910*a* by shifting the ink jet head 921 along the widthwise scanning direction, and third liquid drops of the second composite material are discharged from the nozzles n1*a* through n3*a* against the positive hole injection/transport layers 910*a*.

By doing this, i.e. by shifting the ink jet head 921 a little to and fro along the widthwise scanning direction while scanning the ink jet head 921 along the main scanning direction, liquid drops of the second composite material are discharged against a single picture element region A (a single positive hole injection/transport layer 910*a*) in order from two of the nozzles. The total number of liquid drops which are discharged against a single picture element region A can be in the range, for example, from 6 to 20, but this range will vary according to the area of the picture elements, and in some circumstances the most appropriate number of drops may be greater or less than this stated range. The total amount of the second composite material which is discharged against each of the picture element regions (each of the positive hole injection/transport layers 910*a*) is determined according to the sizes of the lower opening portions 912*c* and the upper opening portions 912*d*, according to the thickness of the light emission layers which it is desired to form, according to the concentration of the material for forming the light emission layers within the second composite material, and the like.

In this manner, for the case of forming the light emission layer in a single scanning episode, the nozzles are changed over every time the second composite material is discharged, and, since the second composite material is discharged against each of the picture element regions from two of the nozzles, accordingly, by comparison with the case of discharging the second composite material against each of the picture element regions a plurality of times from a single nozzle as in the prior art, it is possible to perform mutual cancellation between undesirable deviations in the discharge amounts between the nozzles, so that undesirable deviations in the discharge amounts of the second composite material upon each of the picture element regions are reduced, and it is possible to form the light emission layer of a uniform film thickness. By doing this, it is possible to ensure that the amount of emitted light from each of the picture elements should be maintained to be uniform, and accordingly it is possible to manufacture a display device which is endowed with a superior display quality.

(5) A Method Performed with a Plurality of Scans of the Ink Jet Head 921, and a Method Using a Plurality of Nozzles During Those Scans In this method, first in the same manner as in the case of FIG. 67(*a*), in a first scanning episode, among the various nozzles of the ink jet head 921, the initial liquid drops of the second composite material are discharged from the nozzles n1*a* through n3*a* against the picture element regions which these nozzles respectively oppose, and then the ink jet head 921 is shifted a little in the widthwise scanning direction and the second liquid drops of the second composite material are discharged from the nozzles n1*b* through n3*b* against the picture element regions which these nozzles respectively oppose.

By doing this, in the same manner as shown in FIG. 67(*a*), two liquid drops are discharged against each of the picture element regions. It should be understood that each of these first and second liquid drops may be discharged against its one of the picture element regions with an interval being mutually opened up between them, in the same manner as shown in FIG. 67(*a*); or, alternatively, they may be discharged over one another in a mutually superimposed manner.

Next, in the second scanning episode, in the same manner as during the first scanning episode, among the various nozzles of the ink jet head 921, the third liquid drops of the second composite material are discharged from the nozzles n1*a* through n3*a* against the picture element regions which these nozzles respectively oppose, and then again the ink jet head 921 is shifted a little in the widthwise scanning direction and the fourth liquid drops of the second composite material are discharged from the nozzles n1*b* through n3*b* against the picture element regions which these nozzles respectively oppose. By doing this, in the same manner as shown in FIG. 67(*b*), the further two liquid drops are discharged against each of the picture element regions. It should be understood that each of these third and fourth liquid drops may be discharged against its one of the picture element regions with an interval being opened up mutually between them and also with an interval being opened up between them and the first and second liquid drops and so that none of these four liquid drops are mutually superimposed, in the same manner as shown in FIG. 67(*b*); or, alternatively, they may be discharged over one another and over the first and second liquid drops, so that all four are mutually superimposed.

Next, in the third scanning episode, in the same manner as during the first and second scanning episodes, among the various nozzles of the ink jet head 921, the fifth liquid drops of the second composite material are discharged from the nozzles n1*a* through n3*a* against the picture element regions which these nozzles respectively oppose, and then again the ink jet head 921 is shifted a little in the widthwise scanning direction and the sixth liquid drops of the second composite material are discharged from the nozzles n1*b* through n3*b* against the picture element regions which these nozzles respectively oppose. By doing this, in the same manner as shown in FIG. 67(*c*), a further two liquid drops are discharged against each of the picture element regions. It should be understood that each of these fifth and sixth liquid drops may be discharged against its one of the picture element regions with an interval being opened up mutually between them and also with an interval being opened up between them and the first four liquid drops so that none of these six liquid drops are mutually superimposed, in the same manner as shown in FIG. 67(*c*); or, alternatively, they may be discharged over one another and over the first through the fourth liquid drops, so that all six of the liquid drops are mutually superimposed.

Since in this manner, when forming the light emission layer with a plurality of scans, the nozzles are changed over between each scan and the next, and the second composite material is discharged against each of the picture element regions from its own two ones of the nozzles, accordingly, by comparison with the case of discharging the second composite material against each of the picture element regions a plurality of times from a single nozzle as in the prior art, it is possible to perform mutual cancellation between undesirable deviations in the discharge amounts between the nozzles, so that undesirable deviations in the discharge amounts of the second composite material upon each of the picture element regions are reduced, and it is possible to form the light emission layer of a uniform film thickness. By doing this, it is possible to ensure that the amount of emitted light from each of the picture elements is maintained as uniform, and accordingly it is possible to manufacture a display device which is endowed with a superior display quality.

(6) A Method Performed with a Plurality of Scans of the Ink Jet Head 921, and by Using a Different Nozzle in Each of Those Scans In this method, first, in the same manner as shown in FIG. 68(*a*), in a first scanning episode, the initial liquid drops and the second and third liquid drops of the second composite material are discharged in order from each of the nozzles n1*a* through n3*a* among the various nozzles of the ink jet head 921 against each of the picture element regions which these nozzles respectively oppose. By doing this, in the same manner as shown in FIG. 68(*a*), three liquid drops are discharged against each of the picture element regions. It should be understood that each of these liquid drops may be discharged against its one of the picture element regions with an interval being mutually opened up between them, in the same manner as shown in FIG. 68(*a*); or, alternatively, they may be discharged over one another so as to be mutually superimposed.

Then, in the second scanning episode, the ink jet head 921 is shifted a little in the widthwise scanning direction and the fourth, fifth, and sixth liquid drops of the second composite material are discharged in order from the nozzles nib through n3*b* against the picture element regions which these nozzles respectively oppose. By doing this, in the same manner as shown in FIG. 68(*b*), the further three liquid drops are discharged against each of the picture element regions. It should be understood that each of these fourth through sixth liquid drops may be discharged against its one of the picture element regions with an interval being opened up mutually between them and also with an interval being opened up between them and the first three liquid drops so that none of these six liquid drops are mutually superimposed, in the same manner as shown in FIG. 68(*b*); or, alternatively, they may be discharged over one another and over the first through the third liquid drops, so that all six of these liquid drops are mutually superimposed.

Furthermore, as a variant of this method, in the same manner as shown in FIG. 68(*c*), the liquid drops which are discharged in the first scanning episode may all be located in one half portion of each of the picture element regions, while the liquid drops which are discharged in the second scanning episode are all located in the other half portion of each of the picture element regions; in other words, the liquid drops which are discharged in the first scanning episode are not interleaved with the liquid drops which are discharged in the second scanning episode.

It should be understood that although the total number of liquid drops which are discharged against a single picture element region was supposed to be six, it may be in the range, for example, from 6 to 20; but, since this range will vary according to the area of the picture elements, in some circumstances the most appropriate number of drops may be greater or less than this stated range. The total amount of the second composite material which is discharged against each of the picture element regions (i.e., upon each of the positive hole injection/transport layers 910*a*) is determined according to the sizes of the lower opening portions 912*c* and the upper opening portions 912*d*, according to the thickness of the light emission layer which it is desired to form, according to the concentration of the material for forming the light emission layer within the second composite material, and the like.

Since in this manner, when forming the positive hole injection/transport layer with a plurality of scanning episodes, the nozzles are changed over between each scan and the next, and the second composite material is discharged against each of the picture element regions from its own two ones of the nozzles, accordingly, by comparison with the case of discharging the second composite material against each of the picture element regions a plurality of times from a single nozzle as in the prior art, it is possible to perform mutual cancellation between undesirable deviations in the discharge amounts between the nozzles, so that undesirable deviations in the discharge amounts of the second composite material upon each of the picture element regions are reduced, and it is possible to form the light emission layer of a uniform film thickness. By doing this, it is possible to ensure that the amount of emitted light from each of the picture elements is maintained as uniform, and accordingly it is possible to manufacture a display device which is endowed with a superior display quality.

It should be understood that, in the same way as was the case in the process of forming the positive hole injection/transport layer, it would also be acceptable, when performing scanning of the ink jet head 921 a plurality of times, to perform each pass of the ink jet head 921, i.e. each scan, in the same direction; or, alternatively, each pass of the ink jet head 921 might be performed in an opposite direction to the previous one.

Furthermore, as the material for the light emission layer, for example, it is possible to utilize polyfluolenederivetive, polyphenylenederivative, polyvinylcarbazole, polythiophenederivative, or doped materials by doping penylene group pigments, coumaline group pigments, rhodamine group pigments, for instance, rublene, perylene, 9,10-diphenylanthracene, terraphenylbutadiene, neilred, coumalin 6, quinacridone or the like with the above polymers may be used.

As a non polar solvent, which is a desirable type from the point of view of not dissolving the previously formed positive hole injection/transport layers 910*a*, it is possible to use, for example, cychrohexilbenzene, dihydrobenzofuran, trimethylbenzene, tetramethylbenzene, or the like.

By using this type of non polar solvent in the second composite material for making the light emission layers 910*b*, it is possible to apply the second composite material without re-dissolving the positive hole injection/transport layers 910*a* which have already been formed.

As shown in FIG. 71, the liquid drops 910*e* of the second composite material which have been discharged from the ink jet head 921 spread out over the positive hole injection/transport layer 910*a*, and fill up the lower opening portions 912*c* and the upper opening portions 912*d*. On the other hand, even if one of the liquid drops 910*e* of the second composite material has wandered from its predetermined discharge position and has been discharged against an upper surface 912*f* which has been subjected to water repellentation processing, the upper surface 912*f* is not wetted by this second composite material drop 910*e*, and the second composite material drop 910*e* is shed off from the upper surface 912*f* and is transferred to one of the lower opening portions 912*c* or one of the upper opening portions 912*d*.

Figure 72:
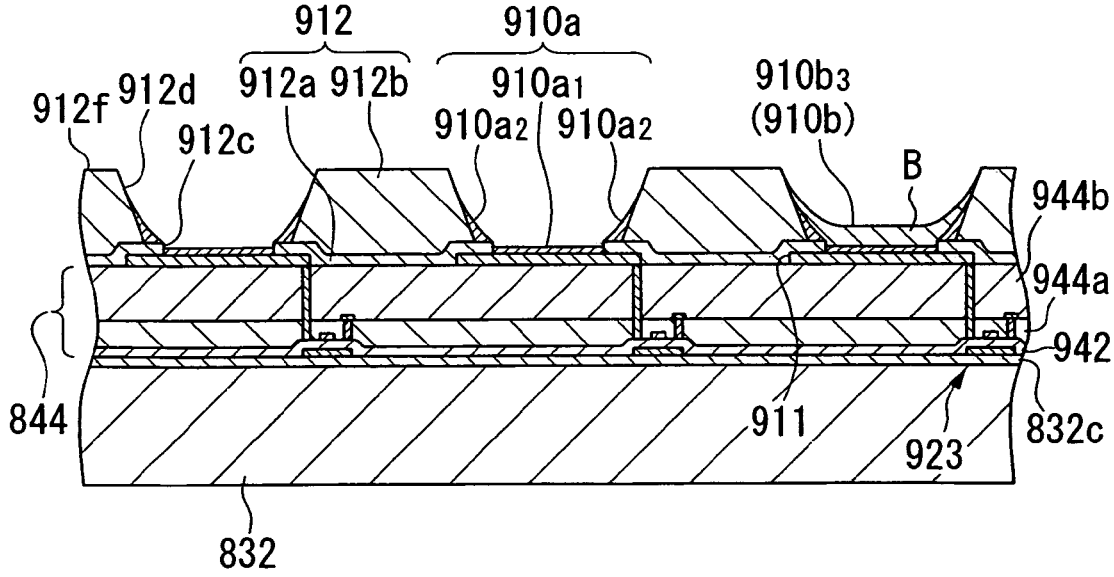
FIG. 72 is another process diagram for explanation of the method of manufacture of the same display device.

Next, after the second composite material has been discharged in the predetermined positions therefor, a drying procedure is performed for the drops 910*e* of the second composite material after their discharge, so as to form the light emission layer 910*b*3. That is to say, the non polar solvent which was contained in the second composite material is vaporized by this drying process, and a blue (B) colored light emission layer 910*b*3 such as shown in FIG. 72 is formed. It should be understood that, although in FIG. 72 only a single light emission layer 910*b*3 which emits blue colored light is shown, in fact, as is clear from FIG. 55 and other figures, basically the light emitting elements are formed so as to be arranged in a matrix pattern, and, viewing the component as a whole, a large number of light emission layers (corresponding to blue color) not shown in the figure are formed.

Figure 73:
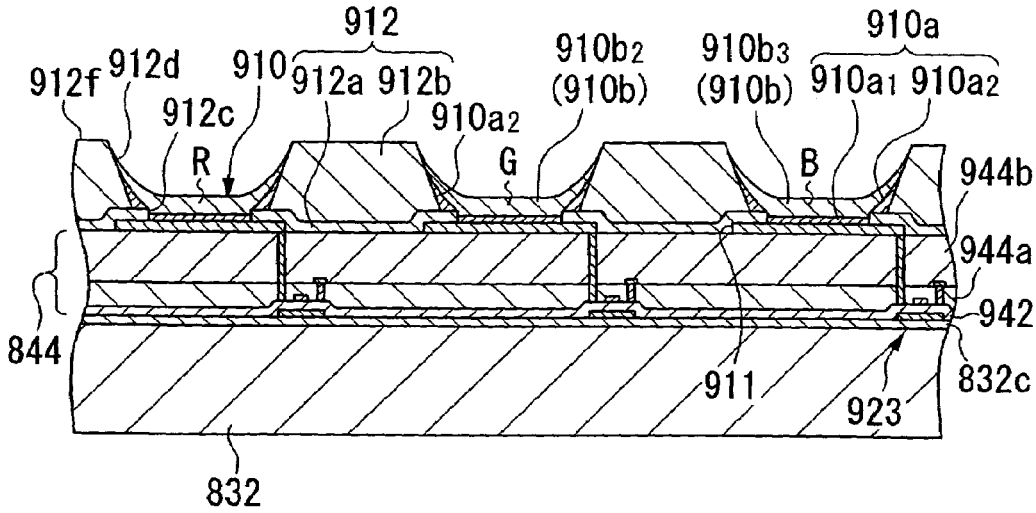
FIG. 73 is yet another process diagram for explanation of the method of manufacture of the same display device.

Next, as shown in FIG. 73, a red (R) colored light emission layer 910*b*1 is formed by using the same process as in the case of formation of the blue (B) colored light emission layer 910*b*3 as described above; and, finally, a green (G) colored light emission layer 910*b*2 is formed by using the same technique.

It should be understood that the order in which these three light emission layers 910*b* are formed is not to be considered as being limited by the example above; any suitable order would be acceptable. For example, it would also be possible to determine the order of formation of the light emission layers, according to the specific qualities of the materials from which they were to be formed.

As drying conditions for the second composite material for forming the light emission layer, for example, in the case of the blue (B) colored light emission layer 910*b*3, they may be: in a nitrogen atmosphere, at room temperature, and at a pressure of, for example, approximately 133.3 to 13.3 Pa (1 to 0.1 torr). If the pressure were too low, the second composite material drops 910*c* would be caused to collide with one another, which would be undesirable. Furthermore, it the temperature were too high, the speed of vaporization of the non polar solvent would be elevated to a level which would be undesirable, and it might be the case that a large quantity of the light emission layer formation material might adhere to the wall surfaces of the upper opening portions 912*d*. Accordingly a working temperature in the range of from 30 degree Celsius to 80 degree Celsius is considered to be desirable.

Furthermore, in the cases of the green (G) colored light emission layer 910*b*2 and of the red (R) colored light emission layer 910*b*1, it is desirable to perform the drying gently, since the number of the components in the material from which the light emission layer is to be formed is relatively large. For example, as acceptable conditions, it may be acceptable to perform this drying by blowing nitrogen against the work-piece at a temperature of 40° C. for about 5 to 10 minutes.

As another possible means of performing this drying procedure, an infrared irradiation method, or a method of blowing nitrogen gas at high temperature against the work-piece, or the like may be utilized. By the above procedures, the positive hole injection/transport layers 910*a* and the light emission layers 910*b* are formed above the picture element electrodes 911.

(5) The Process of Formation of the Opposing Electrode (the Negative Electrode)

Figure 74:
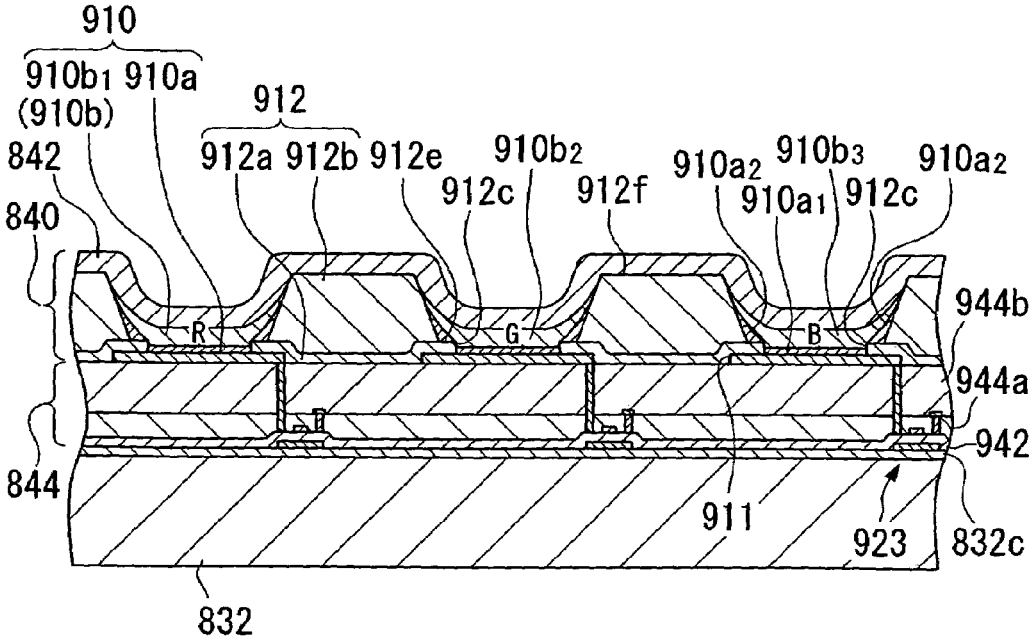
FIG. 74 is still yet another process diagram for explanation of the method of manufacture of the same display device.

Next, in an opposing electrode formation process, the negative electrode 842 (the opposing electrode) is formed over the entire surfaces of the light emission layers 910*b* and the organic material bank layers 912*b*, as shown in FIG. 74. It should be understood that it would also be acceptable, as an alternative, to form this negative electrode 842 from a plurality of layers of different materials superimposed upon one another. For example, it is desirable to form the side of the negative electrode 842 towards the light emission layer from a material whose work function is small, and for example it is possible to use Ca or Ba or the like for this portion, or, for this material, there are also cases in which it is best to make this lower layer as a thin layer of LiF or the like. Furthermore, for the upper side (the sealing side) of the negative electrode 842, it is possible to utilize a material whose work function is higher than that of the material used for the lower side thereof, for example Al or the like.

Yet further, it is desirable to form the negative electrode 842 by, for example, an evaporation adhesion method, a spattering method, a CVD method or the like, and in particular, it is desirable to form it by an evaporation adhesion method, from the point of view of being able to prevent damage to the light emission layers 910*b* due to heat. Furthermore, it would also be acceptable to form only the portions over the light emission layers 910*b* from lithium fluoride; or it would also be possible to form the lithium fluoride portion in correspondence to a predetermined color or colors. For example, it would be acceptable to form the lithium fluoride portion over only the blue (B) colored light emission layers 910*b*3. In this case, an upper negative electrode layer 12*b* which was made from calcium or the like would be contacted against the red (R) colored light emission layers 910*b*1 and against the green (G) colored light emission layers 910*b*2.

Furthermore, it is desirable for an Al layer, an Ag layer or the like to be formed over the upper portion of the negative electrode 842 by an evaporation deposition method, a spattering method, a CVD method or the like. Yet further, it is desirable for the thickness of this layer to be, for example, in the range from 100 to 1000 nm, and in particular it may be in the range from approximately 200 to 500 nm.

Moreover, it would be acceptable to provide a protective layer of SiO2, SiN or the like over the negative electrode 842, for preventation of oxidization thereof.

(6) The Process of Sealing

The final sealing process is a process of sealing between the base plate 832 upon which the light emitting element is formed and the sealing substrate plate 3*b* using a sealing resin 3*a*. For example, a sealing resin 3*a* which consists of a heat curing resin or an ultraviolet light curing resin is applied over the entire surface of the base plate 832, and a substrate plate 3*b* for sealing is laid over this sealing resin 3*a*, i.e. is superimposed thereupon. By this process, a sealing portion 33 is formed over the base plate 832.

It is desirable for this sealing process to be performed in an inert gas atmosphere of nitrogen, argon, helium or the like. If this sealing process is performed in the ambient atmosphere, then, if defect portions such as pinholes or the like have occurred in the negative electrode 842, there is a danger that water or oxygen or the like may enter into the negative electrode 842 through these defect portions, and may oxidize the negative electrode 842, which is not desirable.

Furthermore, along with connecting the negative electrode 842 to a lead wire 35*a* of the substrate plate 5 as shown by way of example in FIG. 55, the lead wires of the circuit element portion 44 are connected to the drive IC 36, and thereby the display device 31 of this preferred embodiment of the present invention is obtained.

In this preferred embodiment as well, by performing the ink jet method described above in the same manner as in the case of the other preferred embodiments explained previously, the same beneficial results are obtained in the same manner. Furthermore since, when selectively applying the functional liquid masses, the liquid mass for a single functional layer is discharged by using a plurality of nozzles, accordingly it is possible to eradicate deviations in the discharge amounts between the nozzles, so that, by reducing variations in the amounts of source material between each of the electrodes, it is possible to ensure that each of the functional layers has a uniform film thickness. By doing this, it is possible to ensure that the amount of emitted light from each of the picture elements is maintained as uniform, and accordingly it is possible to manufacture a display device which is endowed with a superior display quality.

Other Preferred Embodiments

Although the present invention has been described above in terms of certain preferred embodiments thereof, the present invention is not to be considered as being limited by these preferred embodiments; and variations such as will now be described above are acceptable, provided that the objectives of the present invention are attained. In other words, it is possible to implement multitudinous variations in the concrete structure and form of the present invention, without departing from the scope of the present invention, which is to be defined solely by the scope of the appended claims.

In other words although, by way of example, in the device for manufacture of a color filter shown in FIGS. 9 and 10, the main scanning of the motherboard 12 by the ink jet head 22 was performed by shifting the ink jet head 22 along the main scanning direction X, and the widthwise scanning of the motherboard 12 by the ink jet head 22 was performed by shifting the motherboard 12 with the widthwise scanning drive device 21, it would be possible to implement an opposite arrangement, in which the main scanning was executed by shifting the motherboard 12, and the widthwise scanning was executed by shifting the ink jet head 22. Furthermore, it would also be possible to implement various other sorts of structure in which the ink jet head 22 and the surface of the motherboard 12 were mutually shifted respectively to one another, by shifting only the motherboard 12 without shifting the ink jet head 22, or by shifting only the ink jet head 22 without shifting the motherboard 12, or by shifting both of them in relatively opposite directions, or the like.

Furthermore, although in the above described preferred embodiments an ink jet head 421 was utilized which was made so as to discharge the ink by taking advantage of the flexible deformation of the piezoelectric elements, it would also be possible to utilize an ink jet head of any other different structure; for example, one which utilized a method of discharging the ink in pulses which were generated by heating up the ink.

Yet further although, in the preferred embodiments shown in FIGS. 22 through 32, for the irk jet head 421, one was explained in which the nozzles 466 were arranged at substantially equal intervals and in two rows along substantially straight lines, the present invention is not to be considered as being limited to the case of two rows; it would be possible for various different numbers of rows to be utilized. Moreover, the intervals between the nozzles 466 along their rows need not all be equal to one another. Yet further, it is not even necessary for the nozzles 466 to be arranged along straight lines.

And the objects for the manufacture of which the liquid drop discharge devices 16, 401 may be used are not to be considered as being limited to the liquid crystal device 101 and the electro-luminescent device 201; these liquid drop discharge devices 16, 401 may also be applied to the production of a wide range of electro optical devices which comprise substrate plates and predetermined layers formed in predetermined places thereupon, such as an electron emission device such as a FED (Field Emission Display) or the like, a PDP (Plasma Display Panel), an electrical migration device—in other words a device in which ink, which is a functional liquid mass which includes charged grains, is discharged into concave portions between division walls which separate various picture elements, and which performs display by applying voltage between electrodes which are disposed above and below each picture element so as to sandwich it, whereby the charged grains are attracted towards one of the electrodes—a CRT (Cathode Ray Tube) display such as a thin type CRT, or the like.

The device and the method of the present invention can be utilized in various processes for manufacturing various types of devices which have substrate plates (backings), including electro optical devices, in which it is possible to employ a process of discharging liquid drops against such a backing. For example, they can be applied to manufacture of any of the following structures: a structure consisting of electrical connecting wires upon a printed circuit substrate plate, in which these electrical connecting wires are formed by discharging a liquid metal or an electro-conductive material, or a paint containing a metallic substance or the like, against this printed circuit substrate plate by using an ink jet method; a structure for a fuel cell in which an electrode or an ion conduction layer or the like is formed by discharge using an ink jet method; a structure in which an optical member such as a minute micro lens is formed upon a backing by discharge using an ink jet method; a structure in which a resist, which is to be applied on a substrate plate, is applied only upon appropriate portions thereof by discharge using an ink jet method; a structure in which convex portions for scattering light, or a minute white pattern or the like, are formed upon a transparent substrate plate made from a plastic or the like by discharge using an ink drop method, so as to form a light scattering plate; or a structure in which a biochip is formed by discharging RNA (ribonucleic acid) using an ink drop method upon spike spots which are arranged in a matrix array upon a DNA (deoxyribonucleic acid) chip such as a reagent inspection device or the like, or in which a sample or an antibody, or DNA (deoxyribonucleic acid) or the like, is discharged using an ink jet method upon a backing in positions in dot form which are compartmented apart, so as to manufacture a fluorescent marker probe by performing hybridization or the like upon a DNA chip; or the like.

Furthermore, as well as to a complete liquid crystal device 101, the present invention can also be applied to any portion which is included in an electro optical system of a liquid crystal device 101, such as a structure such as an active matrix liquid crystal panel which comprises TFT transistors or the like or active elements such as TFDs in the picture elements, or the like, in which division walls 6 are formed which define and surround the picture element electrodes, and in which ink is discharged by an ink jet method in the concave portions which are defined by these division walls 6, so as to form a color filter 1; or a structure in which a color filter 1 is formed as an electro-conductive color filter upon picture element electrodes by discharging a mixture of a colored material and an electro-conductive material, which serves as an ink, against the picture element electrodes using an ink jet method; or a structure which is formed by discharging, using an ink jet method, particles of a spacer for maintaining a gap with respect to a substrate plate; or the like.

Yet further, the present invention is not limited in its application to a color filter 1 or to an electro-luminescent device 201; it can also be applied to any other type of electro optical device. Moreover, in the case of the electro-luminescent device 201 as well, the present invention can also be applied to any of various structures, such as one in which the electro-luminescent layers which correspond to the three colors R, G, and B are formed in a stripe pattern, or, as described above, it can be applied to an display device of the active matrix type which comprises transistors which control the flow of electric current in the light emission layers for each of the picture elements individually, or to one of the passive matrix type, or the like.

Figure 51:
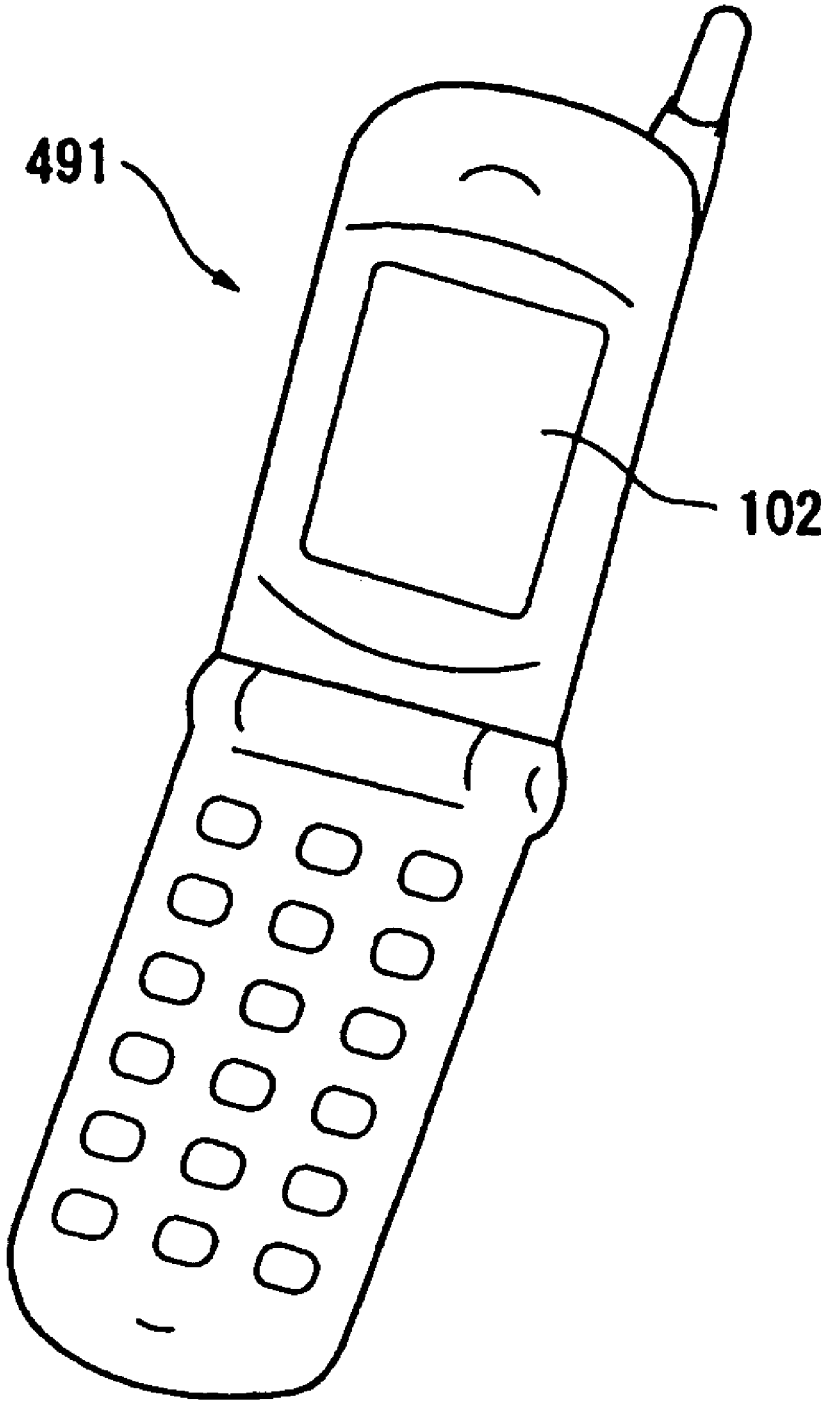
FIG. 51 is a perspective view showing a portable telephone which is an electronic device equipped with the same electro optical device.
Figure 52A:
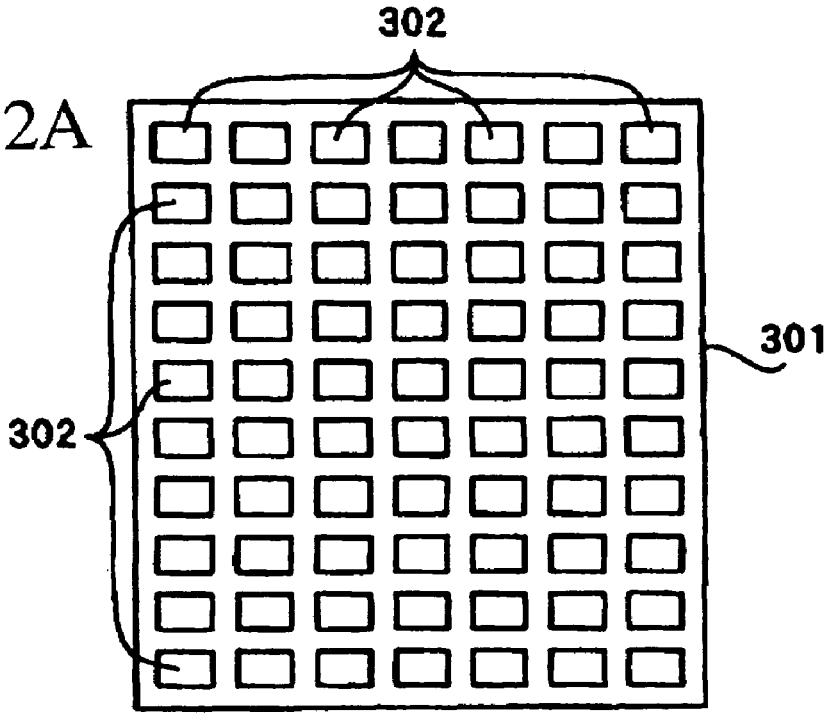
FIGS. 52(A)-52(C) are figures showing one example of a method of manufacture of a prior art color filter.
Figure 52B:
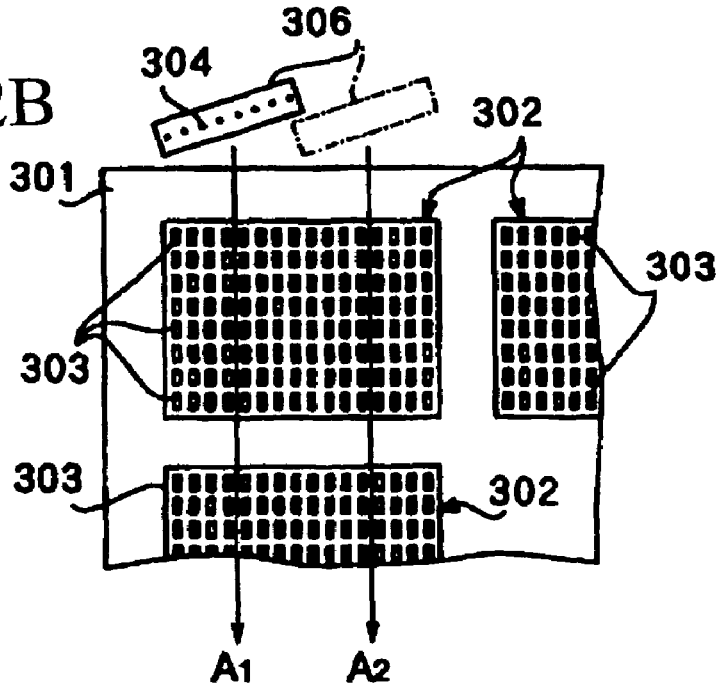
Figure 52C:
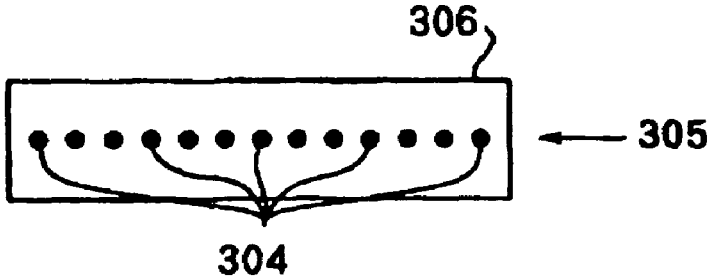

And, as for the electronic device to which the electro optical device according to any of the above described preferred embodiments of the present invention is assembled, its application is not to be considered as being limited to a personal computer 490 such as shown, for example, in FIG. 50; on the contrary, it is possible to adapt the present invention to various types of electronic device, such as a portable telephone instrument like the portable telephone 491 shown in FIG. 51 or a PHS (Personal Handyphone System) unit or the like, or to an electronic notebook, a POS (Point Of Sale) terminal, an IC card, a mini disc player, a liquid crystal projector, an engineering workstation (Engineering Work Station: EWS), a word processor, a television, a video tape recorder of the viewfinder type or the direct vision monitor type, a tabletop electronic calculator, a car navigation device, a device incorporating a touch panel, a watch, a game device, or the like.

And, if for example three rows or more of the nozzles 466 were provided to the ink jet head 22, and a plurality of these nozzles 466 were positioned upon a hypothetical straight line along the scanning direction X, it would also be acceptable to discharge ink from at least two or more of these nozzles 466.

It should be understood that, in the present invention, it is not necessary for the plurality of nozzles 466 which are positioned upon a hypothetical straight line along the relative scanning direction of the ink jet head 22 to be positioned upon this hypothetical straight line with their openings being in the same state relative to said hypothetical straight line; it would also be acceptable to consider them to be positioned upon the hypothetical straight line, if the openings of these nozzles 466 were to intersect said hypothetical straight line in even one place. In other words, it would still be acceptable, if one of the nozzles 466 were to intersect the hypothetical straight line at its portion over on the right side of its nozzle opening, while another of the nozzles 466 were to intersect the hypothetical straight line at its portion over on the left side of its nozzle opening.

Even with such a deviation, there will be no problem if, upon the object against which the liquid drops are to be discharged, the widths of the regions against which the liquid drops are to be discharged are made to be wide, or if it is possible to perform a process of water repellentation upon the portions against which no liquid drops are to be discharged, so that any liquid drops which may have wandered outside the regions upon which they are supposed to be discharged are shifted due to the hydrophobic operation of these regions, or if it is possible to perform a process of hydrophilization upon the portions against which the liquid drops are to be discharged, so that any liquid drops which may have wandered outside the regions upon which they are supposed to be discharged are shifted due to the hydrophilic operation of these regions, or if it is possible to form division walls at the boundaries of the portions against which the liquid drops are to be discharged, so that these portions against which the liquid drops are to be discharged are formed as concave portions and any liquid drops which may have wandered outside these regions are shifted into these concave portions, or if a process is included of eliminating afterwards the portions which stick out due to the liquid drops which have been discharged outside their proper regions, or the like. However, it is desirable for the plurality of nozzles which are positioned upon the hypothetical straight line along the scanning direction to have their openings arranged to intersect this straight line in substantially the same configuration.

It should be understood that, with the present invention, it would also be acceptable to establish non discharge nozzles in the nozzle group in the central region as well, apart from the non discharge nozzles which are positioned in the predetermined regions at the tip portions of the ink jet head 421. That is to say, if, when the head 466 is inclined, the array pitch of the nozzles 466 along the scanning direction and the array pitch of the positions at which the liquid drops are to be discharged upon the object against which the liquid drops are to be discharged are roughly in agreement, or if it is an integral multiple thereof, then it may be acceptable to set the nozzles 466 which are positioned at locations which do not match the positions where ink is to be discharged as non discharge nozzles. For example, in the central region of the row of nozzles which excludes the tip portion regions, it would also be acceptable to set the discharge nozzle array pitch to every second nozzle, or to every third nozzle or the like. It becomes possible to control the non discharge nozzles by driving the piezoelectric drive elements which drive them separately.

Furthermore, in the same manner, it would be acceptable to provide three or more rows of the ink jet heads 22, to position the nozzles 466 of a plurality of the ink jet heads 22 so that they are arranged as a straight line along the scanning direction X, and to discharge the liquid drops against the work-piece from at least two or more of the nozzles.

It should be understood that the structure and the procedures of the various preferred embodiments of the present invention which have been disclosed in concrete terms are not intended to be limiting; other versions thereof which fall within the scope of the appended claims, and which attain the objectives of the present invention, will be acceptable, and are not to be considered as departing from its range.

What is claimed is:

1. A liquid drop discharge head in which a surface which is provided with a plurality of nozzles which discharge a liquid mass is relatively shifted with respect to an object against which liquid drops are to be discharged, and for discharging said liquid mass from said nozzles against said object against which liquid drops are to be discharged, in which, in a state in which the liquid drop discharge head is oriented in a direction which intersects said relative shifting direction at a sloping angle, at least the nozzles among said plurality of nozzles which are positioned in a central portion thereof and are used for discharge of said liquid mass are arranged so that a plurality of their openings are positioned upon a hypothetical straight line which extends along said relative shifting direction;

among said plurality of nozzles which are arranged in rows in said liquid drop discharge heads, the nozzles in predetermined regions at end portions of the rows are set as non-discharge nozzles; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

2. A discharge device comprising:

a liquid drop discharge head as described in claim 1;

a holding means for holding the liquid drop discharge head;

and a shifting means which shifts at least one of the holding means and the object against which liquid drops are to be discharged relatively to the other.

3. A discharge device as described in claim 2, wherein said liquid drop discharge heads are held in said holding means in a state in which the direction in which said nozzles are arranged intersects said relative shifting direction at a slanting angle.

4. A discharge device as described in claim 2, wherein said plurality of nozzles are arranged so that the array pitch of the nozzle openings along a direction which is perpendicular to said relative shifting direction is roughly equal to or is roughly an integral multiple of the pitch of the anticipated discharge positions upon said object against which liquid drops are to be discharged along a direction which is perpendicular to said relative shifting direction.

5. A device for manufacturing an electro optical device which comprises a discharge device as described in claim 2, wherein:

said object against which liquid drops are to be discharged is a substrate plate upon which an electro-luminescent layer is to be formed; and said electro-luminescent layer is formed upon said substrate plate by discharging a liquid mass which contains an electro-luminescent material from predetermined nozzles in said one or more liquid drop discharge heads against said substrate plate, while relatively shifting said one or more liquid drop discharge heads with respect to said substrate plate.

6. A device for manufacturing an electro optical device which comprises a discharge device as described in claim 2, wherein:

said object against which liquid drops are to be discharged is one of a pair of substrate plates between which a liquid crystal is to be sandwiched; and a color filter is formed upon said substrate plate by discharging a liquid mass which contains a color filter material from predetermined nozzles in said one or more liquid drop discharge heads against said substrate plate, while relatively shifting said one or more liquid drop discharge heads with respect to said substrate plate.

7. A device for manufacturing a color filter which comprises a discharge device as described in claim 2, wherein:

said object against which liquid drops are to be discharged is a substrate plate upon which a color filter which presents several colors is to be formed; and a color filter is formed upon said substrate plate by discharging a liquid mass which contains a color filter material from predetermined nozzles in said one or more liquid drop discharge heads against said substrate plate, while relatively shifting said one or more liquid drop discharge heads with respect to said substrate plate.

8. A device for manufacture of a device which comprises a backing, comprising a discharge device as described in claim 2, wherein:

said object against which liquid drops are to be discharged is a backing of a device; and in a process of formation upon said backing, a predetermined layer is formed upon said backing by discharging a liquid mass against said backing from said plurality of liquid drop discharge heads.

9. A discharge device as described in claim 1, wherein, in said liquid drop discharge head, said plurality of nozzles are provided as arrayed in a plurality of rows.

10. A discharge device, in which control of a liquid drop discharge head described in claim 1 is exerted so that different nozzles which are positioned upon a hypothetical straight line which extends along said relative shifting direction are all discharged against the same predetermined place upon said object against which liquid drops are to be discharged.

11. A discharge device comprising:

a liquid drop discharge head which is provided with a plurality of nozzles which discharge a liquid mass which is endowed with a certain flowability;

a holding means for holding said liquid drop discharge head so as to make a surface of the liquid drop discharge head in which said nozzles are provided oppose an object against which liquid drops are to be discharged;

and a shifting means for relatively shifting at least one of this holding means and said object against which liquid drops are to be discharged relatively to the other;

wherein said liquid drop discharge head is held in said holding means so that at least two or more of said nozzles which are positioned at least in a central portion among said plurality of nozzles and which are used for discharge of said liquid mass are positioned upon a hypothetical straight line which extends along said relative shifting direction;

among said plurality of nozzles which are arranged in rows in said liquid drop discharge heads, the nozzles in predetermined regions at end portions of the rows are set as non-discharge nozzles; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

12. A discharge device comprising:

a plurality of liquid drop discharge heads, each of which is provided with a plurality of nozzles which discharge a liquid mass which is endowed with a certain flowability;

a holding means for holding said plurality of said liquid drop discharge heads in a line to oppose an object against which liquid drops are to be discharged;

and a shifting means for relatively shifting at least one of this holding means and said object against which liquid drops are to be discharged relatively to the other;

wherein said plurality of liquid drop discharge heads are arranged in said holding means so that at least one portion each of the nozzles which are used for discharge of said liquid mass in at least two or more of the liquid discharge heads among the liquid drop discharge heads are positioned upon a hypothetical straight line which extends along said relative shifting direction;

among said plurality of nozzles which are arranged in rows in said liquid drop discharge heads, the nozzles in predetermined regions at end portions of the rows are set as non-discharge nozzles;

said plurality of liquid drop discharge heads are arranged in a plurality of parallel rows, with the liquid drop discharge heads which are arranged in one of the rows, and the liquid drop discharge heads which are arranged in another of the rows, being arranged in a positional relationship in which they are at least partially mutually superimposed in said relative shifting direction, and at least partially mutually superimposed in said relative shifting direction; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

13. A discharge device as described in claim 12, wherein each of at least two or more of said liquid drop discharge heads are arranged so as partially to overlap another of said liquid drop discharge heads in said relative shifting direction.

14. A discharge device as described in claim 12, wherein:

the nozzles in a predetermined region in the vicinity of the end portions among the nozzles which are arranged in said liquid drop discharge heads are set as non discharging nozzles, a plurality of nozzles in said liquid drop discharge heads are arranged along a predetermined direction which intersects said relative shifting direction at a slanting angle, and said plurality of liquid drop discharge heads are arranged in a plurality of parallel rows along a direction which intersects said relative shifting direction; and non discharge nozzles of said liquid drop discharge heads in one row of said liquid drop discharge heads among said plurality of rows of liquid drop discharge heads, and discharge nozzles which discharge liquid mass in another row of liquid drop discharge heads which is arranged in said relative shifting direction, are arranged so as to be positioned upon a hypothetical straight line in said relative shifting direction.

15. A discharge device as described in claim 14, wherein:

the nozzles of said liquid drop discharge heads are arranged in a plurality of rows; and;

said plurality of liquid drop discharge heads are arranged so that a state exists in which a non discharge nozzle of one liquid drop discharge head and a plurality of rows of discharge nozzles of another liquid drop discharge head are positioned upon a hypothetical straight line which extends along said relative shifting direction, and a state exists in which a discharge nozzle and a non discharge nozzle of one liquid drop discharge head and a discharge nozzle and a non discharge nozzle of another liquid drop discharge head are likewise positioned upon a hypothetical straight line which extends along said relative shifting direction.

16. A discharge device as described in claim 12, wherein said plurality of liquid drop discharge heads are arranged slopingly in a slanting direction which intersects said relative shift direction at a slanting angle, with the liquid drop discharge heads being arranged in a holding means in an ordered sequence along a predetermined direction which intersects the relative shifting direction with respect to the object against which liquid drops are to be discharged, and each of said plurality of liquid drop discharge heads is arranged in a direction which differs from the predetermined direction in which the liquid drop heads are arranged in order.

17. A discharge device as described in claim 12, wherein:

said plurality of nozzles which are arranged in said liquid drop discharge heads are arranged in a positional relationship such that the nozzles in predetermined regions at the end portions of the arrangement are set as non discharge nozzles, and moreover said plurality of liquid drop discharge heads are arranged in a plurality of parallel rows, with the liquid drop discharge heads which are arranged in one of the rows, and the liquid drop discharge heads which are arranged in another of the rows, being mutually superimposed in said relative shifting direction; and said plurality of liquid drop discharge heads are arranged so that the array of nozzles in the direction which is perpendicular to said relative shifting direction is substantially continuous between each of said plurality of liquid drop discharge heads.

18. An electro optical device which comprises a substrate plate comprising a plurality of electrodes, and a plurality of electro-luminescent layers which are provided in correspondence to said electrodes upon the substrate plate, wherein:

one or more liquid drop discharge heads in which are provided a plurality of nozzles which discharge a liquid mass including an electro-luminescent material form said electro-luminescent layer by discharging said liquid mass from at least two or more different ones of said nozzles among said nozzles which are provided to said one or more liquid drop discharge heads which are positioned along a relative shifting direction against the same predetermined single picture element position upon said substrate plate, while relatively shifting a surface which includes said nozzles with respect to the substrate plate along the relative shifting direction in a state in which the surface opposes said substrate plate;

among said plurality of nozzles which are arranged in rows in said liquid drop discharge heads, the nozzles in predetermined regions at end portions of the rows are set as non-discharge nozzles; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

19. An electro optical device which comprises a substrate plate, and a color filter which presents several colors formed upon the substrate plate, wherein:

one or more liquid drop discharge heads in which are provided a plurality of nozzles which discharge a liquid mass including filter material of a predetermined color form said color filter by discharging said liquid mass from at least two or more different ones of said nozzles among said nozzles which are provided to said one or more liquid drop discharge heads which are positioned long a relative shifting direction against the same predetermined position upon said substrate plate, while relatively shifting a surface which includes said nozzles with respect to the substrate plate along the relative shifting direction in a state in which the surface opposes said substrate plate;

among said plurality of nozzles which are arranged in rows in said liquid drop discharge heads, the nozzles in predetermined regions at end portions of the rows are set as non-discharge nozzles; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

20. A device which comprises a backing and a predetermined layer which is formed by discharging a liquid mass which is endowed with a certain flowability against this backing, wherein:

said predetermined layer is formed by discharging said liquid mass against the same predetermined position upon said backing from at least two or more different nozzles among said plurality of nozzles of said one or more liquid discharge heads which are positioned along this relative shift direction, while relatively shifting said one or more liquid drop discharge heads to which said plurality of nozzles which discharge said liquid mass are provided with respect to this backing in a state in which a surface comprising said nozzles is opposed to said backing;

among said plurality of nozzles which are arranged in rows in said liquid drop discharge heads, the nozzles in predetermined regions at end portions of the rows are set as non-discharge nozzles; and said liquid mass is discharged against said object against which liquid drops are to be discharged from nozzles in the liquid drop discharge head in a state in which the arrangement of said nozzles in the direction perpendicular to said relative shifting direction is substantially continuous between said plurality of liquid drop discharge heads.

* * * * *